US007669713B2

(12) United States Patent
Stahl

(10) Patent No.: US 7,669,713 B2
(45) Date of Patent: Mar. 2, 2010

(54) THREE LEVEL NESTABLE STACKING CONTAINERS

(75) Inventor: Edward L. Stahl, Tyler, TX (US)

(73) Assignee: Orbis Canada Limited, Rexdale, Ontario (CA)

( * ) Notice: Subject to any disclaimer, the term of this patent is extended or adjusted under 35 U.S.C. 154(b) by 76 days.

(21) Appl. No.: 10/582,165

(22) PCT Filed: Dec. 6, 2005

(86) PCT No.: PCT/US2005/043932

§ 371 (c)(1),
(2), (4) Date: Aug. 30, 2007

(87) PCT Pub. No.: WO2006/062899

PCT Pub. Date: Jun. 15, 2006

(65) Prior Publication Data

US 2008/0105583 A1 May 8, 2008

Related U.S. Application Data

(63) Continuation-in-part of application No. 11/005,920, filed on Dec. 6, 2004, now Pat. No. 7,353,950.

(51) Int. Cl.

| | |
|---|---|
| ***B65D 21/032*** | (2006.01) |
| ***B65D 25/30*** | (2006.01) |
| ***B65D 25/32*** | (2006.01) |
| *B65D 21/04* | (2006.01) |

(52) U.S. Cl. ..... 206/506; 40/638; 220/755; 220/763; 220/764

(58) Field of Classification Search ..... 220/763, 220/669, 674, 755, 753; 206/506; 40/638
See application file for complete search history.

(56) References Cited

U.S. PATENT DOCUMENTS 2,026,204 A 12/1935 Andrews (Continued)

FOREIGN PATENT DOCUMENTS

CA 892971 2/1972

(Continued)

OTHER PUBLICATIONS

Canadian Official Action for Canadian Patent Application No. 2,367,649 dated Feb. 20, 2006 (2 pages).

(Continued)

*Primary Examiner*—Anthony Stashick
*Assistant Examiner*—Niki M Eloshway
(74) *Attorney, Agent, or Firm*—Ungaretti & Harris LLP

(57) ABSTRACT

A three level nestable stacking comprising a base, a pair of opposing sidewalls, a pair of opposing endwalls and at least two bail arms. Each of the opposing sidewalls comprises a plurality of peanut or kidney shaped receptacles, and in an alternative embodiment, a plurality of slot shaped receptacles. The receptacles allow for ease of rotational movement of the bail arms between any of at least three positions. The three positions for the bail arms provide three stacking configuration for a second, upper container, in regard to a first, lower container: a nearly fully nested configuration; a partially nested configuration; and a substantially un-nested configuration. The opposing sidewalls also comprise a sidewall interlock system, as well as a container stacking structure. The bails arms are completely contained within the area of the container, and mate with grooves in the base of the container.

6 Claims, 105 Drawing Sheets

U.S. PATENT DOCUMENTS

| | | | | |
|---|---|---|---|---|
| 2,029,746 | A | | 2/1936 | Tufts et al. |
| 2,061,414 | A | | 11/1936 | Tufts et al. |
| 2,134,875 | A | | 11/1938 | Henze |
| 2,609,120 | A | | 9/1952 | Williams |
| 2,641,383 | A | | 6/1953 | Coursey |
| 2,918,379 | A | | 12/1959 | Lurie |
| 3,154,215 | A | | 10/1964 | Le Vesconte |
| 3,375,953 | A | | 4/1968 | Miller, Jr. |
| 3,379,339 | A | | 4/1968 | Asenbauer |
| 3,420,402 | A | | 1/1969 | Frater et al. |
| 3,421,656 | A | | 1/1969 | Asenbauer |
| 3,570,697 | A | | 3/1971 | Langston |
| 3,659,743 | A | | 5/1972 | Box |
| 3,752,352 | A | | 8/1973 | Senecal |
| 3,907,111 | A | | 9/1975 | Levanhagen |
| 3,952,903 | A | | 4/1976 | Sanders et al. |
| 3,993,211 | A | | 11/1976 | Astle |
| 4,105,117 | A | | 8/1978 | Atkin et al. |
| 4,109,791 | A | | 8/1978 | Clipson et al. |
| 4,194,626 | A | | 3/1980 | Boller |
| D258,050 | S | | 1/1981 | Cornou |
| 4,247,004 | A | | 1/1981 | Bird |
| 4,308,762 | A | * | 1/1982 | Jannard ..... 74/551.9 |
| 4,391,369 | A | * | 7/1983 | Stahl et al. ..... 206/506 |
| 4,426,001 | A | | 1/1984 | Stahl et al. |
| 4,601,393 | A | | 7/1986 | Veenman et al. |
| 4,619,371 | A | | 10/1986 | Rehrig |
| 4,671,411 | A | | 6/1987 | Rehrig et al. |
| D292,634 | S | | 11/1987 | Chabot |
| 4,759,451 | A | | 7/1988 | Apps |
| 4,848,578 | A | | 7/1989 | Schafer |
| 4,863,062 | A | | 9/1989 | Holliday |
| 4,947,992 | A | | 8/1990 | Schafer |
| D320,298 | S | | 9/1991 | Apps et al. |
| 5,163,587 | A | | 11/1992 | Apps et al. |
| D343,042 | S | | 1/1994 | Apps et al. |
| D344,387 | S | | 2/1994 | Holliday |
| D348,138 | S | | 6/1994 | Lang-Ree et al. |
| D348,342 | S | | 6/1994 | Lang-Ree et al. |
| D348,343 | S | | 6/1994 | Lang-Ree et al. |
| D350,028 | S | | 8/1994 | Apps |
| D350,437 | S | | 9/1994 | Apps et al. |
| 5,344,021 | A | | 9/1994 | Rose |
| 5,377,858 | A | | 1/1995 | Morris, Sr. |
| 5,392,915 | A | | 2/1995 | Kalin |
| 5,415,293 | A | | 5/1995 | Ackermann et al. |
| 5,469,986 | A | | 11/1995 | Jang |
| 5,494,163 | A | | 2/1996 | Apps |
| D374,555 | S | | 10/1996 | McMath |
| 5,609,254 | A | | 3/1997 | Loftus et al. |
| 5,617,953 | A | | 4/1997 | Cope |
| D379,718 | S | | 6/1997 | Raghunathan |
| D381,203 | S | | 7/1997 | Ackermann et al. |
| D382,404 | S | | 8/1997 | Cope |
| 5,735,431 | A | | 4/1998 | LeTrudet |
| 5,752,602 | A | | 5/1998 | Ackermann et al. |
| 5,772,033 | A | | 6/1998 | Loftus et al. |
| D398,448 | S | | 9/1998 | Zanni |
| D400,711 | S | | 11/1998 | Hwang |
| D401,412 | S | | 11/1998 | LeTrudet |
| 5,860,527 | A | | 1/1999 | Frankenberg et al. |
| 5,896,987 | A | | 4/1999 | Bettenhausen |
| 5,896,992 | A | * | 4/1999 | McGrath ..... 206/507 |
| 5,924,572 | A | | 7/1999 | Cope |
| 5,975,324 | A | | 11/1999 | Schmitt |
| 5,992,673 | A | | 11/1999 | Hwang |
| 6,015,056 | A | | 1/2000 | Overholt et al. |
| D420,219 | S | | 2/2000 | Elvin-Jensen et al. |
| 6,036,049 | A | | 3/2000 | Hwang |
| D423,217 | S | | 4/2000 | Varfeldt |
| D424,299 | S | | 5/2000 | Varfeldt |
| 6,059,114 | A | | 5/2000 | Loftus |
| 6,089,373 | A | | 7/2000 | Cope |
| D429,565 | S | | 8/2000 | Aiken |
| 6,098,827 | A | | 8/2000 | Overholt et al. |
| 6,138,863 | A | | 10/2000 | Aiken |
| D436,729 | S | | 1/2001 | Aiken |
| 6,179,156 | B1 | | 1/2001 | Aiken |
| 6,209,742 | B1 | | 4/2001 | Overholt et al. |
| 6,250,490 | B1 | | 6/2001 | Loftus |
| D446,017 | S | | 8/2001 | Koefelda |
| D446,392 | S | | 8/2001 | Overholt et al. |
| 6,293,418 | B1 | | 9/2001 | Ogden et al. |
| 6,308,858 | B1 | | 10/2001 | Koefelda |
| D452,614 | S | | 1/2002 | Overholt |
| 6,338,181 | B1 | | 1/2002 | Hwang |
| 6,386,388 | B1 | | 5/2002 | Overholt |
| D458,753 | S | | 6/2002 | Overholt et al. |
| 6,398,054 | B1 | | 6/2002 | Overholt et al. |
| 6,405,888 | B1 | | 6/2002 | Overholt et al. |
| 6,409,041 | B1 | | 6/2002 | Overholt et al. |
| D460,619 | S | | 7/2002 | Koefelda |
| D463,667 | S | | 10/2002 | Hwang |
| 6,460,717 | B1 | | 10/2002 | Smyers et al. |
| D478,421 | S | | 8/2003 | Overholt et al. |
| 6,601,724 | B1 | | 8/2003 | Koefelda et al. |
| 6,631,822 | B1 | | 10/2003 | Overholt |
| D487,634 | S | | 3/2004 | Apps et al. |
| 6,843,386 | B2 | | 1/2005 | Raghunathan et al. |
| 6,880,705 | B2 | | 4/2005 | Otting et al. |
| 6,899,242 | B2 | | 5/2005 | Overholt et al. |
| 6,918,502 | B1 | | 7/2005 | Overholt et al. |
| 6,918,508 | B2 | | 7/2005 | Hwang |
| 6,938,772 | B2 | * | 9/2005 | Aiken et al. ..... 206/506 |
| 6,994,216 | B2 | | 2/2006 | Wong |
| 7,014,043 | B2 | | 3/2006 | Raghunathan et al. |
| 7,017,745 | B2 | * | 3/2006 | Raghunathan ..... 206/506 |
| 7,017,766 | B2 | | 3/2006 | Hsu et al. |
| 7,044,319 | B2 | | 5/2006 | Overholt et al. |
| 7,048,134 | B1 | | 5/2006 | Hagan |
| 7,048,135 | B2 | | 5/2006 | Smyers et al. |
| 7,059,489 | B2 | | 6/2006 | Apps et al. |
| 7,063,210 | B2 | | 6/2006 | Smyers et al. |
| 7,086,555 | B2 | | 8/2006 | Overholt et al. |
| 7,100,786 | B2 | | 9/2006 | Smyers |
| 7,104,414 | B2 | | 9/2006 | Apps et al. |
| 7,128,231 | B2 | | 10/2006 | Apps et al. |
| 7,195,127 | B2 | | 3/2007 | Hsu et al. |
| 7,234,599 | B2 | | 6/2007 | Hassell et al. |
| 7,249,675 | B2 | * | 7/2007 | Hassell et al. ..... 206/506 |
| 7,264,122 | B2 | | 9/2007 | Koefelda et al. |
| 7,267,227 | B2 | | 9/2007 | Dubois et al. |
| 6,863,180 | B2 | | 11/2007 | Apps et al. |
| 7,334,683 | B2 | * | 2/2008 | Hassell et al. ..... 206/506 |
| 7,464,817 | B2 | * | 12/2008 | Raghunathan et al. ..... 206/506 |
| 2002/0056717 | A1 | | 5/2002 | Hwang |
| 2002/0130132 | A1 | | 9/2002 | Overholt |
| 2002/0148842 | A1 | | 10/2002 | Overholt et al. |
| 2002/0158067 | A1 | | 10/2002 | Overholt et al. |
| 2002/0179480 | A1 | | 12/2002 | Raghunathan et al. |
| 2003/0024845 | A1 | | 2/2003 | Smyers et al. |
| 2003/0042255 | A1 | | 3/2003 | Smyers et al. |
| 2003/0116564 | A1 | | 6/2003 | Overholt et al. |
| 2003/0132228 | A1 | | 7/2003 | Apps et al. |
| 2003/0155275 | A1 | | 8/2003 | Apps et al. |
| 2003/0222081 | A1 | | 12/2003 | Apps et al. |
| 2003/0230510 | A1 | * | 12/2003 | Aiken et al. ..... 206/506 |
| 2004/0020821 | A1 | | 2/2004 | Koefelda et al. |
| 2004/0069780 | A1 | | 4/2004 | Apps et al. |
| 2004/0099662 | A1 | | 5/2004 | Overholt |
| 2004/0104231 | A1 | | 6/2004 | Hassell et al. |
| 2004/0155048 | A1 | | 8/2004 | Aiken |
| 2004/0178197 | A1 | | 9/2004 | Hsu et al. |
| 2004/0182858 | A1 | | 9/2004 | Smyers |

| | | | | |
|---|---|---|---|---|
| 2004/0195139 | A1 | 10/2004 | Wong | |
| 2004/0226945 | A1 | 11/2004 | Hsu et al. | |
| 2004/0245142 | A1* | 12/2004 | Raghunathan | 206/506 |
| 2005/0224385 | A1* | 10/2005 | Hassell et al. | 206/506 |
| 2005/0263423 | A1* | 12/2005 | Hassell et al. | 206/506 |
| 2005/0263424 | A1 | 12/2005 | Hassell et al. | |
| 2006/0011627 | A1 | 1/2006 | Overholt et al. | |
| 2006/0065567 | A1* | 3/2006 | Hassell et al. | 206/506 |
| 2006/0096883 | A1* | 5/2006 | Raghunathan et al. | 206/506 |
| 2006/0108372 | A1 | 5/2006 | Aiken et al. | |
| 2006/0118450 | A1* | 6/2006 | Stahl | 206/506 |
| 2006/0180491 | A1 | 8/2006 | Zephir et al. | |
| 2006/0186123 | A1 | 8/2006 | Baltz et al. | |
| 2006/0196800 | A1 | 9/2006 | Baltz | |
| 2006/0231449 | A1* | 10/2006 | Hassell et al. | 206/506 |
| 2006/0231555 | A1 | 10/2006 | Smyers et al. | |
| 2006/0237341 | A1 | 10/2006 | McDade | |
| 2007/0144931 | A1 | 6/2007 | McTavish et al. | |

FOREIGN PATENT DOCUMENTS

| | | | |
|---|---|---|---|
| CA | 1273881 | | 9/1990 |
| CA | 2032012 | | 6/1991 |
| CA | 2129617 | | 2/1995 |
| CA | 2130973 | | 3/1995 |
| CA | 2212239 | | 8/1996 |
| CA | 2484830 | | 8/1996 |
| CA | 2313137 | | 7/1999 |
| CA | 2296895 | | 7/2000 |
| CA | 2326118 | | 5/2001 |
| CA | 2387491 | | 5/2001 |
| CA | 2392265 | | 6/2001 |
| CA | 2395367 | | 7/2001 |
| CA | 2397522 | | 8/2001 |
| CA | 2406099 | | 10/2001 |
| CA | 2384941 | | 1/2002 |
| CA | 2421595 | | 3/2002 |
| CA | 2426949 | | 5/2002 |
| CA | 2367649 | | 7/2002 |
| CA | 2455355 | | 2/2003 |
| CA | 2458773 | | 3/2003 |
| CA | 2472360 | | 7/2003 |
| CA | 2475531 | | 9/2003 |
| CA | 2485544 | | 12/2003 |
| CA | 2431444 | | 12/2004 |
| DE | 3511321 | | 10/1986 |
| DE | 3521894 | | 1/1987 |
| DE | 20002537 | | 6/2001 |
| EP | 0368713 | | 5/1990 |
| EP | 0557002 | | 8/1993 |
| EP | 0697341 | | 2/1996 |
| EP | 0926073 | | 6/1999 |
| EP | 0953509 | | 11/1999 |
| FR | 1131652 | | 2/1957 |
| FR | 2678585 | | 1/1993 |
| GB | 2067167 | | 7/1981 |
| GB | 2124588 | | 2/1984 |
| GB | 2129401 | | 5/1984 |
| GB | 2137167 | | 10/1984 |
| GB | 2209737 | | 5/1989 |
| GB | 2296009 | | 6/1996 |
| GB | 2333285 | | 7/1999 |
| GB | 2340485 | | 2/2000 |
| GB | 2350350 | | 11/2000 |
| GB | 2373239 | | 9/2002 |
| GB | 2373240 | | 9/2002 |
| GB | 2374859 | | 10/2002 |
| NL | 7905105 | | 12/1980 |
| TW | 338405 | | 8/1998 |
| TW | 372539 | | 10/1999 |
| WO | 9801352 | A1 | 1/1998 |
| WO | WO 0027716 | A1 | 5/2000 |
| WO | WO 0051900 | A1 | 9/2000 |
| WO | WO 0066440 | A1 | 11/2000 |
| WO | 2006062899 | A2 | 6/2006 |

OTHER PUBLICATIONS

Canadian Official Action for Canadian Patent Application No. 2,431,444 dated Dec. 12, 2005 (2 pages).

* cited by examiner

THREE LEVEL NESTABLE STACKING CONTAINERS

DOMESTIC PRIORITY

The present application is a continuation-in-part application of U.S. Non-provisional patent application Ser. No. 11/005,920, filed Dec. 6, 2004, now U.S. Pat. No. 7,353,950, the entire contents of which are hereby incorporated by reference herein, and claims priority to the same under 35 U.S.C. §120, and further claims priority to U.S. Design Pat. application Ser. No. 29/230,831 filed on May 27, 2005, now U.S. Pat. No. D539,541, the entire contents of which are hereby incorporated by reference herein, and the present application is also a U.S. National Phase Patent Application that claims the benefit under 35 U.S.C. § 365 of International Application No. PCT/US2005/043932, with an international filing date of Dec. 6, 2005, the entire contents of which are hereby incorporated by reference herein.

BACKGROUND OF THE INVENTION

1. Field of the Invention

The invention is related to nestable, stackable containers. More particularly, the invention is related to a container apparatus used to transport various types of goods for use in the retail and shipping industries. The containers have a movable bail structure so that they may be nested together, or stacked together at different heights. The containers can be dimensioned so that they are easily arranged on standard pallets, four or five containers to a level.

2. Description of the Related Art

Portable storage containers, which both stack and nest with similar containers, are commonly used for transporting and storing goods. Nesting is typically achieved when an empty container receives a like container therein such that there is some overlap between the walls and the containers. On the other hand, the stacking feature is typically used when an occupied container has a like container supported thereon, such that there is relatively little or no overlap between the walls of the containers, and the goods contained in the lower container are preferably not in contact with, or damaged by, the upper container. Many containers use members known as bail arms to achieve the stacking feature. Bail arms may typically be positioned out of the way for purposes of nesting, but then moved to a stacking position to allow containers to be stacked thereon. Often, the stacks may consist of multiple containers having a load. Unfortunately, some containers may not have sufficient strength to accommodate such loads in a stack. Examples of such containers are disclosed in U.S. Pat. No. 3,659,743 to Theodor Box, issued on May 7, 1972; U.S. Pat. No. 4,391,369 to Stahl et al. issued on Jul. 5, 1983; U.S. Pat. No. 4,573,577 to Miller, issued on Mar. 4, 1986; U.S. Pat. No. 5,609,254 to Loftus et al, issued on Mar. 11, 1997; U.S. Pat. No. 6,273,259 to Edward Stahl, issued on Aug. 14, 2001; and U.S. Pat. No. 6,938,722 to Aiken et al., issued on Sep. 6, 2005. Further examples include CA 2,387,497 to Koefelda et al., published on May 3, 2001; EP 0370771 to Tabler et al., published on May 30, 1990; and FR 1,131,652. published on Feb. 26, 1957. Examples of such containers are also disclosed in commonly assigned co-pending U.S. patent application Ser. No. 29/230,831, filed on May 27, 2005; Ser. No. 10/457,398 filed on Jun. 10, 2003; Ser. No. 11/005,920, filed on Dec. 6, 2004; Ser. No. 10/045,035, filed on Jan. 15, 2002; Ser. No. 10/275,735, filed Jun. 17, 2003; and Ser. No. 10/350,735, filed on Jan. 24, 2003.

Further, some containers presently allow for only one stacking position, and thus only a single stacking height. Depending on the goods to be carried by the container, however, this single stacking position may not be efficient. Also, the mounting of many present bail arms may be inefficient, in that the bail arms of some containers may be required to travel a great distance in order to move the bail arm into various positions. Further, many known bails are difficult to manipulate into different stacking/nesting positions, especially with one hand. This is often inefficient, from a design and a handling standpoint.

Still further, the movement of some bail arms is restricted by the design of the receptacle that contains the ends of the bail arms. Some of these receptacles have significant sized humps or bumps (as in U.S. Pat. No. 6,938,772) that cause the bail movement process to be impeded. Impeding the movement of the bail arm makes it awkward to easily slide the bail arm from one position to another. Considering the scale of today's economy, it is often the case that hundreds or thousands of pieces of product (i.e., goods for sale) must be moved every day, and this can involve a large number of containers. If the movement of the bail arm from position to position is difficult, this can cause work to be slow and frustrating.

Furthermore, known containers lack the ability to securely and easily stack upon each other in other than the fully nested position. Stacking refers to the general condition of placing one container on top of another similar container. Nesting is the ability to fit a first container within a second similar container. "Nearly fully nested" (or nearly fully nesting) means that a first container (i.e., the upper container) fits substantially within a second similar container (i.e., the lower container). "Partially nested" (or partial nesting) means that the first container fits only partially in the second similar container. And "substantially un-nested" means that only a small portion of the first container is within the second similar container. Thus, nested containers are necessarily stacked containers, but stacked containers are not necessarily nested containers. Typically, partial nesting is a desired configuration so that different sizes of products can be carried by the same containers, thereby increasing the efficient use of the containers, saving money for the product shippers and retailers. If, however, the containers do not easily partially nest, or do not easily stack in a substantially un-nested position, stability problems can occur. For example, if the bail arms do not have a well designed mating receptacle, their placement may be inaccurate, and the upper container may slide off the lower container. The industry defines the term "product clearance height" (PCH) as the height difference between the top of the base in a bottom container, and the bottom of the base in a partially nested second container. The PCH value is defined for the type of product that the containers are expected to carry when the containers are partially nested with respect to one another.

Still further, known containers sometimes lack the rigidity and strength to support each other, especially when loaded with heavy products. For example, in the typical known stacking container, the support for the second container is provided only by the bail arm. The bail arm is typically located at an outer extreme portion of the container. The location of the bail arm provides almost the largest possible moment arm for the weight of the container to act on the bail arm. Therefore, the centers of known containers often bend under their own loaded weight. This causes two problems. Initially, the product carried by the container can become crushed or damaged; and, over time, the container itself can become permanently bent or deformed.

Accordingly, it is desirable to have a portable container that is capable of nesting and stacking with similar containers, and has the necessary strength to support the loads contained therein, particularly in a multiple stacked orientation. Further, it is desirable to have a container that, when in its stacked position, can accommodate various types and sizes of goods. The container should also have an efficient means of mounting the bail arm, and for providing means for easy bail travel from one position to another.

SUMMARY OF THE INVENTION

It is therefore a general object of the invention to provide a nestable stacking container that will obviate or minimize problems of the type previously described.

According to an embodiment of the present invention, a container is provided comprising a pair of opposing endwalls. Each of the pair of opposing endwalls comprises (i) an endwall top portion, (ii) an endwall interior surface, (iii) an endwall exterior surface, and (iv) an bail arm saddle surface located on the endwall top portion. According to an embodiment of the present invention, each of the pair of the opposing endwalls further comprises (v) an endwall upper handle that extends from the endwall interior surface through the endwall exterior surface, and (vi) an endwall lower handle that extends from the endwall interior surface through the endwall exterior surface.

According to the embodiment of the present invention, the container further comprises a pair of opposing sidewalls, each of the pair of opposing sidewalls comprising (i) a sidewall top wall portion, (ii) a sidewall interior surface, (iii) a sidewall exterior surface, and (iv) an outer pair of notches extending downwardly from the corresponding sidewall top portion. The opposing sidewalls of the container still further comprise (v) an inner pair of notches extending downwardly from the corresponding sidewall top portion, (vi) at least one interior step surface and at least one exterior step surface and corresponding interior and exterior step ledges substantially orthogonal to their respective interior and exterior step surfaces, wherein the corresponding combinations of interior step surfaces and step ledges and exterior step surfaces and step ledges are configured to provide support for a second identical container nested in the container by supporting a second exterior step ledge upon an interior step ledge.

Further still, according to an embodiment of the present invention, the opposing sidewalls of the container comprise (vii) at least one container stacking structure comprising a foot portion, at least one reinforcing rib, and a ledge portion connected substantially orthogonally to the reinforcing rib, (viii) at least one container stacking structure receptacle comprising a sufficiently sized hole in each of the pair of opposing sidewalls to receive the container stacking structure, and wherein, when a second container is fully nested into a first container, the foot portion, the at least one reinforcing rib, and the ledge portion of the second nested container fits within the first container's container stacking structure receptacle, such that the foot portion of the second nested container rests upon the ledge of the first container.

Each of the opposing sidewalls of the container according to an embodiment of the present invention still further comprises (ix) a pair of receptacles, wherein each receptacle comprises a kidney shaped opening, the kidney shaped opening formed between a receptacle upper surface and a receptacle projection, the receptacle projection extending downwardly and outwardly from a portion of the kidney shaped opening closest to the respective opposing endwall, and wherein each receptacle further includes a smooth interior surface such that bail arm can easily move from one nesting position to another without substantial obstruction.

According to another embodiment of the present invention, each of the opposing sidewalls of the container according to an embodiment of the present invention still further comprises (ix) a pair of receptacles, wherein each receptacle comprises a slot shaped opening, the slot shaped opening formed between a receptacle upper surface and a receptacle lower surface, and wherein each receptacle further includes a smooth interior surface such that bail arm can easily move from one nesting position to another without substantial obstruction.

According to the embodiment of the present invention, the container further comprises a pair of bail arms, each bail arm comprising (i) a pair of inwardly turned portions that are rotationally received within the corresponding receptacle of each of the pair of opposing sidewalls, (ii) a pair of crank members located adjacent to the inwardly turned portions, (iii) a first engaging portion located between the pair of crank members, and (iv) a platen at an inwardly disposed end of the inwardly turned portions. When the first engaging portions of both bail arms are placed on the support surfaces of each endwall top portion, the container is configured to stack a second identical container in nested position. The bail arms of the container according to an embodiment of the present invention are configured such that (i) when the bail arms are placed in the inner set of notches of each of the pair of opposing sidewalls, the container is configured to stack the second identical container in a first stacking position that is higher than the nearly fully nested position, and (ii) when the bail arms are placed in the outer set of notches of each of the pair of opposing sidewalls, the container is configured to stack the second identical container in a second stacking position that is higher than the first stacking position. The platens as described above are configured to provide additional loading strength for the container by resisting any outward movement by the inwardly turned portions of the bail arms when a second container is stacked on a first container.

According to the embodiment of the present invention, the container further comprises a base comprising an inner and outer pair of bail arm stacking grooves, wherein the inner and outer pair of bail arm grooves each comprises a cut-away tube shape across the base that is substantially semi-circular. When the bail arms are placed in the inner set of notches of the opposing walls, the container is configured to stack the second identical container in a first stacking position that is higher than the nearly fully nested position by positioning the inner pair of bail arm stacking grooves of the second identical container upon the bail arms of the first container. When the bail arms are placed in the outer set of notches of the opposing walls, the container is configured to stack the second identical container in a second stacking position that is higher than the first stacking position by the same arms of the first identical container in the outer pair of bail arm stacking grooves of the second identical container.

Accordingly, it is an object of the present invention to provide a container comprising a base, a pair of opposing endwalls, each of the pair of opposing endwalls comprising (i) an endwall top portion, (ii) an endwall interior surface, (iii) an endwall exterior surface, and (iv) an endwall support surface located on the endwall top portion, and a pair of opposing sidewalls, each of the pair of opposing sidewalls comprising (i) a sidewall top portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, wherein each receptacle comprises a kidney shaped opening, the kidney shaped opening formed between a receptacle upper surface and a receptacle projection, the receptacle projection extending downwardly and outwardly from a portion of the kidney shaped opening closest to the respective opposing endwall. The container according to an embodiment of the present invention further comprises a pair of bail arms, each bail arm comprising (i) a pair of inwardly turned portions that are rotationally received within the corresponding receptacle of the opposing wall, (ii) a pair of crank members located adjacent to the inwardly turned portions, and (iii) an engaging portion located between the pair of crank members, wherein when the engaging portions of both bail arms are placed on the support surfaces of each endwall top portion, the container is configured to stack a second identical container in nested position, and the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position.

It is another object of the present invention to provide a container that further comprises (ii) a recessed portion recessed inwardly from the outer opposing wall surface, each recessed portion including a top edge of the corresponding receptacle and the corresponding outer notch. It is still a further object of the present invention to provide a container that further comprises a paper sticking preventing structure, wherein the paper sticking preventing structure comprises a plurality of micro-bumps on a plurality of surfaces of the container, and wherein the plurality of surfaces comprises a plurality of endwall exterior and interior surfaces, and a plurality of bail arms. The micro-bumps comprise a plurality of grooves, ridges, X's, and many other shapes.

The container according to another embodiment of the present invention still further comprises one or more bail arm locks, wherein the one or more bail arm locks are located on the sidewall top portion. The container according to another embodiment of the present invention still further comprises a plurality of air flow passages, wherein the plurality of airflow passages comprises a first passage formed by a pair of endwall lower handles and a plurality of retail meat trays, wherein the retail meat trays comprise an angled tray lip, two of the angled tray lips meeting together to form the first passage between the endwall lower handles, and a second passage formed by a pair of sidewall lower handles and a plurality of retail meat trays, wherein the retail meat trays comprise angled tray lips, to of the angled tray lips meeting together to form the second passage between the sidewall lower handles.

Accordingly, it is still another object of the present invention to provide a container a pair of opposing endwalls, each of the pair of opposing endwalls comprising (i) an endwall top portion, (ii) an endwall interior surface, (iii) an endwall exterior surface, and (iv) an endwall support surface located on the endwall top portion, a pair of opposing sidewalls, each of the pair of opposing sidewalls comprising (i) a sidewall top wall portion, (ii) a sidewall interior surface, and (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, wherein each receptacle comprises an opening, and a pair of bail arms, each bail arm comprising (i) a pair of inwardly turned portions that are rotationally received within the corresponding receptacle of the opposing wall, (ii) a pair of crank members located adjacent to the inwardly turned portions, and (iii) an engaging portion located between the pair of crank members, wherein when the engaging portions of both bail arms are placed on the support surfaces of each endwall top portion, the container is configured to stack a second identical container in nested position, and the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position.

It is an object of the present invention to provide a container that further comprises a base comprising an inner and outer pair of bail arm stacking grooves, wherein the inner and outer pair of bail arm grooves each comprises a cut-away tube shape across the base that is substantially semi-circular, wherein when the bail arms are placed in the inner set of notches of the opposing walls, the container is configured to stack the second identical container in a first stacking position that is higher than the nested position by positioning the inner pair of bail arm stacking grooves of the second identical container upon the bail arms of the first container; and when the bail arms are placed in the outer set of notches of the opposing walls, the container is configured to stack the second identical container in a second stacking position that is higher than the first stacking position by the same arms of the first identical container in the outer pair of bail arm stacking grooves of the second identical container.

Accordingly, it is an object of the present invention to provide a container that comprises a base, a pair of opposing endwalls, each of the pair of opposing endwalls comprising (i) an endwall top portion, (ii) an endwall interior surface, (iii) an endwall exterior surface, and (iv) an endwall support surface located on the endwall top portion, a pair of opposing sidewalls, each of the pair of opposing sidewalls comprising (i) a sidewall top wall portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, (vi) at least one interior step surface and at least one exterior step surface and corresponding interior and exterior step ledges substantially orthogonal to their respective interior and exterior step surfaces, wherein the corresponding combinations of interior step surfaces and step ledges and exterior step surfaces and step ledges are configured to provide support for a second identical container nested in the container by supporting a second exterior step ledge upon an interior step ledge, and wherein each of the pair of opposing sidewalls further comprises (vii) a pair of receptacles, and wherein each receptacle comprises an opening, and a pair of bail arms, each bail arm comprising (i) a pair of inwardly turned portions that are rotationally received within the corresponding receptacle of the opposing wall, (ii) a pair of crank members located adjacent to the inwardly turned portions, and (iii) a first engaging portion located between the pair of crank arms, wherein when the first engaging portions of both bail arms are placed on the support surfaces of each endwall top portion, the container is configured to stack a second identical container in nested position, and the bail arms being configured such that (i)

when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position.

Accordingly, it is a further object of the present invention to provide a container that comprises a base, a pair of opposing endwalls, each of the pair of opposing endwalls comprising (i) an endwall top portion, (ii) an endwall interior surface, (iii) an endwall exterior surface, and (iv) an endwall support surface located on the endwall top portion, a pair of opposing sidewalls, each of the pair of opposing sidewalls comprising (i) a sidewall top wall portion, (ii) a sidewall interior surface, (iii) a sidewall exterior surface, (iv) at least one container stacking structure comprising a foot portion, at least one reinforcing rib, and a ledge portion connected substantially orthogonally to the reinforcing rib, (v) at least one container stacking structure receptacle comprising a sufficiently sized hole in each of the pair of opposing sidewalls to receive the container stacking structure, and wherein, when a second container is fully nested into a first container, the foot portion, the at least one reinforcing rib, and the ledge portion of the second nested container fits within the first container's container stacking structure receptacle, such that the foot portion of the second nested container rests upon the ledge of the first container, and each of the pair of opposing sidewalls still further comprising (vi) an outer pair of notches extending downwardly from the corresponding sidewall top portion, and (vii) an inner pair of notches extending downwardly from the corresponding sidewall top portion, and wherein each of the opposing sidewalls further comprises (viii) a pair of receptacles, and wherein each receptacle comprises an opening.

It is still a further embodiment of the present invention to provide a container that further comprises a pair of bail arms, each bail arm comprising (i) a pair of inwardly turned portions that are rotationally received within the corresponding receptacle of each of the pair of opposing sidewalls, (ii) a pair of crank members located adjacent to the inwardly turned portions, and (iii) an engaging portion located between the pair of crank members, and wherein when the engaging portions of both bail arms are placed on the support surfaces of each endwall top portion, the container is configured to stack a second identical container in nested position, and the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position.

Accordingly, it is an object of the present invention to provide a container that comprises a base layer, a pair of opposing endwalls, each of the pair of opposing endwalls comprising (i) an endwall top portion, (ii) an endwall interior surface, (iii) an endwall exterior surface, and (iv) an endwall support surface located on the endwall top portion, a pair of opposing sidewalls, each of the pair of opposing sidewalls comprising (i) a sidewall top wall portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, and wherein each receptacle comprises a kidney shaped opening, the kidney shaped opening formed between a receptacle upper surface and a receptacle projection, the receptacle projection extending downwardly and inwardly from a portion of the kidney shaped opening closest to the respective opposing endwall, and a pair of bail arms, each bail arm comprising (i) a pair of inwardly turned portions that are rotationally received within the corresponding receptacle of each of the pair of opposing sidewalls, (ii) a pair of crank members located adjacent to the inwardly turned portions, and (iii) an engaging portion located between the pair of crank members, wherein when the first engaging portions of both bail arms are placed on the support surfaces of each endwall top portion, the container is configured to stack a second identical container in nested position, the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position; and wherein each receptacle further includes a smooth interior surface such that bail arm can easily move from one nesting position to another without substantial obstruction.

Still further accordingly, it is an object of the present invention to provide a container that comprises a base, a pair of opposing endwalls, each of the pair of opposing endwalls comprising (i) an endwall top portion, (ii) an endwall interior surface, (iii) an endwall exterior surface, and (iv) an endwall support surface located on the endwall top portion, and each of the pair of the opposing endwalls further comprising (v) an endwall upper handle that extends from the endwall interior surface through the endwall exterior surface, and (vi) an endwall lower handle that extends from the endwall interior surface through the endwall exterior surface; a pair of opposing sidewalls, each of the pair of opposing sidewalls comprising (i) a sidewall top wall portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, and wherein each receptacle comprises an opening, and each of the pair of opposing sidewalls still further comprising (vii) a sidewall upper handle that extends from the sidewall interior surface through the sidewall exterior surface, and (vii) a sidewall lower handle that extends from the sidewall interior surface through the sidewall exterior surface, and a pair of bail arms, each bail arm comprising (i) a pair of inwardly turned portions that are rotationally received within the corresponding receptacle of each of the pair of opposing sidewalls, (ii) a pair of crank members located adjacent to the inwardly turned portions, and (iii) an engaging portion located between the pair of crank members, wherein when the engaging portions of both bail arms are placed on the support surfaces of each endwall top portion, the container is configured to stack a second identical container in nested position, the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position.

Accordingly, it is another object of the present invention to provide a container that comprises a base, a pair of opposing endwalls, each of the pair of opposing endwalls comprising (i) an endwall top portion, (ii) an endwall interior surface, (iii) an endwall exterior surface, and (iv) an endwall support surface located on the endwall top portion; a pair of opposing sidewalls, each of the pair of opposing sidewalls comprising (i) a sidewall top wall portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, and wherein each receptacle comprises a kidney shaped opening, the kidney shaped opening formed between a receptacle upper surface and a receptacle projection, the receptacle projection extending downwardly and inwardly from a portion of the kidney shaped opening closest to the respective opposing endwall, and a pair of bail arms, each bail arm comprising (i) a pair of inwardly turned portions that are rotationally received within the corresponding receptacle of each of the pair of opposing sidewalls, (ii) a pair of crank members located adjacent to the inwardly turned portions, (iii) a first engaging portion located between the pair of crank members, and (iv) a platen at an inwardly disposed end of the inwardly turned portions, wherein when the first engaging portions of both bail arms are placed on the support surfaces of each endwall top portion, the container is configured to stack a second identical container in nested position, the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position, and further such that the platens are configured to provide additional loading strength for the container by resisting any outward movement by the inwardly turned portions of the bail arms when a second container is stacked on a first container.

Accordingly, it is yet another object of the present invention to provide a container that comprises a pair of opposing endwalls, each of the pair of opposing endwalls comprising (i) an endwall top portion, (ii) an endwall interior surface, (iii) an endwall exterior surface, and (iv) an endwall support surface located on the endwall top portion, and each of the pair of the opposing endwalls further comprising (v) an endwall upper handle that extends from the endwall interior surface through the endwall exterior surface, and (vi) an endwall lower handle that extends from the endwall interior surface through the endwall exterior surface, a pair of opposing sidewalls, each of the pair of opposing sidewalls comprising (i) a sidewall top wall portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, (vi) at least one interior step surface and at least one exterior step surface and corresponding interior and exterior step ledges substantially orthogonal to their respective interior and exterior step surfaces, wherein the corresponding combinations of interior step surfaces and step ledges and exterior step surfaces and step ledges are configured to provide support for a second identical container nested in the container by supporting a second exterior step ledge upon an interior step ledge, (vii) at least one container stacking structure comprising a foot portion, at least one reinforcing rib, and a ledge portion connected substantially orthogonally to the reinforcing rib, (viii) at least one container stacking structure receptacle comprising a sufficiently sized hole in each of the pair of opposing sidewalls to receive the container stacking structure, and wherein, when a second container is fully nested into a first container, the foot portion, the at least one reinforcing rib, and the ledge portion of the second nested container fits within the first container's container stacking structure receptacle, such that the foot portion of the second nested container rests upon the ledge of the first container, and wherein each of the opposing sidewalls further comprises (ix) a pair of receptacles, wherein each receptacle comprises a kidney shaped opening, the kidney shaped opening formed between a receptacle upper surface and a receptacle projection, the receptacle projection extending downwardly and outwardly from a portion of the kidney shaped opening closest to the respective opposing endwall, and wherein each receptacle further includes a smooth interior surface such that bail arm can easily move from one nesting position to another without substantial obstruction, and a pair of bail arms, each bail arm comprising (i) a pair of inwardly turned portions that are rotationally received within the corresponding receptacle of each of the pair of opposing sidewalls, (ii) a pair of crank members located adjacent to the inwardly turned portions, (iii) a first engaging portion located between the pair of crank members, and (iv) a platen at an inwardly disposed end of the inwardly turned portions, wherein when the first engaging portions of both bail arms are placed on the support surfaces of each endwall top portion, the container is configured to stack a second identical container in nested position, the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position, and further such that the platens are configured to provide additional loading strength for the container by resisting any outward movement by the inwardly turned portions of the bail arms when a second container is stacked on a first container.

It is still another object of the present invention to provide a container that further comprises a base comprising an inner and outer pair of bail arm stacking grooves, wherein the inner and outer pair of bail arm grooves each comprises a cut-away tube shape across the base that is substantially semi-circular, wherein when the bail arms are placed in the inner set of notches of the opposing walls, the container is configured to stack the second identical container in a first stacking position that is higher than the nested position by positioning the inner pair of bail arm stacking grooves of the second identical container upon the bail arms of the first container; and when the bail arms are placed in the outer set of notches of the opposing walls, the container is configured to stack the second identical container in a second stacking position that is higher than the first stacking position by the same arms of the first identical container in the outer pair of bail arm stacking grooves of the second identical container.

Accordingly, it is an object of the present invention to provide a method of stacking a plurality of containers according to an embodiment of the present invention, comprising the steps of determining whether to stack a second container in a fully nested configuration or a partially nested configuration or an un-nested configuration with respect to a first container; (i) interfacing a container sidewall interlock system of the second container with a container sidewall interlock system of the first container if stacking the containers in either the fully nested configuration or the partially nested configuration, (ii) interfacing a pair of bail arms on the first container with a pair of bail arms grooves on the second container if stacking the containers in either the partially nested configuration or an un-nested configuration, and obtaining an additional container to stack and repeating steps (i) and (ii) with respect to the additional container and the previously stacked container until there are no remaining additional containers to be stacked.

Further still, it is an object of the present invention to provide a container that comprises a base, a pair of opposing endwalls, each of the pair of opposing endwalls comprising (i) an endwall top portion, (ii) an endwall interior surface, (iii) an endwall exterior surface, and (iv) an endwall support surface located on the endwall top portion, a pair of opposing sidewalls, each of the pair of opposing sidewalls comprising (i) a sidewall top portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, wherein each receptacle comprises a curved slot shaped opening, the curved slot shaped opening formed on a sidewall receptacle panel, the sidewall receptacle panel comprising a portion of the sidewall exterior surface, and wherein the slot shaped opening extends downwardly on the sidewall and inwardly from the closest endwall, and a pair of bail arms, each bail arm comprising (i) a pair of outwardly turned portions that are rotationally received within the corresponding receptacle of the opposing sidewall, (ii) a pair of crank members located adjacent to the outwardly turned portions, and (iii) an engaging portion located between the pair of crank members, wherein when the engaging portions of both bail arms are placed on the support surfaces of each endwall top portion, the container is configured to stack a second identical container in nested position, and the bail arms being configured such that (i) when the bail arms are placed in the inner set of notches of each of the pair of opposing sidewalls, the container is configured to stack the second identical container in a first stacking position that is higher than the nested position, and (ii) when the bail arms are placed in the outer set of notches of each of the pair of opposing sidewalls, the container is configured to stack the second identical container in a second stacking position that is higher than the first stacking position.

Accordingly, it is yet a further object of the present invention to provide an automated bail arm placement system that comprises a link arm assembly configured to interface with a plurality of bail arms on a plurality of containers, a memory configured to store a set of instructions, and a processor configured to process the set of instructions stored in the memory wherein the link arm assembly moves and interfaces with the plurality of bail arms, to move them from any position to any other position.

Further still, it is an object of the present invention to provide a method for automatically moving a plurality of bail arms on a plurality of containers, comprising the steps of locating a first container with the plurality of bail arms proximal to an automated bail arm placement system, interfacing a link arm assembly with the plurality of bail arms on the first container, and moving the plurality of bail arms from any position to any other position.

BRIEF DESCRIPTION OF THE DRAWINGS

The various objects, advantages and novel features of the present invention will be best understood by reference to the detailed description of the preferred embodiments which follows, when read in conjunction with the accompanying drawings, in which.

DETAILED DESCRIPTION OF THE INVENTION

Figure 1:
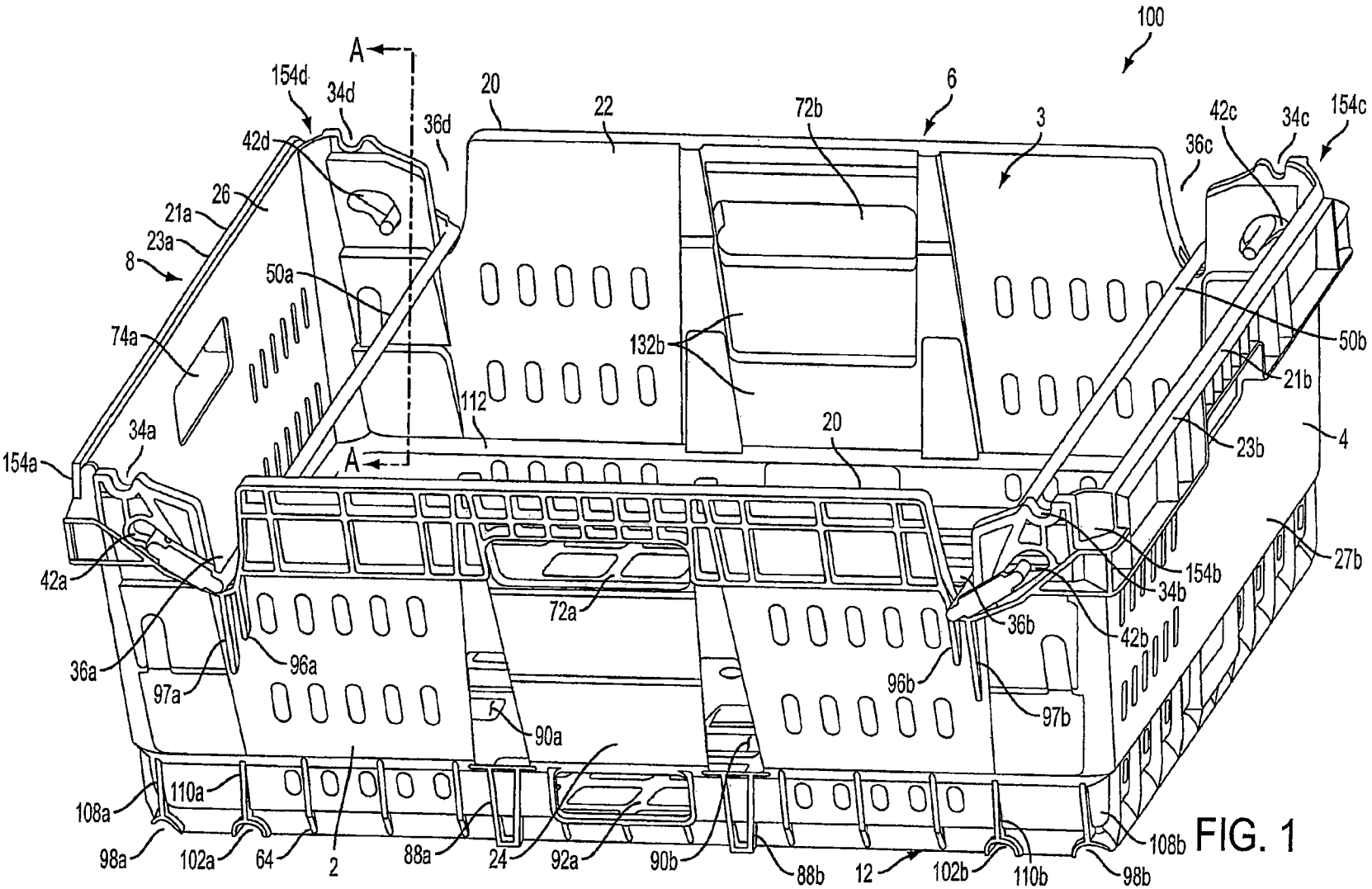
FIG. 1 illustrates a front perspective view of a multiple nestable stacking container according to an embodiment of the present invention.

The various features of the invention will now be described with reference to the figures, in which like parts are identified with the same reference characters.

Described herein is a three level nestable stacking container comprising a base, a pair of opposing sidewalls, a pair of opposing endwalls and at least two bail arms. Each of the opposing sidewalls comprises a plurality of peanut or kidney shaped receptacles, and in an alternative embodiment of the present invention, a plurality of slot shaped receptacles. The receptacles allow for ease of rotational movement of the bail arms between any of at least three positions. The three positions for the bail arms provide three stacking configurations for a second, upper container, in regard to a first, lower container: a nearly fully nested configuration; a partially nested configuration; and a substantially un-nested configuration. The opposing sidewalls also comprise a sidewall interlock system, as well as a container stacking structure. The bails arms are completely contained within the "footprint" or area of the container, and mate with grooves in the base of the container in the partially nested and substantially un-nested configuration.

Referring to FIGS. 1-5 and 6-10, containers 100 and 200 according to an embodiment of the present invention are illustrated respectively. Container 100 is referred to as a "4down" container, and container 200 is referred to as a "5down" container. Container 100, the "4down" version, is sized to fit, in a preferred embodiment of the present invention, four such containers 100 onto a single level of a standard sized pallet used in the industry. Similarly, the "5down" container 200 is sized to fit five such containers 200 onto a single level of a standard pallet. This same configuration applies to the container 400 shown in FIGS. 25 through 32 (also a "4down" container), and container 500 shown in FIGS. 33 through 40 (also a "5down" container). Of course, the containers according to a preferred embodiment of the present invention may be designed to hold any numbers of smaller containers.

Standard pallets have both metric and a U.S. standard measurement configurations. In European and many other countries, the metric system is the standard of measurement. In the U.S., England, and some other countries, however, standard measurements are the standard of measurements. Pallets in the U.S. typically measure 48×40 inches, while a metric equivalent pallet is 120×100 centimeters.

Figure 48A:
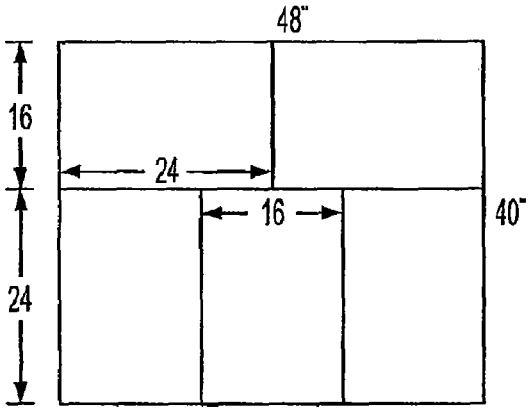
FIG. 48A illustrates a standard 5down container pallet configuration.
Figure 48B:
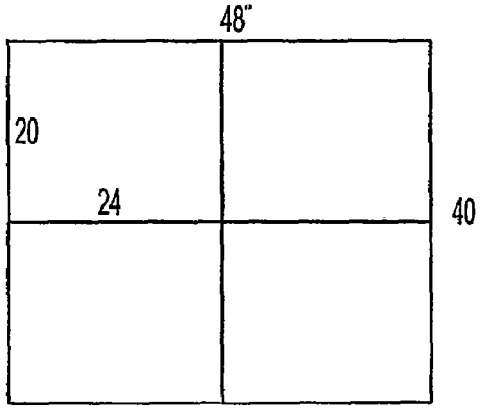
FIG. 48B illustrates a standard 4down container pallet configuration.
Figure 49A:
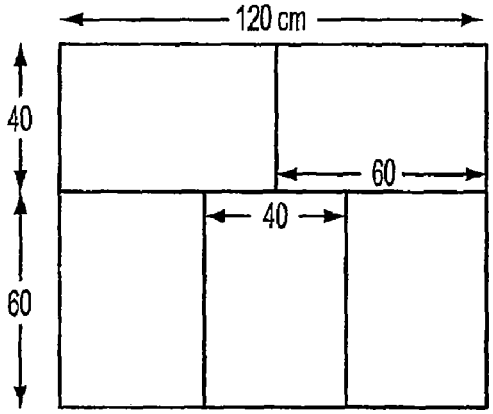
FIG. 49A illustrates a metric 5down container pallet configuration.
Figure 49B:
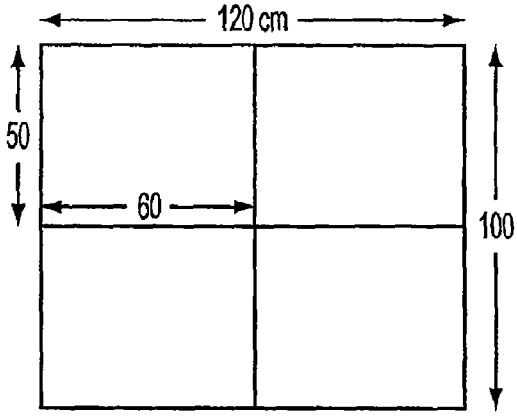
FIG. 49B illustrates a metric 4down container pallet configuration.

In the 4down configuration, the standard pallet contains four separate containers, each about 20×24 inches. This is shown in FIG. 48B. In FIG. 48A, the same standard pallet in a 5down configuration is shown. In the 5down configuration, the containers measure about 16×24 inches. In FIGS. 49A and 49B, metric pallets are shown in a 5down and 4down configuration respectively. The containers for the 5down pallet measure about 60×40 centimeters, and the containers for the 4down configuration measure about 60×50 centimeters.

Container 100 is, according to an embodiment of the present invention, portable and comprises a base 10, and a pair of opposing endwalls 4, 8 (which can also be referred to as a right endwall 4 and a left endwall 8). The container 100 further comprises a pair of opposing sidewalls 2, 6 (which can also be referred to as a front sidewall 2 and a back sidewall 6). The opposing pair of endwalls 4, 8 and opposing pair of sidewalls 2, 6 extend upwardly from base 10. Base 10 and the opposing pair of endwalls 4, 8 and opposing pair of sidewalls 2, 6 are integrally molded to form a unitary construction having a compartment area 3 within which goods are stored and transported. Container 100 is, according to an embodiment of the present invention, formed from an injection molded thermoplastic such as crate-grade high density polyethylene, but can also comprise other types of plastics. The process for manufacturing containers 100, 200 is pressure injection molding. Container 100 also comprises a pair of opposed bail arms 50*a, b*, each of which is selectively moveable and pivotable among a plurality of positions, with at least three such positions illustrated herein.

For purposes of ease of discussion and brevity, reference to and the detailed description herein will be directed to container 100 and all the components comprised thereof. The same description applies equally to the containers 200, 400, 500 but will not be repeated. FIGS. 6-10 illustrate container 200, and contain the same element feature numbers as in FIGS. 1-5, and 11-25, which describe container 100, and methods of using and making the same. The same description that applies to containers 100, 200 also equally applies to containers 400 (4down version) and 500 (5down version), with the notable exception of the receptacle that receives the bail arms 50*a, b* inwardly turned portion 86*a, b*. In containers 400, 500, the receptacle is a slot shaped receptacle 45, with a slot receptacle hole 55. The unique features of the slot shaped receptacle are provided and discussed in greater detail below. Further, in the discussion below, reference is generally made to the features of the embodiments of the present invention in regard to a single sidewall, a single endwall, or single bail arm. The discussions of any such feature apply equally to the opposing sidewall, endwall, or bail arm.

Figure 20:
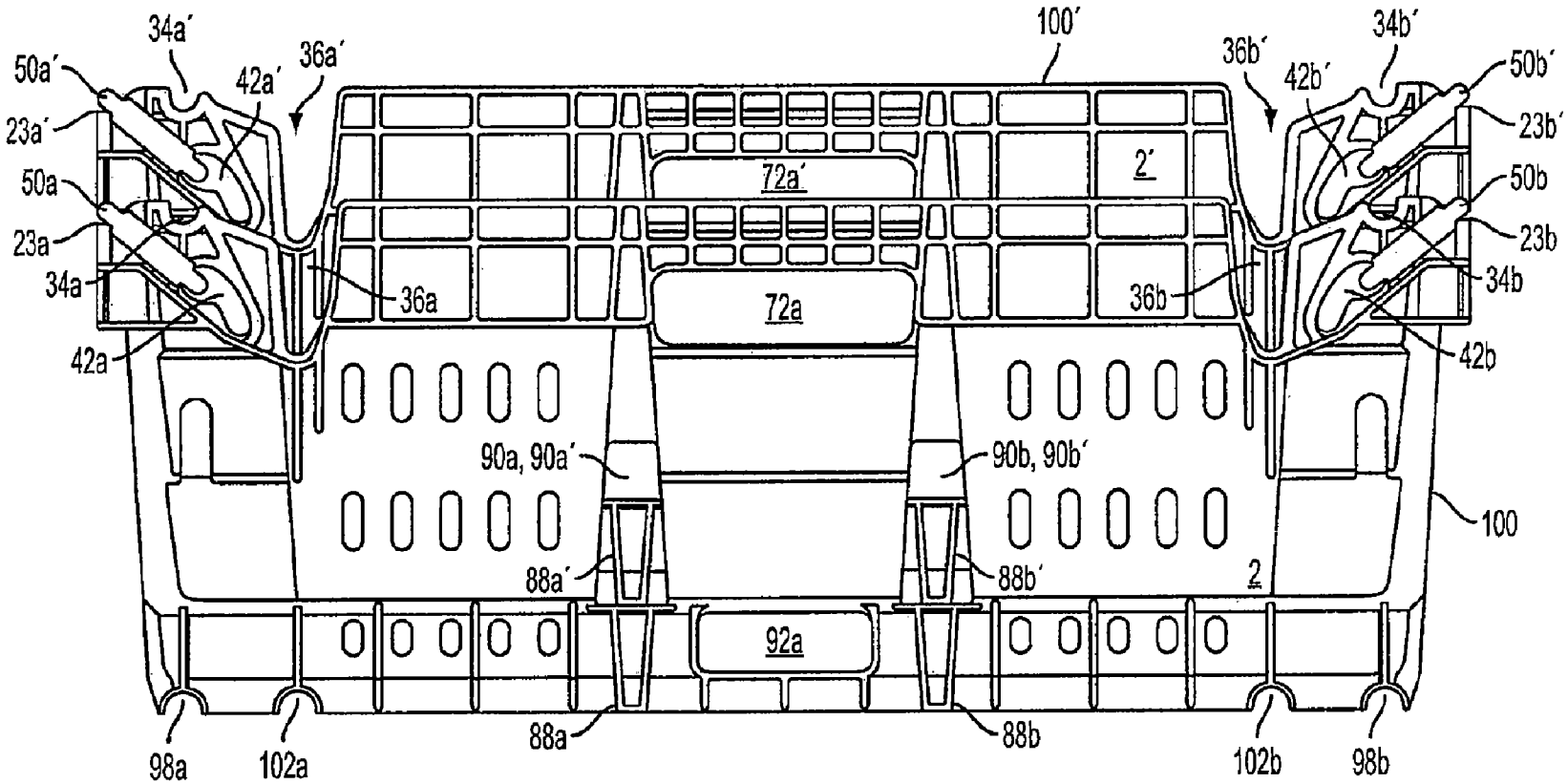
FIG. 20 illustrates a second container nearly fully nested into a first container, wherein the first and second containers are the containers shown in FIGS. 1 through 10, according to an embodiment of the present invention.
Figure 21:
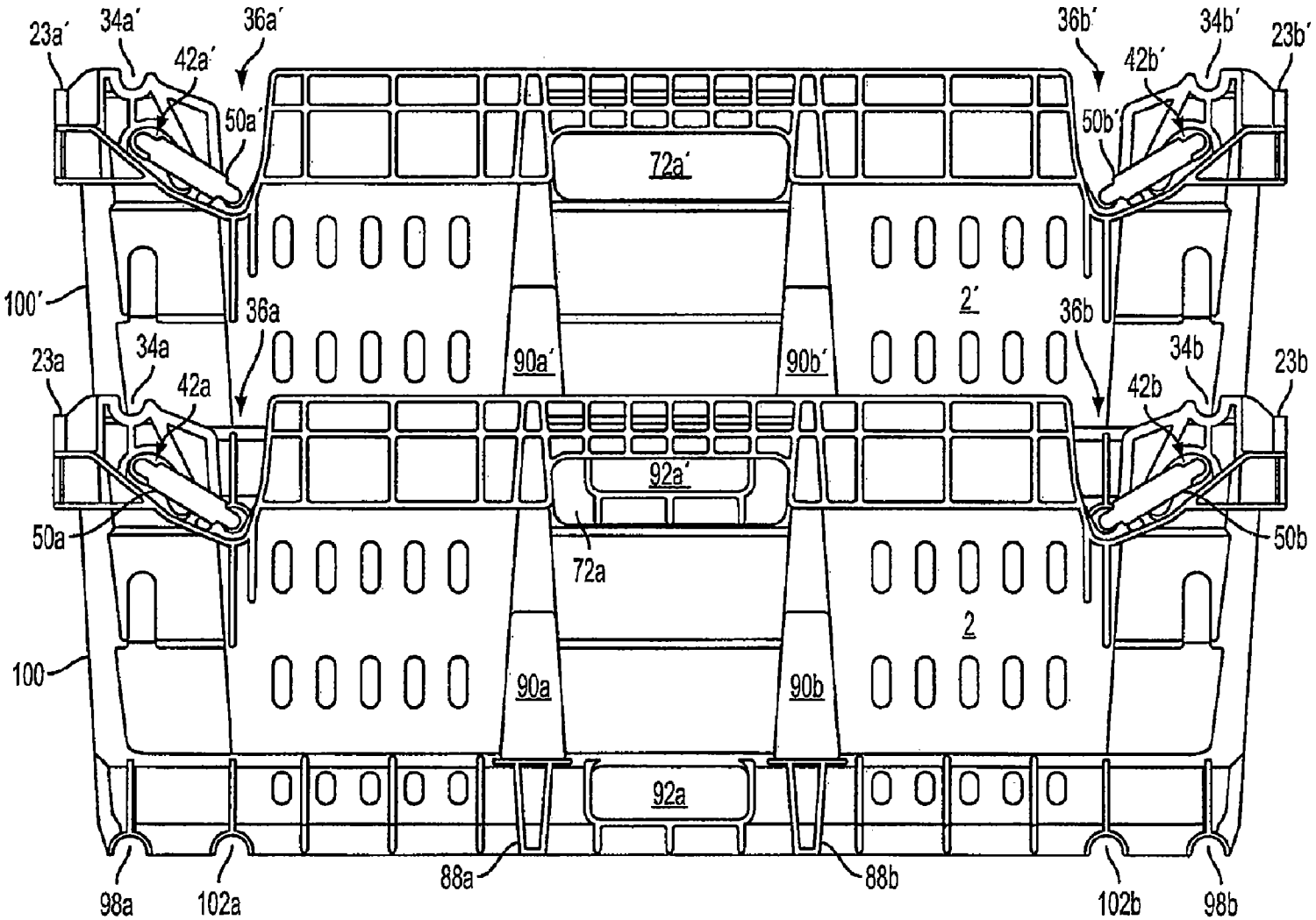
FIG. 21 illustrates a second container partially nested into a first container, wherein the first and second containers are the containers shown in FIGS. 1 through 10, according to an embodiment of the present invention.
Figure 44:
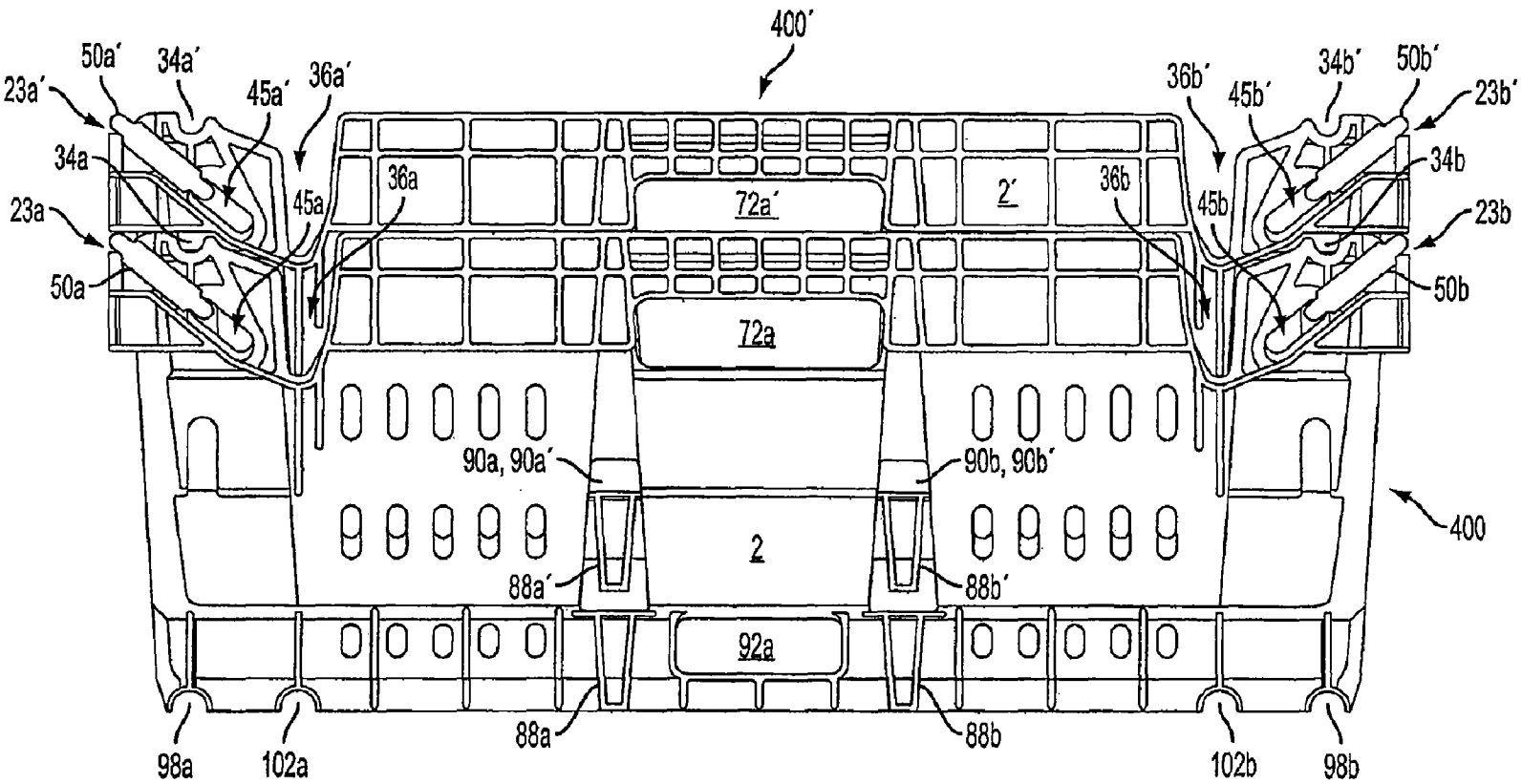
FIG. 44 illustrates a second container nested fully into a first container, wherein the first and second containers are the containers shown in FIGS. 25 through 40, according to another embodiment of the present invention.
Figure 45:
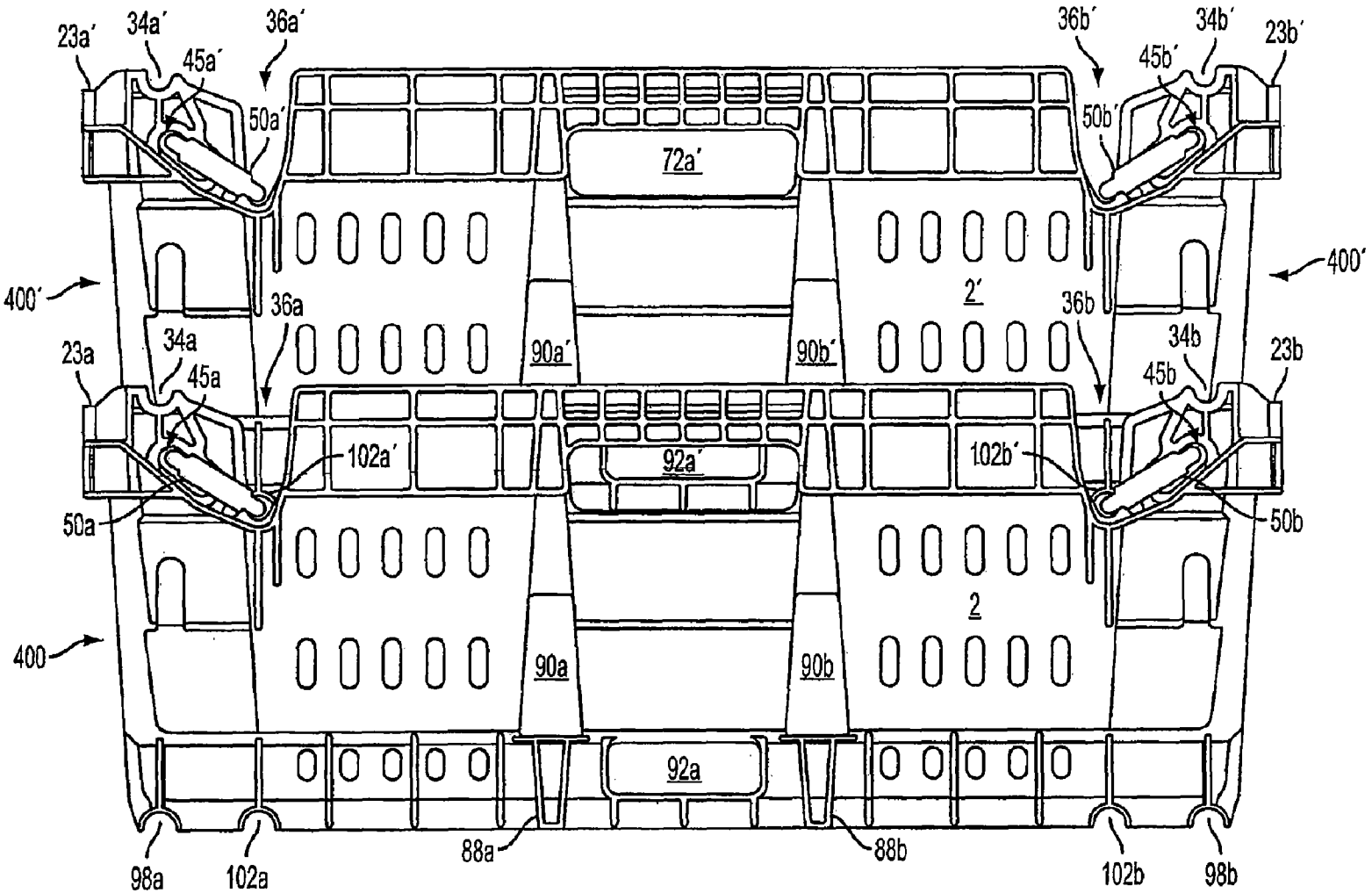
FIG. 45 illustrates a second container nested partially into a first container, wherein the first and second containers are the containers shown in FIGS. 25 through 40, according to another embodiment of the present invention.
Figure 46:
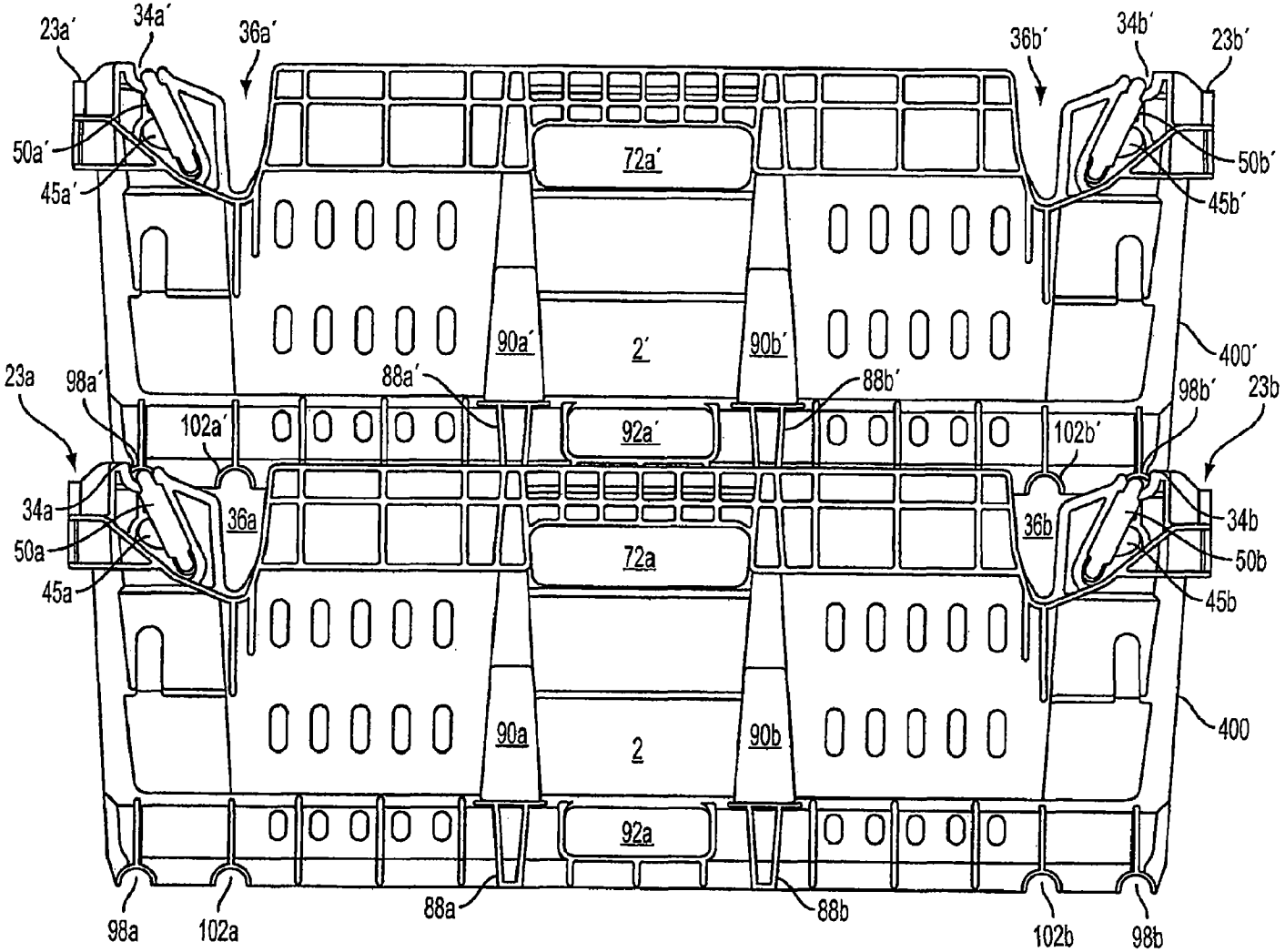
FIG. 46 illustrates a second container in an un-nested position with regard to a first container, wherein the first and second containers are the containers shown in FIGS. 25 through 40, according to another embodiment of the present invention.
Figure 50A:
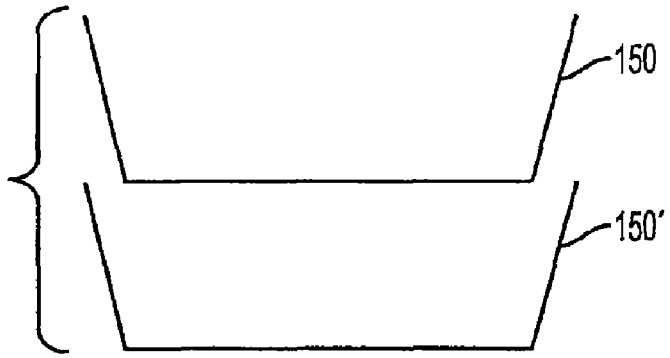
FIGS. 50A-C illustrate two containers in a substantially un-nested configuration, a partially nested configuration, and a nearly fully nested configuration.
Figure 50B:
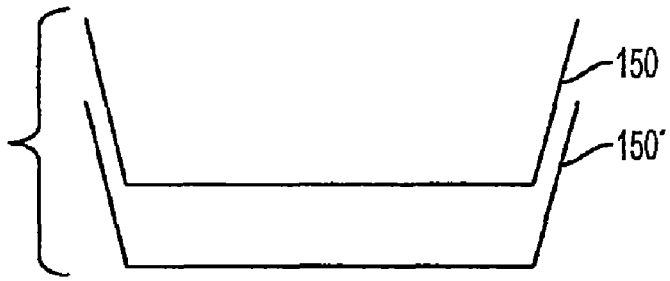
Figure 50C:
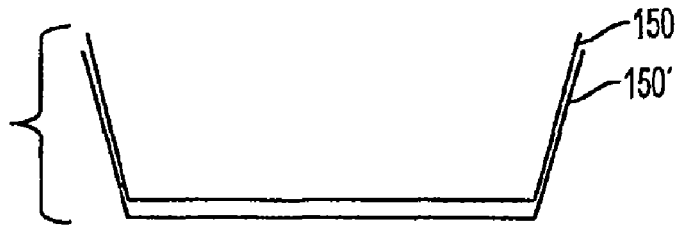

As will be described in greater detail below, and as generally described above, the containers 100, 200 and 400, 500 are capable of being placed in either a nearly fully nested configuration, a partially nested configuration, or a substantially un-nested configuration according to an embodiment of the present invention. As shown in FIG. 20, second container 100', the upper container, is nearly fully nested in container 100. In FIG. 21 second container 100' is partially nested in first container 100, and in FIG. 22 second container 100' is substantially un-nested with respect to first container 100. FIGS. 44-46 illustrate the same configurations with container 400. In FIG. 44, container 400', the upper container, is nearly fully nested in container 400, the lower container. In FIG. 45, container 400' is partially nested in container 400', the lower container. In FIG. 46, container 400' is substantially un-nested with respect to container 400. FIGS. 50A-50C illustrate the same configurations (FIG. 50A—substantially un-nested; FIG. 50B—partially nested; and FIG. 50C—nearly fully nested) for two generic containers 150 and 150'.

In FIGS. 1-4, 11-14C, and 23, bail arm 50 comprises a first bail arm crank member (first crank member) 84*a*, and a second bail arm crank member (second crank member) 84*b*. Each crank member 84*a*, 84*b* is capable of being engaged with and mountably connected to a respective sidewall 2, 6. According to an exemplary embodiment of the present invention, bail arm 50 is made of metal, preferably a high strength steel. As one of ordinary skill in the art can appreciate, however, other high strength materials can also be used to make the bail arm, including, for example, plastics such as crate-grade high density polyethylene, among others. Engagement and mounting of the bail arm 50 with the sidewalls 2, 6 is discussed in greater detail below. Bail arm 50 includes an elongated central bail member engaging portion (engaging portion) 82 extending across the compartment area 3 between sidewalls 2, 6. Bail arm 50 also includes first and second bail member inwardly turned portions (first and second inwardly turned portions) 86*a*, 86*b* that are connected to an end of the first and second crank members 84*a*, 84*b*, respectively. Furthermore, as shown in FIGS. 14A, 14B, 14C, and 23, a first and second bail arm platen (platen) 83*a*, 83*b* is formed at the end of the first and second inwardly turned portions 86*a*, 86*b* to which it is attached, respectively.

In a first alternative embodiment of the present invention, the first and second platens 83A, 83B are formed by striking the end of the respective inwardly turned portion 86A, 83B with a mechanical device with sufficient force such that a portion of the inwardly turned portion 86*a*, 86*b* creates a flattened platen at that point. Alternatively, the first and second platens 83*a*, 83*b* can be formed separately and attached by being welded, glued, and/or attached via mechanical means (rivet, screw, nut and bolt, among other ways) to the end of the inwardly turned portion 86*a*, 86*b*.

Bail arms 50*a*, 50*b* are positionable at several different positions on the sidewalls 2, 6 such that a second like container 100' can nest into a first container 100 in at least three different manners. For example, as shown in FIG. 20, an empty second container 100' can achieve space efficiency in storage and transport by being nearly fully nested into a first container 100. This occurs when the first and second bail arms 50*a*, 50*b* are located on top of the endwalls 4, 8. Secondly, the second container 100' can be in a partial nesting position, when the first and second bail arms occupy a lowest position, as shown and described in greater detail below in regard to FIG. 21. Further, the second container 100' can be in a nearly substantially un-nested position in regard to the first container 100 when the first and second bail arms 50*a*, 50*b* are in a highest position, also shown and described in greater detail below in regard to FIG. 22. By varying the bail arms 50*a*, 50*b* between the three different locations, a plurality of stacking configurations are possible. The availability of the different stacking configurations allows the stacker to achieve multi-height stacking capability and different stack heights between like containers.

Figure 57A:
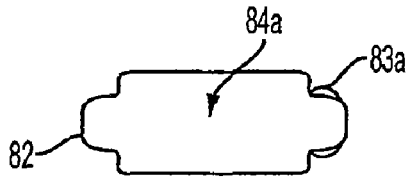
FIGS. 57A-57E illustrate a plurality of bail arm crank members according to an embodiment of the present invention.
Figure 57B:
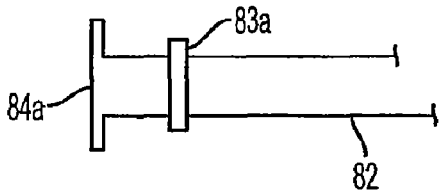
Figure 57C:
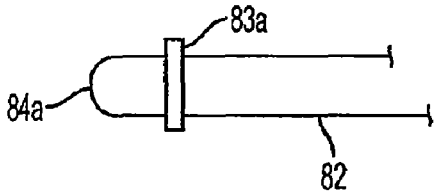
Figure 57D:
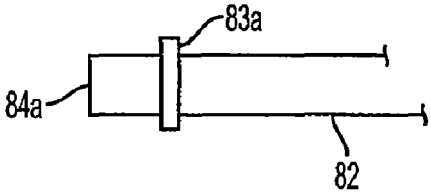
Figure 57E:
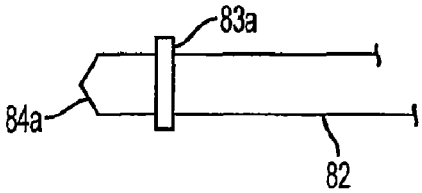

As discussed above, each crank member 84*a, b* is capable of being engaged with and being mountably connected to a respective sidewall 2, 6. Attention is directed towards FIGS. 13B-D. In FIG. 13B, bail arm 50*b* is shown in a nearly fully nested position, sitting on top of bail arm saddle surface 23*b*. The crank members 84*a, b* are engaged in a close fashion against the sidewall exterior surface 24 of the outer notch ribs 30*a*, 30*b* and 30*c*. FIGS. 57A-E illustrate several possible shapes of crank members 84*a, b*. In FIG. 57B, the shape of crank member 84*a* is the same as appears in FIGS. 14B and 14C. This is an elongated platen shape, generally rectangular as viewed from the front (FIG. 57A), and taller than the bail arm engaging portion 82 (as shown in FIG. 57B). As one of ordinary skill in the art can appreciate, however, the shape of crank members 84*a, b* can vary and still operate in substantially the same manner. For example, in FIG. 57C, crank member 84*a* is now generally semi-circular and of substantially the same dimensions as engaging portion 82. In FIG. 57D, crank member 84*a* is substantially square, and in FIG. 57E, crank members 84*a* is substantially triangular. In all these configurations, the bail arm 50 can operate in substantially the same manner as when crank member 84*a* is shaped according to FIGS. 57A and 57B, as I does not extend beyond the perimeter or outer edges of the container 100, as is discussed in greater detail below.

Preferably, the crank members 84*a*, 84*b* do not project, in a horizontal direction, any farther from the sidewall exterior surface of the outer notch ribs 30*a*, 30*b* and 30*c* than the sidewall exterior surface of the receptacle lower surface 48. That is, if an imaginary vertical plane was drawn touching and parallel to the exterior surface of the receptacle lower surface 48, the crank member 84*b* would not touch such imaginary plane. Thus, the crank members 84A, 84B preferably do not protrude out from the sidewalls 2, 6 of the container 100. The same is true when the bail arm 50*b* is located in the substantially un-nested configuration as shown in FIG. 13C, and when the bail arm 50*b* is placed in the partially nested configuration as shown in FIG. 13D. This prevents containers from interfering with each other, and allows for closer stacking of columns of containers 100. By keeping the bail arms 50*a*, 50*b* within the dimensions of the container 100, users of the container 100 can more efficiently use shipping space, thus reducing costs.

Figure 23:
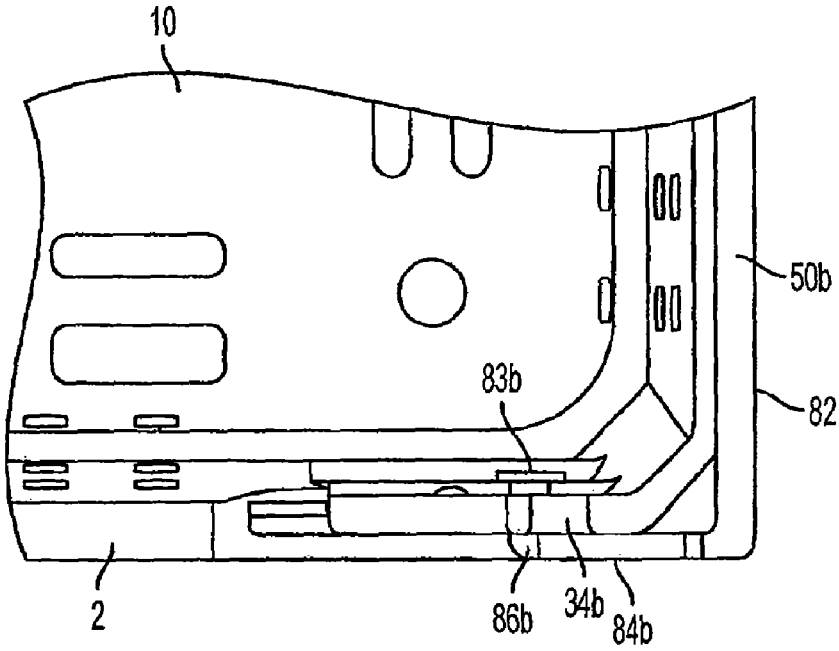
FIG. 23 illustrates a close-up top view of the container of FIGS. 1 through 10 showing the bail arm and bail arm platen.

Referring now to FIG. 23, the bail arm platen 83*b* is shown in greater detail. When the bail arms 50*a*, 50*b* are located in either the substantially un-nested or partially nested position, and a second container 100' is placed on the bail arms 50*a*, 50*b*, the bail arm engaging portion 82 of the bail arms 50*a*, 50*b* will tend to bow down if the second container 100' is loaded with a heavy product. If the bail arm engaging portion 82 of the bail arms 50*a*, 50*b* bows down, then the inwardly turned portions 83*a*, 83*b* may be forced outward from within the compartment 3 of the container 100 to a location exterior of the opposing sidewalls 2, 6. This could then cause the first container 100 to malfunction. The platens 83A, 83B help prevent this from occurring by providing an impediment to any outward movement of the inwardly turned portions 86*a*, 86*b* of the bail arms 50*a*, 50*b*.

Figure 4:
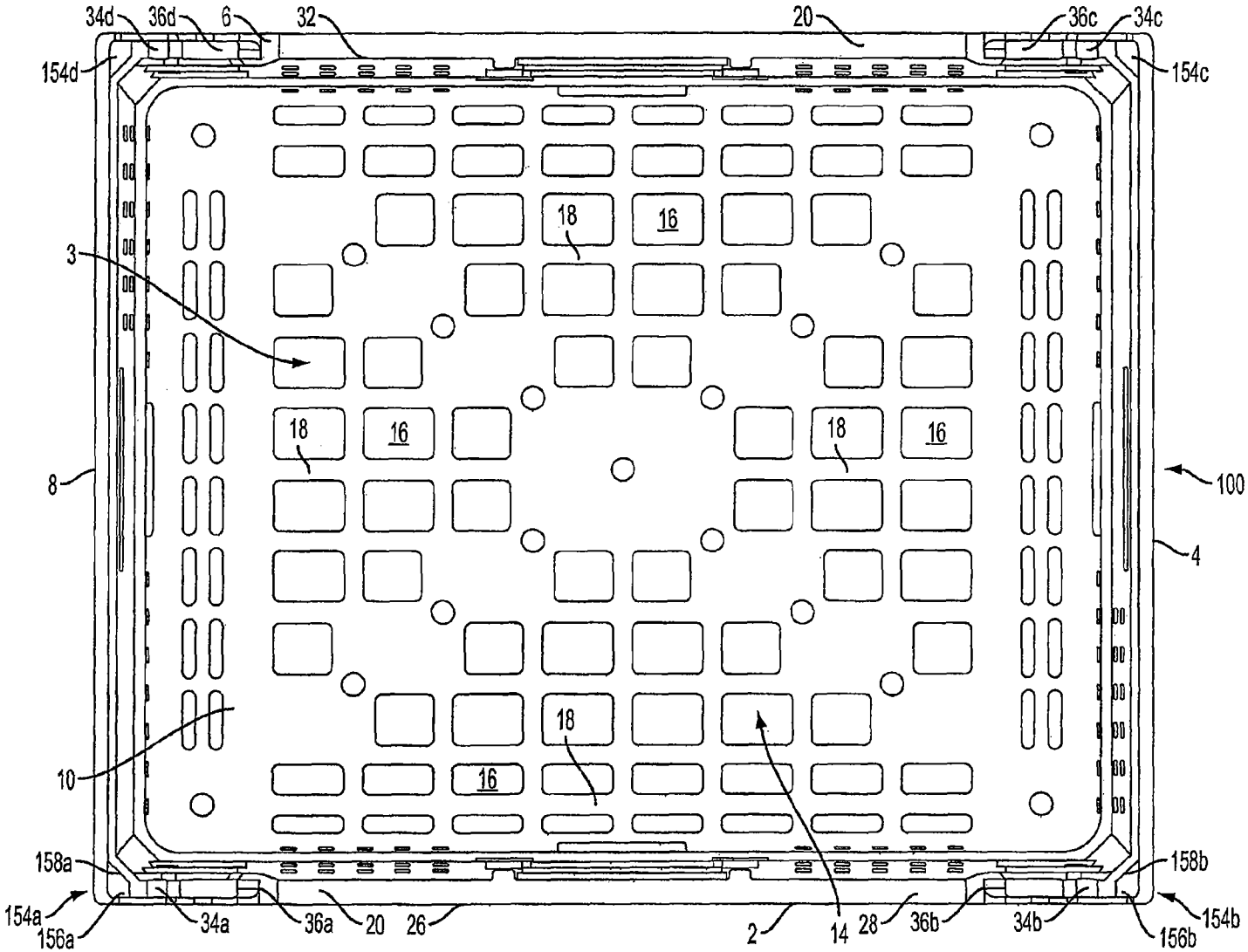
FIG. 4 illustrates a top view of the container shown in FIG. 1.
Figure 47:
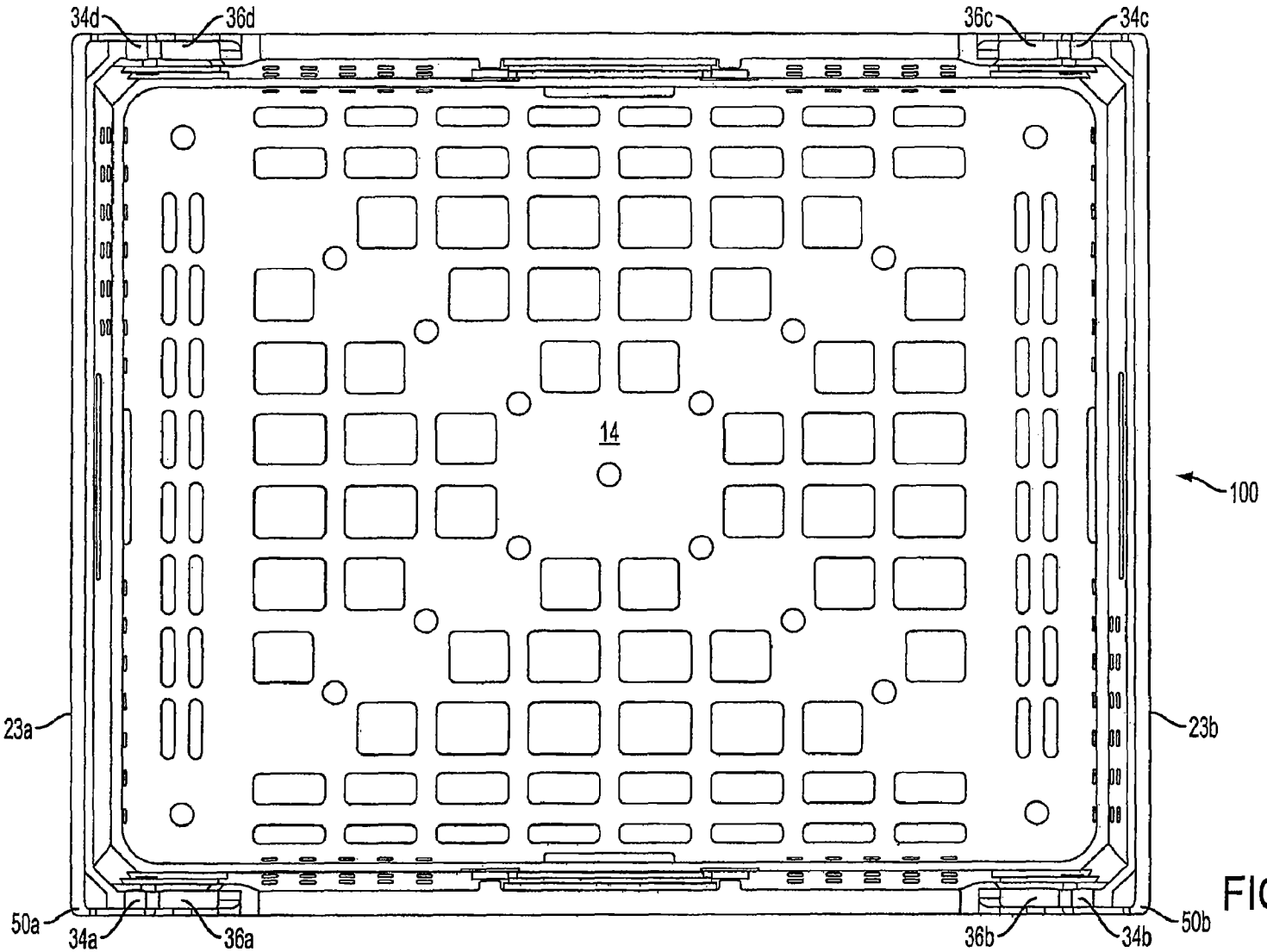
FIG. 47 illustrates a top view of the container shown in FIGS. 1 through 10 and 25 through 40 with the bail arms 50*a, b* in a nearly fully nested position.

FIGS. 4 and 47 illustrates a top view of container 100, and FIG. 47 in particular illustrates the top view of container 100, with the bail arms 50*a, b* in a nearly fully nested position. In the nearly fully nested position, bail arms 50*a, b* are located on bail arm saddles 23*a, b* respectively. When the bail arms 50*a, b* are located at bail arm saddles 23*a, b*, and a second container 100' is placed in the first container 100, the second container 100' is in the nearly fully nested configuration. Note that bail arms 50*a, b* preferably do not extend beyond the outer edge or perimeter of the container 100 on any side, even in this nearly fully nested configuration. As seen in FIG. 47, the bail arm engaging portion 82 for each bail arm 50*a, b* does not extend beyond or outwardly from the endwall exterior surface 28. Thus, if any imaginary vertical plane was drawn just touching the endwall exterior surface 28 at both bail arm saddles 23*a, b*, the bail arms 50*a, b* preferably would not touch such imaginary vertical plane at the bail arm engaging portion 82. Similarly, if another imaginary vertical place was drawn just touching either sidewall exterior surface 24 at the receptacle lower surface 48*a-d*, the bail arm crank members 84*a, b* (for both bail arms 50*a, b*) preferably would not touch such imaginary vertical place. The bail arms 50*a, b* are substantially contained within the perimeter of the container 100 (or container 200). This occurs regardless of the configuration of the bail arms 50*a, b*: the nearly fully nested configuration wherein the bail arms 50*a, b* are located on bail arm saddles 23*a, b*; the partially nested configuration, wherein the bail arms 50*a, b* are located on the first and second inner notches 36*a*-36*d*; and the substantially un-nested configuration, wherein the bail arms 50*a, b* are located at the first and second pair of outer notches 34*a*-34*d*. See also FIGS. 13A-13C, which also illustrate these configurations and are discussed in greater detail below.

Locating the bail arms 50*a, b* within the perimeters of the containers 100, 200 provides several advantages when shipping and using the containers 100, 200. For example, by being located substantially entirely within the perimeters of the containers 100, 200, the bail arms 50*a, b* cannot interfere with other containers or other objects. The advantages of having containers that can be nearly fully nested within each other are that more empty containers can be shipped to desired locations using less space, than if they merely stacked on one another. Some of the advantages provided by having the containers be partially nested and substantially un-nested with respect to one another, is that different products, or different amounts of product, can be shipped/stored using the same containers, thereby achieving greater efficiencies. Using the same containers for different products or amounts of products means less money has to be spent on different containers. Additionally, using the same container for different products or amounts of products means less space is necessary for storing different types of containers, thereby saving money on the different containers, and space for storing the different containers. This is a two-fold savings.

Engagement and mounting of the bail arm 50 with the sidewalls 2, 6 is discussed in greater detail below.

Referring now to FIGS. 1, 2, 4, 11-13, and 16-19, the first and second opposing sidewalls 2, 6 will now be discussed. As seen in the drawing figures, each opposing sidewall 2, 6 is preferably comprised of a single unitary structure, usually, but not necessarily, made of plastic material, that is co-fabricated (e.g., injection-molded) with the base 10 and opposing endwalls 4, 8. According to an exemplary embodiment of the present invention, a typical method for manufacturing the containers 100, is plastic injection molding. In plastic injection molding, a steel mold (usually a very high quality steel, such as tool steel), is created by machining the steel according to very detailed drawings. For components such as container 100, the steel mold must be upwards of at least about a foot thick on all sides. The reason the steel mold must be so thick is that the hot molten plastic is injected at pressures up to 20,000 PSI. A complete description of the plastic injection molding process is both beyond the scope of this document, and well known to those of ordinary skill in the art of the invention. As such, for the purpose of brevity, further discussion is not necessary.

Each sidewall 2, 6 comprises several different features that provide different functions in the use of the container 100. Each sidewall 2, 6 comprises a sidewall top portion 20, a plurality of upper sidewall strength and rigidity areas 38*a-c*, an upper handle 72, and lower handle 92. The upper sidewall strength and rigidity areas 38*a*-38*c* provide strength and rigidity to the upper wall area of the sidewalls 2, 6, and therefore the container 100 can contain heavier loads. Further, each sidewall 2, 6 also comprises a pair of receptacles 42*a*, 42*b*, and first and second container stacking structures 88A, 88B. The pair of receptacles 42*a*, 42*b* are provided to retain the bail arms 50*a*, 50*b*, as discussed above, and their operation will be described in greater detail below. Each sidewall still further comprises a sidewall interior surface 22, a sidewall exterior surface 24, container stacking structure receptacles 90*a*, 90*b*, a plurality of sidewall upper ventilation holes 70, a plurality of sidewall middle ventilation holes 68, and a plurality of lower sidewall ventilation holes 66. The first and second container stacking structures 88*a*, 88*b* and container stacking structure receptacles 90*a*, 90*b* are provided to give the container 100 additional load carrying capacity, and their operation will also be discussed in greater detail below.

Formed along the bottom of each of the sidewalls 2, 6 are a plurality of sidewall lower strengthening ribs 64 that provide additional wall and container strengthening.

Figure 11A:
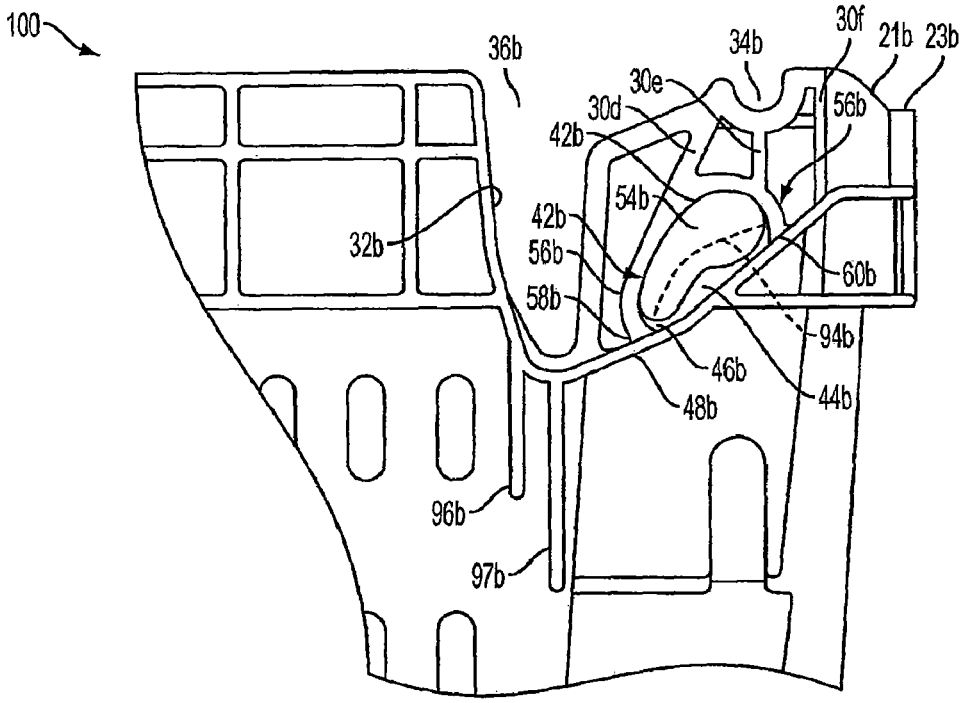
FIG. 11A illustrates a close-up front view of a second receptacle in the containers shown in FIGS. 1 through 10.
Figure 11B:
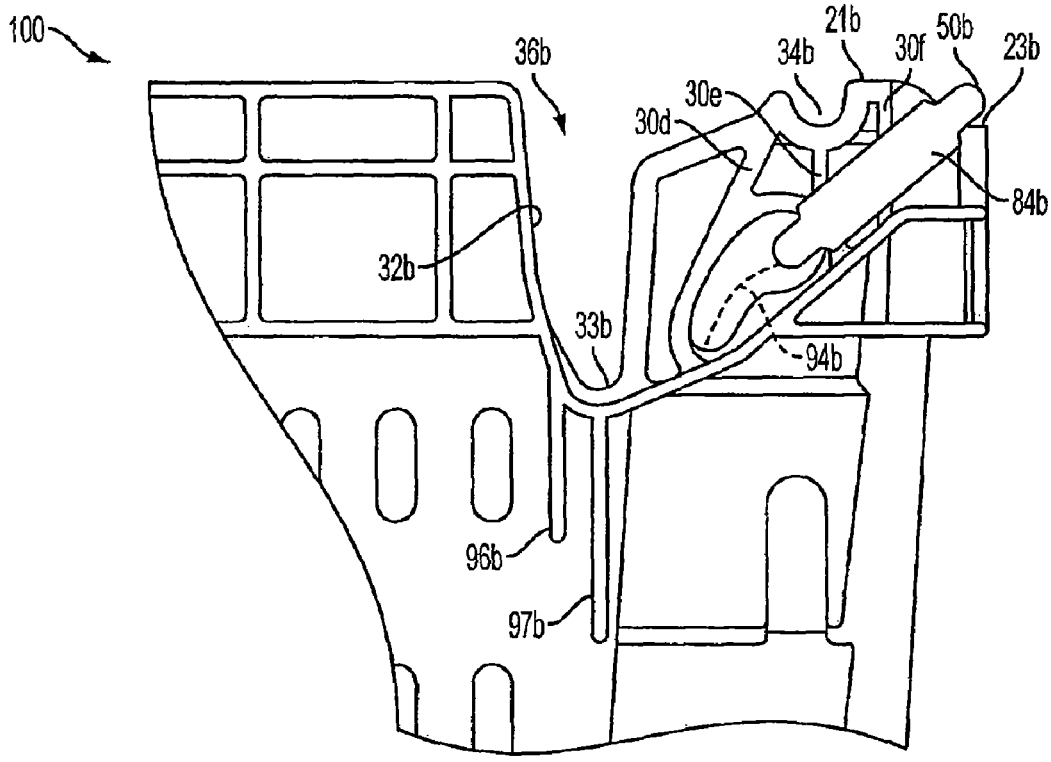
FIG. 11B illustrates the same close-up view as FIG. 11A, but with a bail arm according to an embodiment of the present invention.
Figure 12A:
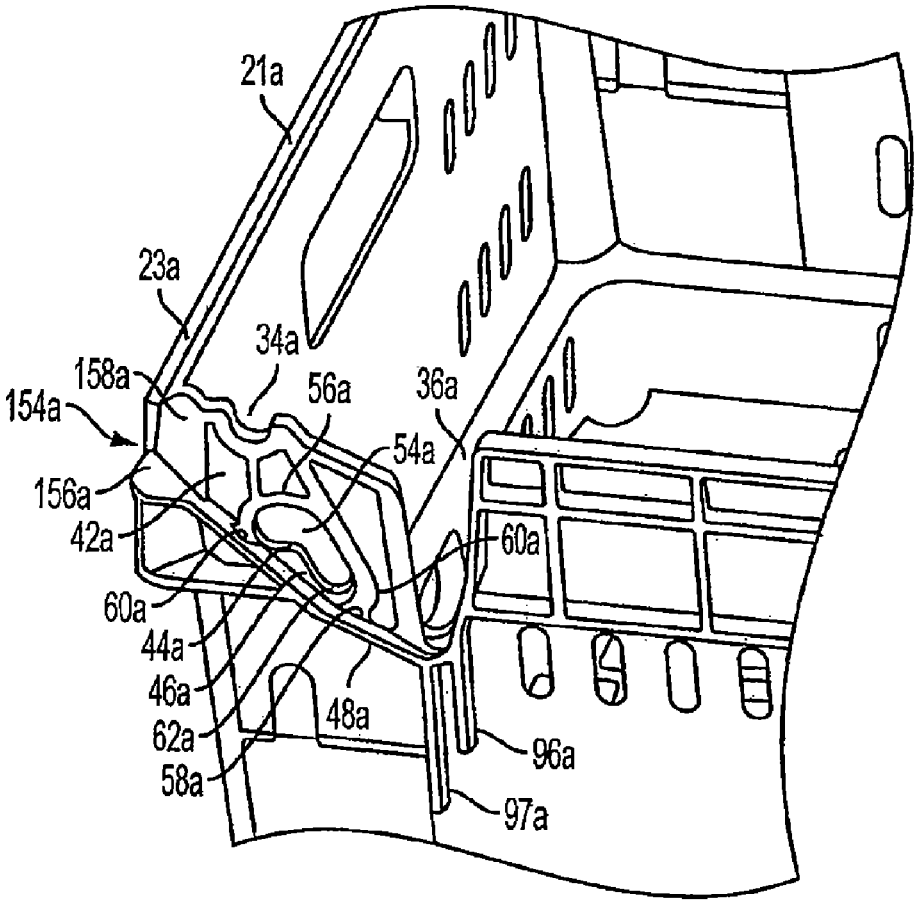
FIG. 12A illustrates a close-up perspective view of a first receptacle in the containers shown in FIGS. 1 through 10.

Referring now to FIGS. 1, 2, 11A, 11B, 12A-D, 13A-D, and FIGS. 20-22, the inner and outer notches 34*a*, 34*b* and 36*a*, 36*b*, and the bail arm saddles 23*a*, 23*b* are shown according to an embodiment of the present invention. As discussed above, the container 100 is designed so that containers 100 can be nearly fully nested, partially nested, or substantially un-nested with respect to on another. Placement of the bail arm 50*a* for the nearly full nested configuration is shown in FIG. 12A, the substantially un-nested position in FIG. 12B, and the partially nested position in FIG. 12C.

Figure 2:
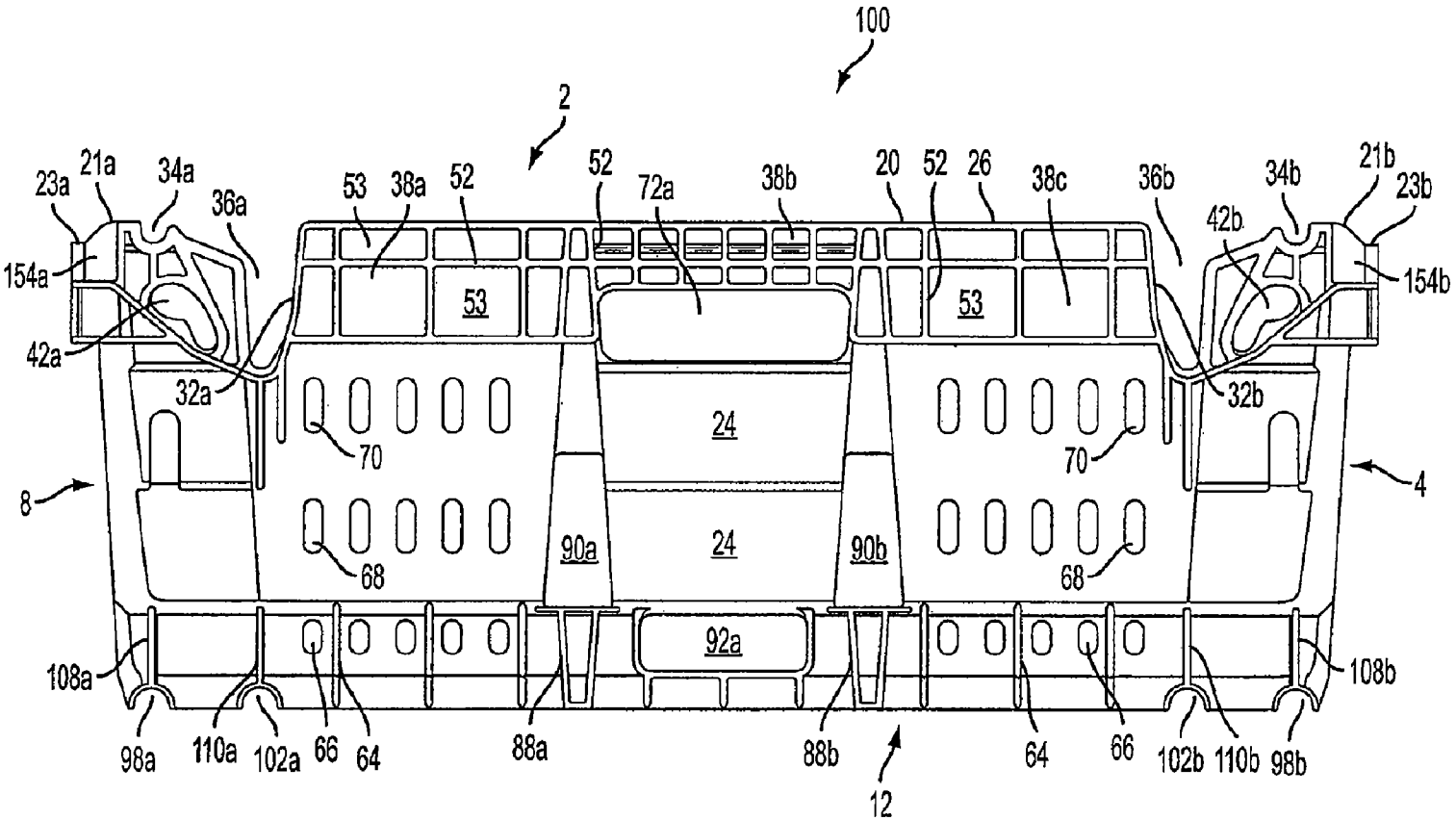
FIG. 2 illustrates a front view of the container shown in FIG. 1.

In the following discussion regarding the movement and location of the bail arm 50*b*, from one nesting configuration to another, the point of reference is taken to be facing the front of the container 100 (as shown in FIG. 2). As one of ordinary skill in the art can appreciate, moving and/or locating the bail arms 50*a*, 50*b* entails different directions of movement (clockwise versus counter clockwise) and components or features, that merely depend on which direction the user is viewing the container, or which components the user is manipulating. Thus, what might be clockwise from a first perspective, will be counter clockwise from another perspective, or use of a different but like component (i.e. 50*a* versus 50*b*). In order to clarify the discussion herein and for the purpose of brevity, reference is made to bail arm 50*b*, and its motion relative to the container 100 and the components and features of the container 100 located nearby. One of ordinary skill in the art of the present invention can appreciate that the other similar components (i.e., bail arm 50*a* and its co-located components and features of container 100) operate in a substantially similar manner, and a detailed description thereof is omitted, for the purpose stated above.

Figure 12B:
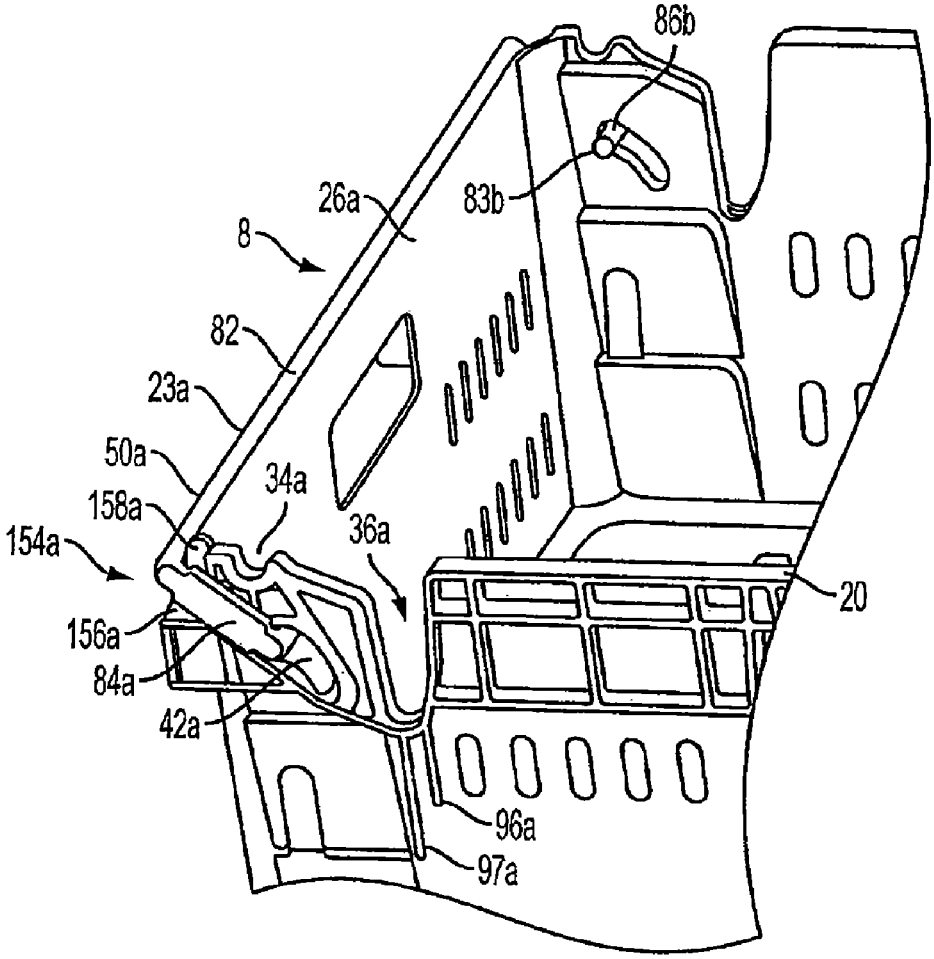
FIGS. 12B-D illustrates several close-up perspective views of the bail arm in the first receptacle in the containers shown in FIGS. 1 through 10 in a fully nested position, an un-nested position, and a partially nested position, according to an embodiment of the present invention.

In a first nesting configuration, a user locates the bail arms 50*a*, in a nearly fully nested position. This entails placing the bail arms 50*a*, onto the bail arm saddle 23*a*. This is shown in FIG. 12B for bail arm saddle 23*a* and bail arm 50*a*. In this configuration of containers, a second container 100' nearly fully nests within a first container 100 because the bail arms 50*a, b* do not interfere or restrict the placement of the second container 100' inside the first container 100. An example of a nearly fully nested container is shown in FIG. 20. The bail arms 50*a, b* rest upon respective bail arm saddles 23*a, b*, which are located at the top of the endwalls 4, 8, as shown in FIGS. 12B and 13B.

Figure 61A:
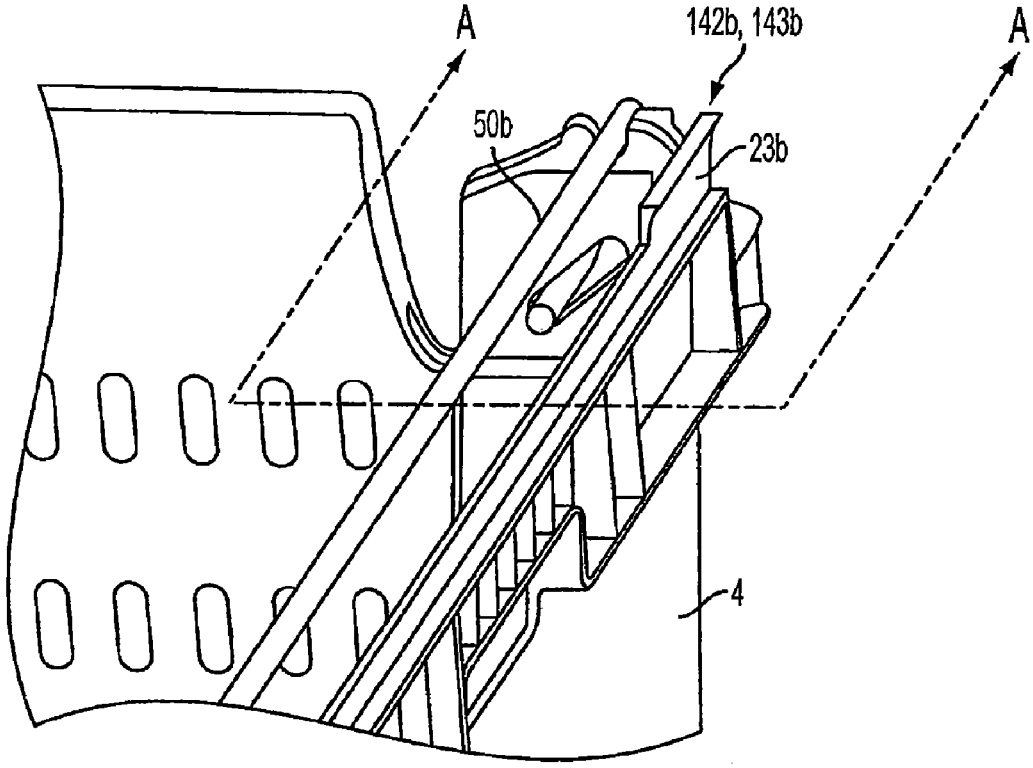
FIGS. 61A and 61B illustrate expanded front perspective views of a saddle area for the bail arm and bail arm locks used in the containers described herein according to several embodiments of the present invention.
Figure 61B:
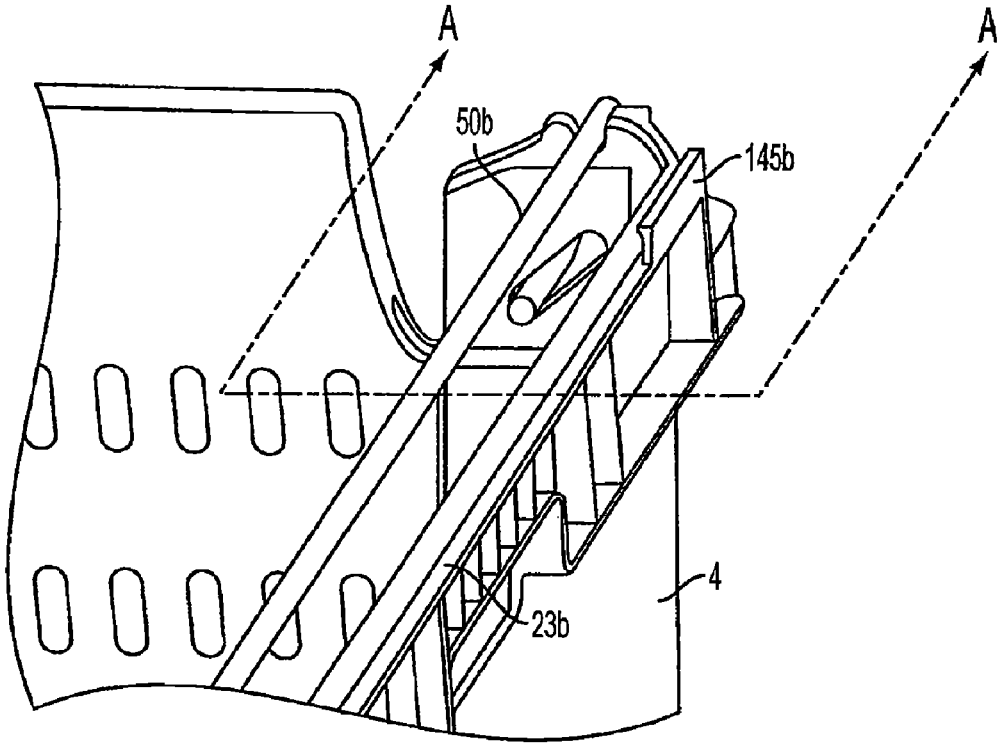
Figure 62:
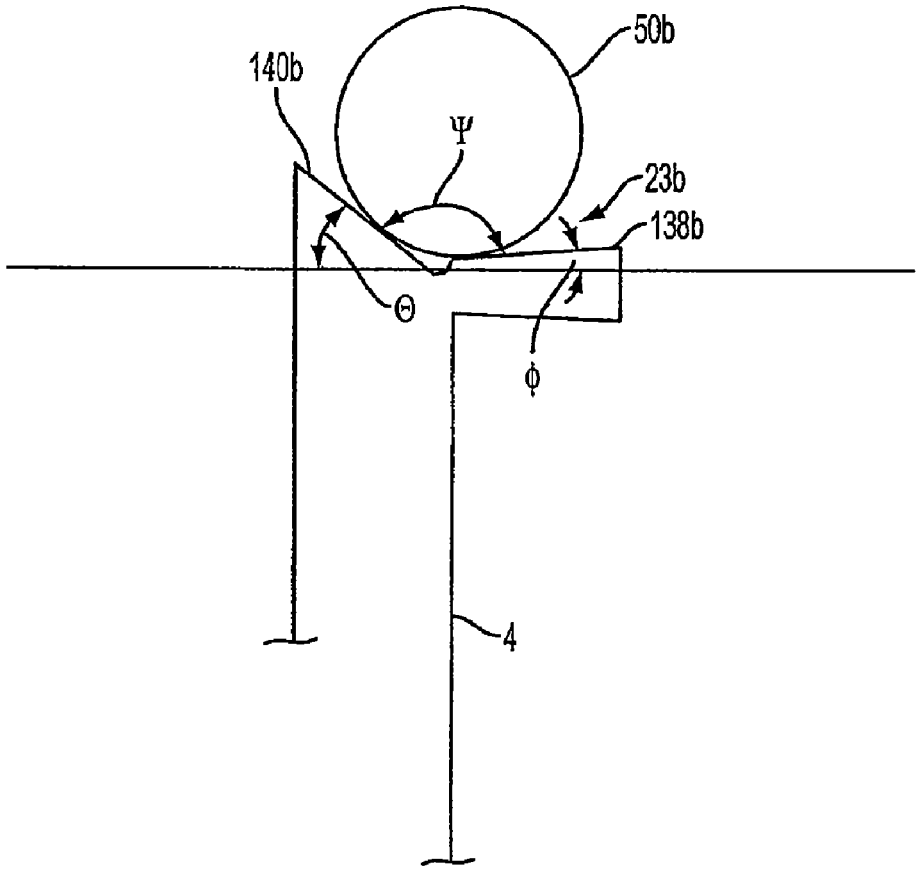
FIG. 62 illustrates an expanded cross section view along line A-A of FIG. 61 showing the bail arm and the bail arm saddle according to an embodiment of the present invention.

FIGS. 61A and 61B illustrate an expanded front perspective view of a bail arm saddle 23*b* for the bail arm 50*b* used in the containers 100, 200, 400 and 500 described herein according to an embodiment of the present invention. FIG. 62 illustrates an expanded cross section view along line A-A of either FIG. 61A or 61B showing the bail arm 50*b* and the bail arm saddle 23*b* according to an embodiment of the present invention. As seen in FIG. 62, the bail aim 50*b* rests upon bail arm saddle 23*b*, which is formed by saddle outward sloping surface 138 and saddle inward sloping surface 140. Saddle outward sloping surface 138*b* is formed at an angle Φ with respect to an imaginary horizontal plane, and saddle inward sloping surface 140*b* is formed at an angle Θ with respect to the identical imaginary plane. In this manner, an angle Ψ is formed between the saddle inward sloping surface 140 and saddle outward sloping surface 138, that holds the bail arm 50*b* securely in place.

Figure 63A:
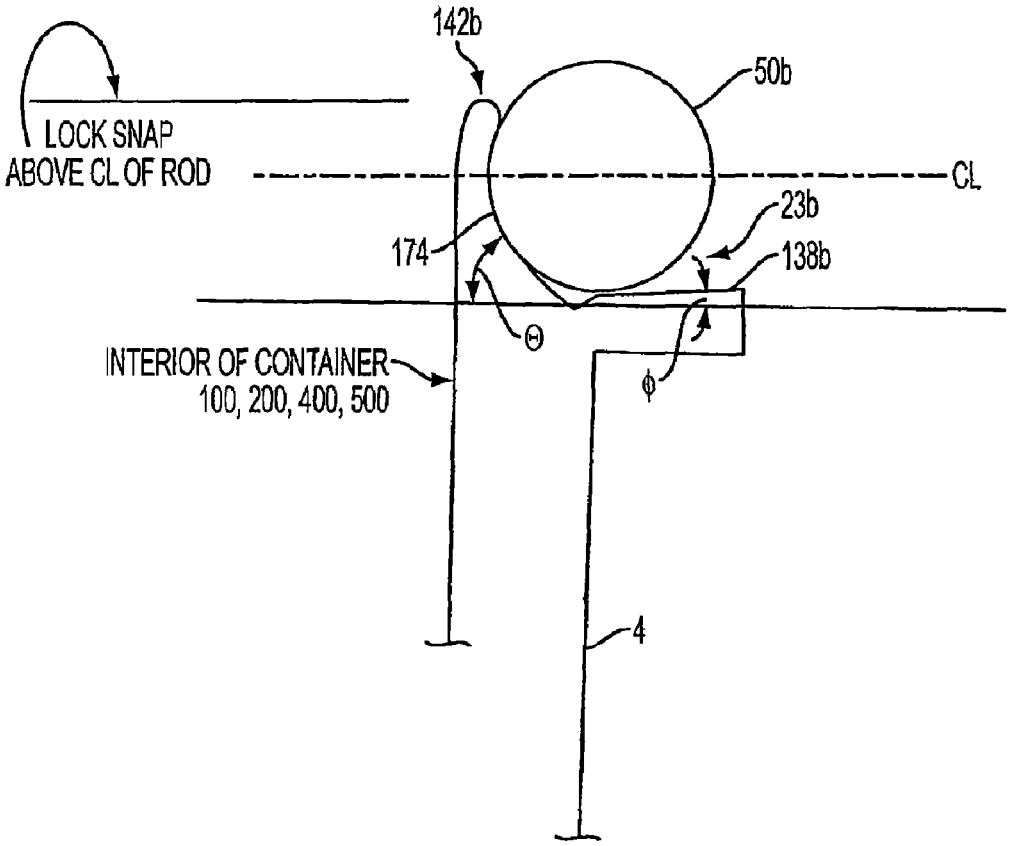
FIGS. 63A-63C illustrate expanded cross section views along line A-A of FIG. 61 showing the bail arm, several embodiments of the bail arm locks, and bail arm saddle according to several embodiments of the present invention.
Figure 63B:
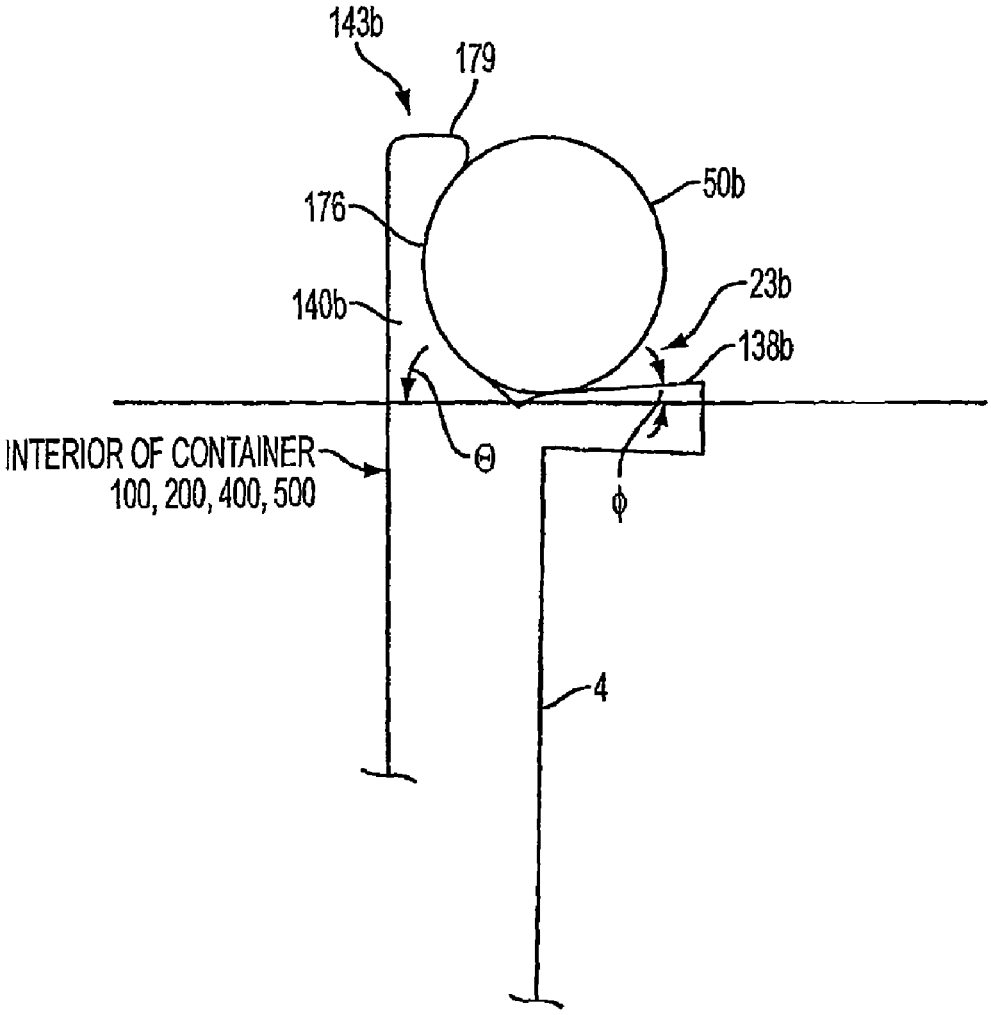

In FIG. 61A, the location of a first and second bail arm lock 142*b* and 143*b* is shown. FIGS. 63A and 63B illustrate a first and second embodiment of the bail arm lock 142*b* and 143*b* respectively. Referring now to FIG. 63A, the first bail arm lock 142*b* preferably comprises a short, substantially vertical piece extending up from the bail arm saddle 23*b*. Although FIG. 61A illustrates the location of the first bail arm lock 142*b* at the far right side of the right endwall 4, one of ordinary skill in the art can appreciate that this is not a limiting example, as the first bail arm lock 142*b* can be located anywhere along the bail arm saddle 23*b*. A corresponding first bail arm lock 142*a* can also be used on bail arm saddle 23*a* on top of left endwall 8, again anywhere along the bail arm saddle 23*a*, although this need not necessarily be the case. The top of first bail arm lock 142*b* preferably extends above the centerline of the bail arm 50*b* as shown in FIG. 63A. The radius of curvature of a first bail arm lock interior surface 174 is substantially the same as the radius of curvature of the bail arm 50*b*. As discussed above, the bail arms 50*a, b* can be made of either a metal or plastic material. Either material will interact properly with the bail arm locks in all there various embodiments described herein. The first bail arm lock 142*b* locks the bail arm 50*b* in place when bail arm 50*b* is placed on the bail arm saddle 23*b*, preventing inadvertent and unnecessary movement. An appropriate and sufficient force, that can be applied either manually or automatically via machine, can readily move the bail arm 50*b* from its locked condition.

FIG. 63*b* illustrates a second bail arm lock 143*b*. Second bail arm lock 143*b* comprises a somewhat taller and thicker piece than first bail arm lock 142*b* that is also a substantially vertical piece extending up from the bail arm saddle 23*b* and further comprises a first curving over piece 179. Although FIG. 61A illustrates the location of the second bail arm lock 143*b* at the far right side of the right endwall 4, one of ordinary skill in the art can appreciate that this is not a limiting example, as the second bail arm lock 143*b* can be located anywhere along the bail arm saddle 23*b*. A corresponding second bail arm lock 143*a* can also be used on bail arm saddle 23*a* on top of left endwall 8, again anywhere along the bail arm saddle 23*a*, although this need not necessarily be the case. The first curving over piece 179 of second bail arm lock 143*b* preferably extends above the centerline of the bail arm 50*b* and is substantially even with the top of the bail arm 50*b* as shown in FIG. 63B. The radius of curvature of a second bail arm lock interior surface 176 is substantially the same as the radius of curvature of the bail arm 50*b*. The second bail arm lock 143*b* locks the bail arm 50*b* in place when bail arm 50*b* is placed on the bail arm saddle 23*b*, preventing inadvertent and unnecessary movement. An appropriate and sufficient force, that can be applied either manually or automatically via machine, can readily move the bail arm 50*b* from its locked condition.

As one of ordinary skill in the art of the present invention can appreciate, the location of first and second bail arm locks 142, 143 on the interior side of the right and left endwalls 4, 8 is not necessarily the only position the first and second bail arm locks 142, 143 can be located. It is also possible, according to another embodiment of the present invention, to locate the first and second bail arm locks 142, 143 on the outer side of the right and left endwalls 4, 8.

Figure 63C:
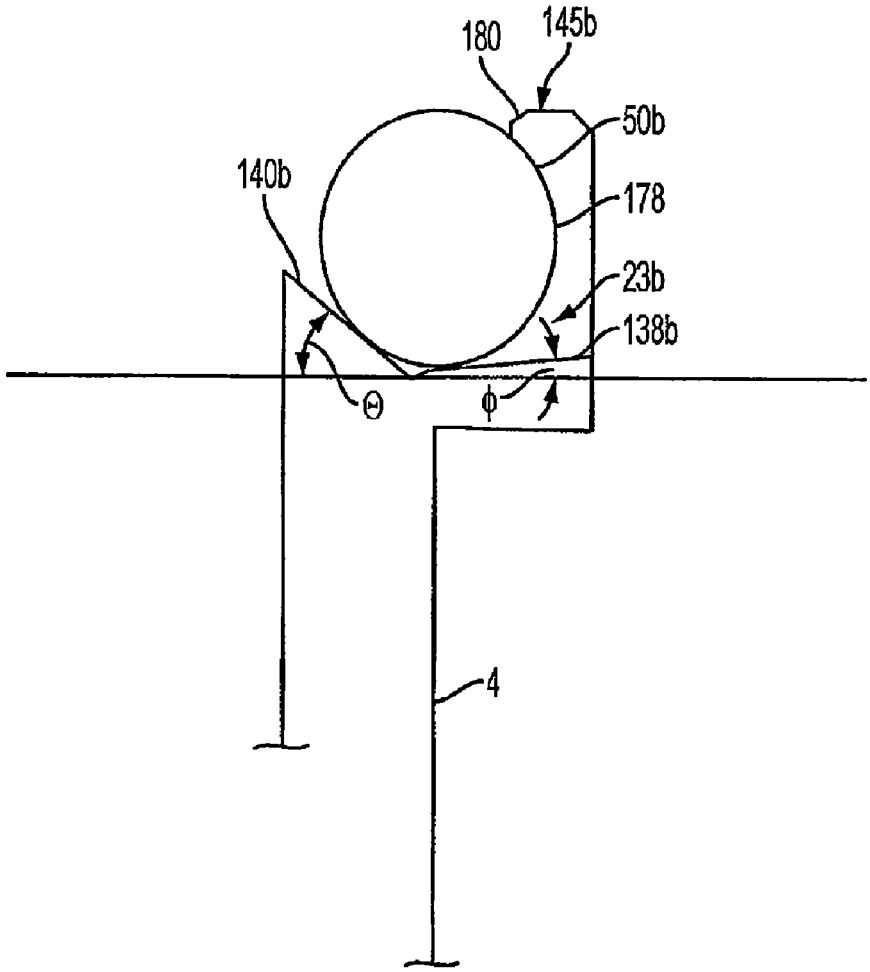

In FIG. 61B, the location of a third bail arm lock 145*b* is shown according to an embodiment of the present invention, and FIG. 63C illustrates the third bail arm lock 145*b* according to an embodiment of the present invention. As shown in FIG. 63C, the third bail arm lock 145*b* comprises a short, substantially vertical piece extending up from the bail arm saddle 23*b* with a second curving over piece 180. Although FIG. 61A illustrates the location of the third bail arm lock 145*b* at the far right side of the right endwall 4, one of ordinary skill in the art can appreciate that this is not a limiting example, as the third bail arm lock 145*b* can be located anywhere along the bail arm saddle 23*b*. A corresponding third bail arm lock 145*a* can also be used on bail arm saddle 23*a* on top of left endwall 8, again anywhere along the bail arm saddle 23*a*, although this need not necessarily be the case. The second curving over piece 180 of the third bail arm lock 145*b* preferably extends above the centerline of the bail arm 50*b* as shown in FIG. 63C. The radius of curvature of a third bail arm lock interior surface 178 is substantially the same as the radius of curvature of the bail arm 50*b*. The third bail arm lock 145*b* locks the bail arm 50*b* in place when bail arm 50*b* is placed on the bail arm saddle 23*b*, preventing inadvertent and unnecessary movement. An appropriate and sufficient force, that can be applied either manually or automatically via machine, can readily move the bail arm 50*b* from its locked condition.

Figure 12C:
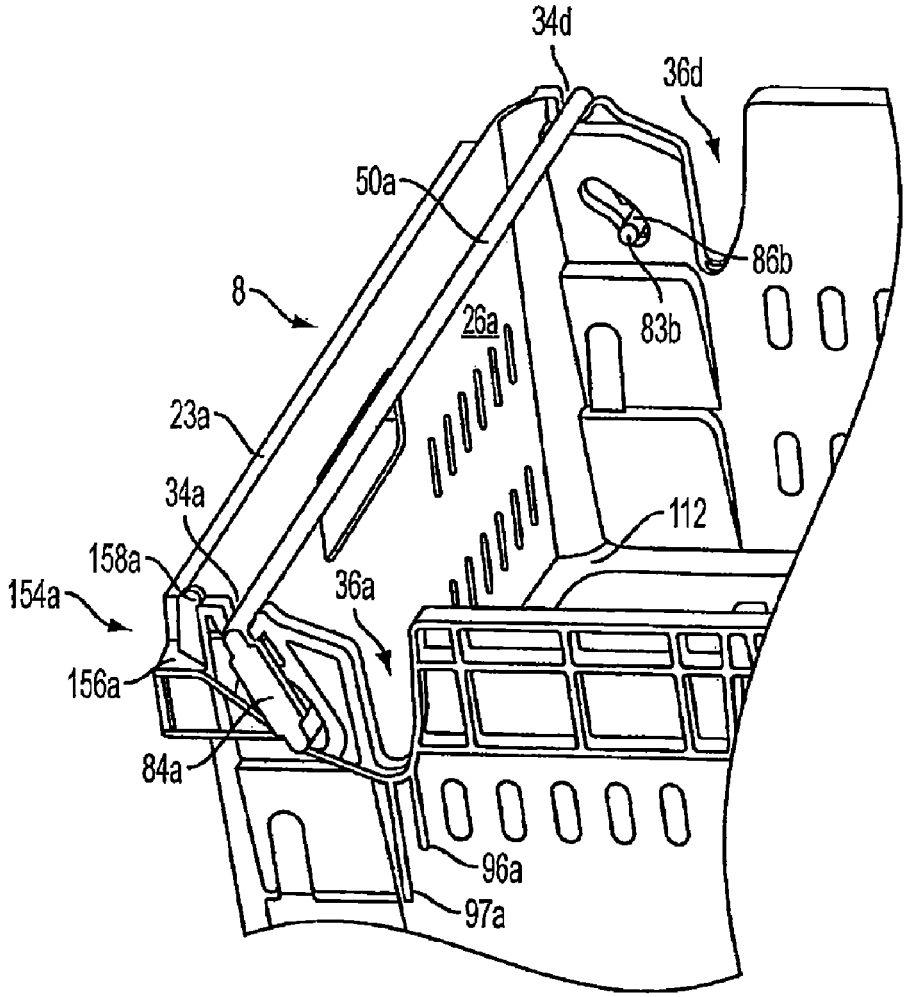

FIG. 12C illustrates the position of bail arm 50*a* for a second nesting configuration according to an embodiment of the present invention. To change the position of the bail arm 50*a* from its nearly fully nested position on bail arm saddle 23*a* to the substantially un-nested position on outer notches 34*a*, 34*d*, the user rotates the bail arm 50*a*, in a clockwise direction from its nearly fully nested position, in which the bail arm 50*a* is located on the bail arm saddle 23*a*, to the substantially un-nested position, which corresponds to the pair of respective outer notches 34*a, d*. Similarly, as viewed from the front of the container 100, the user would rotate bail arm 50*b* from its nearly fully nested position on bail arm saddle 23*b* in a counterclockwise position to the respective pair of outer notches 34*b, c* wherein bail arm 50*b* is now located at the substantially un-nested position. Outer notches 34*a, b* are formed on the sidewall top portion 20, and are substantially semi-circular in shape to receive and retain the engaging portion 82 of the bail arms 50*a, b*. The outer notches 34*a-d*, as shown in the above-referenced figures, are strengthened by a plurality of outer notch ribs 30*a*-30*c* that transfer the load from the second container 100' through the sidewalls 2, 6. As the bail arms 50*a*, 50*b* move from the nearly fully nested position at bail arm saddle 23*a*, 23*b* to the substantially un-nested position, outer notches 34*a*-34*d*, the bail arm crank members 84*a*, 84*b* rotate and move through an arc along pivot axis arcs 94*a*-94*d*. FIGS. 11A and 11B illustrate the pivot axis arc 94*b* for receptacle 42*b*. Similar pivot axis arcs 94*a*, 94*c* and 94*d* exist for receptacles 42*a*, 42*c*, and 42*d*, respectively. Because of the unique design of the receptacles 42, the bail arms 50*a, b* are able to move easily and with little or no resistance from any surface or portion of the container 100. When the bail arms 50*a, b* are finally located in the substantially un-nested position, they appear as shown in FIGS. 12C and 13C.

In a third nesting configuration according to an embodiment of the present invention, a user moves the bail arms 50*a, b* from its substantially un-nested position, in which the bail arms 50*a, b* are located on respective pairs of outer notches 34*a-d*, to a partially nested position, in which the bail arms 50*a, b* are located on respective pairs of inner notches 36*a-d*. Inner notches 36*a-d* are formed on the sidewall top portion 20, and are substantially semi-elliptical and elongated in shape to receive and retain the engaging portion 82 of the bail arms 50*a, b*. Each inner notch 36*a-d* comprises an inner notch inward sloping surface 32 and an inner notch receiving area 33. Each of the inner notches 36*a-d*, as shown in the above-referenced figures, are strengthened by a shorter inner notch rib 96 and a longer inner notch rib 97, that transfers the load from the second container 100' through the sidewalls 2, 6.

Figure 12D:
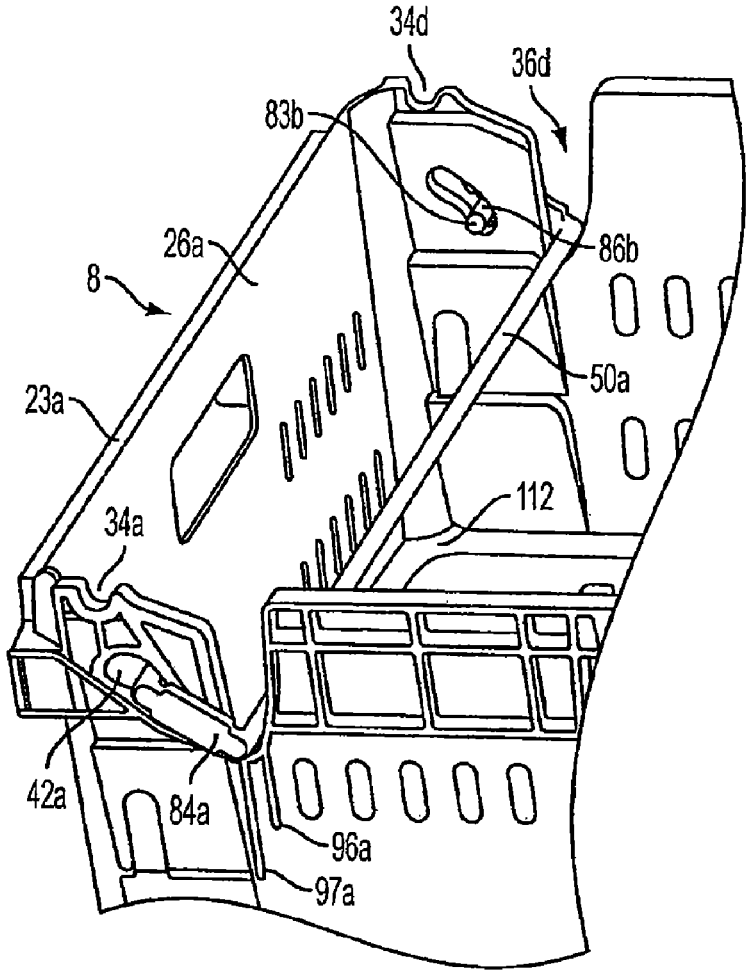

Referring again to FIGS. 12B and 12C, to position the bail arm 50*a* from its substantially un-nested position on outer notches 34*a*, 34*d*, to the partially nested position on inner notches 36*a*, 36*d*, the user rotates bail arm 50*a* in a clockwise direction, so that the bail arm 50*a* comes to rest in the pair of inner notches 36*a*, 36*d*, as shown in FIG. 12C. As the bail arms 50*a, b* move from either the nearly fully nested position at bail arm saddles 23*a, b*, or from the substantially un-nested position at the outer notches 34*a-d*, the bail arm crank members 84*a, b* rotate and move through an arc along pivot axis arc 94*a-d*. Because of the unique design of the receptacles 42, the bail arms 50*a, b* are able to move easily and with little or no resistance from any surface or portion of the container 100. Furthermore, the inner notch inward sloping surface 32 provides a smooth continuous surface for the bail arm 50 as it moves to the inner notch receiving area 33. The inner notch receiving area 33 is also substantially semi-circular in shape, to allow the bail arms 50*a*, 50*b* to fully and securely rest therein. When the bail arms 50*a, b* are finally located in the partially nested position, they look as shown in FIGS. 12D and 13D.

Figure 13A:
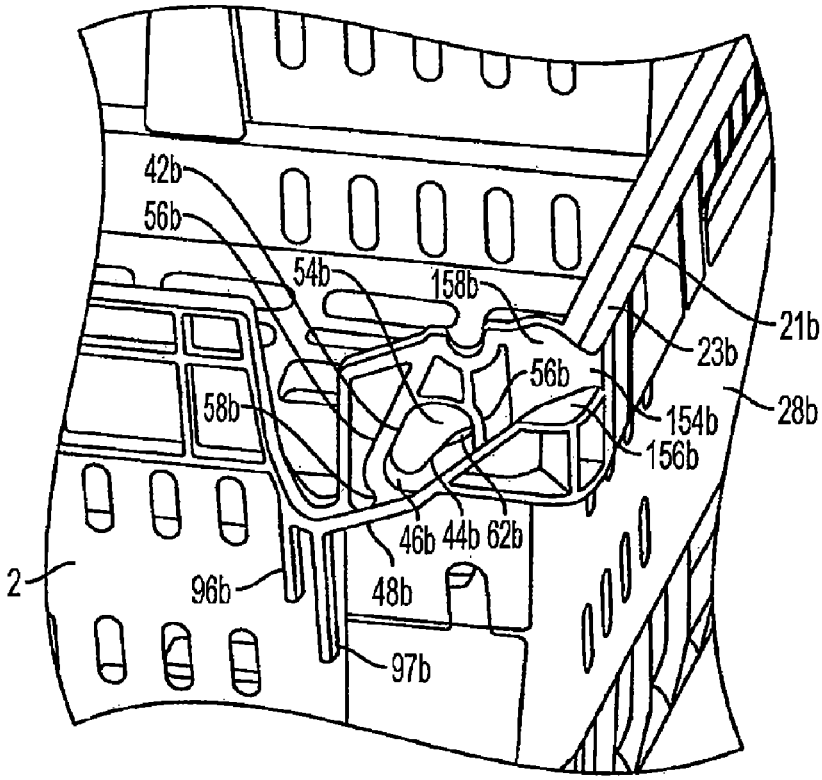
FIG. 13A illustrates a close-up perspective view of a second receptacle in the containers shown in FIGS. 1 through 10.
Figure 13B:
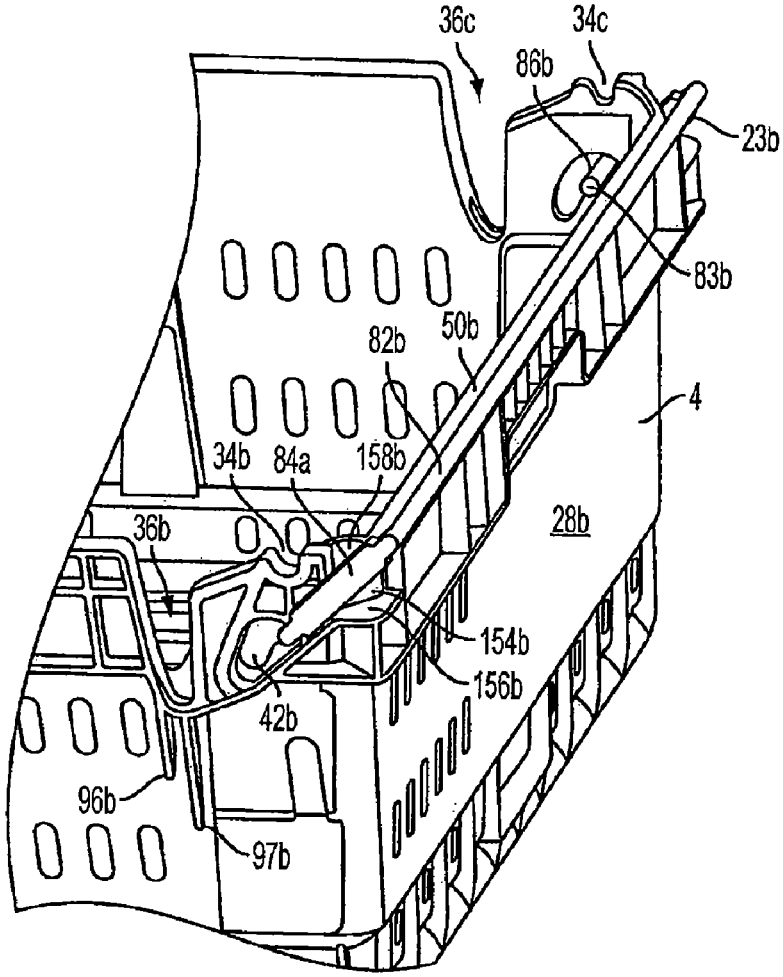
FIGS. 13B-D illustrate several close-up perspective views of the bail arm in the second receptacle in the containers shown in FIGS. 1 through 10 in a fully nested position, an un-nested position, and a partially nested position, according to an embodiment of the present invention.
Figure 13C:
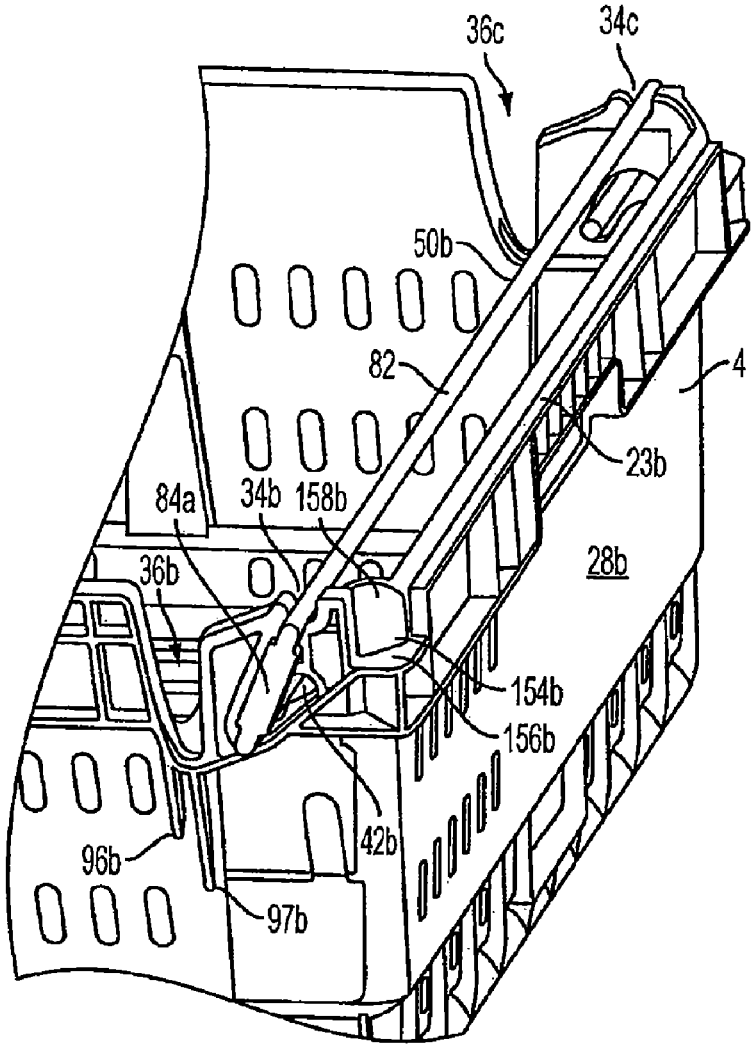
Figure 13D:
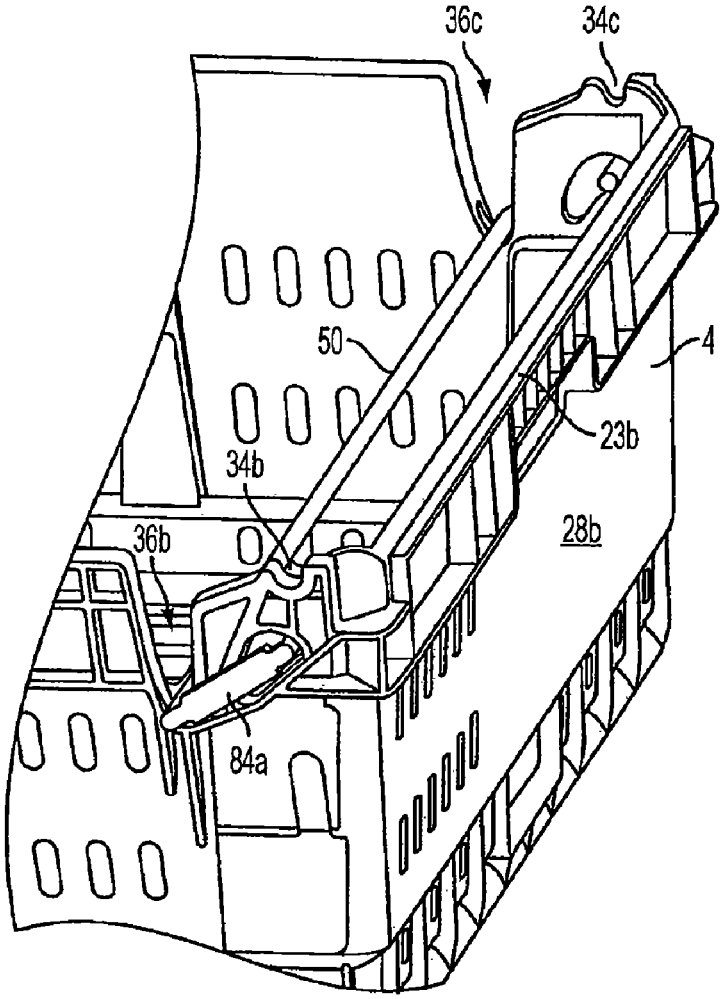
Figure 14A:
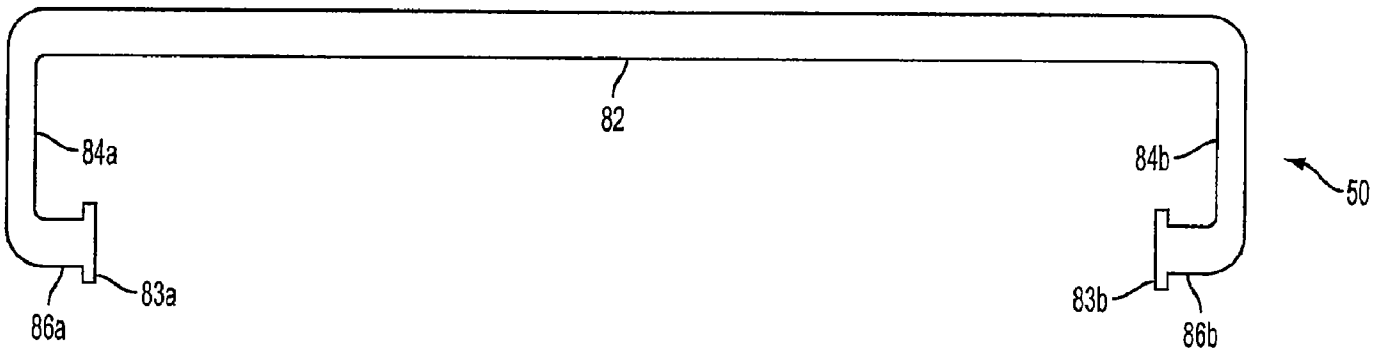
FIGS. 14A, 14B, and 14C illustrate a top, front and side view, respectively, of a bail arm used in the containers shown in FIGS. 1 through 10 according to an embodiment of the present invention.
Figure 14B:
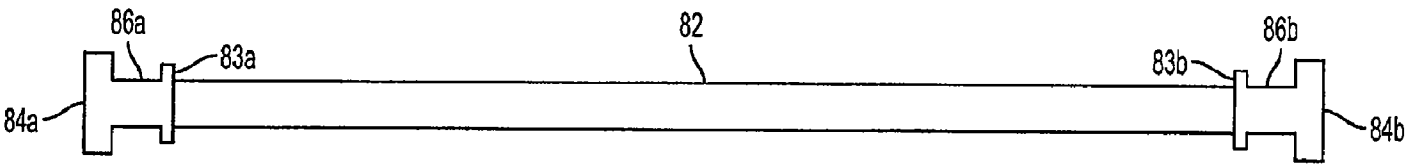
Figure 14C:
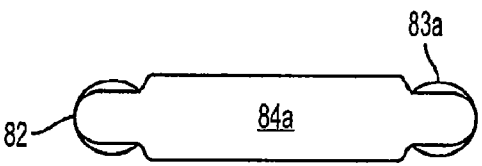
Figure 73:
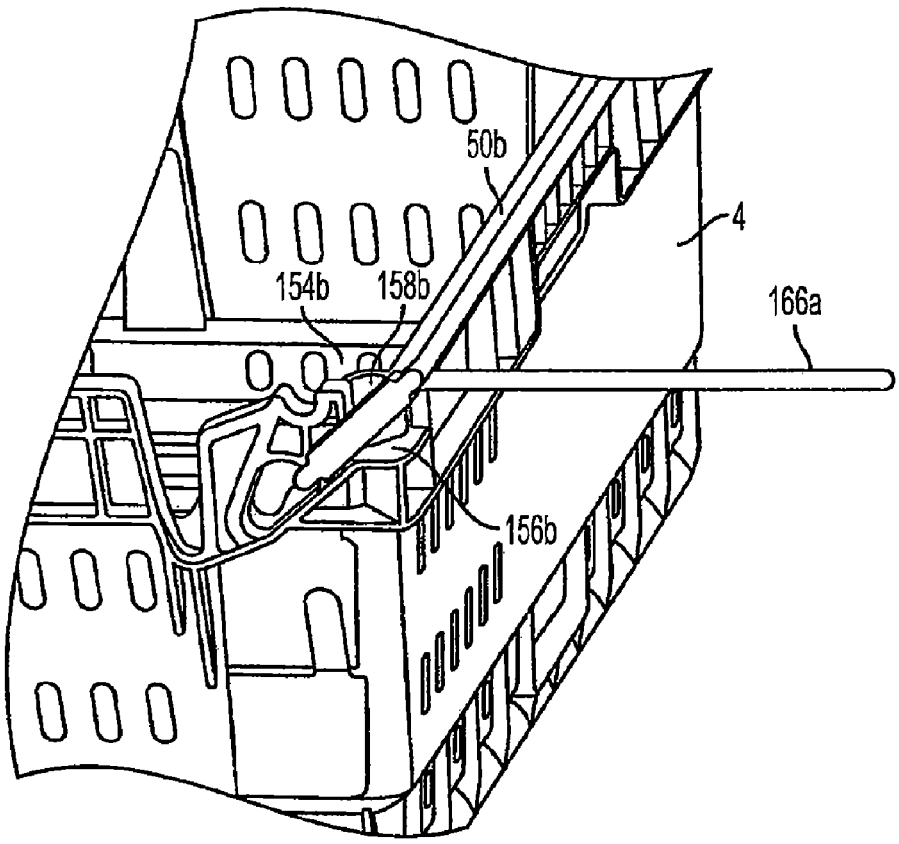
FIG. 73 illustrates an expanded view of any of the containers described herein showing location of a bail arm corner clearance area and a link arm of a bail arm locator automation system according to an embodiment of the present invention.
Figure 74:
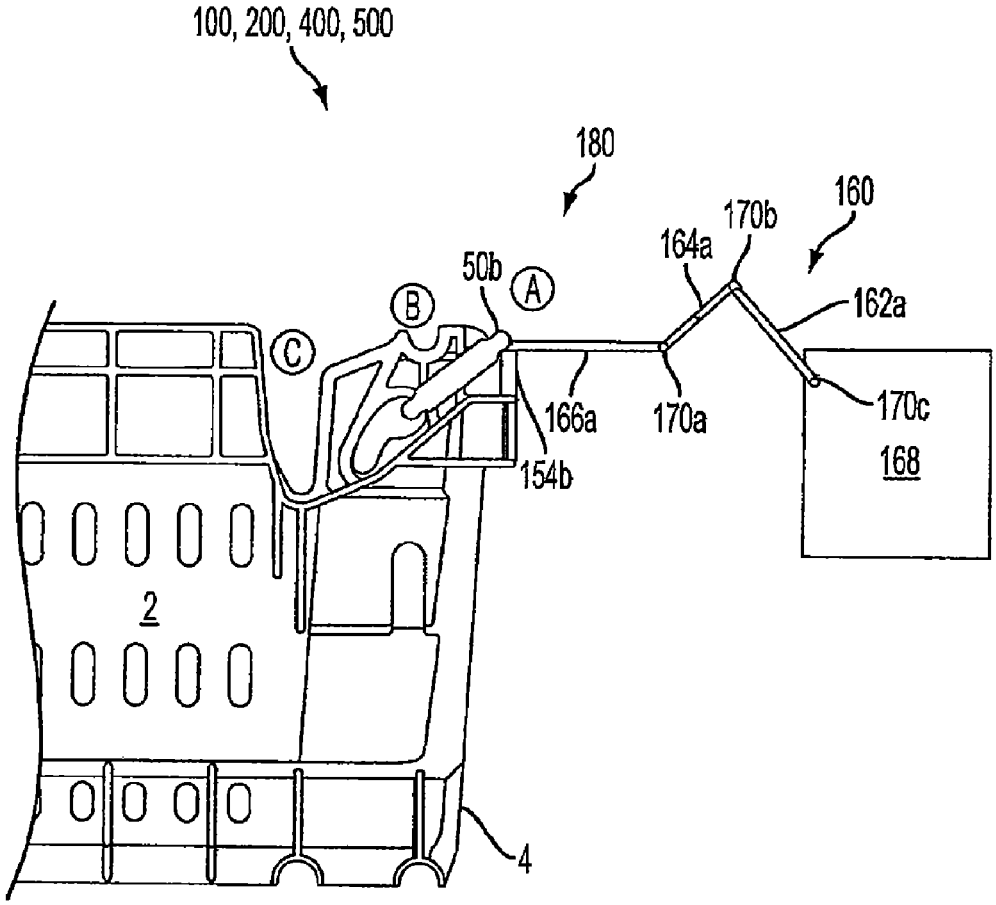
FIG. 74 illustrates a simplified bail arm locator automation system for changing location of the bail arm used in the containers described herein according to an embodiment of the present invention.
Figure 75:
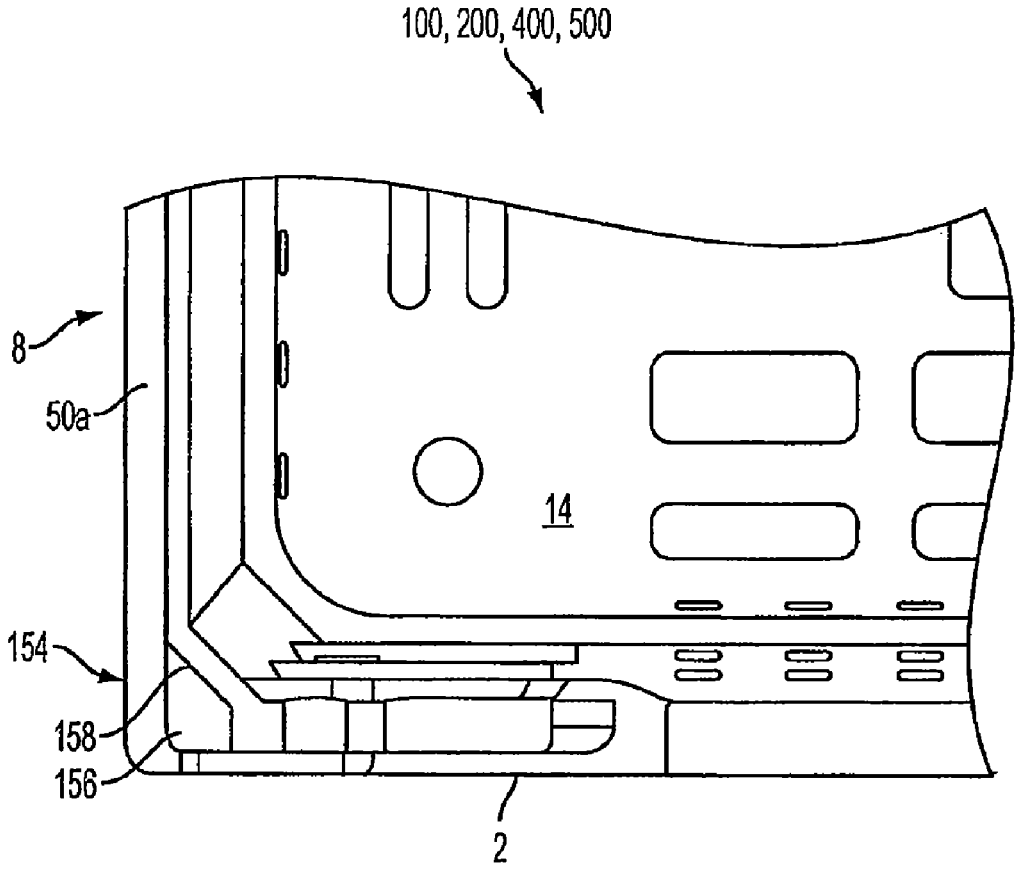
FIG. 75 illustrates an expanded top view of the container shown in FIGS. 1-10 and 25-40 further illustrating a corner clearance area according to an embodiment of the present invention.

Attention is directed to FIGS. 1, 4, 12A, 12B, 13A, 13B and 75 in regard to a bail arm corner clearance area 154. Although the bail arm corner clearance area (corner clearance area) 154 is shown in FIGS. 73 and 74, those drawing figures will be discussed in greater detail below in regard to an automated bail arm locator device, which uses the corner clearance areas 154 to access the bail arms 50*a, b*. As shown in FIGS. 12A and 13A, each of the corner clearance areas 154*a-d* preferably comprises a corner clearance floor surface 156 and a corner clearance wall surface 158. The corner clearance area 154 is shown from a top view in FIG. 4, and in much greater detail in FIG. 75. Referring now to FIG. 75, it can be seen that the corner clearance wall surface 158 is preferably formed at about a 45° angle between respective endwalls 4, 8 and sidewalls 2, 4, and is substantially perpendicular to corner clearance floor surface 156. As shown in FIGS. 12A and 13A, the corner clearance area 154 provides a substantial amount of room for the corners of the bail arms 50*a, b* to retract into the bail arm saddle 23*a, b* when a user moves the bail arms 50*a, b* into the nearly fully nested position. Furthermore, as discussed in greater detail below, the corner clearance area 154 provides access to the bail arms 50*a, b* for an automated bail arm locator device that can be used to move the bail arms 50*a, b* to their different positions.

FIG. 74 illustrates a simplified automation system 160 for changing location of the bail arms 50*a, b* used in the containers 100, 200, 400, 500 described herein according to an embodiment of the present invention. For the purpose of this discussion, reference shall be made to container 100 only, although, as one of ordinary skill in the art of the present invention can appreciate, this discussion applies equally to all the various embodiments of the containers discussed herein. A detailed discussion of the programming and operation of the automation system 160 is both beyond the scope of this discussion and not necessary to understand the embodiments of the present invention. As such, this discussion shall only provide a general discussion of the operation of the automation system 160 and how it interacts with the container 100 according to an embodiment of the present invention.

The automation system 160 comprises a central processing unit (CPU, or processor), a memory, a bus (that connects all internal components), a database, a hard drive (HD), data input and output circuitry (including, for example, network interface circuitry (Internet, LAN, WAN, among others), a keyboard, a display, among other types of data input/output devices), and a means for moving a link arm assembly (electric motors, pneumatic devices (both air and fluid), among other methods). The memory preferably comprises an input buffer, automation software, an output buffer, and operating system software. The hardware items—database, hard drive (H/D), central processing unit (CPU), and the network circuitry, are all preferably interconnected by the bus.

A description of operation of the automation system 160, shall be omitted as one of ordinary skill in the art of the present invention can appreciate how these components work. It should be noted that in this exemplary embodiment of the present invention, the database is preferably a separate hardware memory item, though that need not always be the case. The database can also be implemented as a portion of the memory. The automation system 160 can be connected to an organization's main network, or to the internet, a local area network (LAN), a wide area network, a wireless network, a wired network, or any combination thereof. Details of the operation of networks are well known to those of ordinary skill in the art of the present invention, and shall not be repeated for the purpose of brevity.

The database can be used to store information created by automation software (such as the number of bail arms moved, how many were moved successfully, from what positions, among other data). The automation software comprise one or more computer programs that can be stored on any type of computer readable medium or other data storage devices. These additional data storage devices can include removable and/or non-removable devices, such as, for example, magnetic disks, optical disks, or tape. Computer readable medium can include volatile and nonvolatile, removable and non-removable medium implemented in any method or technology for storage of information, such as computer readable instructions, data structures, program modules, or other data. Computer readable medium can include, by way of a non-limiting example, random access memory (RAM), read-only memory (ROM), electrically erasable programmable ROM (EEPROM), computer disk ROMs (CD-ROMS), digital versatile disks (DVDs), magnetic tape, flash memory, bubble memory devices, optical storage devices, floppy disks, hard drives, and any other type of memory storage devices (e.g., memory sticks, micro-cassettes, among other types of devices).

In FIG. 74, the bail arm locator automated system (automation system) 160 is shown contacting the bail arm 50*b* on a container 100. The automation system 160 comprises an automation system body 168 and a link arm assembly 180. The link arm assembly 180 comprises a link arm 166 that attaches, grabs or interfaces with the bail arms 50*a, b*, a plurality of linkage joints 170, a telescoping linkage 164*a*, and a linkage 162*a*. The link arm assembly 180 and plurality of linkage joints 170 operate and move in response to commands processed in the automation system body via control motors (not shown), to grab or attach to the bail arms 50*a, b* and move them from one position to another. There are, as discussed above, three different positions of the bail arms 50*a, b*. These comprise the nearly fully nested position (wherein the bail arms reside on bail arm saddle 23*a, b* (position A)), the substantially un-nested position (wherein the bail arms 50*a, b* reside upon outer notches 34*a-d* position B)) and the partially nested position (wherein the bail arms 50*a, b* reside on the inner pair of notches 32*a-d* (position C)). For purposes of this discussion, these positions shall be referred to as positions A, B and C, as shown in FIG. 74.

The link arms 166 attach or grab the bail arms 50. This attaching or grabbing can occur by a grasping mechanism (i.e., a claw), a magnet, a vacuum, or simply by inserting a link arm 166 under the bail arm 50. One of ordinary skill in the art of the present invention can appreciate that this is only a partial list of all the alternative means for interfacing with the bail arm 50 to cause it to move from one position to another, and all such alternative means, methods, and apparatus are considered to be within the scope of the embodiments of the present invention.

FIG. 73 illustrates an expanded view of the container 100 showing the location of the corner clearance area 154 and a link aim 166 of an automation system 160 according to an embodiment of the present invention. The link arm assembly 180 can move via electric motors, or air pressure, or other means. The corner clearance area 154, as discussed above, provides extra room for the link arm 166 to interface with the bail arm 50 in the corners of the container 100.

Figure 76:
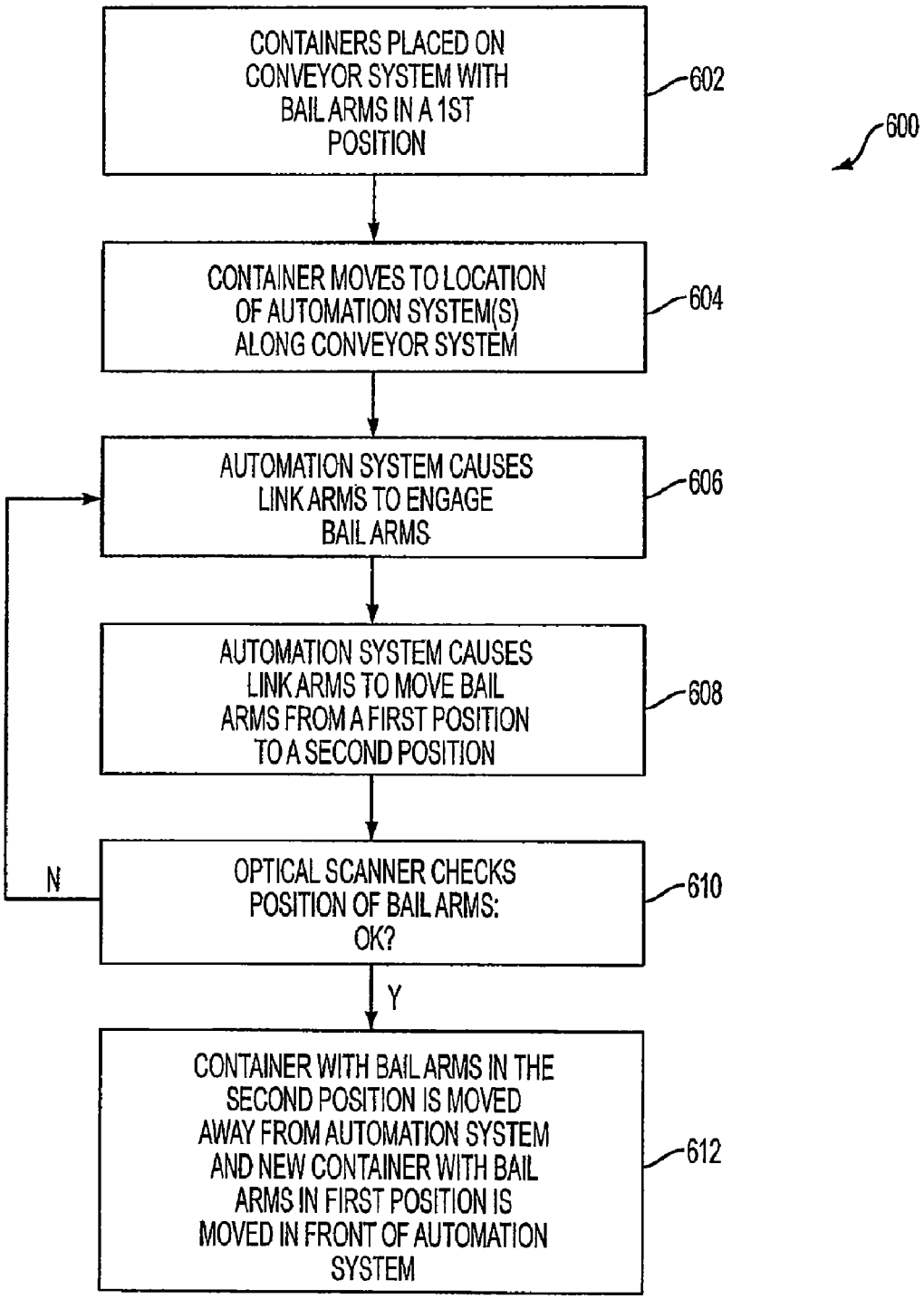
FIG. 76 illustrates a flow diagram of a method for operating a bail arm locator automation system with the containers described herein according to an embodiment of the present invention.
Figure 77:
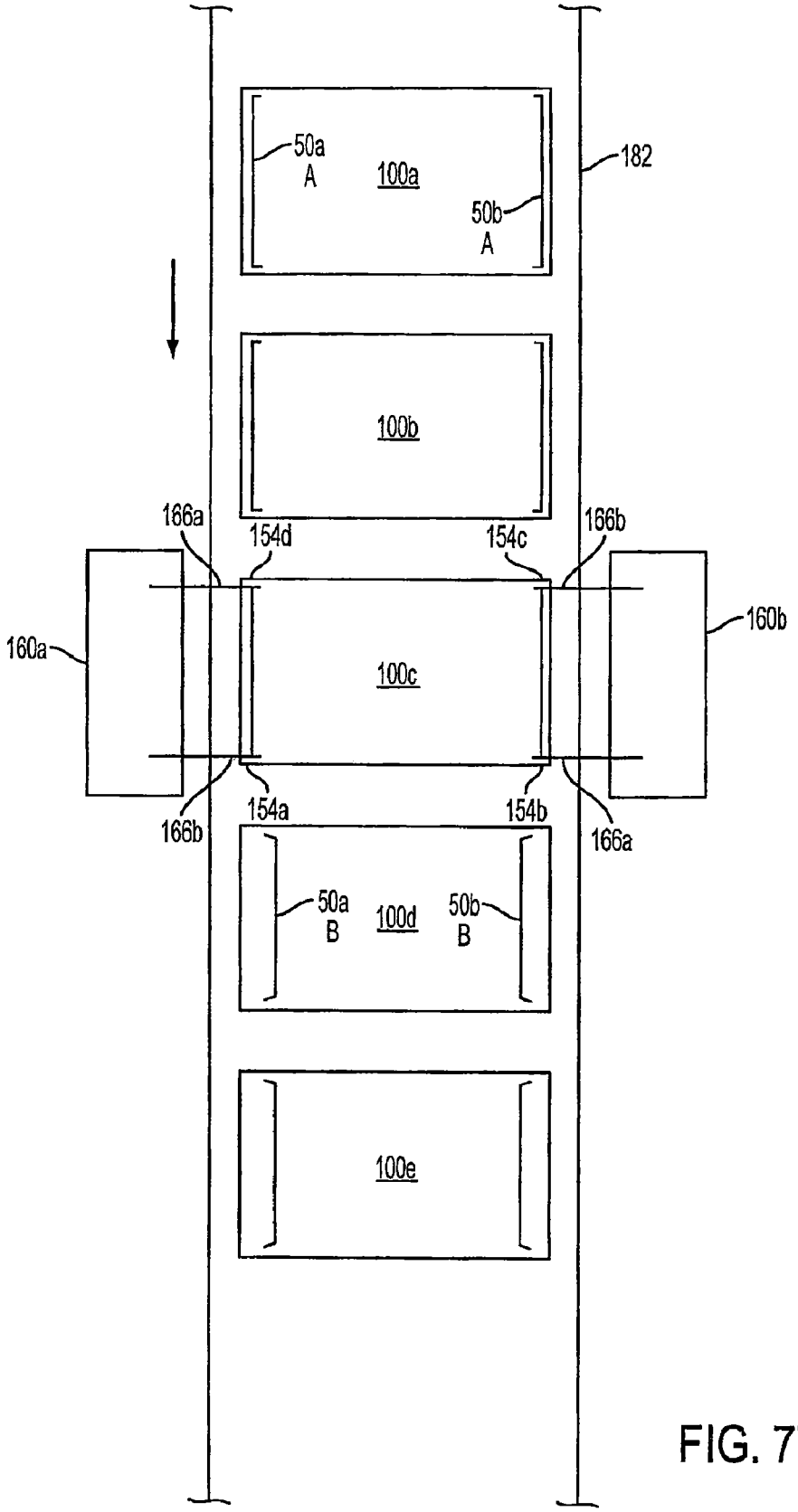
FIG. 77 illustrates a top view of a plurality of bail arm locator automation systems and a conveyor moving a plurality of containers to change the location of the bail arms of the containers according to an embodiment of the present invention.

FIG. 77 illustrates a top view of a plurality of bail arm locator automation systems 160 and a conveyor 182 moving a plurality of containers 100 to change the location of the bail arms 50 of the containers 100 according to an embodiment of the present invention, and FIG. 76 illustrates a flow diagram of a method 600 for operating the bail arm locator automation system (automation system) 160 with the containers 100. Method 600 begins with step 602, in which a plurality of containers 100*a*-100*e* are loaded onto a conveyor system 182. In step 602, the containers 100 are moved into position immediately in front of automation systems 160*a, b*. In FIG. 77, container 100*c* is in front of the two automation systems 160*a, b*. Note that overall control of the conveyor system 182 and automation systems 160 is, according to an exemplary embodiment of the present invention, maintained by another main controller that is not shown nor described. Such control systems are well known to those of ordinary skill in the art, and as such, a detailed description has been omitted for purposes of brevity.

Once the container 100*c* is proximal to the two automation systems 160, the automation system 160 causes the first and second pair of link arms 166*a, b* to attach to or interface with the bail arms 50*a, b*. In this discussion, we shall presume that the bail arms 50*a, b* are initially in position A, that is, the nearly fully nested position, and the automation system 160 will move the bail arms 150*a, b* to position B, the substantially un-nested position. In step 608, automation system 160 causes the first and second pair of link arms 166*a, b* to move the bail arms 50*a, b* from a first position (position A) to a second position (position B). In decision step 610, an optical scanner system (not shown) scans the container 100 to verify whether the bail arms 50*a, b* are located in the correct position (in this case, position B). If either or both of the bail arms 50*a, b* are not properly located, the conveyor system 182 does not start again, but allows the automation system another try, up to a certain specified amount of times, to move the bail arms(s) 50 to the correct position ("No" path from decision step 610). It is possible, depending upon the speed and capabilities of the automation system 160 and conveyor 182 that the container 100 actually never stop in front of the automation systems 160, but move continuously and the link arms 166 are capable of moving the bail arms 50 "on the fly".

To accomplish a re-try, method 600 reverts back to step 606. The automation system 160 is capable of moving the bail arms 50*a, b* from any position on the container to any other position on the container (i.e., from position C to position A, from position B to C, and so on). It is possible that only one of the bail arms 50 is in the correct position. The automation system 160 and main controller are capable of correcting the position of either or both of the bail arms 50.

If the bail arms are in the correct position ("Yes" path from decision step 610), method 600 proceeds to step 612. In step 612, container 100*c* is moved from its proximal location in front of the automation system 160, and a new container (100*b*) with the bail arms in position A is moved in front of the automation systems 160*a, b*. The method continues to move the bail arms 50*a, b*, of a plurality of containers 100, 200, 400, 500 as long as necessary.

Referring now to FIGS. 1, 2, and 11-13, a receptacle 42 feature is shown according to an embodiment of the present invention. As seen in FIGS. 11-13, but especially FIG. 11A, the receptacle 42 preferably comprises a kidney or peanut shaped hole 54 that is defined by the outer surfaces of a receptacle projection 44, and receptacle upper surface 56. The receptacle projection 44 is formed by a receptacle projection wall 46 that forms the shape of the receptacle projection 44 by rising upwardly and curvedly in the manner shown in the accompanying FIGS. 11-13 from the upper surface of a receptacle lower surface 48. The receptacle projection wall 46 is displaced inwardly from the outer surface of the receptacle lower surface 48. The plane of the outer surface of the receptacle lower surface 48 is substantially parallel to the plane of the sidewall exterior surface 24, in the vicinity of the kidney shaped receptacle 42. The receptacle upper surface 56 helps define the kidney shape of the kidney shaped receptacle 42 by joining the receptacle lower surface 48 at a receptacle upper and lower surface first intersection 58 and a receptacle upper and lower surface second intersection 60. The outer surface of the receptacle projection wall 46 is also substantially parallel to the sidewall exterior surface 24 in the vicinity of the kidney shaped receptacle 42.

Figure 11C:
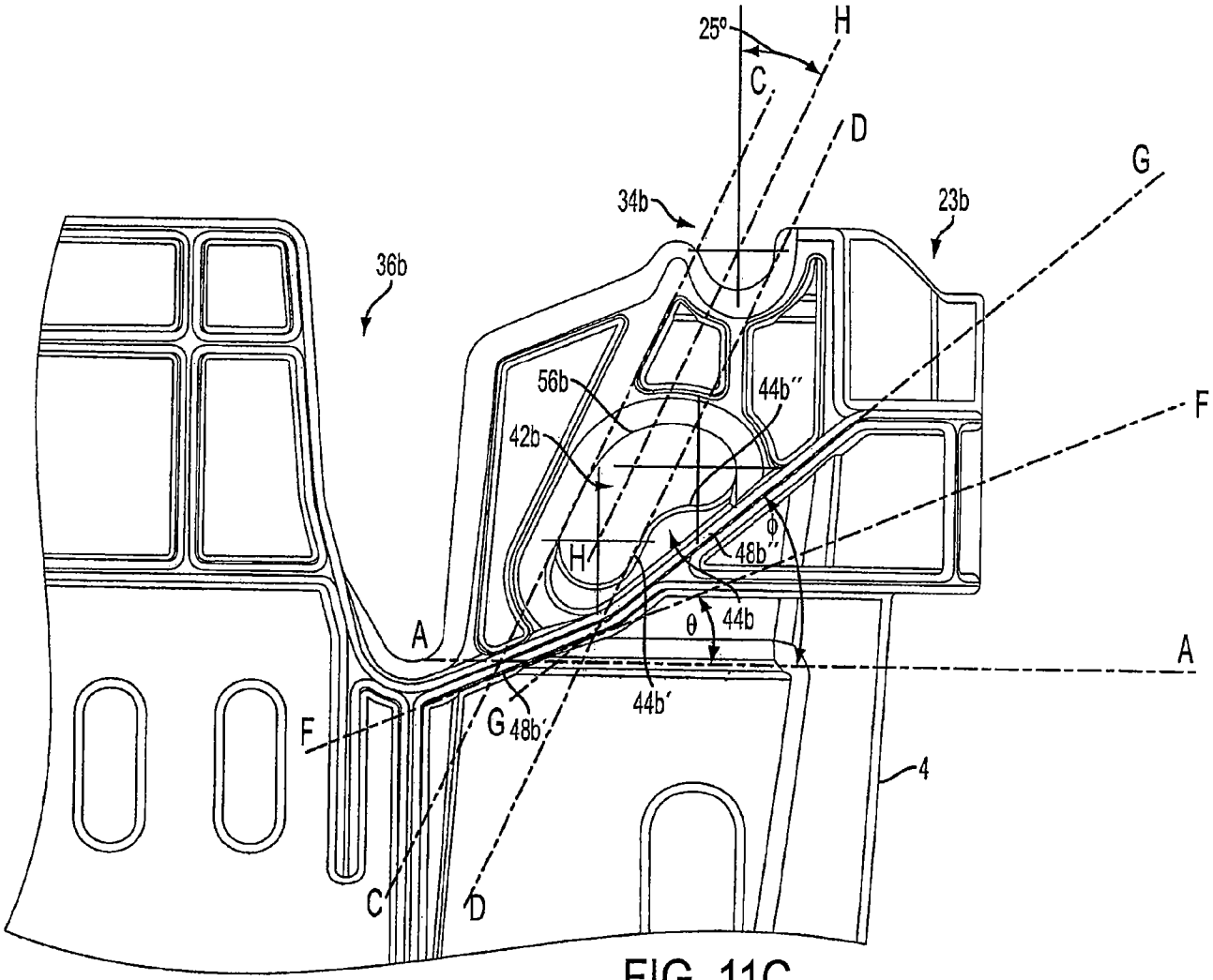
FIG. 11C illustrates an expanded view of the second receptacle in the containers shown in FIGS. 1 through 10.
Figure 11D:
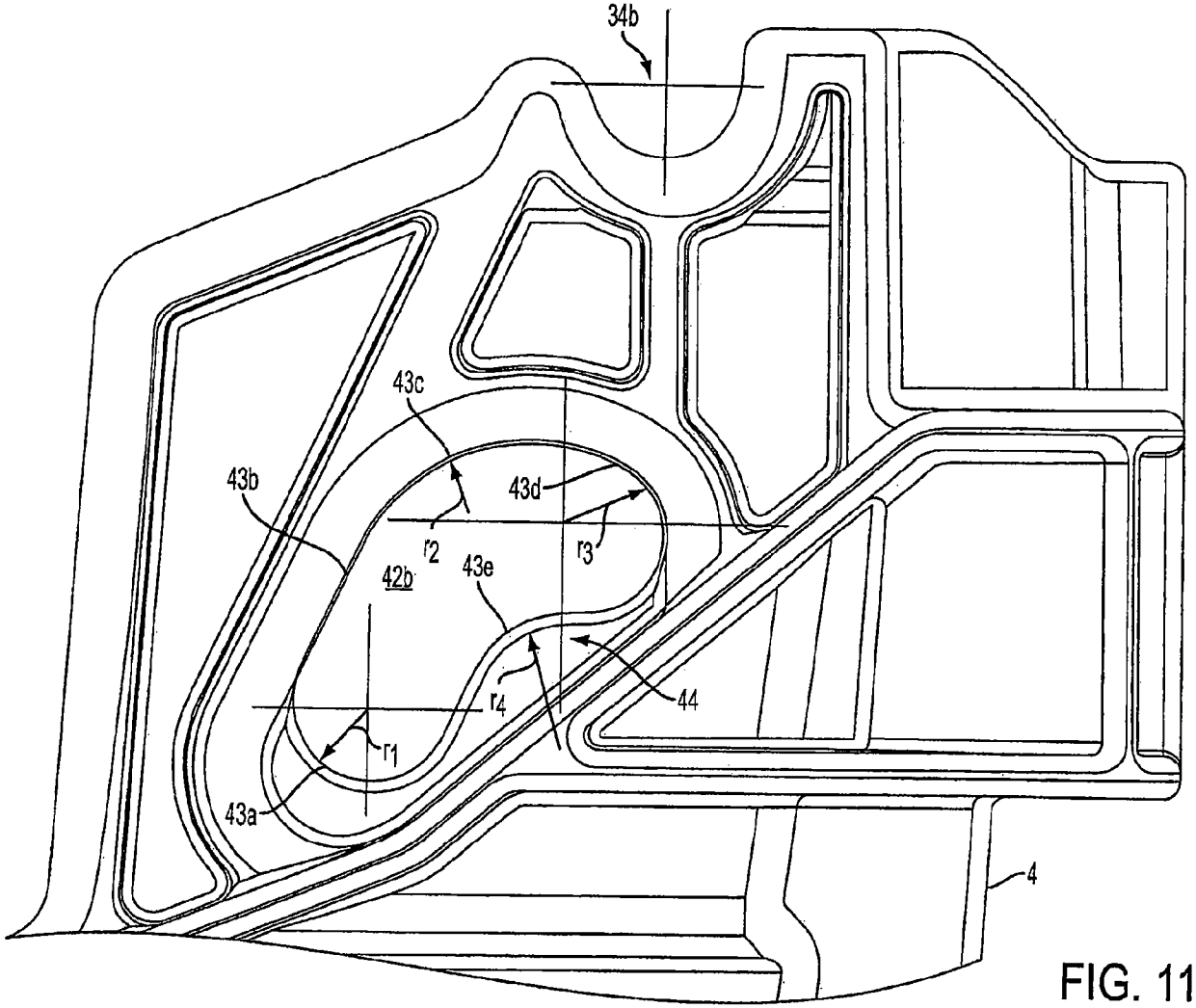
FIG. 11D illustrates a greater expanded view of the second receptacle of FIG. 11C.

Attention is now directed to FIG. 11C. FIGS. 11C and 11D illustrate one exemplary embodiment of the present invention, but, as one of ordinary skill in the art can appreciate, are not meant to be limiting in any manner whatsoever. In FIG. 11C, which is substantially similar to the view of FIG. 11A, with differences as noted below, kidney shaped receptacle 42*b* is illustrated along with a plurality of lines and angles, in order to more fully describe the advantages of the kidney or peanut shaped receptacle 42. Many feature numbers have been purposely omitted, for clarity, in order to highlight the advantages by the unique shape and design of kidney shaped receptacle 42. As one of ordinary skill in the art of the present invention can appreciate, the discussions above and below in regard to kidney shaped receptacle 42*b* apply equally to kidney shaped receptacles 42*a*, 42*c* and 42*d*, and need not be repeated for the purpose of brevity. It can also be appreciated that identical feature numbers apply to FIG. 11C as in FIG. 11A.

As shown in FIG. 11C, lines C and D are drawn substantially tangent to an inner wall of the receptacle upper surface 56*b* and a first surface 44*b*' of receptacle projection 44 respectively. As shown in FIG. 11C, lines C and D are substantially parallel with each other, as well as with line H. Line H is a line that connects the center of the bail arm inwardly turned portion 86 of bail arm 50 when the bail arm inwardly turned portion 86 is in the lowermost position of kidney shaped receptacle 42, and the center of the bail arm engaging portion 82 of the bail arm 50 when the bail arm engaging portion 82 is located on the outer notch 34.

According to an exemplary embodiment of the present invention, lines C, H and D, and hence the inner wall of the receptacle upper surface 56*b*, and first surface 44*b*' of receptacle projection 44*b* are preferably about 65° to the horizontal (line A), as the intersection of lines C, H and D with line A illustrate in FIG. 11C. Line H is drawn substantially tangent to a second surface 44*b*" of projection 44*b*.

According to an exemplary embodiment of the present invention, the receptacle lower surface 48*b* can be further described as comprising a first surface 48*b*' and a second surface 48*b*". First surface 48*b*' of receptacle lower surface 48*b* preferably forms an angle θ with horizontal line A of about 40°. Second surface 48*b*" of receptacle lower surface 48*b* preferably forms an angle Φ with horizontal line B of about 22.6°.

As discussed above, kidney shaped receptacle 42 is peanut or kidney shaped as shown in the accompanying figures, but especially in reference to FIG. 11C. FIG. 11D illustrates an expanded view of kidney shaped receptacle 42*b*. In FIG. 11D, kidney shaped receptacle 42*b*, as shown, comprises several surfaces 43*a-e*. Receptacle surface 43*a* is defined in the lower left region of kidney shaped receptacle 42*b*. Receptacle surface 43*a* is preferably formed along a radius $r_1$ of about 0.225 inches, is substantially circular, and forms about a half of a complete circle. Receptacle surface 43*a* transitions from its circular shape to a linear portion of receptacle surface 43*b*. Receptacle surface 43*b* makes up almost the entire top portion of kidney shaped receptacle 42. From the substantially linear portion receptacle surface 43*b*, kidney shaped receptacle 42 transitions to receptacle surface 43*c*. Receptacle surface 43*c* preferably has a radius $r_2$ of about 0.543 inches, and creates a smaller portion of kidney shaped receptacle 42 than does receptacle surface 43*a*. Receptacle surface 43*d* joins receptacle surface 43*c*, and is larger portion of receptacle 42 than receptacle surface 43*c*. Receptacle surface 43*d* is preferably defined by a radius $r_3$ of about 0.225 inches.

Radii $r_1$, $r_2$, and $r_3$ are defined as interior radii, that is, they emanate from an interior of kidney shaped receptacle 42. Now, however, from receptacle surface 43*d* to receptacle surface 43*e*, an exterior radius is formed. This exterior radius in effect, "pushes" wall material into the kidney shaped receptacle 42 hole, creating its unique kidney or peanut shape. Radius $r_4$ is preferably about 0.313 inches. Receptacle surface 43*e* then transitions to receptacle surface 43*a*. The composition of receptacle surfaces, from 43*a* to 43*b* to 43*c* to 43*d* and finally to 43*e* form the interior receptacle surface 43 of kidney shaped receptacle 42. Receptacle surfaces 43*a*, 43*c*, and 43*d* are formed by interior radii ($r_1$, $r_2$, and $r_3$), and receptacle surface 43*e* is formed by an exterior radius $r_4$.

The design of the kidney shaped receptacles 42*a-d* facilitates easier movement of the bail arms 50*a, b* because of its unique shape. A pivot axis arc 94 is defined along approximately the inner contour of the kidney shaped receptacles 42*a-d* along which the bail arms 50*a, b* moves when a user transitions the bail arms 50*a, b* from any one of its three positions to another. There is virtually no restriction or impeding of the movement along the pivot axis arc 94 because of the unique kidney or peanut shape of the receptacle 42. Since movement of the bail arms 50*a, b* is more fluid and less restricted, users of the container 100 will be less fatigued in using the container according to an embodiment of the present invention.

Referring now to FIG. 1, generally, and in particular to FIG. 2, a plurality of upper sidewall strength and rigidity areas 38*a*-38*c* are shown on front sidewall 2. The upper sidewall strength and rigidity areas 38*a*-38*c* preferably comprises a series of sidewall upper strengthening ribs 52 formed in a grid-like pattern, and in between the series of sidewall upper strengthening ribs 52 are a plurality of sidewall upper planar areas 53. In the upper sidewall strength and rigidity area 38*a*, the grid-like pattern is generally rectangular, though as can be seen in FIG. 2, the outermost portions of the upper sidewall strength and rigidity areas 38*a*, 38*c* are curved on one side to assist in forming a first inner notch 36*a*. Further, as can be seen in FIG. 2, the innermost portion of the upper sidewall strength and rigidity areas 38*a*, 38*c* are trapezoidal in shape. This results partially from creating aesthetic design of the sidewalls 2, 6 and also because of the placement of certain other components to be described below.

FIG. 2 also shows the upper sidewall strength and rigidity area 38*b*. The grid-like pattern of ribs and planar areas in the upper sidewall strength and rigidity area 38*b* is much smaller, and the bottom portion of the upper sidewall strength and rigidity area 38*b* forms an upper portion of a sidewall upper handle 72. Together, the upper sidewall strength and rigidity areas 38*a-c* provide additional strength and rigidity to the upper sidewalls 2, 6. The grid design provides additional strength and eliminates the need for a proportionally thicker wall. This reduces the cost of in manufacturing the container 100 because less material is used to make the container 100. Since less material is used in manufacturing the container 100, the container 100 is lighter than it otherwise would be, and this provides users a savings in shipping costs. Heavier items can be placed in the container 100 because of its increased strength. This provides users of the container 100 a greater range of types of goods that can be transported in the container 100. The back sidewall 6 comprises identical upper sidewall strength and rigidity areas 38*a-c* as the front sidewall 2.

FIGS. 1, 2, 18 and 19 illustrate a pair of container stacking structures 88A, 88B and a pair of container stacking structure receptacles 90*a*, 90*b* on the front sidewall 2. Use of the container stacking structures 88*a*, 88*b* and container stacking structure receptacles 90*a*, 90*b* provides an additional means of strength for the container 100, especially when loaded. According to an embodiment of the present invention, the container stacking structures 88*a*, 88*b* are preferably located centrally about a lower portion of sidewall exterior portion 24. Similarly, respective container stacking structure receptacles 90*a*, 90*b* are preferably located just above the container stacking structures 88*a*, 88*b*.

Figure 18:
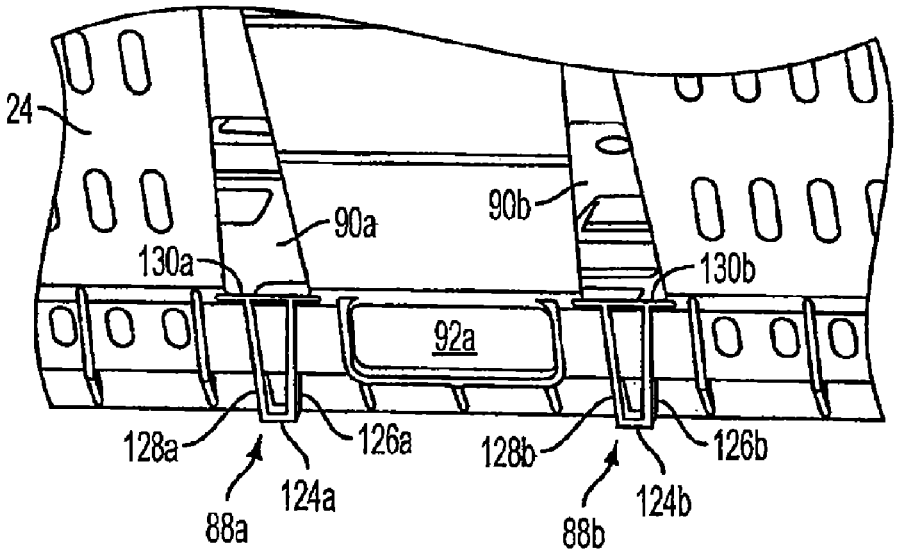
FIG. 18 is a close-up perspective view of a container stacking structure of the containers shown in FIGS. 1 through 10 according to an embodiment of the present invention.

Each of the container stacking structures 88*a*, 88*b* comprises a container stacking foot 124 (shown in detail in FIGS. 18 and 19), first and second container stacking structure reinforcement ribs 126*a*, 128*b*, and a container stacking structure ledge 130*a*. As shown in FIG. 18, the container stacking structure foot 124*a* has a substantially planar surface of a specific height, depth and width to extend outwardly (away from the compartment 3) in substantially the same plane as the base 10 of the container 100. According to an embodiment of the present invention, the container stacking structure feet 124*a*, 124*b* preferably extend from the base 10 of the container 100 as though one coherent piece. In alternative embodiments of the present invention, however, this need not be the case. The container stacking structure receptacles 90*a*, 90*b* are substantially trapezoidally shaped holes in the front sidewall 2 (as well as in the back sidewall 6). The container stacking structure receptacles 90*a*, 90*b* are, according to an embodiment of the present invention, sized such that the container stacking structure 88*a*, 88*b* can fit within the container stacking structure receptacles 90*a*, 90*b* as shown in FIG. 19.

Figure 19:
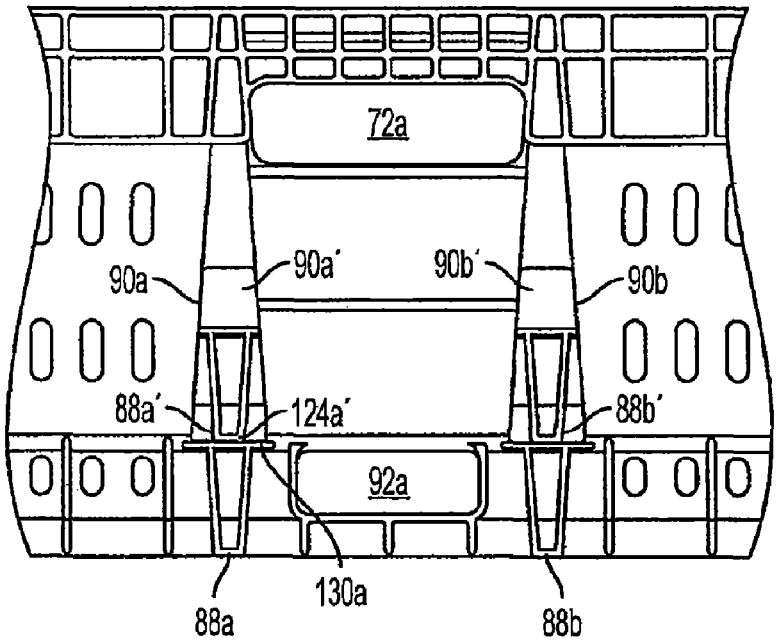
FIG. 19 illustrates operation of the container stacking structure when two containers as shown in FIGS. 1 through 10 are fully nested according to an embodiment of the present invention.

In FIGS. 19 and 20, a second container 100' has been located in a fully nested position in a first container 100. For ease of discussion, only one container stacking structure 88*a* and container stacking structure receptacle 90*a*, and their component parts, will be described. It should be apparent to those of ordinary skill in the art, however, that this description applies equally to as many different pairs of container stacking structures 88 and container stacking structure receptacles 90 that can be provided in the containers 100. The container stacking foot 124 of the second container 100' fits into the first container's 100 container stacking structure receptacle 90*a*. The load of the second container 100' is applied partially through the bail arms 50*a*, 50*b* and the innermost pair of notches 36*a*-36*d* of the first container 100, to the sidewalls 2, 6 of the first container 100. The remaining part of the load of the second container 100' is applied by the second container's 100' container stacking structure feet 124' directly to the container stacking structure ledges 130*a* of the first container 100. This, in turn, transmits the second partial load force of the second container through the container stacking structure reinforcement ribs 126*a*, 128*a*, and the lower portion of the sidewall 2 to the container stacking structure foot 124 and base 10, thus sharing the load with the bail arm.

Use of the container stacking structures 88*a*, 88*b* provides at least several advantages. First, it strengthens the lower portions of the sidewalls 2, 6 such that the container 100 can be filled with heavier products. Second, by manufacturing the container 100 with the container stacking structure feet 124*a* and container stacking structure reinforcement ribs 126, 128, the manufacturer uses less material to make the container 100 (because the sidewalls 2, 6 can be proportionally thinner), yet still provides a strong and resilient device. This reduces cost for the manufacturer. Third, the additional strength in the lower portions of the sidewalls 2, 6, allows larger numbers of empty containers 100 to be stacked and stored when not in use. This can potentially save storage space, which can further reduce costs and increase operating efficiencies. Of course, the containers 100 do not have to be empty when fully nested, to take advantage of the additional weight carrying capability provided by the container stacking structure 88A, 88B.

Figure 16:
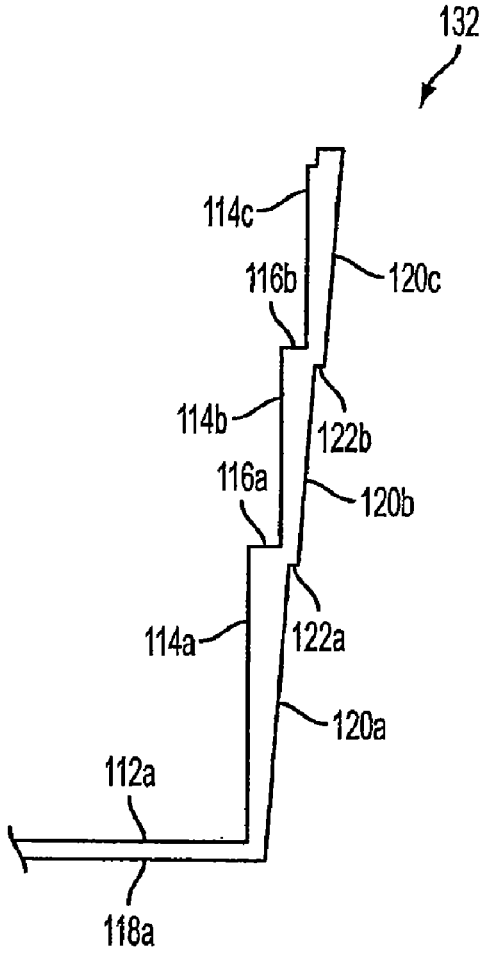
FIG. 16 is a view along a view line A-A of FIG. 1 illustrating a nesting feature of the containers according to an embodiment of the present invention.
Figure 17:
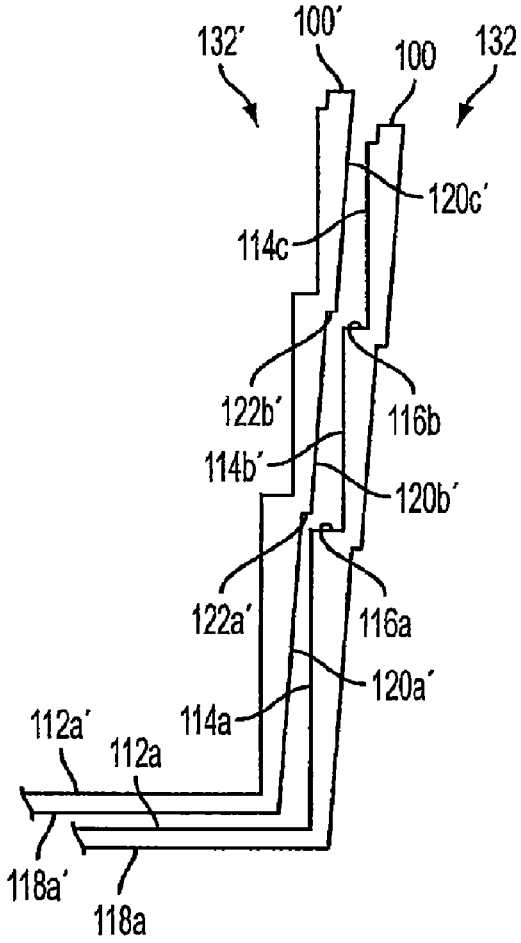
FIG. 17 is a view along the view lines A-A of FIG. 1 for two containers illustrating nesting of the containers according to an embodiment of the present invention.

Another feature that provides additional strength when stacking the containers together, in either an unloaded or loaded configuration, is a container sidewall interlock system 132 located on the sidewalls 2, 6 of the container 100, as illustrated in FIGS. 1, 2, 16, and 17. FIGS. 16 and 17 illustrate a view along line A-A shown in FIG. 1. FIG. 16 is a view of along line A-A of a first container 100, and FIG. 17 is a view along line A-A of the first container 100 and a second container 100'. In FIG. 17, the two containers 100, 100' are shown in a fully nested condition. Referring first to FIGS. 1 and 16, the container sidewall interlock system 132 preferably comprises sidewall ledge inner surface 112*a*, sidewall ledge-outer surface 118*a*, sidewall steps inner surface 114, sidewall steps outer surface 120*a*, sidewall step ledge inner surface 116A, and sidewall step ledge outer surface 122*a*. In the container 100 according to an embodiment of the present invention, there are six such container sidewall interlock systems 132*a*-132*f*: three on each sidewall 2, 6, located on each end and in the middle. As one of ordinary skill in the art of the present invention can appreciate, however, there can be more or less than six such systems 132 depending on the design constraints of the particular container 100.

Operation of the container sidewall interlock system 132 will now be described in references to FIGS. 16 and 17. As shown in FIG. 16, for each sidewall step inner surface 114*a*, there is a sidewall step outer surface 120*a*. At the top of sidewall step inner surface 114*a*, there is a sidewall step-ledge inner surface 116*a*, with a corresponding sidewall step outer surface 122*a*. The dimensions of the sidewall step outer surface 120*a* and sidewall step ledge outer surface 122*a* are such that they fit in an interlocking manner with the sidewall step inner surface 114*a* and sidewall step ledge inner surface 116. This occurs when a second container 100' is placed within a first container 100, as shown in FIG. 17. The sidewall step-ledge outer surface 122*a* rests upon the sidewall step-ledge inner surface 116*a* and sidewall step-ledge outer surface 122*b* rests upon sidewall step-ledge inner surface 116*b*. In this case shown in FIG. 17, the second container 100' is fully nested in the first container 100, such that sidewall ledge outer surface 118*a'* of the second container 100' nearly fully rests upon the sidewall ledge inner surface 112*a* of the first container 100.

This sidewall ledge inner surface 112*a* aids in forming the container stacking structure ledge 130A, as discussed above. Even when the second container is not fully nested in the first container 100, the container sidewall interlock system 132 still provides support because of the interaction of the sidewall step ledge outer surface 122 and the sidewall step ledge inner surface 116.

Attention is again directed toward FIGS. 1 and 2, which illustrate a plurality of handles located on the sidewalls 2, 6. Sidewall upper handles 72*a, b* and lower sidewall handles 92*a, b* are provided according to an embodiment of the present invention for ease in transporting loaded and unloaded containers 100. The lower sidewall handles 92*a, b* allow a user the personal preference of how to carry the container 100. Sidewall lower handles 92*a, b* are located just below the middle container sidewall interlock system 132 of sidewall 2 between the container stacking structures 88*a*, 88*b*. Of course, as one of ordinary skill in the art of the present invention can appreciate, it is possible to locate the sidewall lower handles 92*a-d* in different locations along the sidewalls 2, 4.

Sidewall upper handles 72*a, b* are preferably formed centrally on the sidewall, just below the middle upper sidewall strength and rigidity area 38*b*, and just above the middle container sidewall interlock system 132 of sidewall 2. Sidewall upper handles 72*a, b* are preferably suitably sized such that an average sized hand can be placed within and through it for ease in carrying the container 100. Of course, as one of ordinary skill in the art of the present invention can appreciate, it is possible to locate the sidewall upper handles 72*a, b* in different locations along the sidewalls 2, 6.

Figure 58:
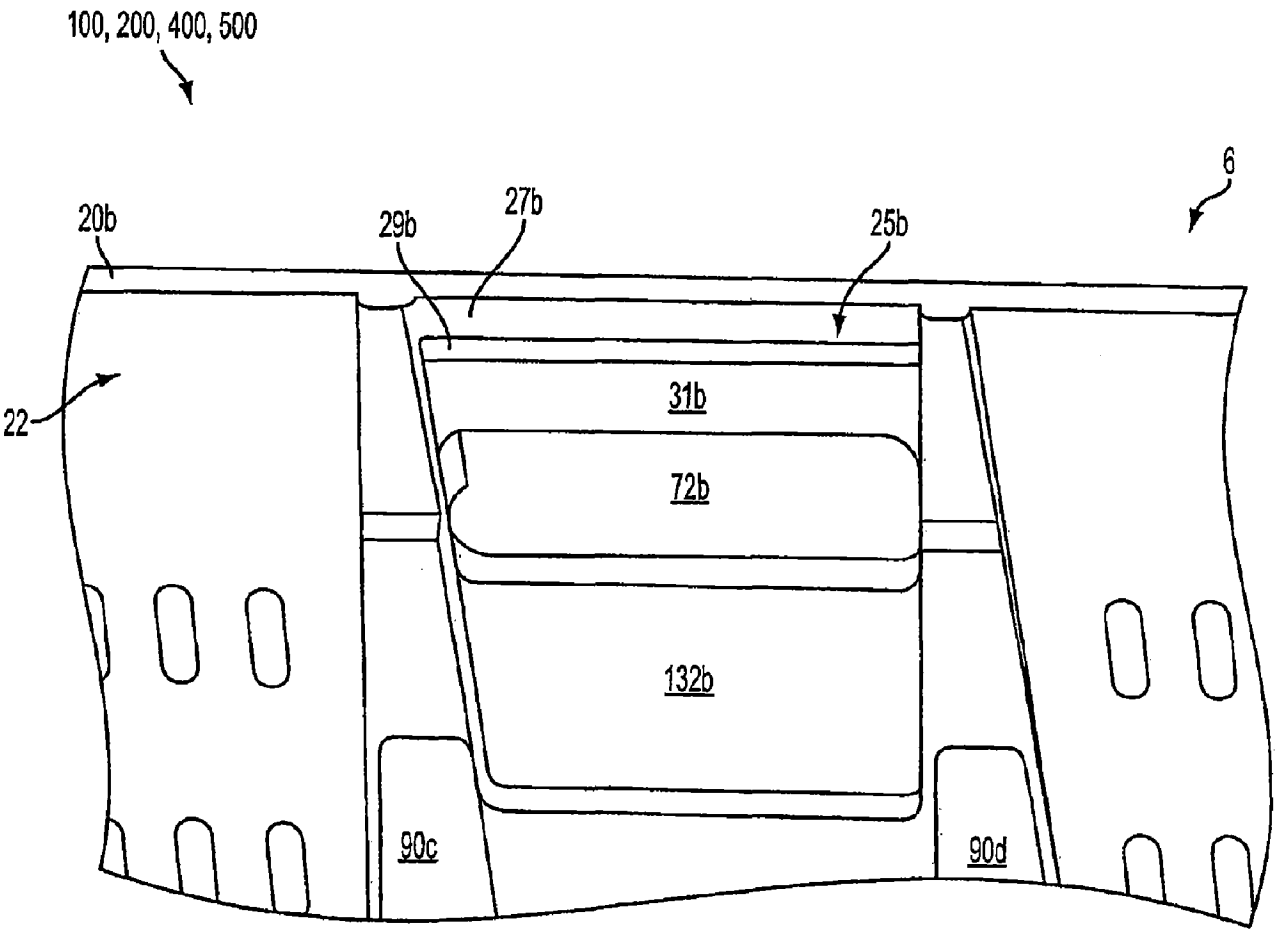
FIG. 58 illustrates an expanded perspective view of an upper handle used in the containers described herein according to an embodiment of the present invention.
Figure 59:
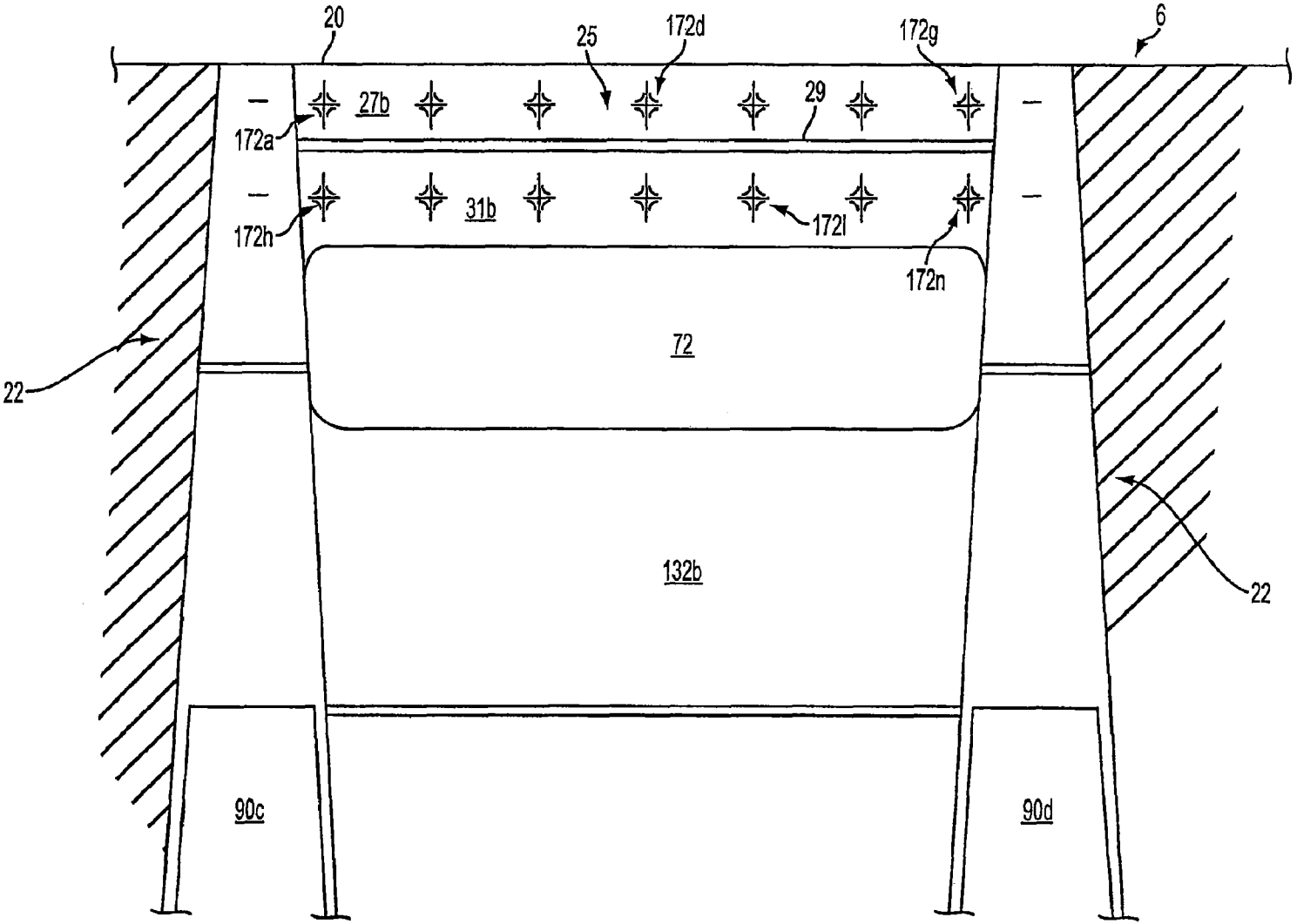
FIG. 59 illustrates an expanded front view of the upper handle.
Figure 60:
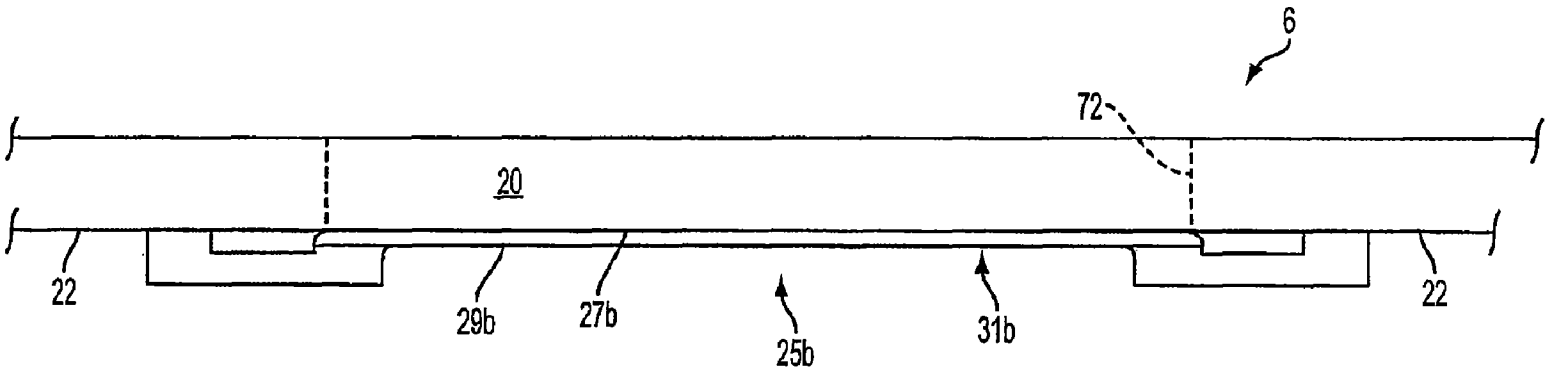
FIG. 60 illustrates an expanded top view of the upper handle.

FIG. 58 illustrates an expanded perspective view of an upper handle 72*b* used in the containers described herein according to an embodiment of the present invention, FIG. 59 illustrates an expanded front view of the upper handle 72*b*, and FIG. 60 illustrates an expanded top view of the upper handle 72*b*. FIG. 58 also shows a lifting feature 25 comprising a lifting feature upper surface 27*b*, a lifting feature sloping surface 29*b* and, shown in FIG. 59 finger recess areas 172*a-n*. The combination of lifting feature upper surface 27*b*, a lifting feature sloping surface 29*b* and, shown in FIG. 59 finger recess areas 172*a-n* provides a user with a substantially improved lifting surface by which to grab the containers 100, 200, 400, 500. As FIG. 60 illustrates, lifting feature upper surface 27*b* is preferably recessed from lifting feature lower surface 31*b*. Lifting feature sloping surface 29*b* is preferably located in between lifting feature upper surface 27*b* and lifting feature lower surface 31*b*, and preferably slopes from the lifting surface lower surface 31*b* towards the outer wall of sidewall 6 to lifting surface upper surface 27*b*. This sloping surface, plus the finger recess areas 172*a-n* provides a comfortable ergonomic gripping surface for a user.

Other components of the sidewalls 2, 6 of the container 100 according to an embodiment of the present invention include a plurality of sidewall upper ventilation holes 70, a plurality of sidewall middle ventilation holes 68, and a plurality of sidewall lower ventilation holes 66. All three sets of ventilation holes (66, 68, 70), provide ventilation into the compartment 3 of the container 100, and also save on material costs in manufacturing the containers 100. The three sets of holes 66, 68, 70 eliminate a good deal of material from which the container 100 is made, without compromising the strength of the container 100. This, therefore, provides a saving on costs of manufacturing the container 100. In addition, a plurality of outer wall ribs 64 are provided for additional strengthening along the bottom of the sidewalls 2, 6.

Figure 3:
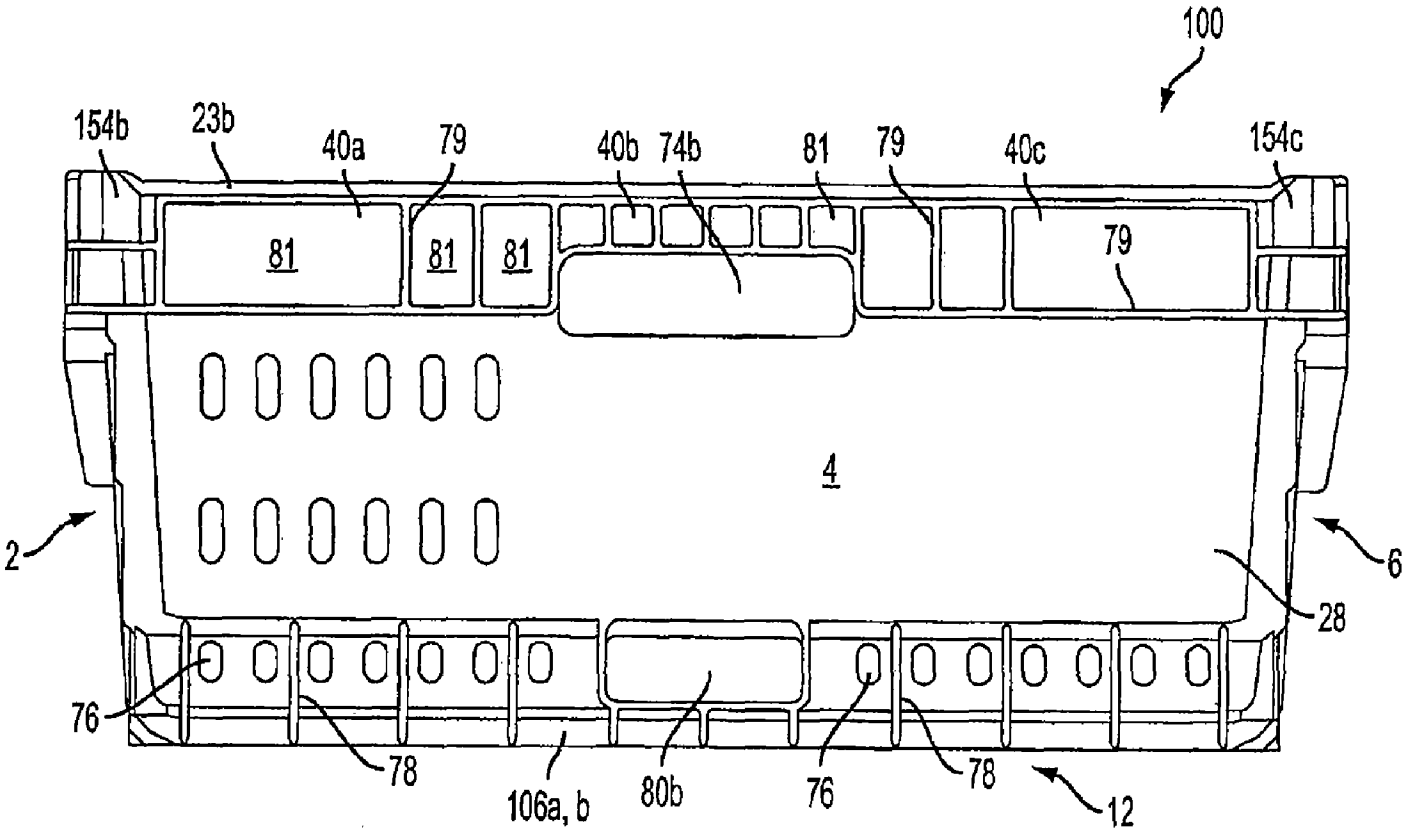
FIG. 3. illustrates a right side view of the container shown in FIG. 1.

Referring to FIGS. 1, 3, 4, 11A, 11B, and 20, the endwalls 4, 8 of the container are shown, along with several features according to an embodiment of the present invention. As discussed above, endwalls 4, 8 of the container 100 according to an embodiment of the present invention provide, along the endwall top portion 21, an bail arm saddle 23*a* upon which the bail arm 50*a* rests when a second container 100' is to be fully nested into a first container 100. As shown in FIGS. 4, 11B, and 20, the bail arm 50 sits on the bail arm saddle 23 when the bail arm 50 is placed in its fully nested position. Also as shown in FIG. 3 are the endwall's upper handle 74*b* and lower handle 80*b*. As with the handles on the sidewalls 2, 6, the endwalls' handles 74, 80 can also be located in a plurality of positions. According to an embodiment of the present invention as shown in FIG. 3, the endwall upper handle 74*b* is preferably located centrally on an upper portion of the endwall, though, as with sidewall upper handle 72*a* and sidewall lower handle 92*a*, this need not always be the case.

The endwalls 4, 8 further comprise an endwall interior surface 26 and an endwall exterior surface 28, as well as a plurality of endwall ventilation holes 76, and endwall lower strengthening ribs 78. The plurality of endwall lower strengthening rubs 78, along with the plurality endwall lower ventilation holes 76, provide strength to the container 100, and remove unnecessary material from the container 100, respectively. By reducing the amount of material used to manufacture the container 100, manufacturing costs are reduced. Implementing the plurality of lower strengthening ribs increases the container's 100 weight bearing capacity, thereby increasing its usefulness to users of the container 100. The reductions in weight and costs makes the containers 100 more useful and profitable to users because it allows them to transport a greater range of products, at reduced shipping costs (i.e., because of the weight reductions).

Endwall 4 comprises a left, central, and right upper endwall strength and rigidity areas 40*a*, 40*b* and 40*c*. The endwall upper handle 74*b* defines portions of the upper endwall strength and rigidity areas 40*a*, 40*b* and 40*c*. The left upper endwall strength and rigidity areas 40*a* is preferably located to the left of the central portion of the endwall 4 (as viewed from the exterior of the container 100), and the right upper endwall strength and rigidity area 40*c* is preferably located to the right of the central portion of the endwall 4. Upper endwall strength and rigidity area 40*a* comprises a series of endwall upper strengthening ribs 79 preferably formed in a grid-like pattern, and in between the series of endwall upper strengthening ribs 79 is a plurality of endwall upper planar areas 81. According to an embodiment of the present invention, the upper endwall strength and rigidity area 40*a* shown in FIGS. 1, 3, and 13A-D comprises a grid-like pattern that is generally rectangular, though this need not necessarily be the case. A similar, but oppositely located upper endwall strength and rigidity areas 40*a*-40*c* is also located on endwall 2.

FIG. 3 also shows the upper endwall strength and rigidity area 40B. The grid-like pattern of endwall upper strengthening ribs 79 and plurality of endwall upper planar areas 81 in the upper endwall strength and rigidity area 40*b* is much smaller than the upper endwall strength and rigidity area 40*a, c*, and the bottom grid-planar area forms an upper portion of the endwall upper handle 74*b*.

The upper endwall strength and rigidity areas 40*a*-40*c* provide additional strength and rigidity to the upper endwalls 4, 8. The grid design provides additional strength and eliminates the need for a proportionally thicker wall. This reduces the cost of manufacturing the container 100, because less material is used to make the container 100. Because less material is used, the containers 100 weighs less than it might otherwise, and users of the container 100 will experience a savings in shipping costs. Because of the increased strength due to its design, the container 100 can transport heavier items, thereby giving the user of the container 100 a greater range in the type of goods that can be transported in the container 100. The left endwall 8 comprises identical upper endwall strength and rigidity areas 40*a*-40*c* as the right endwall 4.

All of the strengthening features discussed in regards to the sidewalls 2, 6 and endwalls 4, 8 provide significant improvements in the utilization of containers 100, 200, 400, 500. These improvement includes, as noted above, a reduction in the amount of plastic used, which can lead to significant cost savings when manufacturing or purchasing hundreds or thousands of these containers. Through the use of the strengthening features, the integrity of the container is maintained, while less plastic is used (as noted), but thereby maximizing the interior volume of the containers: thinner walls maximizes the interior volume.

Figure 64:
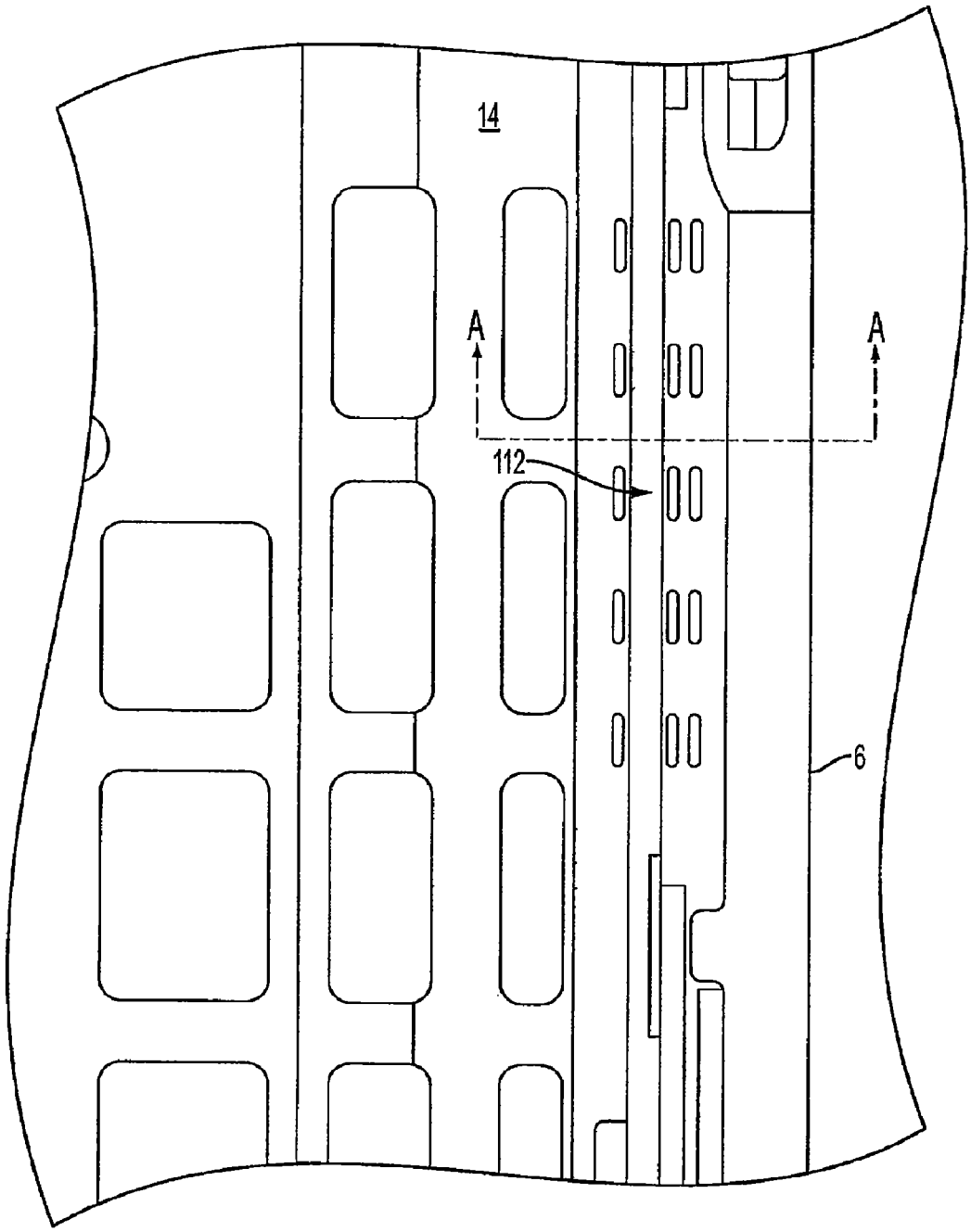
FIG. 64 illustrates an expanded top view of the sidewall of the containers described herein according to an embodiment of the present invention.
Figure 65:
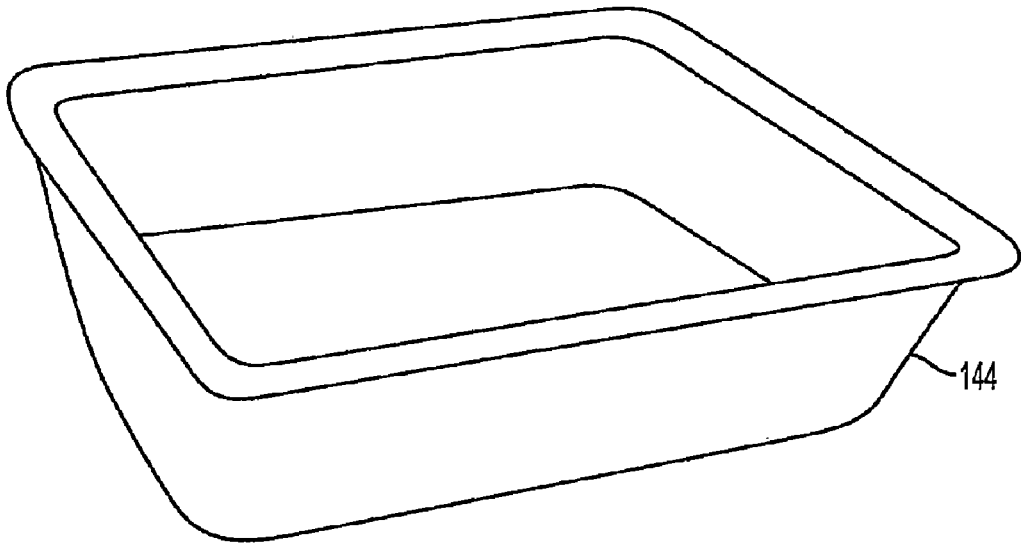
FIG. 65 illustrates a front perspective view of a conventional retail meat tray for use in any of the containers described herein according to an embodiment of the present invention.
Figure 66:
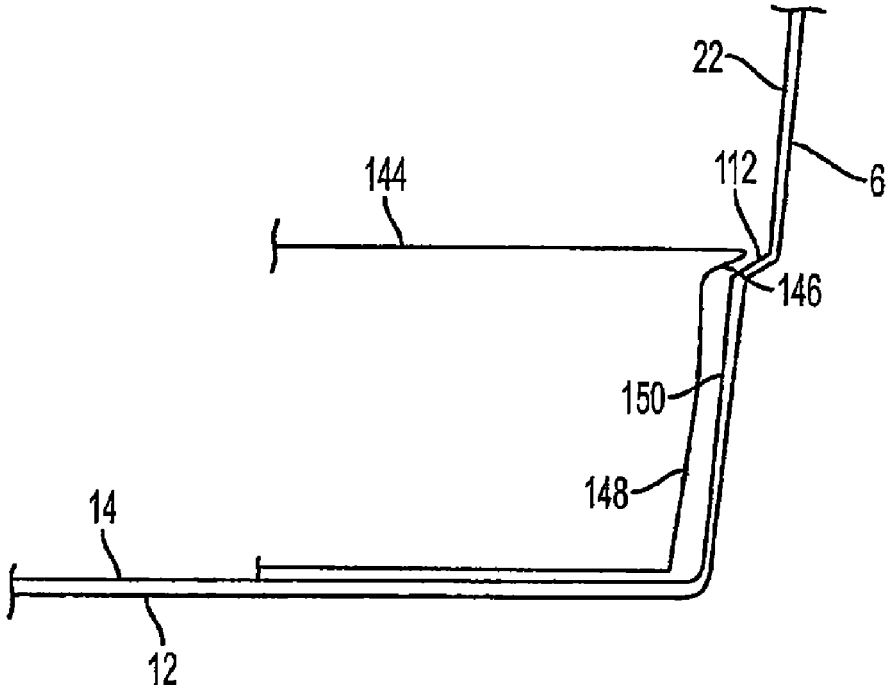
FIG. 66 illustrates a view along lines A-A of FIG. 66 showing the interaction between a sidewall inner ledge surface and the conventional retail meat tray shown in FIG. 65.

Discussion will now be made of a conformal flange feature of the containers 100, 200, 400, 500. FIG. 64 illustrates an expanded top view of the sidewall of the containers described herein according to an embodiment of the present invention. FIG. 66 illustrates a view along lines A-A of FIG. 66 showing the interaction between a sidewall inner ledge surface and the conventional retail meat tray shown in FIG. 65. In FIG. 66, a retail meat tray 144 (shown in greater detail in FIG. 65), is shown on the base upper surface 14, and nestled against an inner wall of container sidewall 6, specifically a sidewall lower portion 150. The retail meat tray 144 comprises a retail meat tray wall (tray wall) 148, and retail meat tray lip (tray lip) 146. The tray wall 148 fits against the sidewall lower wall portion 150, and the tray lip 146 abuts a sidewall ledge inner surface 112.

Figure 67:
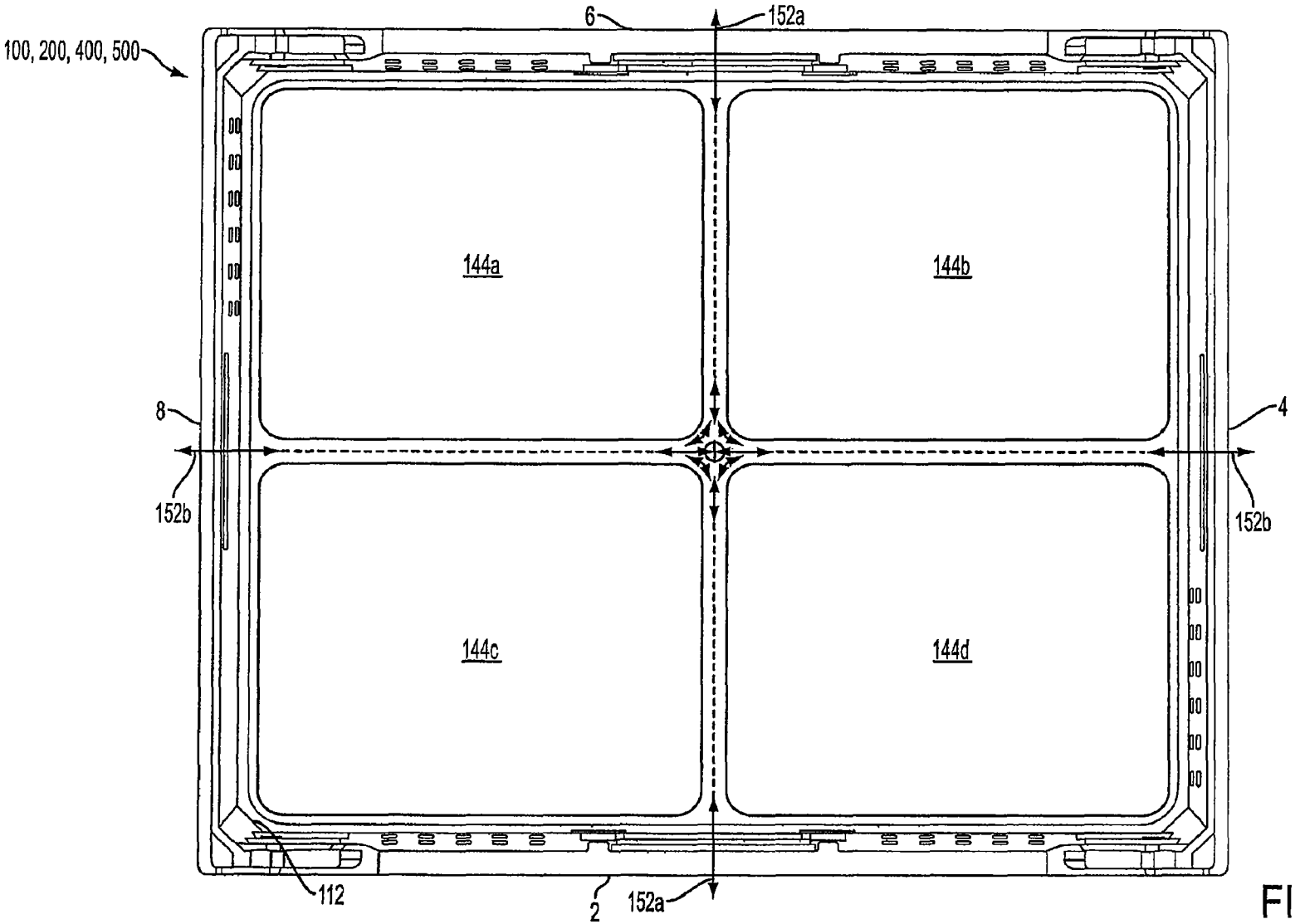
FIG. 67 illustrates a top view of any of the containers shown and described herein with a plurality of retail meat trays stacked on the bottom of the container according to an embodiment of the present invention.
Figure 68:
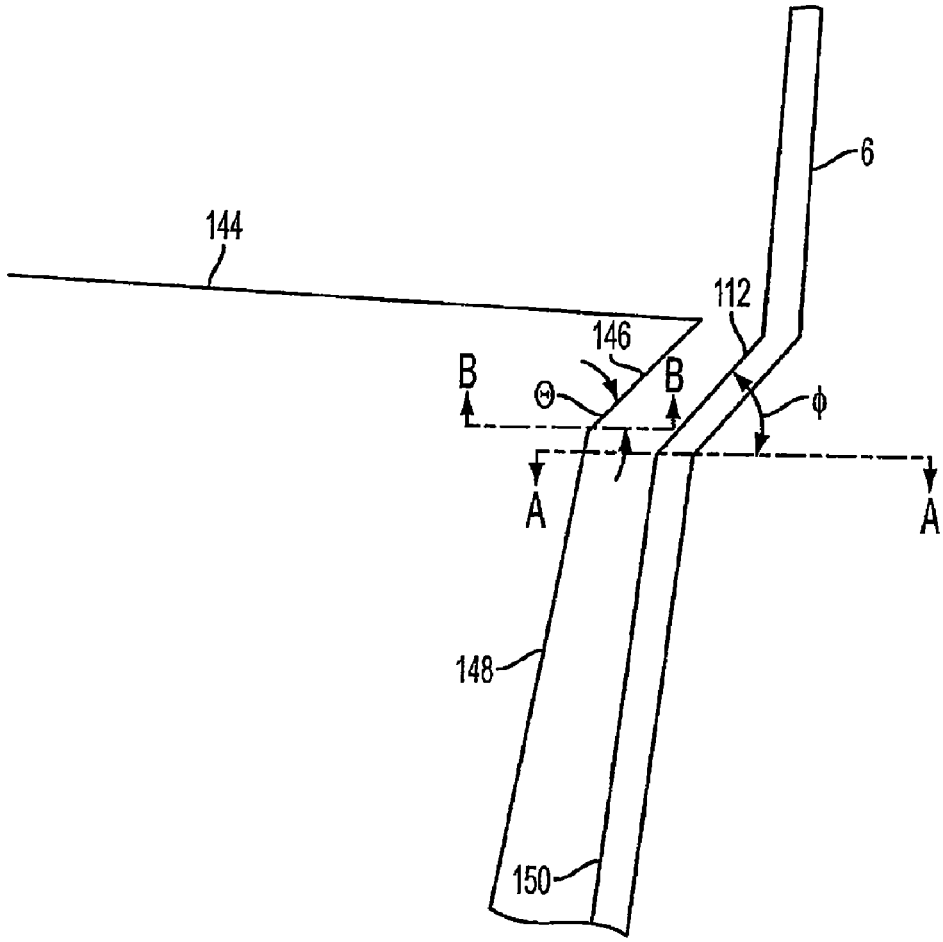
FIG. 68 illustrates an expanded view along lines A-A of FIG. 66 showing the interaction between a sidewall inner ledge surface and the conventional retail meat tray shown in FIG. 65.

The sidewall ledge inner surface 112 is preferably formed at an angle Φ from an imaginary horizontal line A-A as shown in FIG. 68. The angle Φ is chosen to substantially match the angle Θ the tray lip makes with a similar imaginary line B-B formed as shown in FIG. 68. FIG. 68 illustrates an expanded view along lines A-A of FIG. 66 showing the interaction between a sidewall inner ledge surface and the conventional retail meat tray shown in FIG. 65. Therefore, because angles Θ and Φ are substantially the same, and the interior dimensions of the base 10 are carefully chosen to hold a certain number of retail meat trays 144, the retail meat trays 144 fit snugly within the interior compartment of the container 100. FIG. 67 illustrates a top view of any of the containers 100, 200, 400, 500 shown and described herein with a plurality of retail meat trays 144 stacked on the bottom of the container according to an embodiment of the present invention. The dimensions of the containers 100, 200, 400, 500 are chosen to maximize the fit of the different retail meat trays 144 (i.e., standard vs. metric, 4down vs. 5down).

Figure 69:
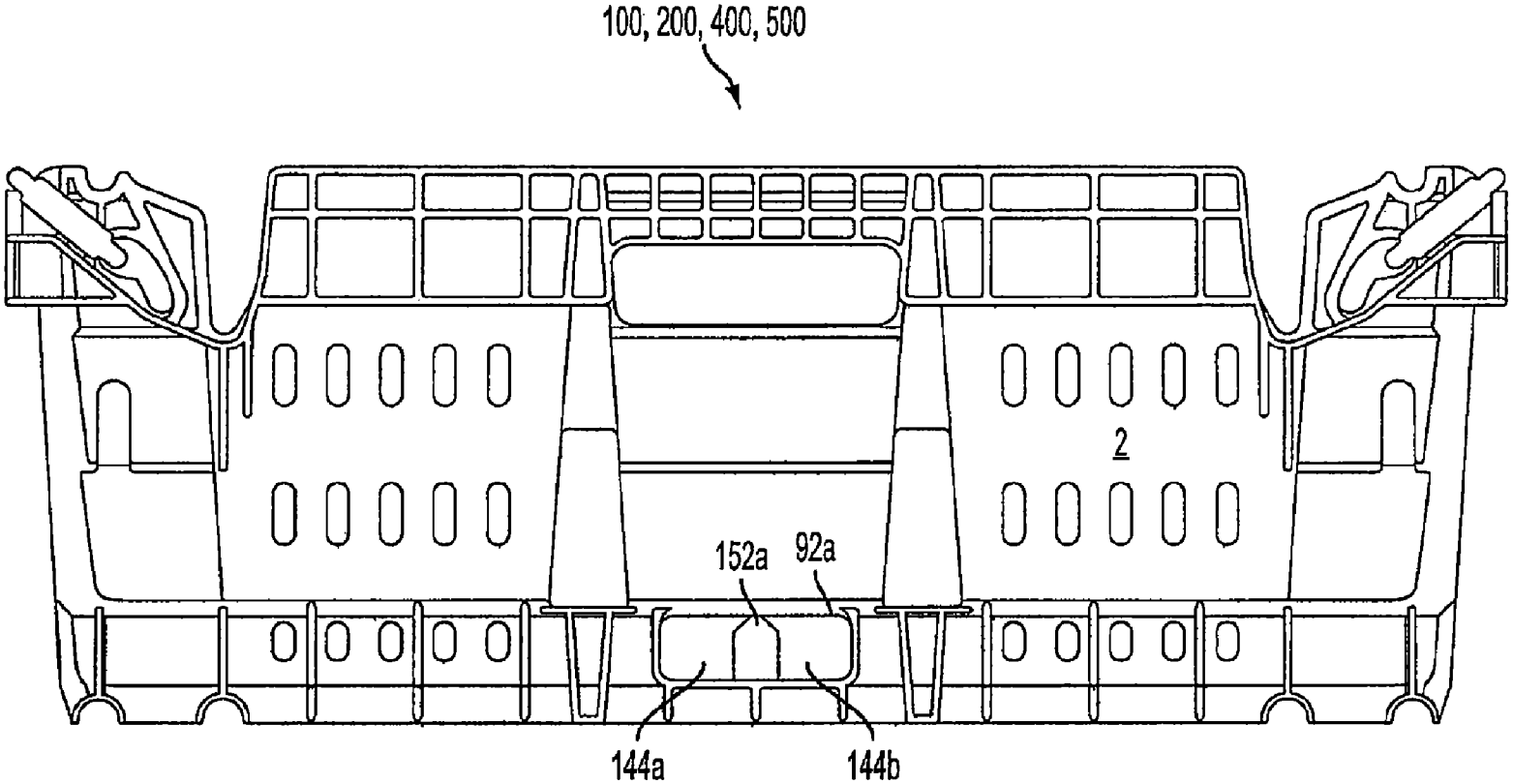
FIG. 69 illustrates a side view of the container shown in FIGS. 1-10 and 25-40 showing placement of a plurality of retail meat trays on the bottom of the container and an air flow passage according to an embodiment of the present invention.
Figure 70:
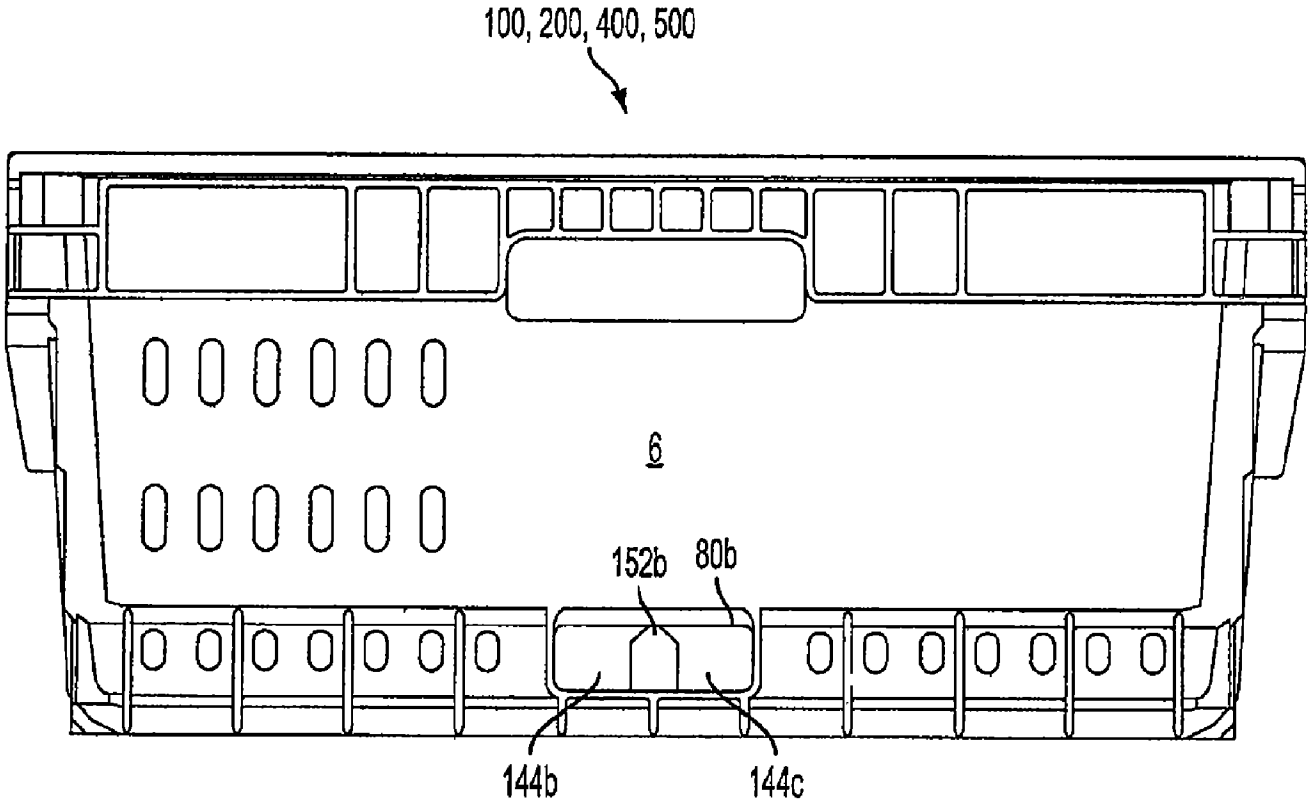
FIG. 70 illustrates a side view of the container shown in FIG. 69 illustrating an additional air flow passage according to an embodiment of the present invention.
Figure 71:
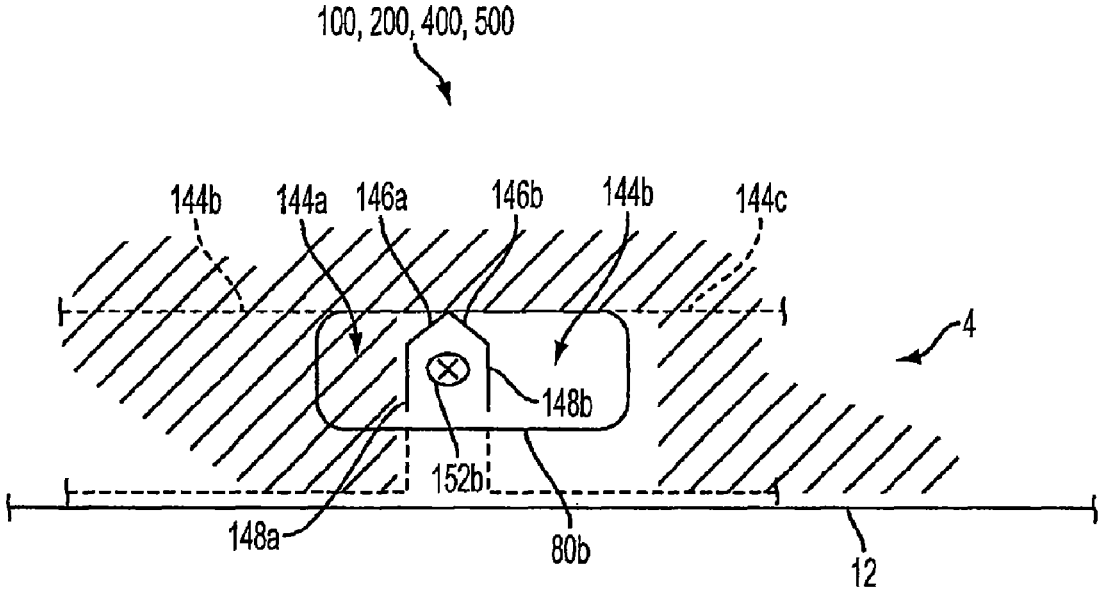
FIG. 71 illustrates a close-up cut-away view of the container shown in FIG. 70.
Figure 72:
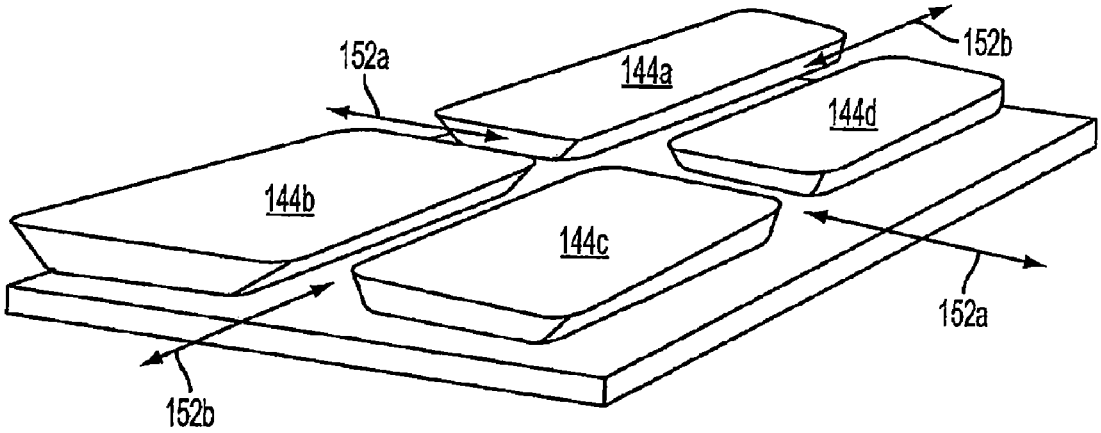
FIG. 72 illustrates a perspective cut-away view of the container shown in FIG. 69 with a plurality of retail meat trays and a plurality of air flow passages according to an embodiment of the present invention.

Referring to FIGS. 67, 69, 70, 71, and 72 an air flow passage feature of the containers 100, 200, 400, 500 will now be described. FIG. 69 illustrates a side view of the container shown in FIGS. 1-10 and 25-40 showing placement of a plurality of retail meat trays 144 on the bottom of the container and an air flow passage 152 according to an embodiment of the present invention. FIG. 72 illustrates a perspective cut-away view of the container shown in FIG. 69 with a plurality of retail meat trays and a plurality of air flow passages 152*a, b* according to an embodiment of the present invention. Because of the dimensions and locations of the lower handles 80*a, b* and 92*a, b*, air passages 152*a, b* are formed when retail meat trays 144 are placed on the base 10 of the containers 100, 200, 400, 500. These air passages 152*a, b* are formed by the intersection of the tray lips 146 and tray walls 148. A first air passage 152*a* is formed from lower handle 92*a* on sidewall 2 to lower handle 92*b* on sidewall 6, and a second air passage 152*b* is formed from lower handle 80*a* on endwall 4 to lower handle 80*b* on endwall 80*b*.

FIG. 71 illustrates a close-up cut-away view of the container shown in FIG. 70. This close-up view illustrates airflow passage 152*b* and its relationship to lower handle 80*b* (on endwall 4). Tray lips 146*a, b* and tray walls 148*b* form the airflow passage 152*b*. referring back to FIG. 67, it can bee seen that air will flow along the airflow passage 152*a, b* in both directions (i.e., from endwall 4 to 8, and from endwall 8 to 4), and can also change directions internally (i.e., from endwall 4 to sidewall 5); these changes in the directions of the airflow are indicated by the arrows drawn along the airflow passages 152*a, b*.

FIGS. 1, 2, 4, 5, and 15 illustrate several views of a base 10 of the container 100 according to an embodiment of the present invention. FIG. 4 is a top view of the container 100, and from this perspective, the top of the base 10 can be seen, as well as the top of each of the sidewalls 2, 6 and the endwalls 4, 8. The top view of the sidewalls 4, 8 shows the inner and outer pair of notches 36*a*, 36*b* and 34*a*, 34*b*, and the top view of the endwalls 4, 8 shows the bail arm saddles 23*a, b*. The base 10, as shown in FIG. 4, preferably comprises a plurality of openings 16. The base openings 16 saves weight (because it takes less plastic to make a base with the base openings 16 as opposed to a base 10 that is solid) without sacrificing strength, due to the rigidity of the design of the base ribs 18.

Figure 5:
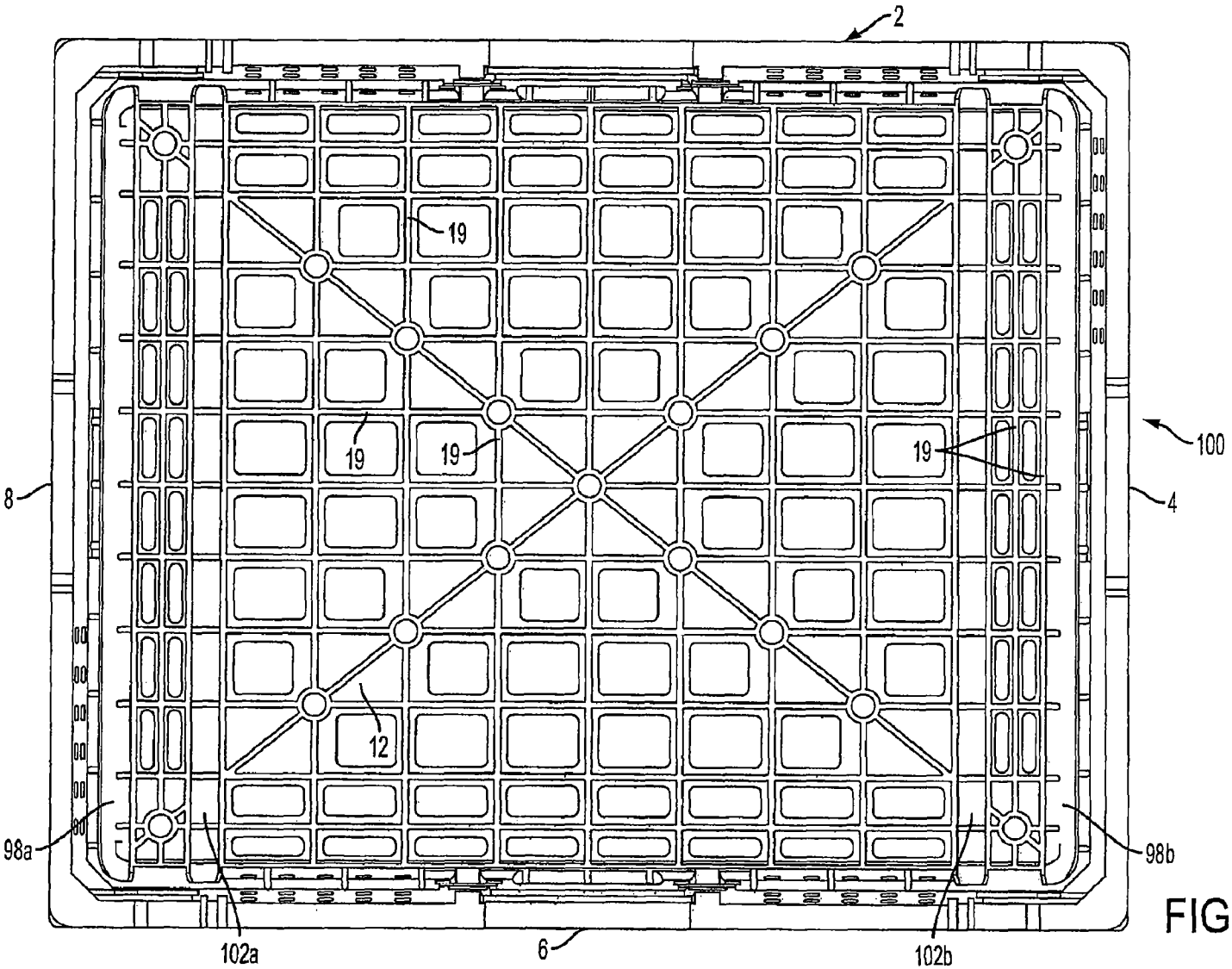
FIG. 5 illustrates a bottom view of the container shown in FIG. 1.
Figure 6:
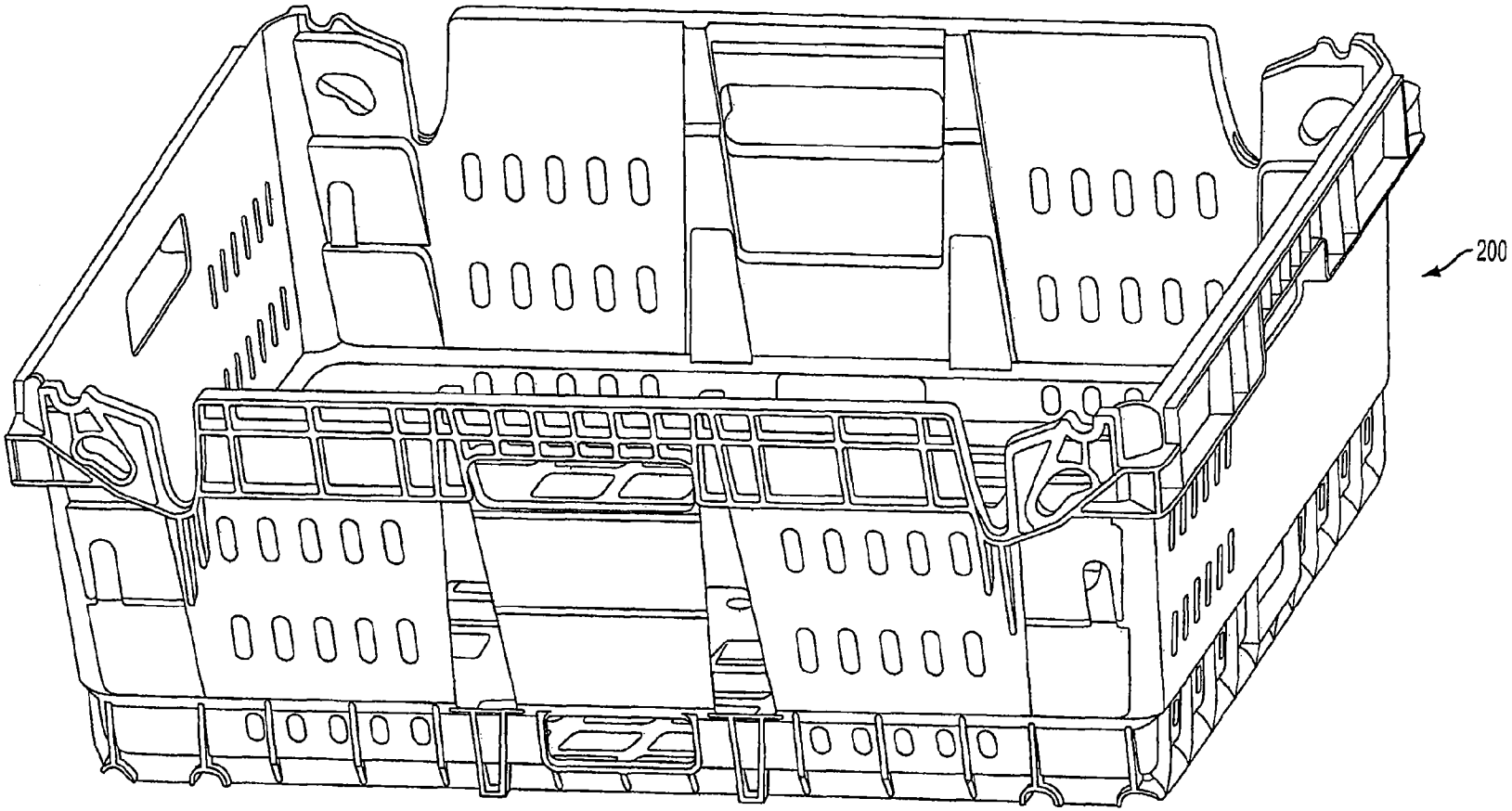
FIG. 6 illustrates a front perspective view of a multiple nestable stacking container according to another embodiment of the present invention.
Figure 7:
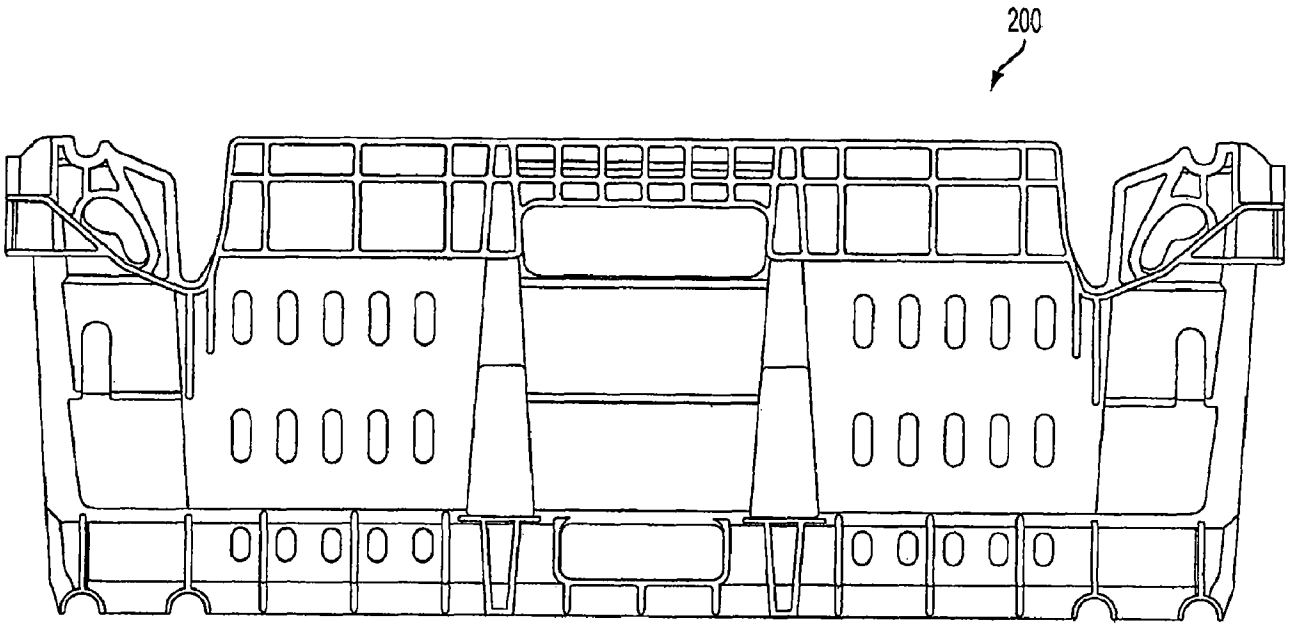
FIG. 7 illustrates a front view of the container shown in FIG. 6.
Figure 8:
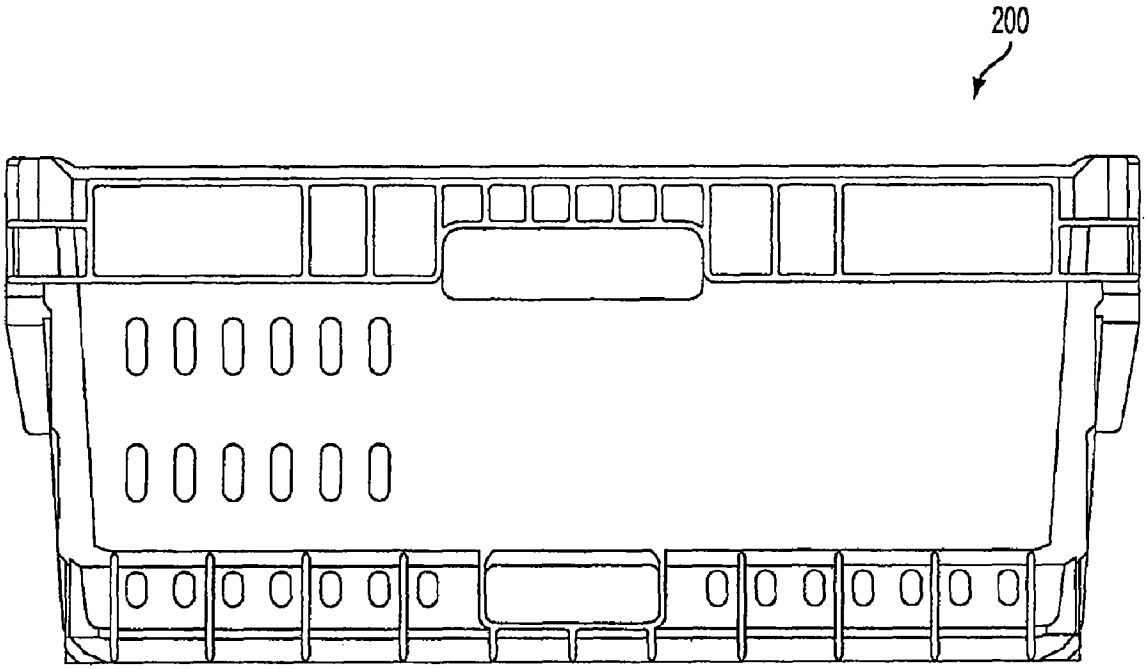
FIG. 8 illustrates a right side view of the container shown in FIG. 6.
Figure 9:
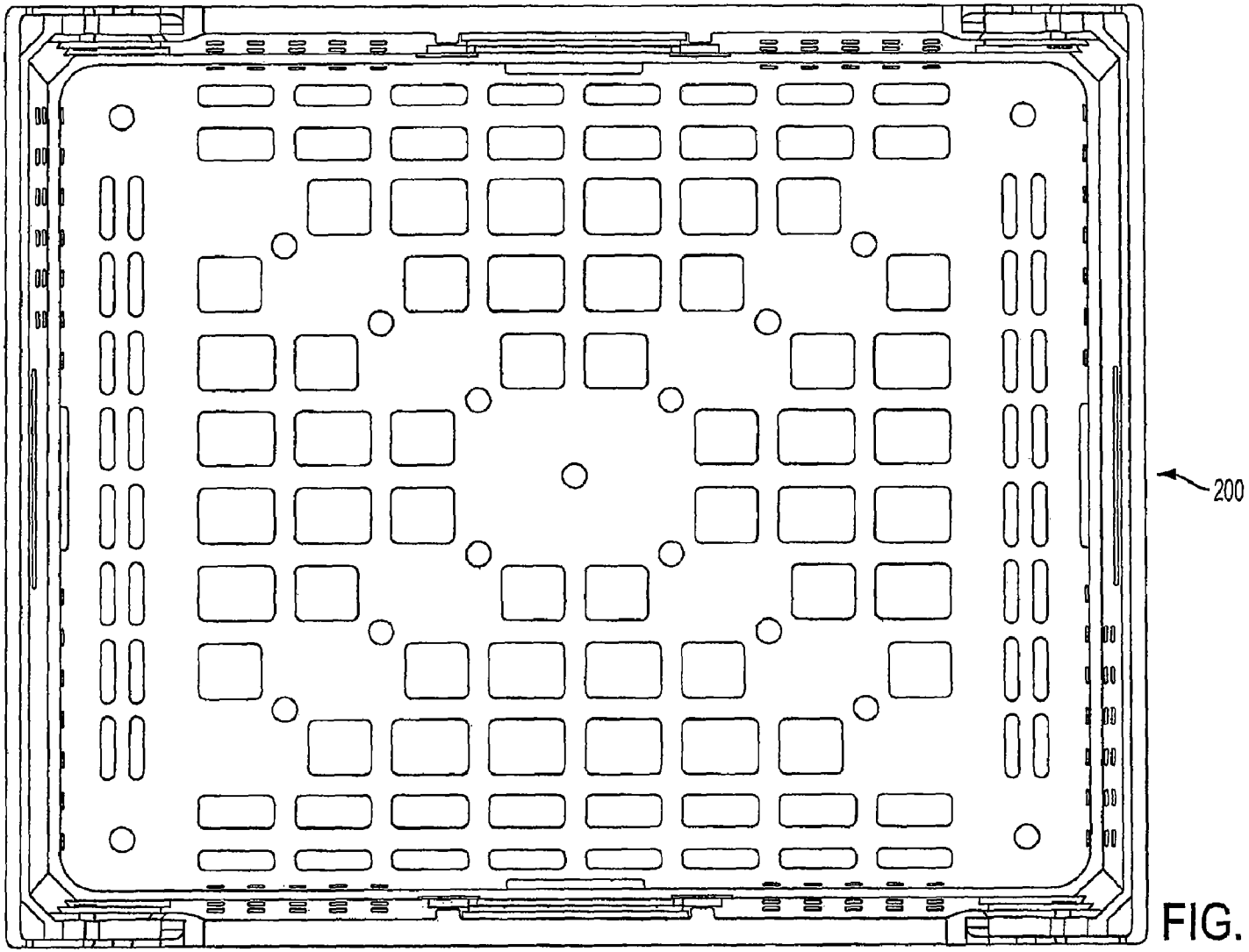
FIG. 9 illustrates a top view of the container shown in FIG. 6.
Figure 10:
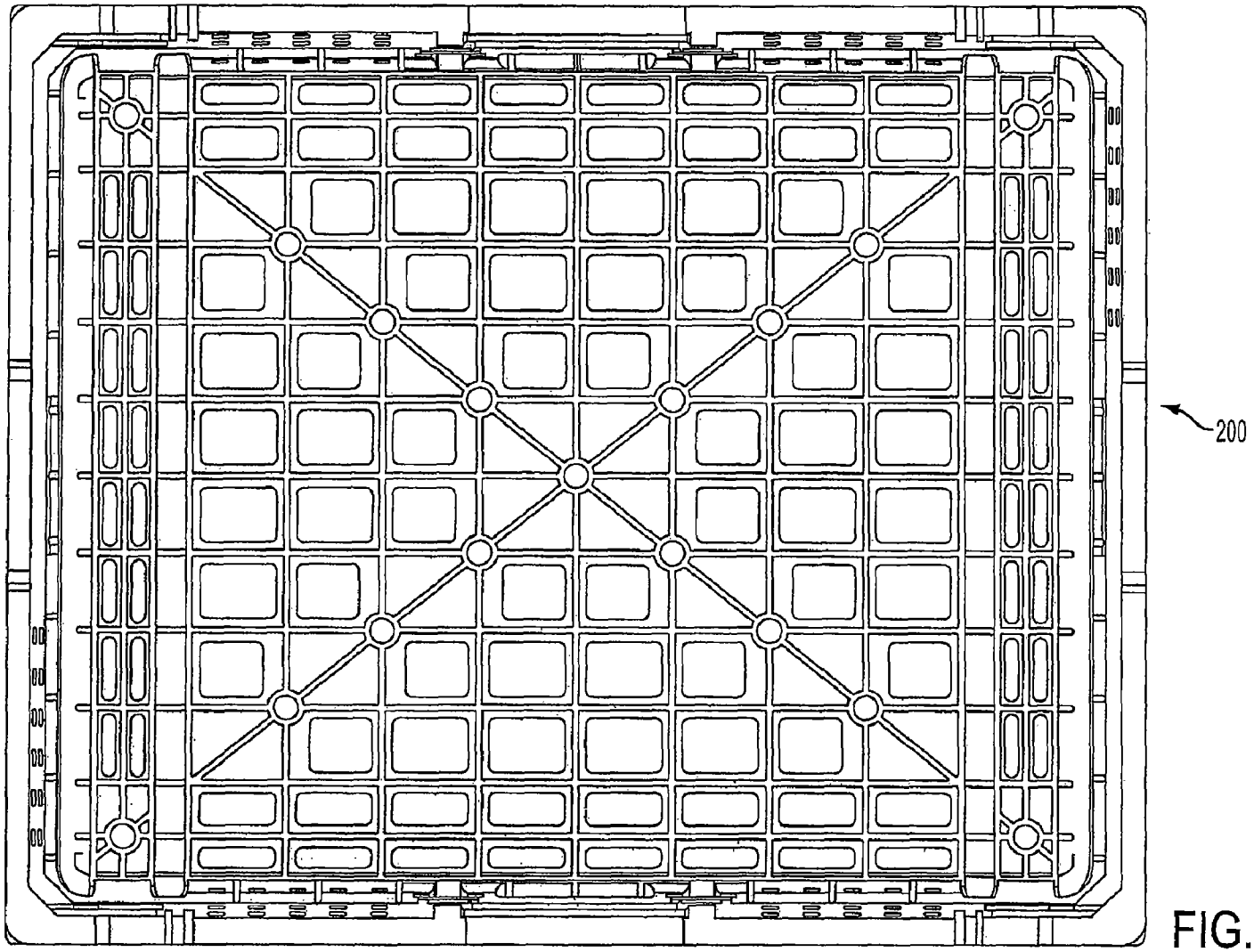
FIG. 10 illustrates a bottom view of the container shown in FIG. 6.
Figure 15:
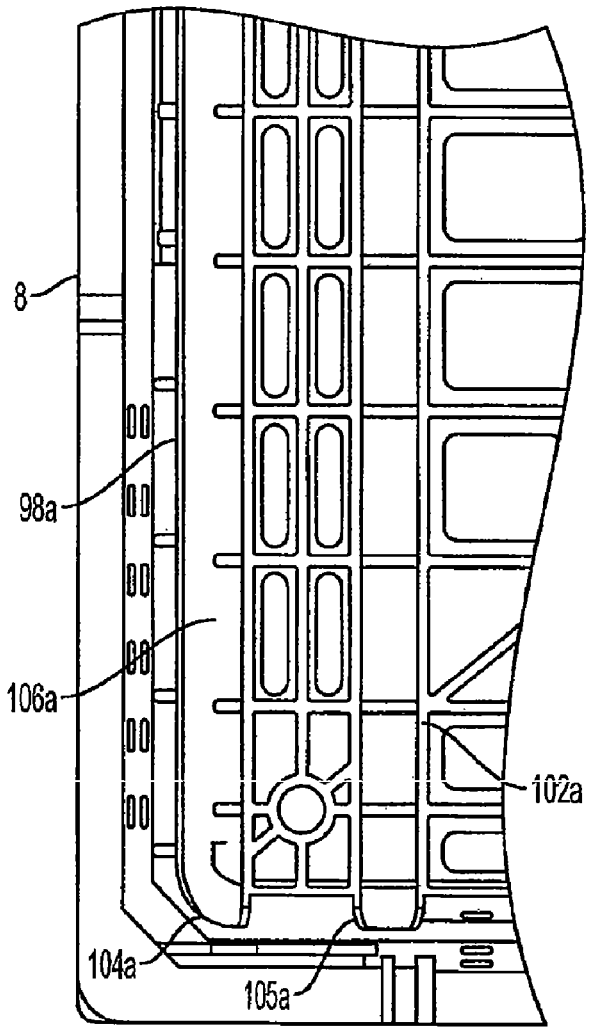
FIG. 15 is a close-up bottom view of a portion of the base of the container shown in FIGS. 1 through 10.
Figure 22:
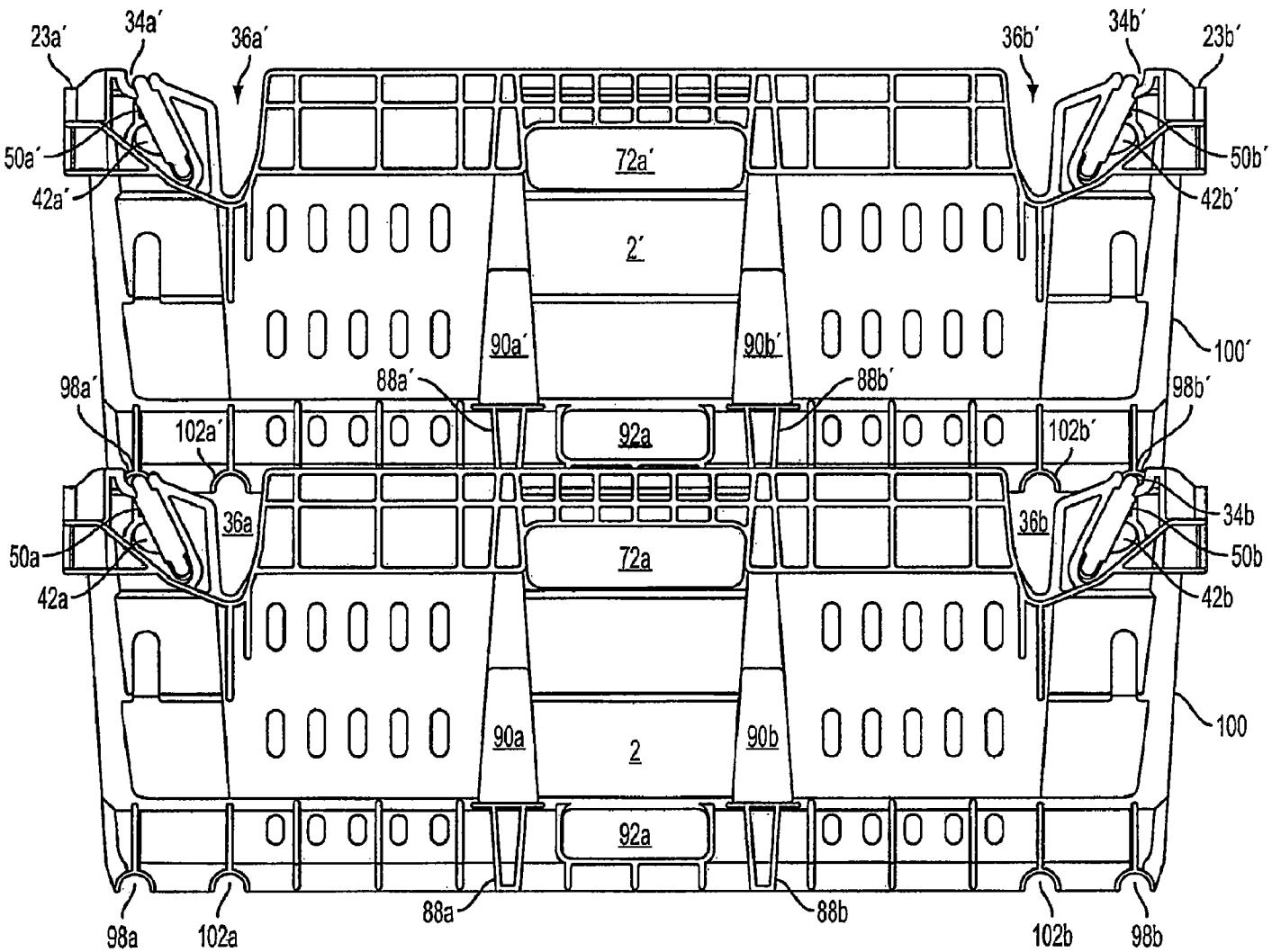
FIG. 22 illustrates a second container substantially un-nested in regard to a first container, wherein the first and second containers are the containers shown in FIGS. 1 through 10, according to an embodiment of the present invention.

FIG. 2 illustrates a front view of the container 100, showing a front view of a pair of outer bail arm grooves 98*a*, 98*b* and a pair of inner bail arm grooves 102*a*, 102*b*. In FIG. 2, the outer bail arm groove ribs 108*a*, 108*b* can be seen, as well as the inner bail arm groove ribs 110*a*, 110*b*. FIG. 5 is a bottom view of the container 100, and illustrates the base 10 from the bottom, and FIG. 15 is a close up view of one corner of the base 10 showing the inner and outer bail arm grooves 98*a*, 102*a*. The outer and inner bail arm grooves 98*a, b* and 102*a, b* can be seen to run nearly the fall width of the container 100. Referring to FIGS. 1, 2, 5, and 15, it can be seen that the outer bail arm grooves 98*a, b* preferably comprise the outer bail arm groove ribs 108*a, b*, the outer bail arm groove receptacle 106*a, b*, and an outer bail arm groove curved end piece 104*a, b*. The outer bail arm groove 98*a, b* provides a means for receiving the bail arms 50*a, b* when a second container 100' is placed in an substantially un-nested stacking position, i.e., when the bail arms 50*a, b* are placed in the pair of outer notches 34*a, b* (as shown in FIG. 22). The outer bail arm groove receptacle 106*a, b* is substantially semi-circular in shape, to form-fit around the substantially tubular shaped bail arm engaging portion 82. Implementing the outer bail arm groove receptacles 106*a, b* to be of substantially the same shape as the bail arm engaging portion 82 provides a better fit between the two components. The outer bail arm groove curve end piece 104*a* provides for an easier nesting of the second container 100' onto the first container 100. The outer bail arm groove end pieces 104*a-d* and inner bail arm groove end pieces 102*a-d* also provide a safety feature. If several containers 100 were stacked (e.g., 7 or more) and there were no outer bail arm groove pieces 104*a-d* or inner bail arm groove end pieces 102*a-d*, then the containers could move laterally to either the front or back sidewall 2, 6. If all the containers stacked laterally in the same direction, the absence of the inner and outer bail arm groove end pieces 102*a-d* and 104*a-d* would allow the base 10 of the containers 100 to abut a sidewall, for example, front sidewall 2. In this case, if all the containers 100 were stacked such that the base 10 of each upper container abutted the front sidewall 2, the center of gravity of the uppermost containers could shift to such a point that the stacked containers 100 could tip over, thereby causing serious personal injury to nearby people, especially if heavily loaded.

The outer bail arm groove ribs 108*a, b* provide additional strength and support when the containers 100 are loaded. An inner bail arm groove rib 110*a, b* is provided for the inner bail arm grooves 102*a, b* for the same purpose of providing strength and support. The inner bail arm groove 102*a* is used when the second container 100 is in a partially nested stacking position, i.e., when the bail arms 50*a, b* are located in the inner notches 36*a-d* (as shown in FIG. 21).

Referring now to FIGS. 4 and 5, the base 10 comprises a base upper surface 12, a base lower surface 14, and a plurality of base openings 16 and ribs 18 arranged in a grid pattern. The particular arrangement of the base openings 16 and ribs 18 according to an embodiment of the present invention provides sufficient loading strength for various types of products or goods to be transported within the containers 100. The ribs 18 have a smooth upper surface as seen in FIG. 4, and a series of base strengthening ridges 19 on the base lower surface 14 as seen in FIG. 5. By eliminating the material that would otherwise be taken up by the base openings 16, the manufacturer of the containers 100 reduces material costs and also provides a lighter container. This saves on shipping costs for the users of the containers 100.

Figure 51:
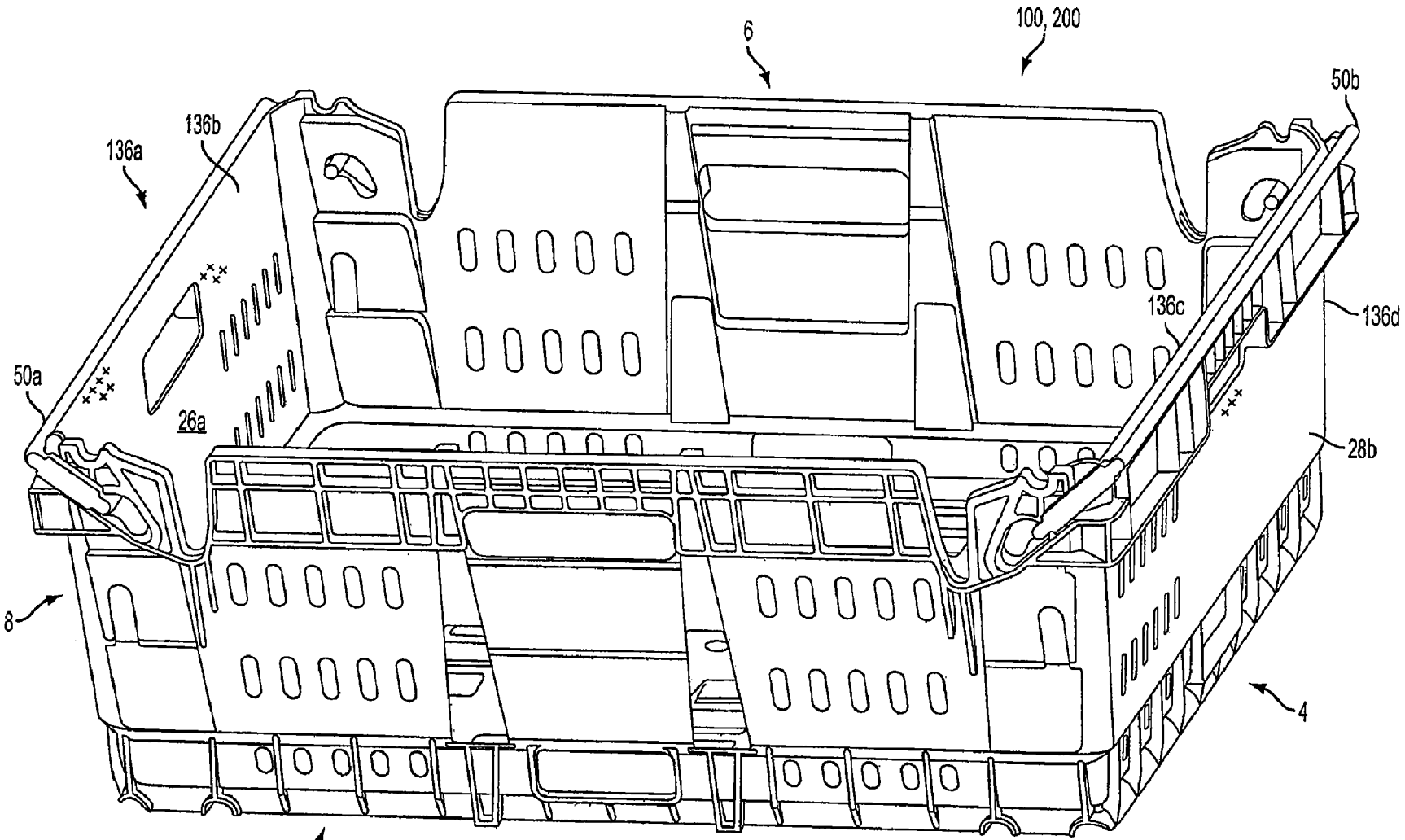
FIG. 51 illustrates a front perspective view of the container shown in FIGS. 1 through 10 with micro-bumps added to certain areas according to an embodiment of the present invention.
Figure 52:
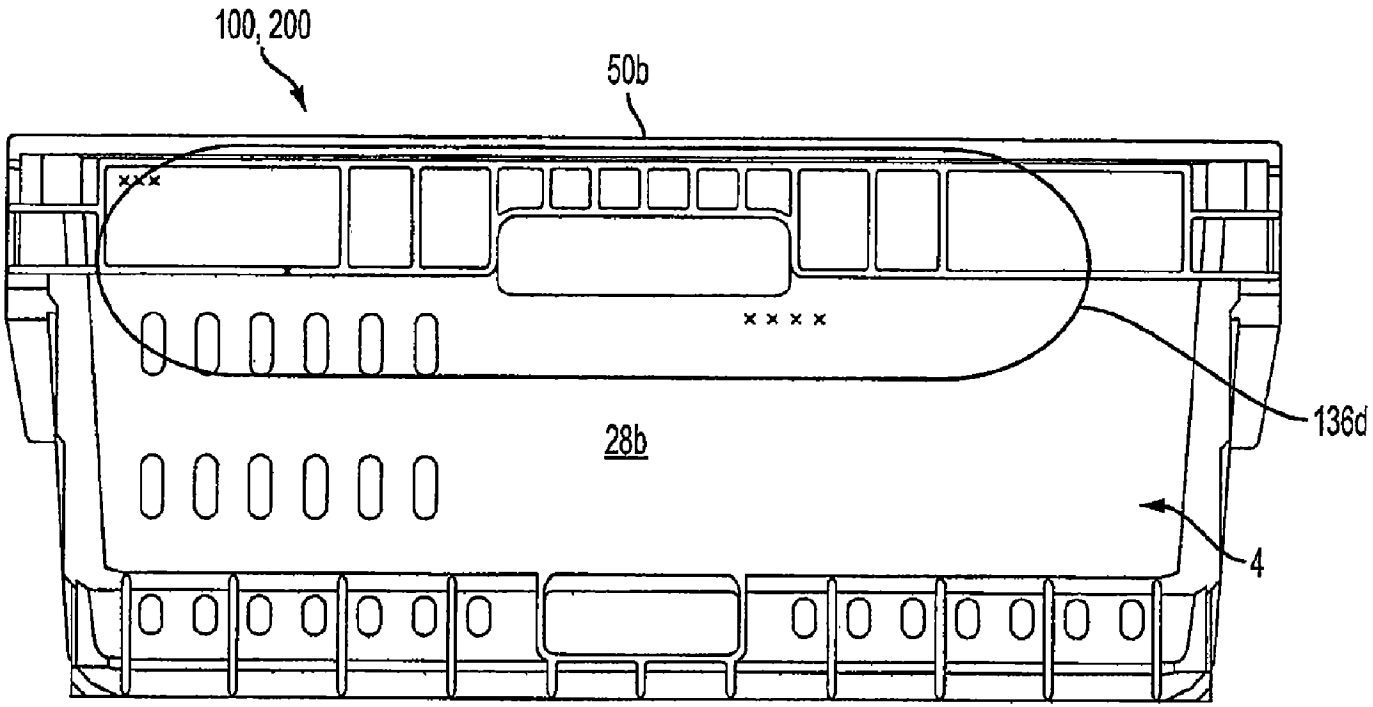
FIG. 52 illustrates a side view of the container shown in FIGS. 1 through 10 with micro-bumps added to certain areas according to an embodiment of the present invention.
Figure 53:
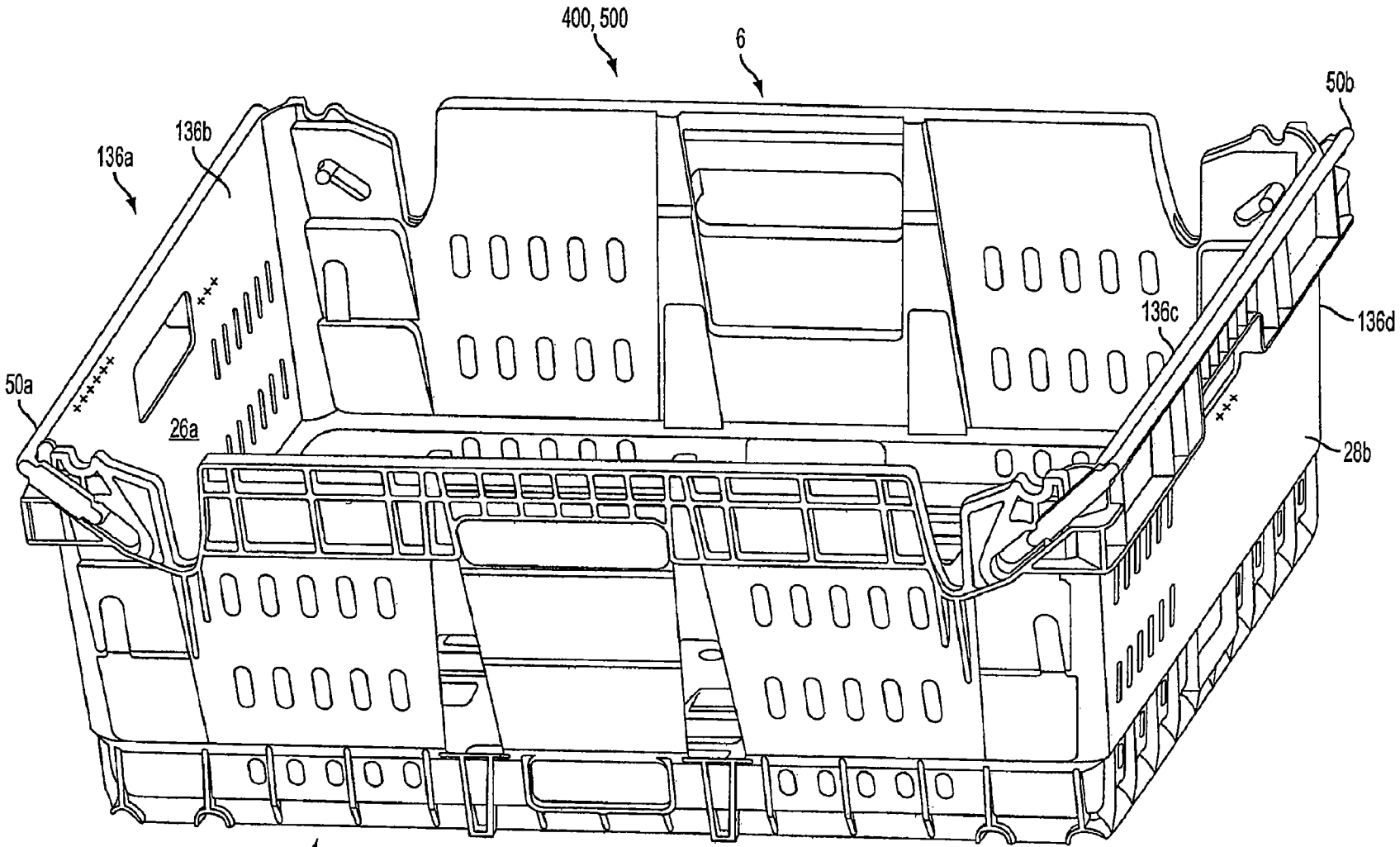
FIG. 53 illustrates a front perspective view of the container shown in FIGS. 25 through 40 with micro-bumps added to certain areas according to an embodiment of the present invention.
Figure 54:
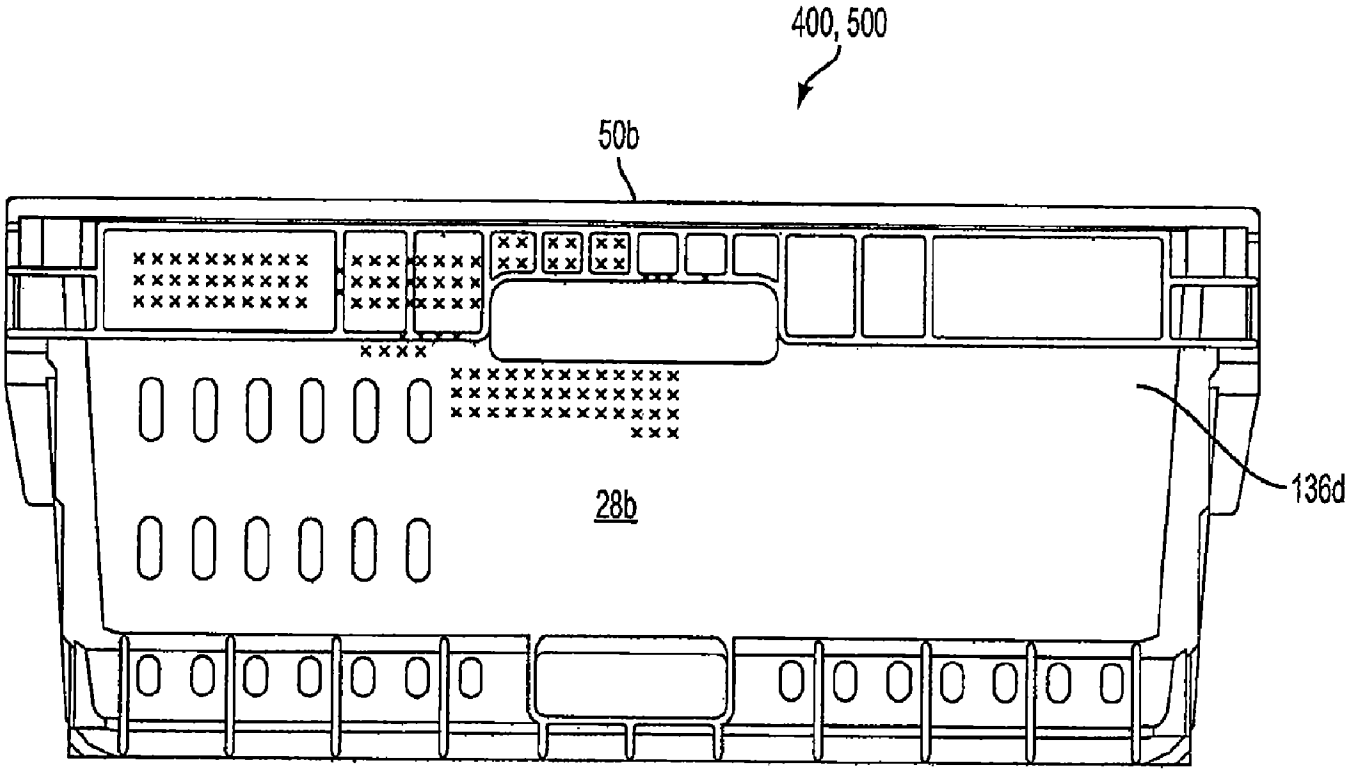
FIG. 54 illustrates a side view of the container shown in FIGS. 25 through 40 with micro-bumps added to certain areas according to an embodiment of the present invention.

FIG. 51 illustrates a front perspective view of the containers 100, 200 shown in FIGS. 1-10 with micro-bumps 134 added to certain areas according to an embodiment of the present invention, and FIG. 52 illustrates a side view of the containers 100, 200 shown in FIGS. 1 through 10 with micro-bumps added to certain areas according to an embodiment of the present invention. FIG. 53 illustrates a front perspective view of the containers 400, 500 shown in FIGS. 25 through 40 with micro-bumps added to certain areas according to an embodiment of the present invention, and FIG. 54 illustrates a side view of the containers 400, 500 shown in FIGS. 25 through 40 with micro-bumps added to certain areas according to an embodiment of the present invention. Micro-bumps 134 are raised or depressed areas on various surfaces of the containers 100, 200, 400, 500 that assist in preventing commonly used stickers from adhering permanently to the surfaces of the container and/or bail arms 50*a, b*, as one of ordinary skill in the art can appreciate. These stickers can indicate, for example, the time and date of processing, the type of meat product, the source of the meat, the plant that packed the meat, and other such information that might be necessary. Once the meat is retrieved from the containers 100, 200, 400, 500, the stickers are no longer pertinent, and must be removed. The micro-bumps 134 make such removal much easier, because there is less surface area of the containers for the sticker to adhere to. Because of the micro-bumps 134, only 30-40% of the sticker surface area adheres to the container. On a substantially flat container surface, however, close to 100% of the surface area of the sticker adheres to the substantially flat container surface.

Figure 55A:
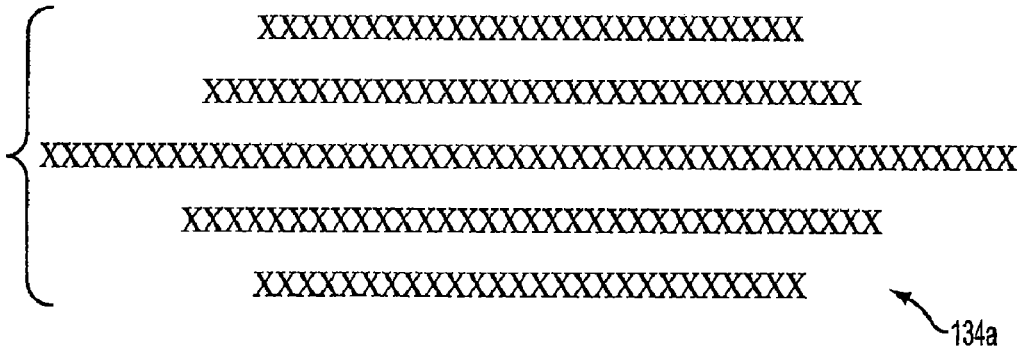
FIGS. 55A-55F illustrate a plurality of designs for the micro-bumps used on the containers shown in FIGS. 1 through 10 and 25 through 40 according to an embodiment of the present invention.
Figure 55B:
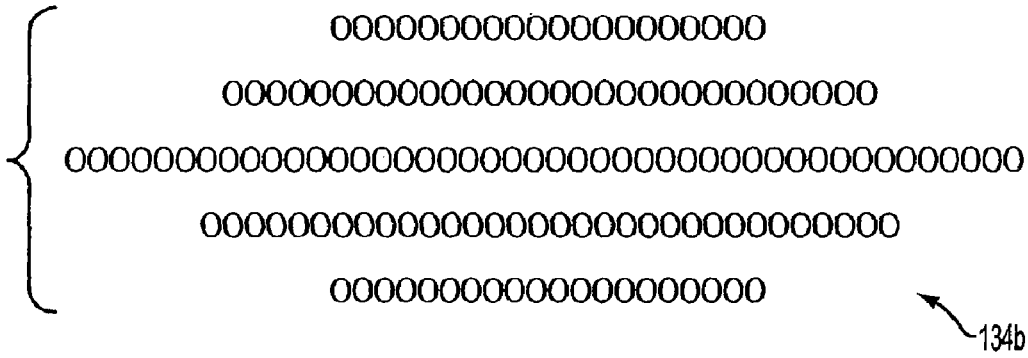
Figure 55C:
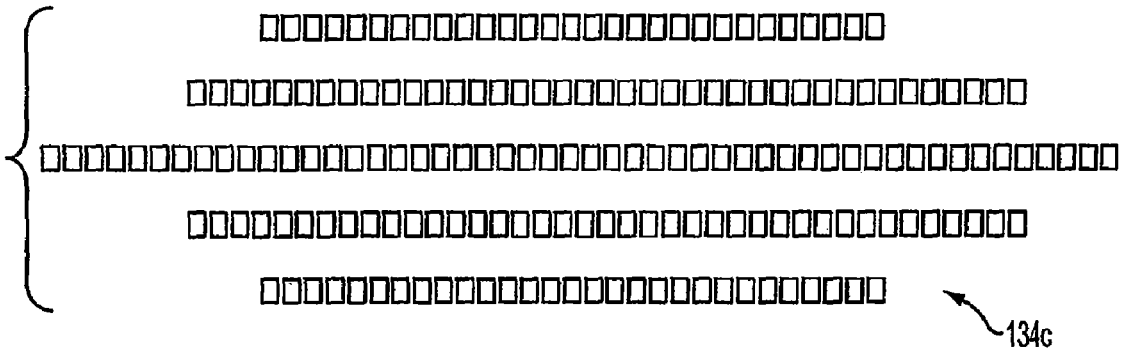
Figure 55D:
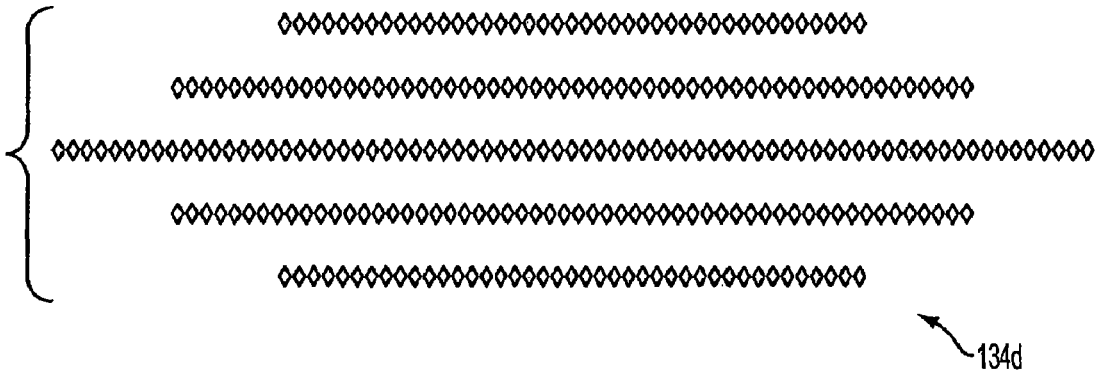
Figure 55E:
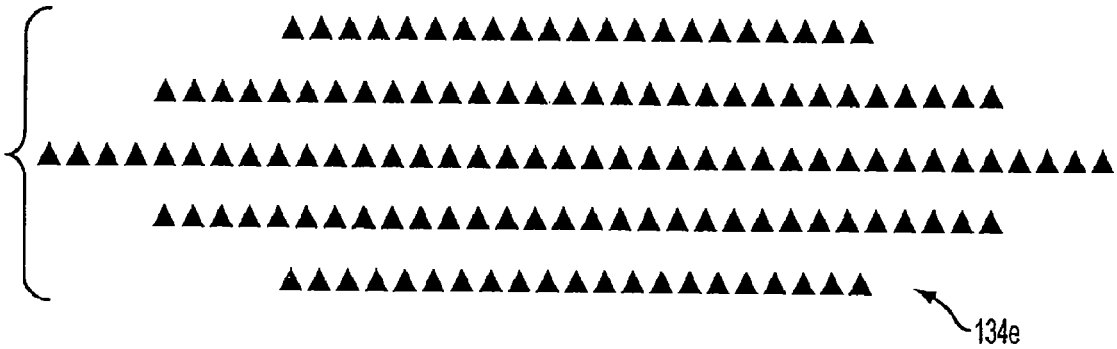
Figure 55F:
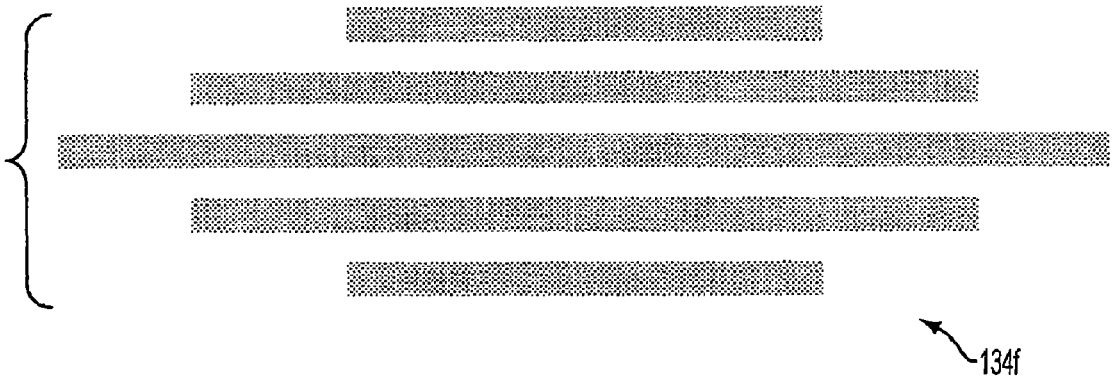

The micro-bumps can be in almost any imaginable shape, though, as FIGS. 55A-F illustrate, there are more common designs prevalent throughout the industry of the retail meat packing industry. In FIG. 55A, micro-bumps 134*a* are in the form of an "X"; in FIG. 55B, micro-bumps 134*a* are in the form of and circles ○; in FIG. 55C, micro-bumps 134*a* are in the form of a box □; in FIG. 55D, micro-bumps 134*d* are in the form of a diamond ◇; in FIG. 55E, micro-bumps 134E are in the form of a triangle ▲; and in FIG. 55F, micro-bumps 134F are in the form of dots ▒. According to another embodiment of the present invention, the micro-bumps 134 can be in the shape of grooves or ridges.

As FIGS. 51-54 indicate, there are several areas, though not the only ones, that micro-bumps 134 are located. These areas are referred to as micro-bump areas 136*a-d*. Referring to FIGS. 51 and 53, micro-bump area 136*a* is preferably located on the exterior surface 28*a* of endwall 8, and micro-bump area 136*b* is preferably located on the interior surface 26*a* of endwall 8. Micro-bump area 136*c* is preferably located on the interior surface 26*b* of endwall 4, and micro-bump area 136*d* is preferably located on the exterior surface 28*b* of endwall 4. FIGS. 52 and 54 show micro-bump area 136*d* on the exterior surface 28*b* of endwall 4. The placement and configuration of micro-bump area 136*a* on the exterior surface 28*a* of endwall 8 is substantially similar to the placement of micro-bump area 136*d* on the exterior surface 28*b* of endwall 4.

Figure 56:
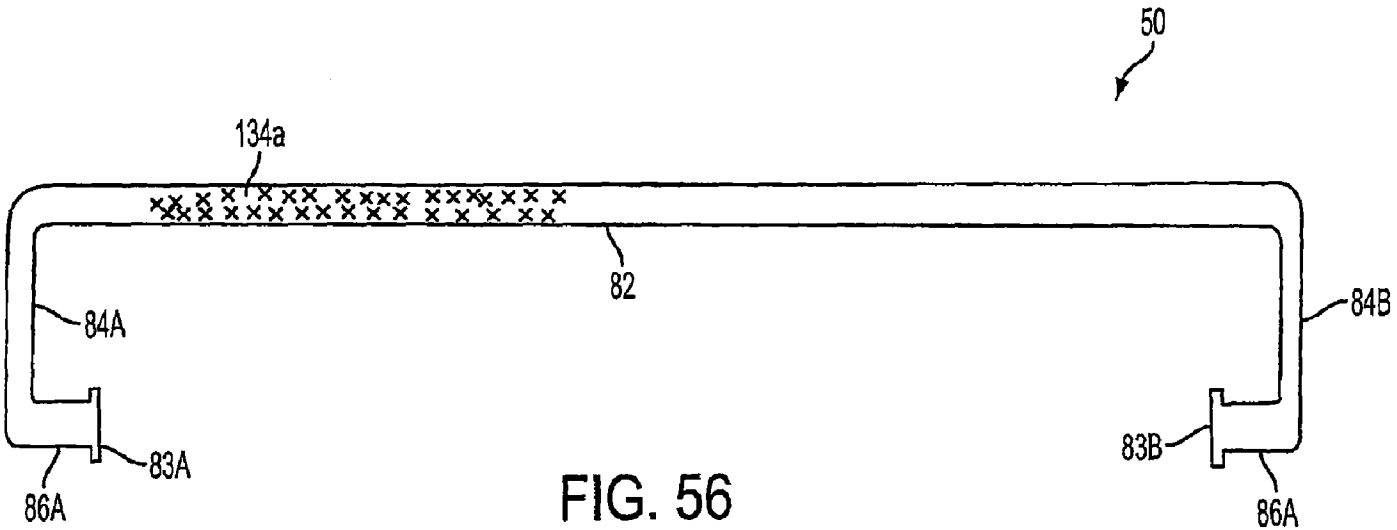
FIG. 56 illustrates a bail arm with micro-bumps that can be used with the containers shown in FIGS. 1 through 10 and 25 through 40.

As FIGS. 51-54 illustrate bail arms 50*a, b* are proximally located to the micro-bump areas 136*a-d*. According to an embodiment of the present invention, bail arms 50*a, b* are preferably manufactured from a metal, preferably a high strength steel. As can be readily appreciated, however, by of ordinary skill in the art of the present invention, steel provides a surface to which the sticker can very easily and permanently adhere to. As such, the bail arms 50*a, b* can also, according to another exemplary embodiment of the present invention, be manufactured from a high strength plastic, that can also incorporate the micro-bumps 134*a-f*. FIG. 56 illustrates a bail arm 50 with micro-bumps 134 that can be used with the containers shown in FIGS. 1 through 10 and 25 through 40. A bail arm 50 manufactured from steel or another metal can also have the micro-bumps 134.

FIGS. 20-22 illustrate a pair of containers 100 and 100' that are nearly fully nested (FIG. 20), partially nested (FIG. 21) and substantially un-nested (FIG. 22) with respect to one another. The containers in FIGS. 20-22 can also be container 200 according to an embodiment of the present invention. In FIG. 20, container 100' (the upper container) is nearly fully nested in container 100 (the lower container). In order to achieve the nearly fully nested configuration, the bail arms 50*a, b* of the lower container 100 are located in the nearly fully nested position, i.e., on bail arm saddles 23*a, b*. By locating the bail arms 50*a, b* on the bail arm saddles 23*a, b* the bail arms 50*a, b* of the first container 100 are completely out of the way of the second container 100' so that it can fit within the first container 100 as much as possible.

In FIG. 21, container 100' (the upper container) is partially nested with respect to container 100 (the lower container). In order to achieve the partially nested configuration, the bail arms 50*a, b* of the lower container 100 are located in respective pairs of inner notches 36*a, d* and 36*c, d*. By locating the bail arms 50*a, b* on the respective pairs of inner notches 36*a, d* and 36*c, d*, the bail arms 50*a, b* of the first container 100 are positioned to interface with the first and second inner bail arm grooves 102*a, b*. In the partially nested configuration, the inner bail arm groove curved end piece 105*a-d*, as shown in FIG. 15, substantially prevents tipping should multiple containers 100, 200 be stacked on top of one another. The dimensions of the inner bail arm groove curved end piece 105*a-d* are such that they cause the upper container 100' to neatly fit into a lower container 100, so that there is little or no movement between the upper and lower containers 100', 100. As a result, tipping is prevented be prohibiting the upper containers 100' from being continuously stacked on one side to form an arc, whereupon once a certain number of heavily laden containers 100' were stacked, tipping could occur.

In FIG. 22, container 100' (the upper container) is substantially un-nested with respect to container 100 (the lower container). In order to achieve the substantially un-nested configuration, the bail arms 50*a, b* of the lower container 100 are located in respective pairs of outer notches 34*a, d* and 34*c, d*. By locating the bail arms 50*a, b* on the respective pairs of outer notches 34*a, d* and 34*c, d*, the bail arms 50*a, b* of the first container 100 are positioned to interface with the first and second outer bail arm grooves 99*a, b*. In the substantially un-nested configuration, the outer bail arm groove curved end piece 104*a-d*, as shown in FIG. 15, substantially prevents tipping should multiple containers 100, 200 be stacked on top of one another, as described above in regard to FIG. 21 and the partially nested configuration. The dimensions of the outer bail arm groove curved end piece 104*a-d* are such that they cause the upper container 100' to neatly fit into a lower container 100, so that there is little or no movement between the upper and lower containers 100', 100. As a result, tipping is prevented be prohibiting the upper containers 100' from being continuously stacked on one side to form an arc, whereupon once a certain number of heavily laden containers 100' were stacked, tipping could occur.

FIGS. 44-46 illustrate a pair of containers 400 and 400' that are nearly fully nested (FIG. 44), partially nested (FIG. 21) and substantially un-nested (FIG. 22) with respect to one another. FIGS. 44-46 are substantially identical to FIGS. 20-22 in regard to containers 100, 200, except that in FIGS. 44-46 with containers 400, 500, the receptacle is a slot shaped receptacle 45. The containers in FIGS. 44-46 can also be container 500 according to an embodiment of the present invention. In FIG. 44, container 400' (the upper container) is nearly fully nested in container 400 (the lower container). In order to achieve the nearly fully nested configuration, the bail arms 50*a, b* of the lower container 400 are located in the nearly fully nested position, i.e., on bail arm saddles 23*a, b*. By locating the bail arms 50*a, b* on the bail arm saddles 23*a, b* the bail arms 50*a, b* of the first container 400 are completely out of the way of the second container 400' so that it can fit within the first container 400 as much as possible.

In FIG. 45, container 400' (the upper container) is partially nested with respect to container 400 (the lower container). In order to achieve the partially nested configuration, the bail arms 50*a, b* of the lower container 400 are located in respective pairs of inner notches 36*a, d* and 36*c, d*. By locating the bail arms 50*a, b* on the respective pairs of inner notches 36*a, d* and 36*c, d*, the bail arms 50*a, b* of the first container 400 are positioned to interface with the first and second inner bail arm grooves 102*a, b*. In the partially nested configuration, the inner bail arm groove curved end piece 105*a-d*, as shown in FIG. 15, substantially prevents tipping should multiple containers 100, 200 be stacked on top of one another. The dimensions of the inner bail arm groove curved end piece 105*a-d* are such that they cause the upper container 400' to neatly fit into a lower container 400, so that there is little or no movement between the upper and lower containers 400', 400. As a result, tipping is prevented be prohibiting the upper containers 400' from being continuously stacked on one side to form an arc, whereupon once a certain number of heavily laden containers 400' were stacked, tipping could occur.

In FIG. 46, container 400' (the upper container) is substantially un-nested with respect to container 400 (the lower container). In order to achieve the substantially un-nested configuration, the bail arms 50*a, b* of the lower container 400 are located in respective pairs of outer notches 34*a, d* and 34*c, d*. By locating the bail arms 50*a, b* on the respective pairs of outer notches 34*a, d* and 34*c, d*, the bail arms 50*a, b* of the first container 400 are positioned to interface with the first and second outer bail arm grooves 98*a, b*. In the substantially un-nested configuration, the outer bail arm groove curved end piece 104*a-d*, as shown in FIG. 15, substantially prevents tipping should multiple containers 400, 600 be stacked on top of one another, as described above in regard to FIG. 45 and the partially nested configuration. The dimensions of the outer bail arm groove curved end piece 104*a-d* are such that they cause the upper container 400' to neatly fit into a lower container 400, so that there is little or no movement between the upper and lower containers 400', 400. As a result, tipping is prevented be prohibiting the upper containers 400' from being continuously stacked on one side to form an arc, whereupon once a certain number of heavily laden containers 400' were stacked, tipping could occur.

Figure 24A:
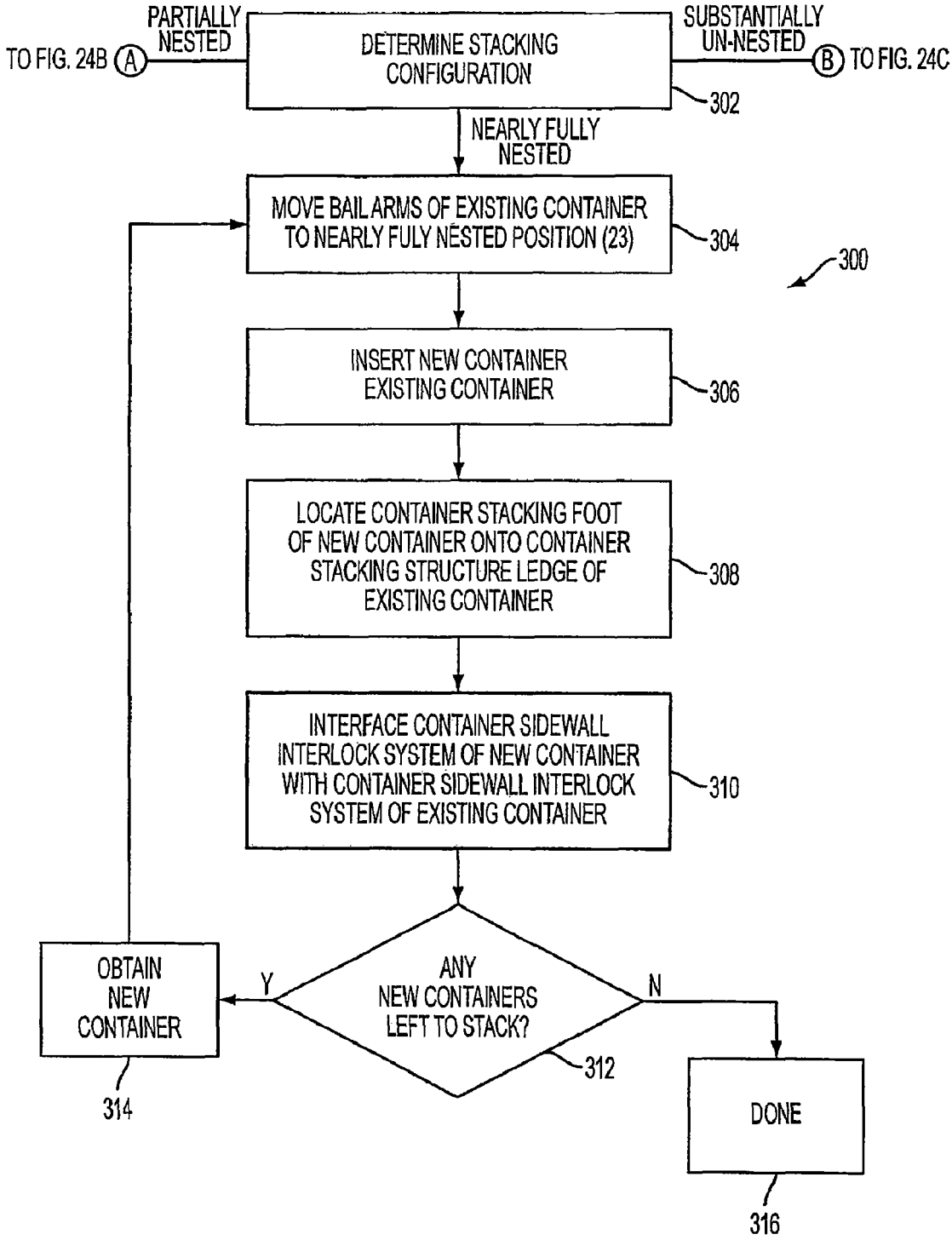
FIGS. 24A-24C illustrate a method for using a plurality of the containers shown in FIGS. 1 through 10 according to an embodiment of the present invention.
Figure 24B:
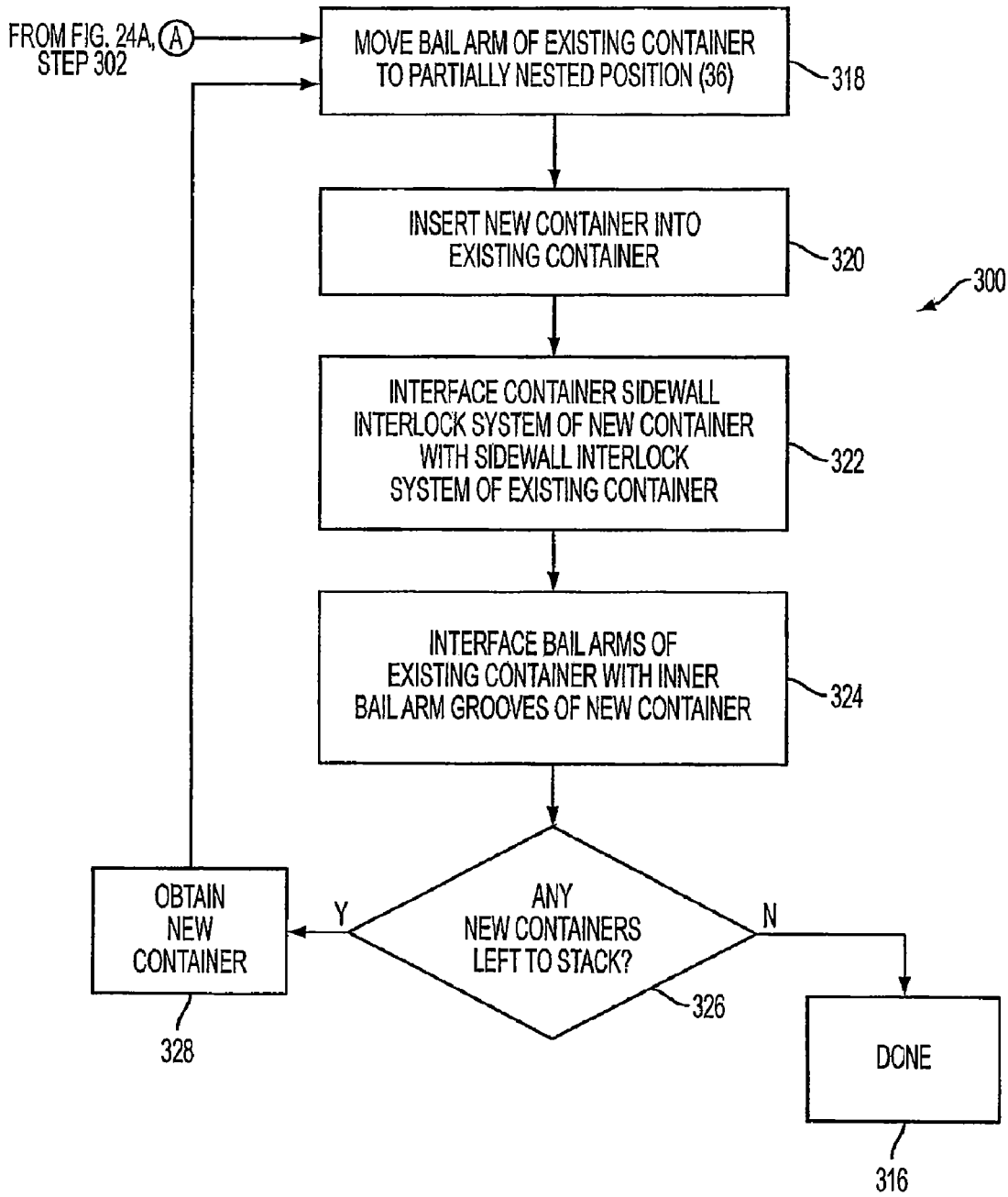
Figure 24C:
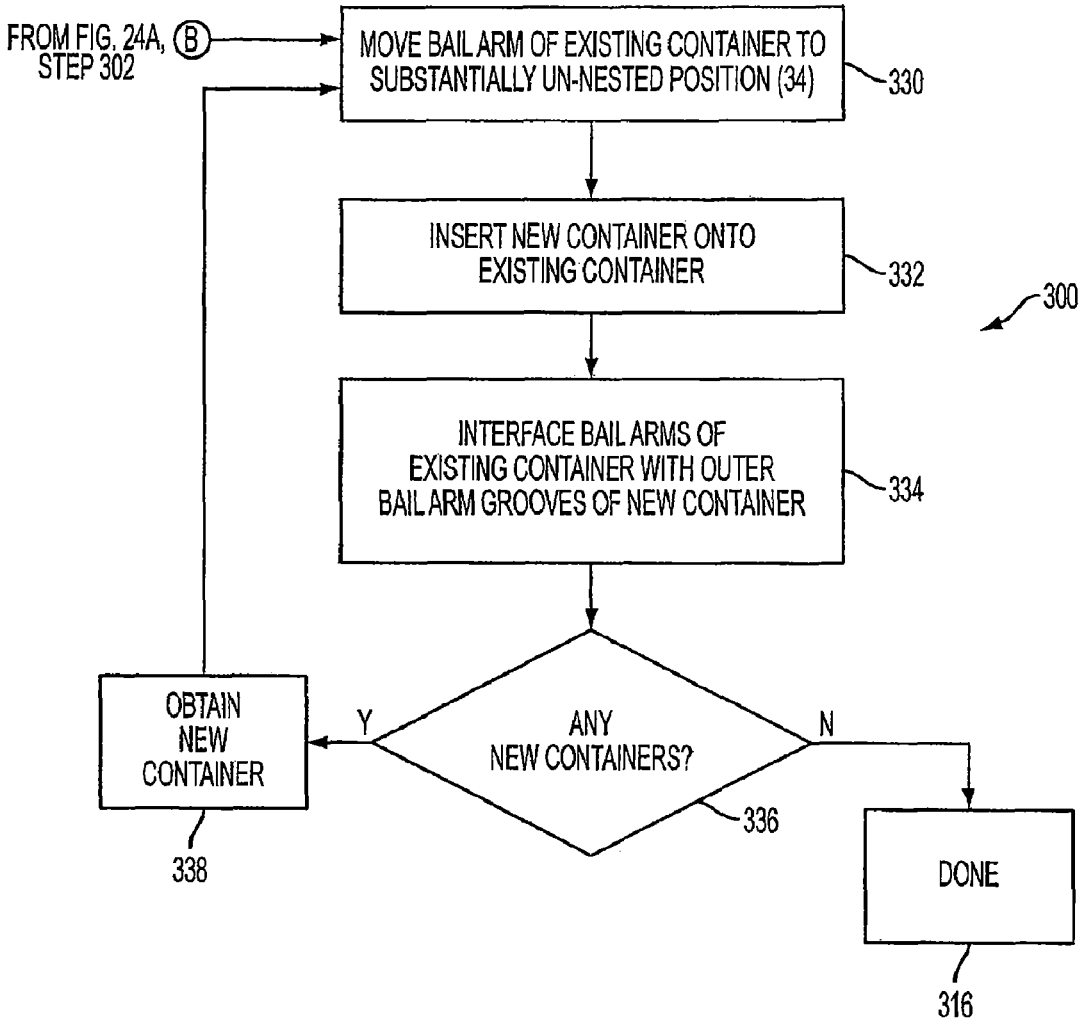
Figure 25:
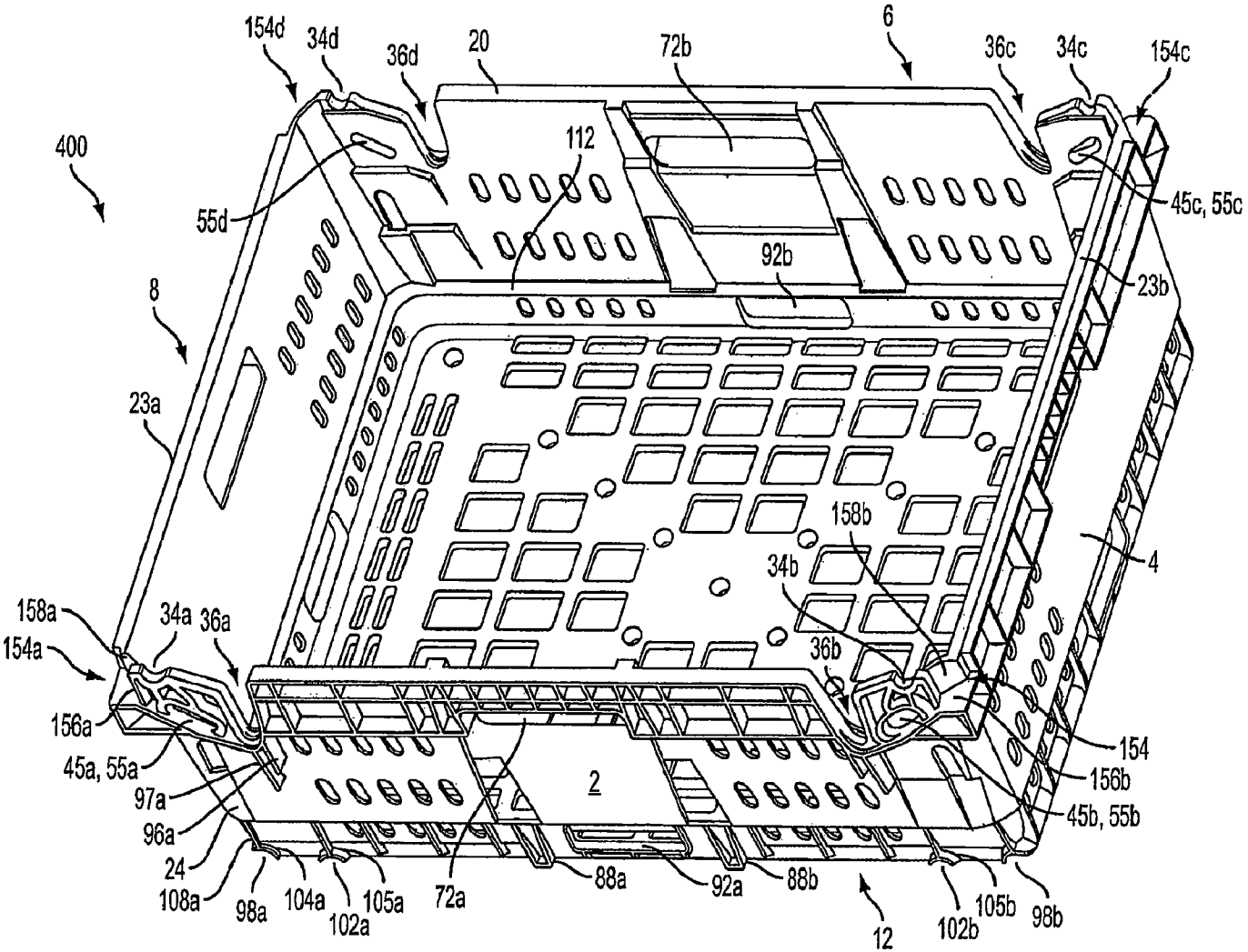
FIG. 25 illustrates a front perspective view of a multiple nestable stacking container according to another embodiment of the present invention.
Figure 26:
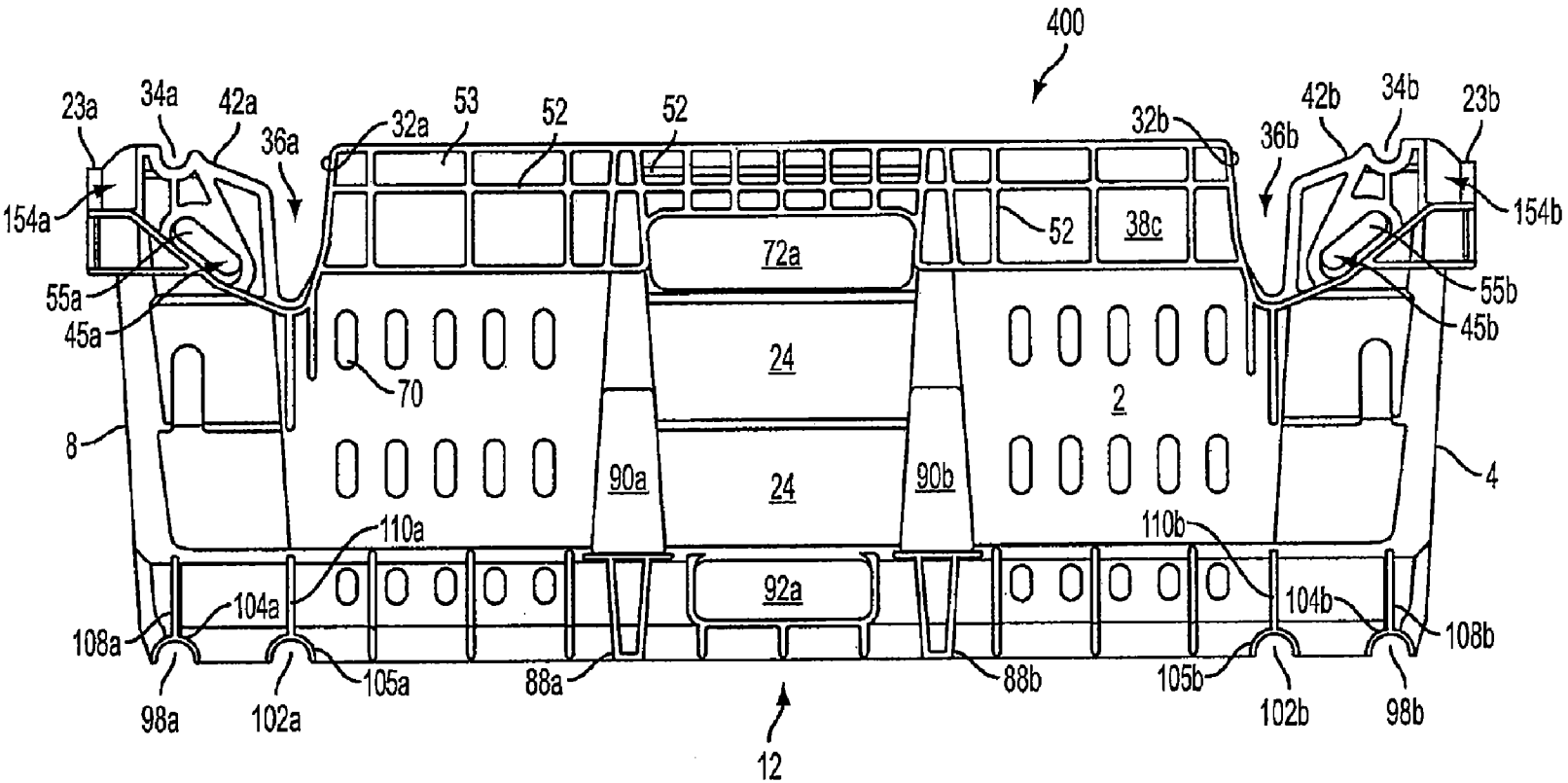
FIG. 26 illustrates a front view of the container shown in FIG. 25.
Figure 27:
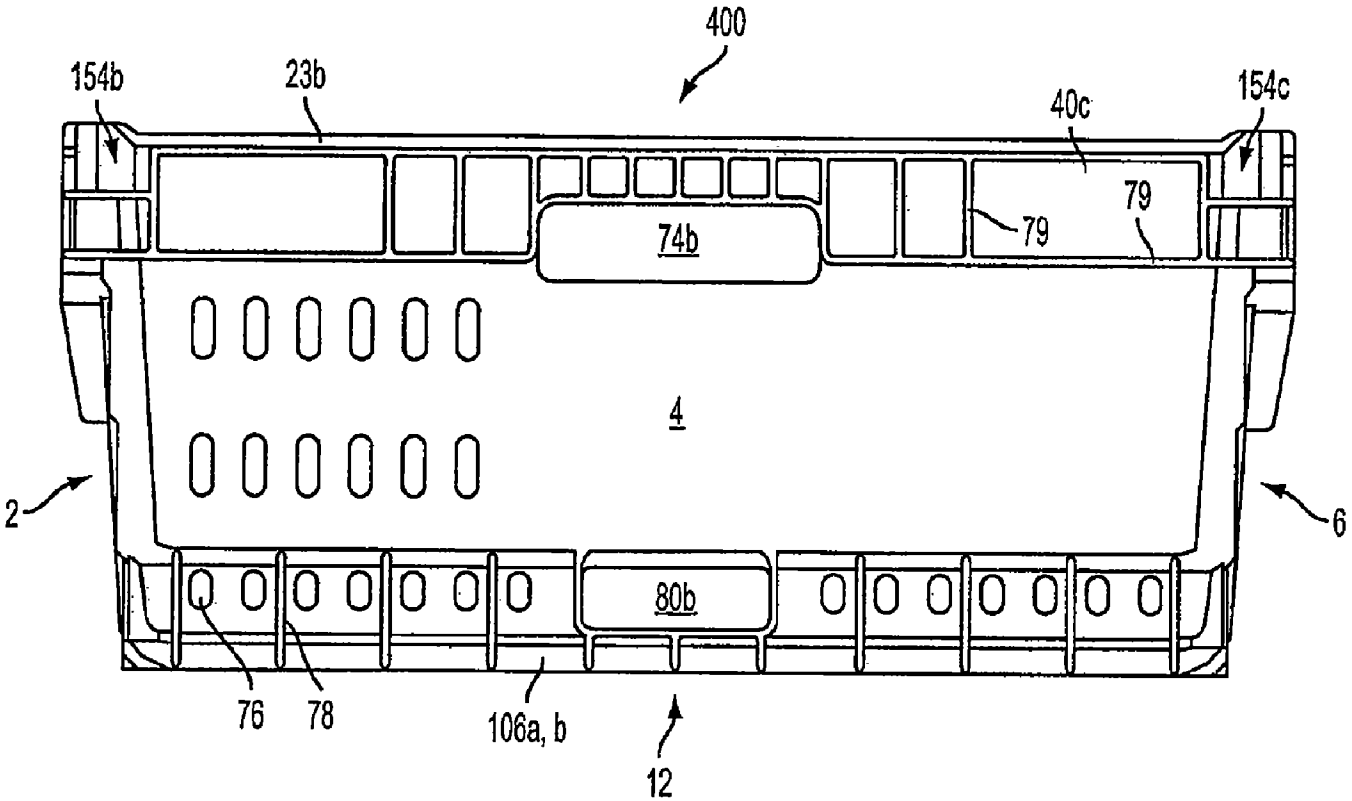
FIG. 27 illustrates a right side view of the container shown in FIG. 25.
Figure 28:
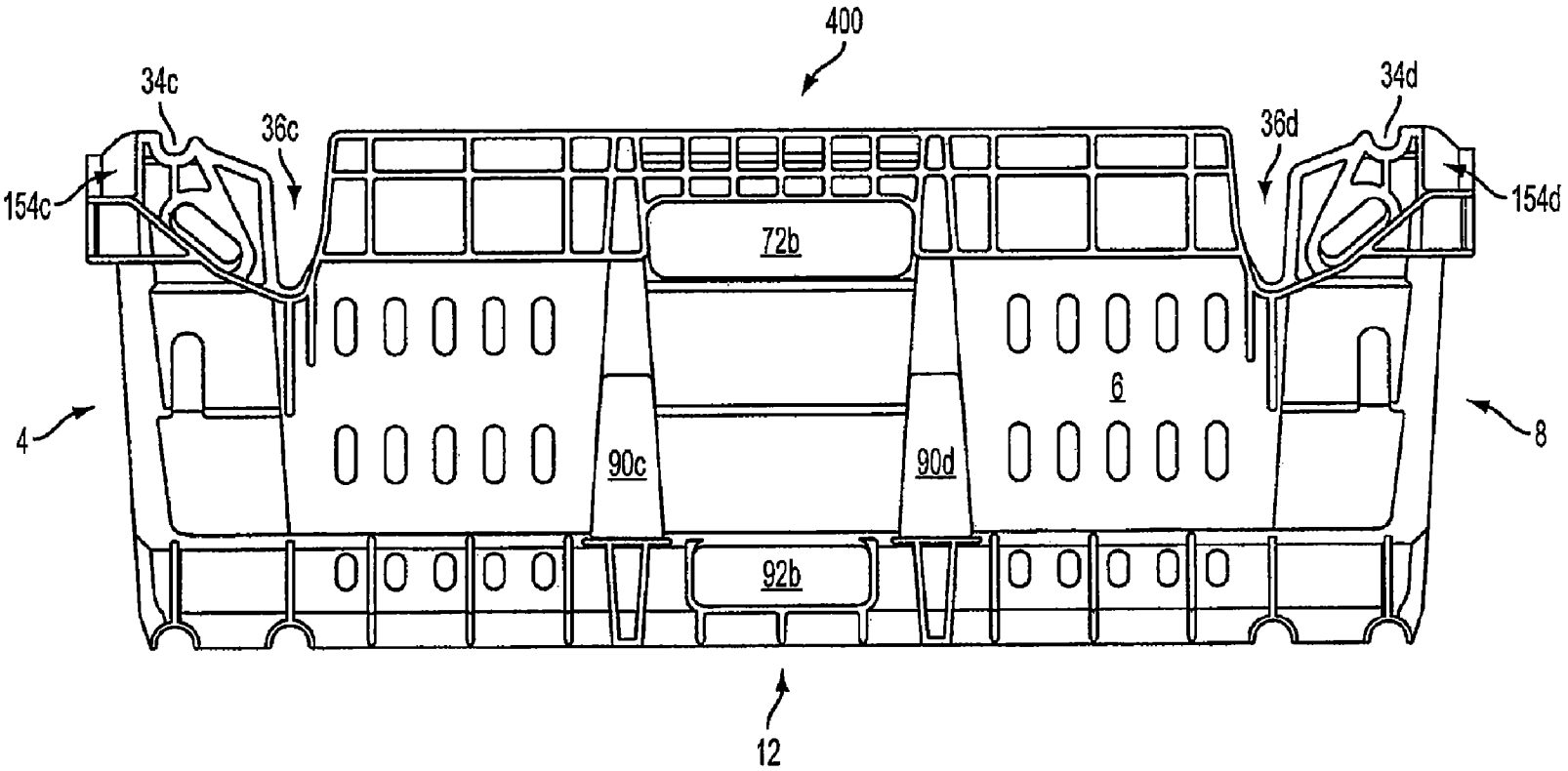
FIG. 28 illustrates a back side view of the container shown in FIG. 25.
Figure 29:
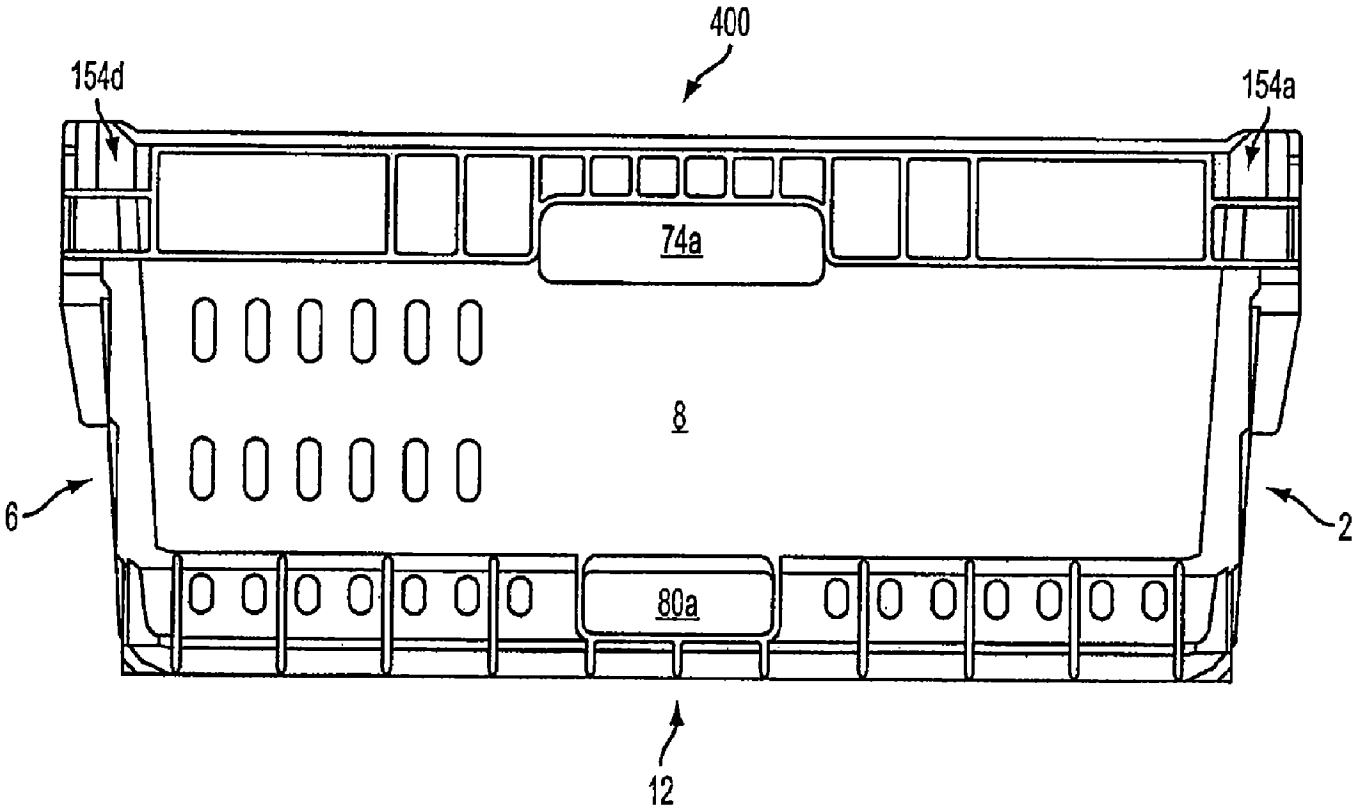
FIG. 29 illustrates a left side view of the container shown in FIG. 25.
Figure 30:
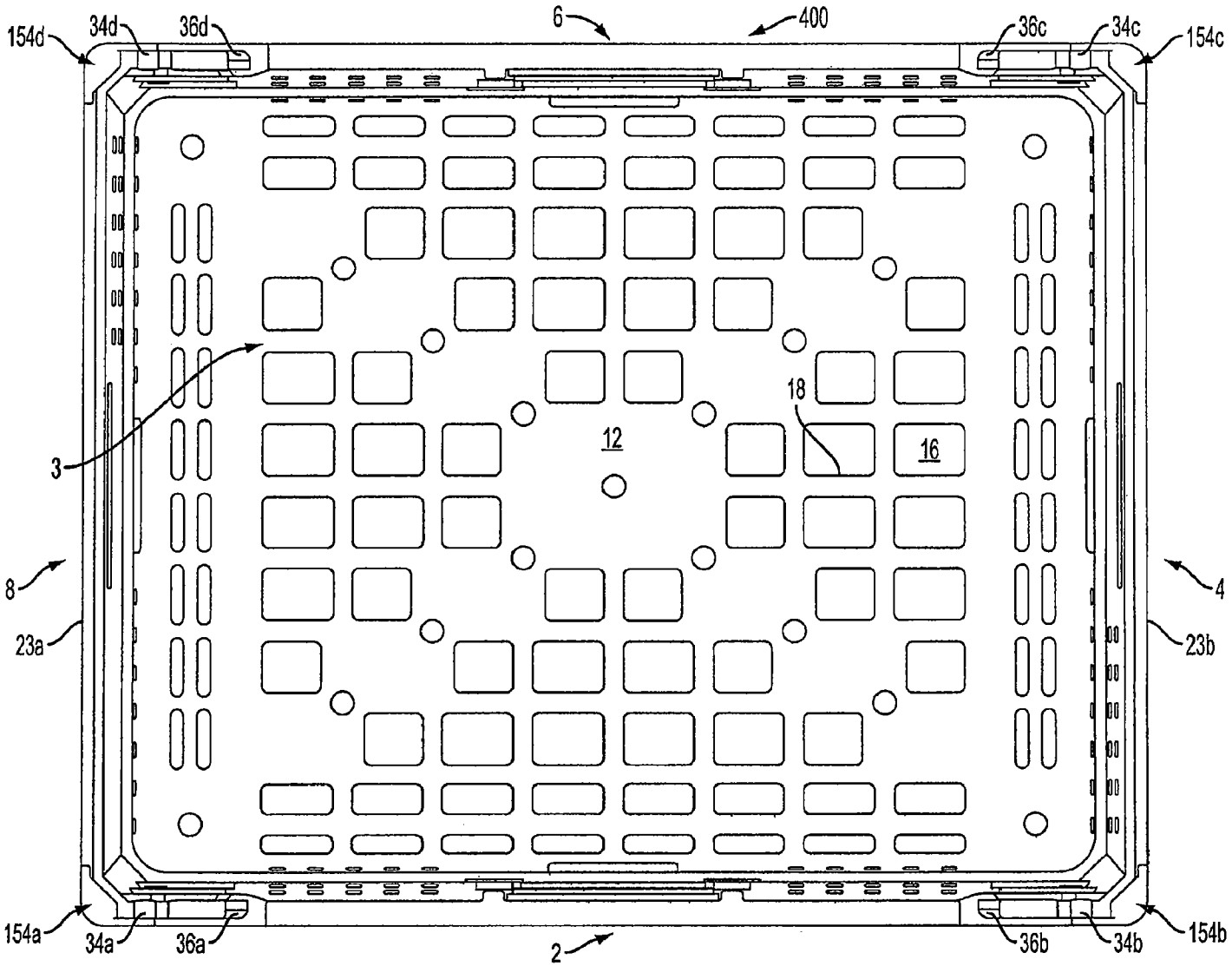
FIG. 30 illustrates a top view of the container shown in FIG. 25.
Figure 31:
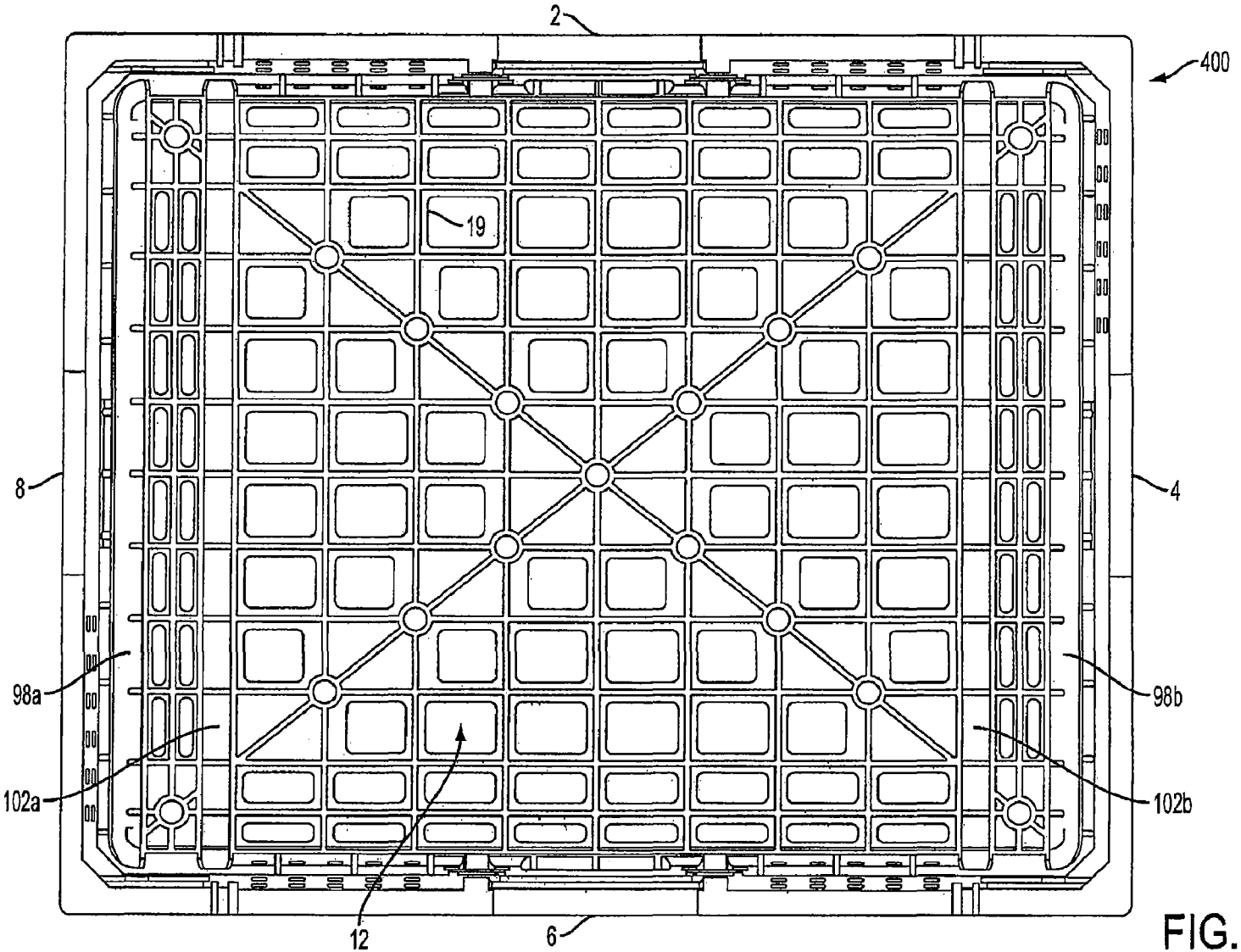
FIG. 31 illustrates a bottom view of the container shown in FIG. 25.
Figure 32:
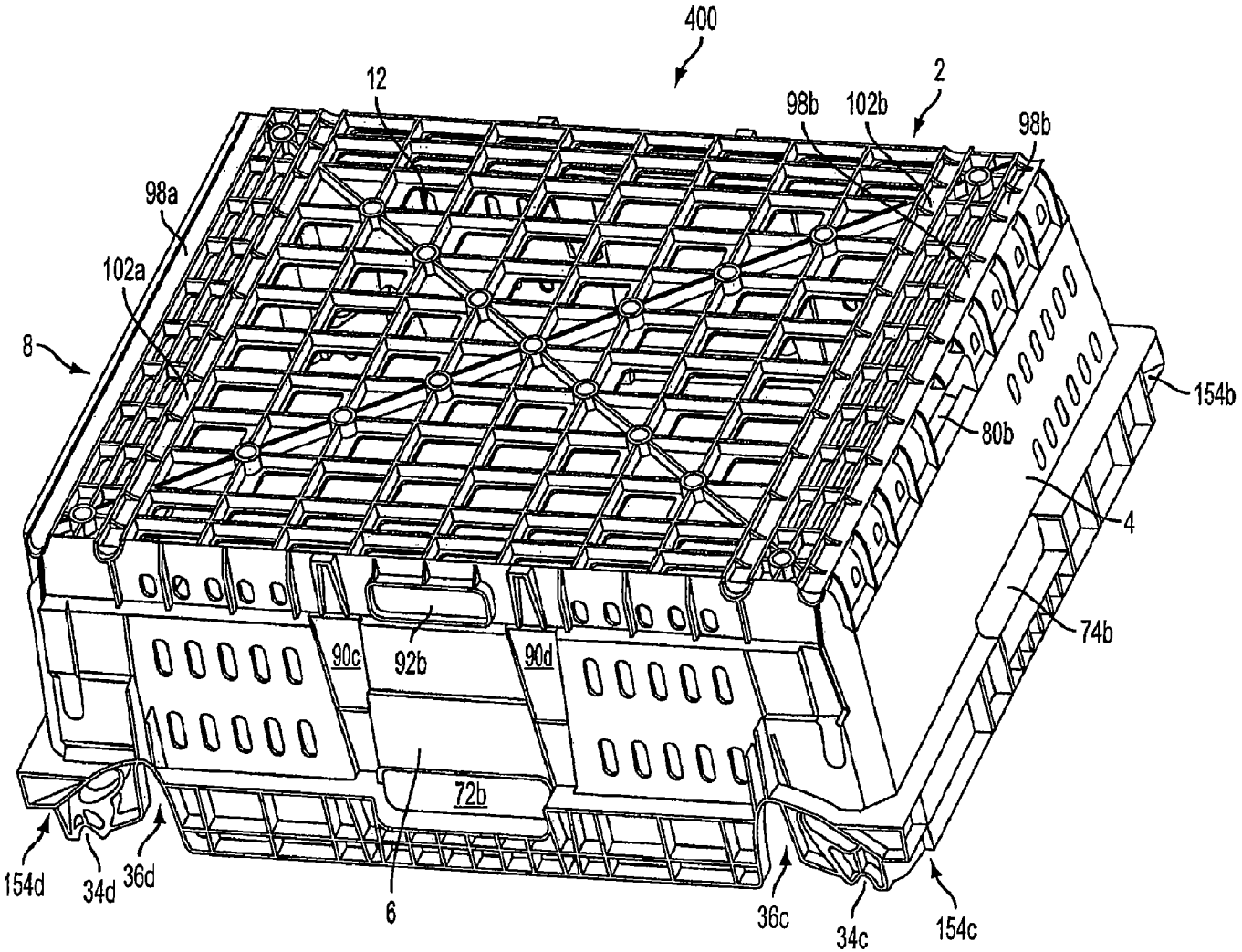
FIG. 32 illustrates a bottom perspective view of the container shown in FIG. 25.
Figure 33:
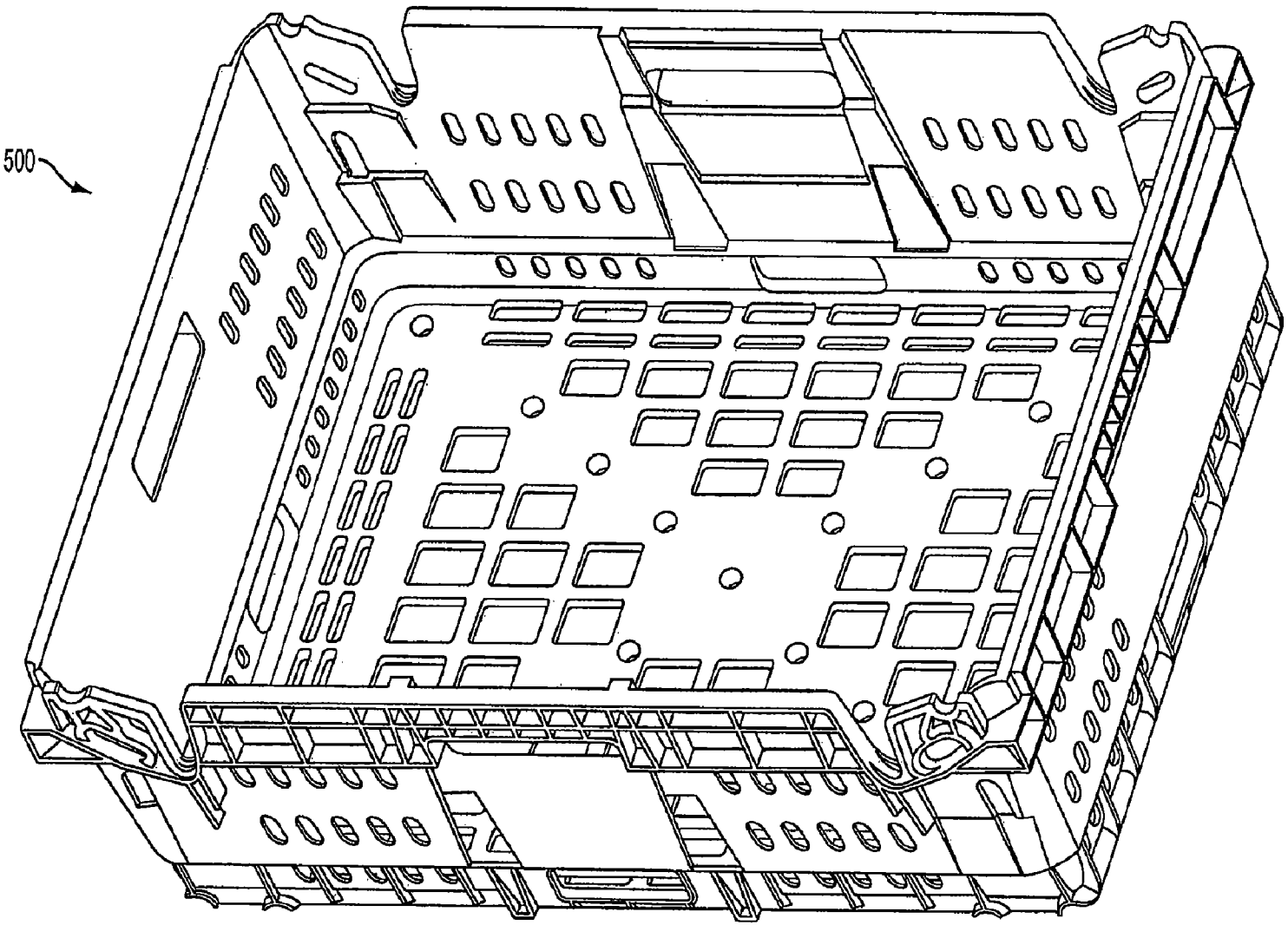
FIG. 33 illustrates a front perspective view of a multiple nestable stacking container according to still another embodiment of the present invention.
Figure 34:
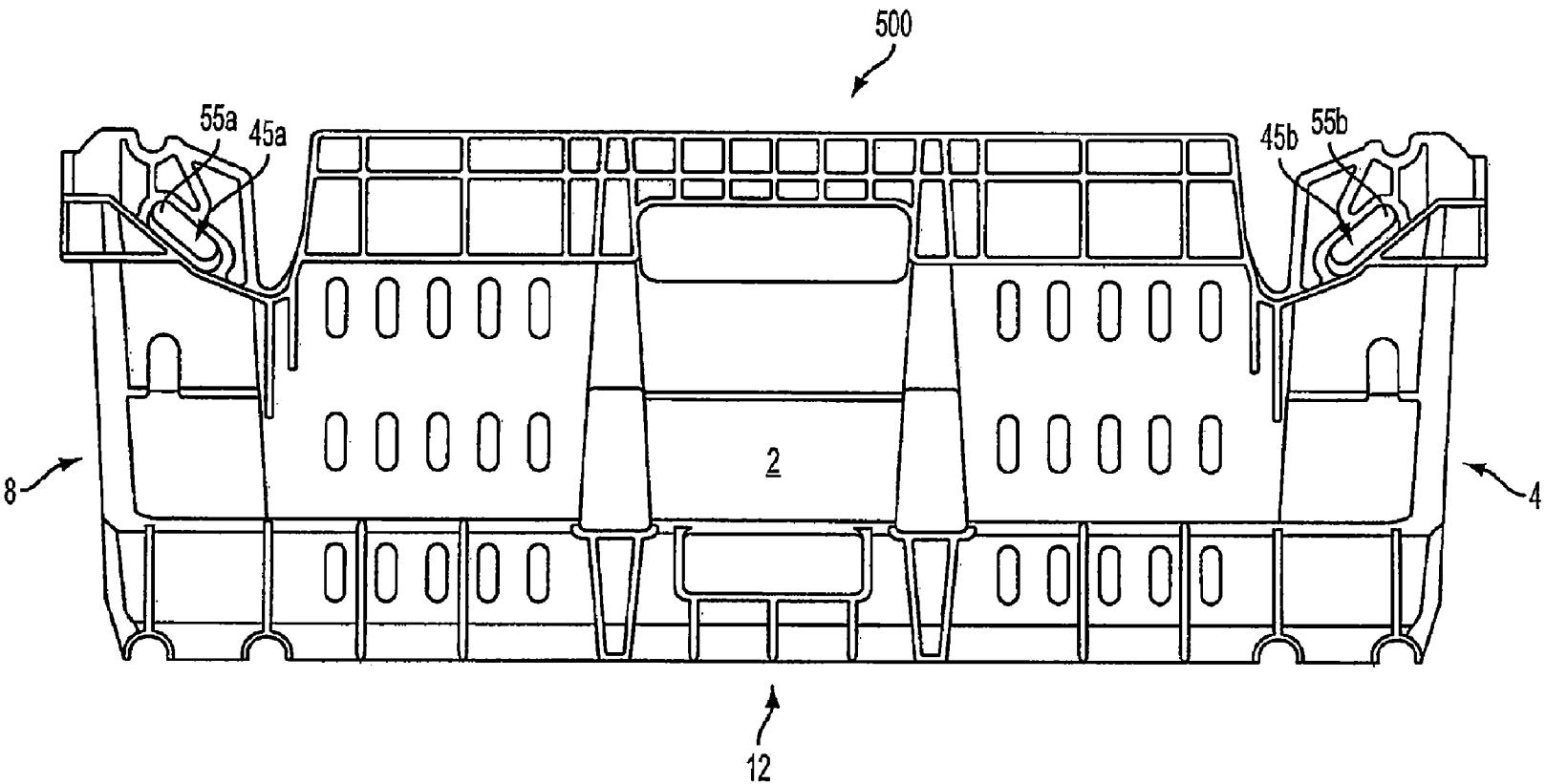
FIG. 34 illustrates a front view of the container shown in FIG. 33.
Figure 35:
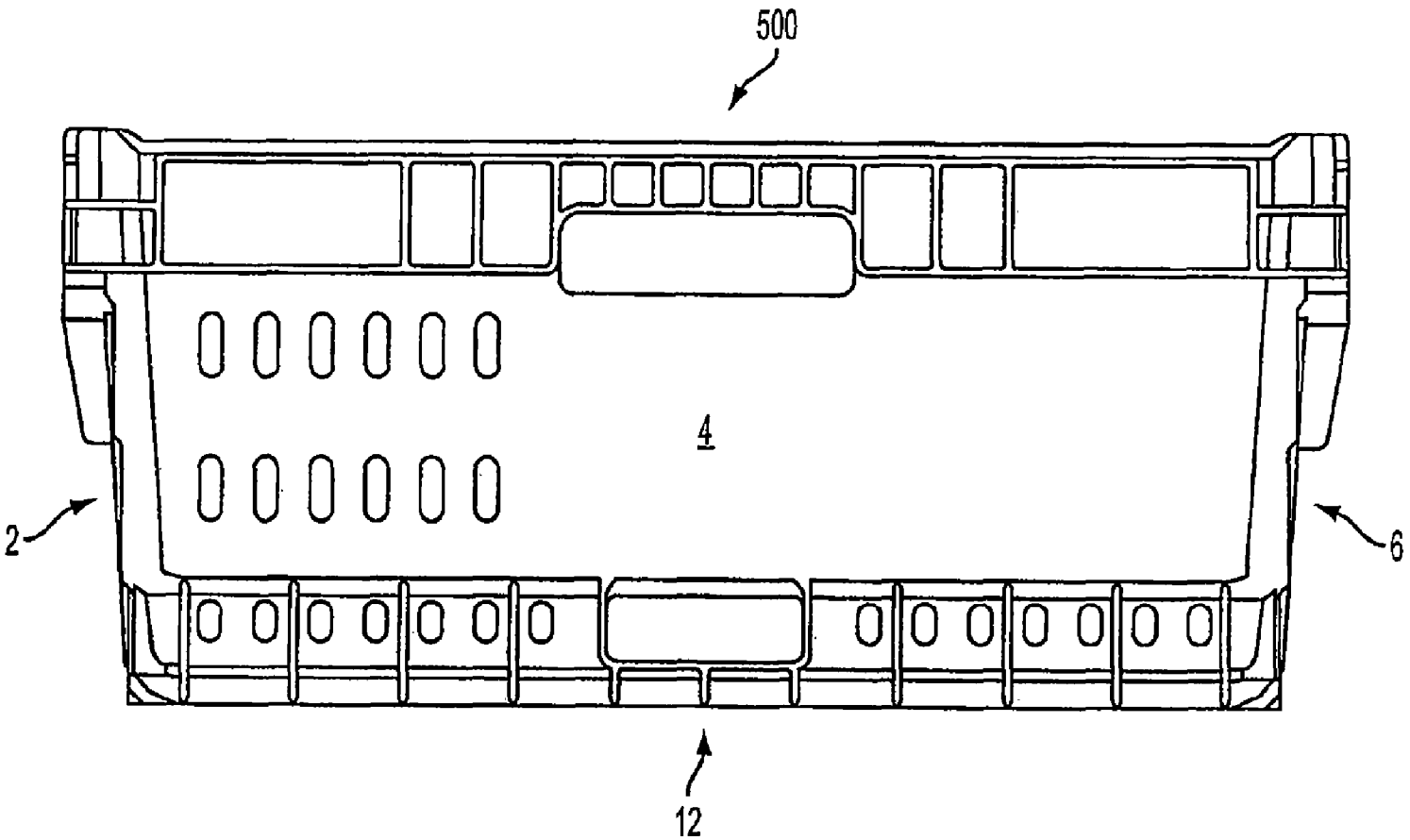
FIG. 35 illustrates a right side view of the container shown in FIG. 33.
Figure 36:
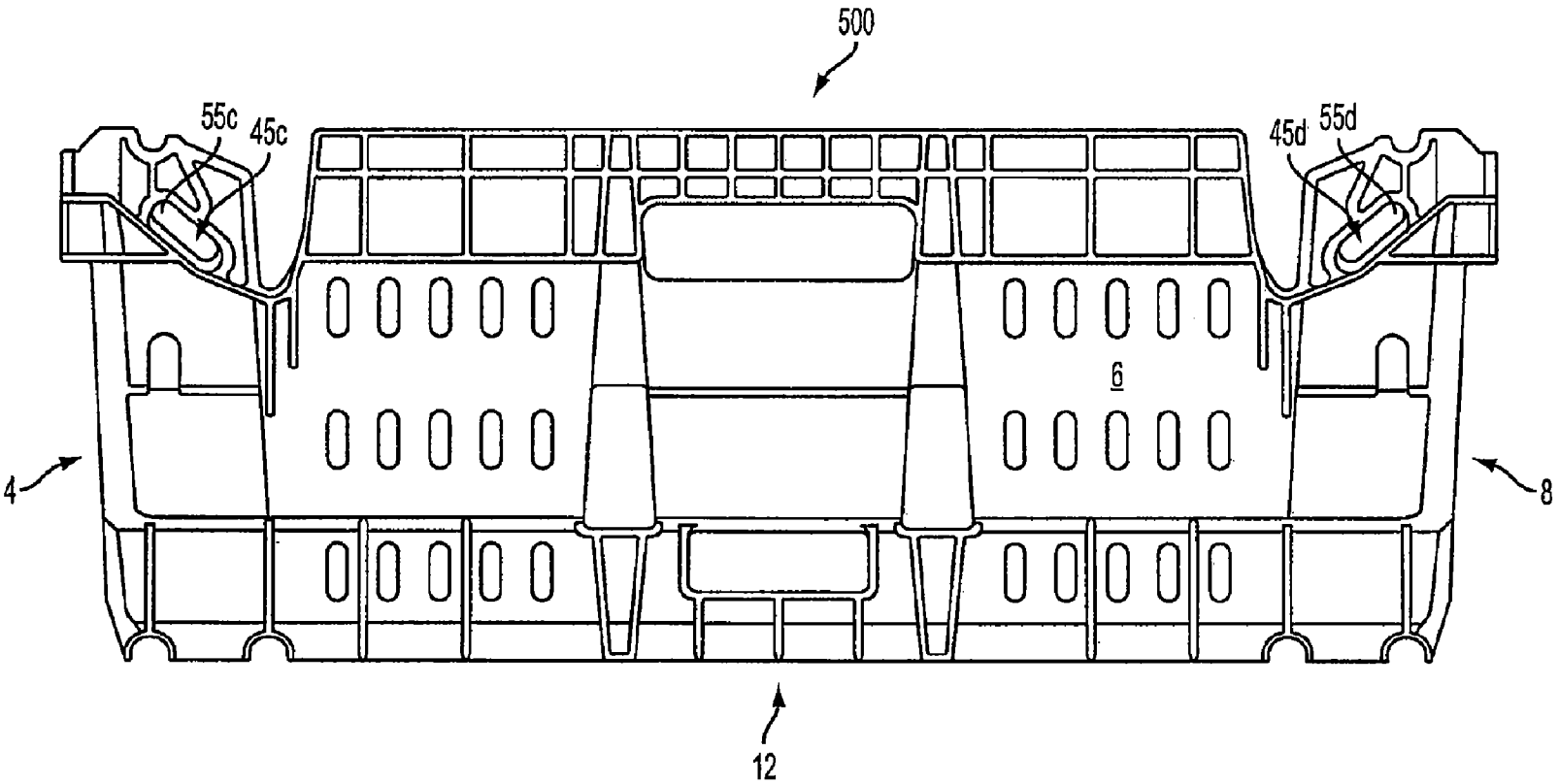
FIG. 36 illustrates a back side view of the container shown in FIG. 33.
Figure 37:
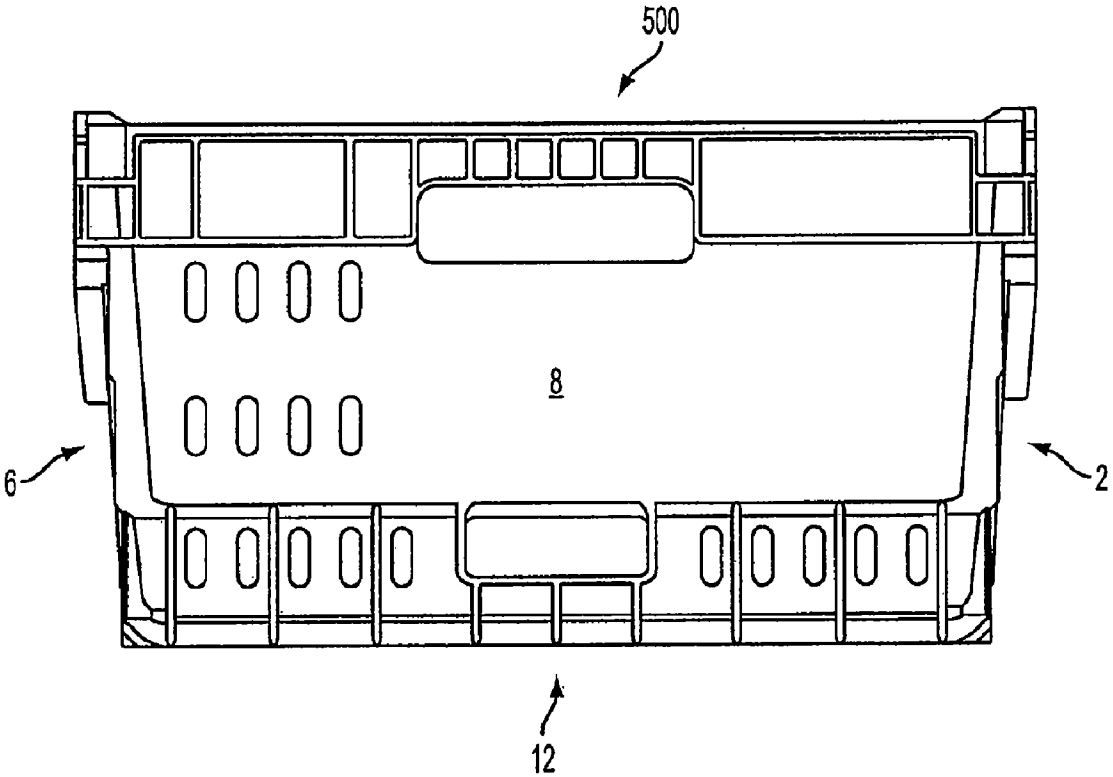
FIG. 37 illustrates a left side view of the container shown in FIG. 33.
Figure 38:
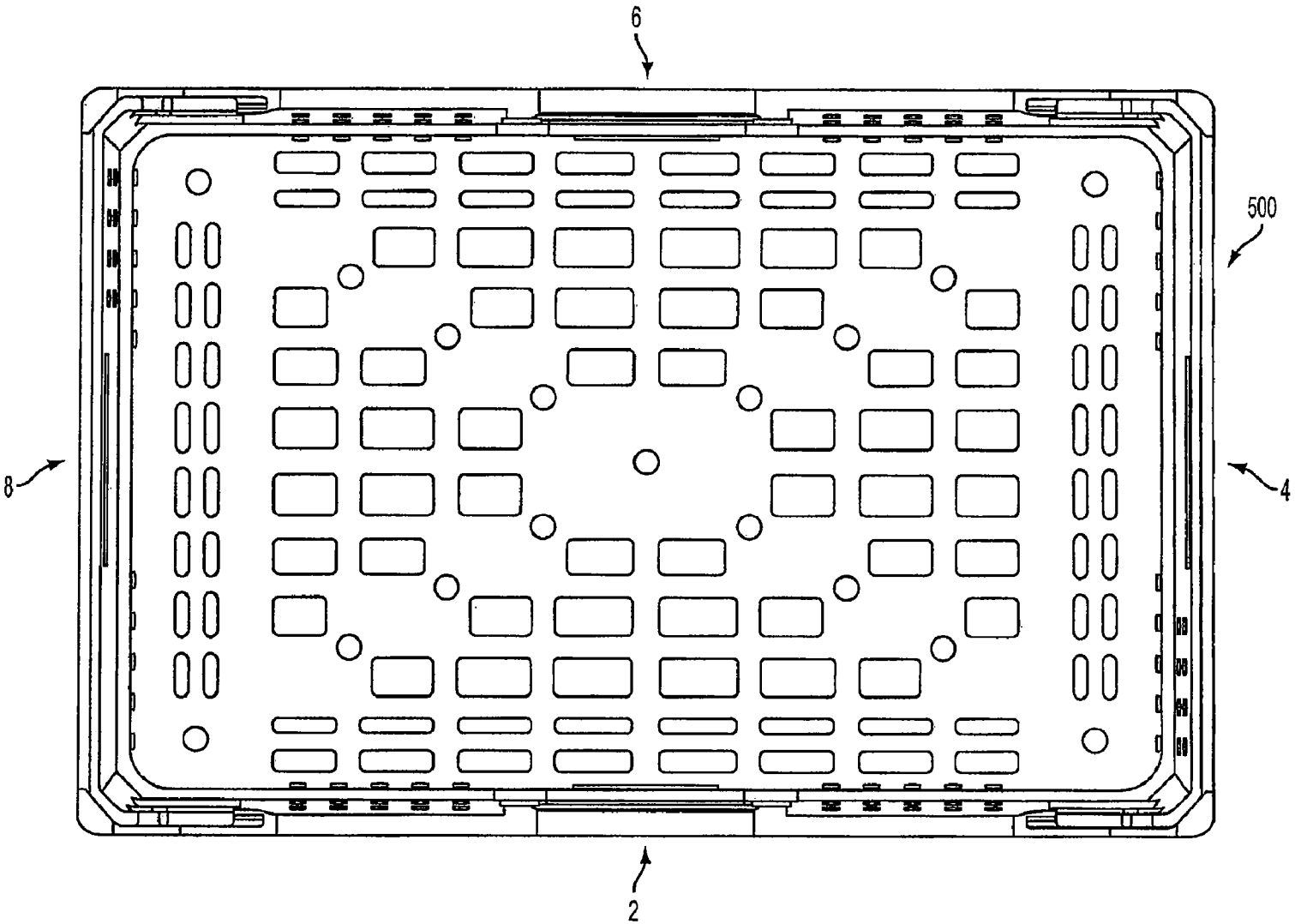
FIG. 38 illustrates a top view of the container shown in FIG. 33.
Figure 39:
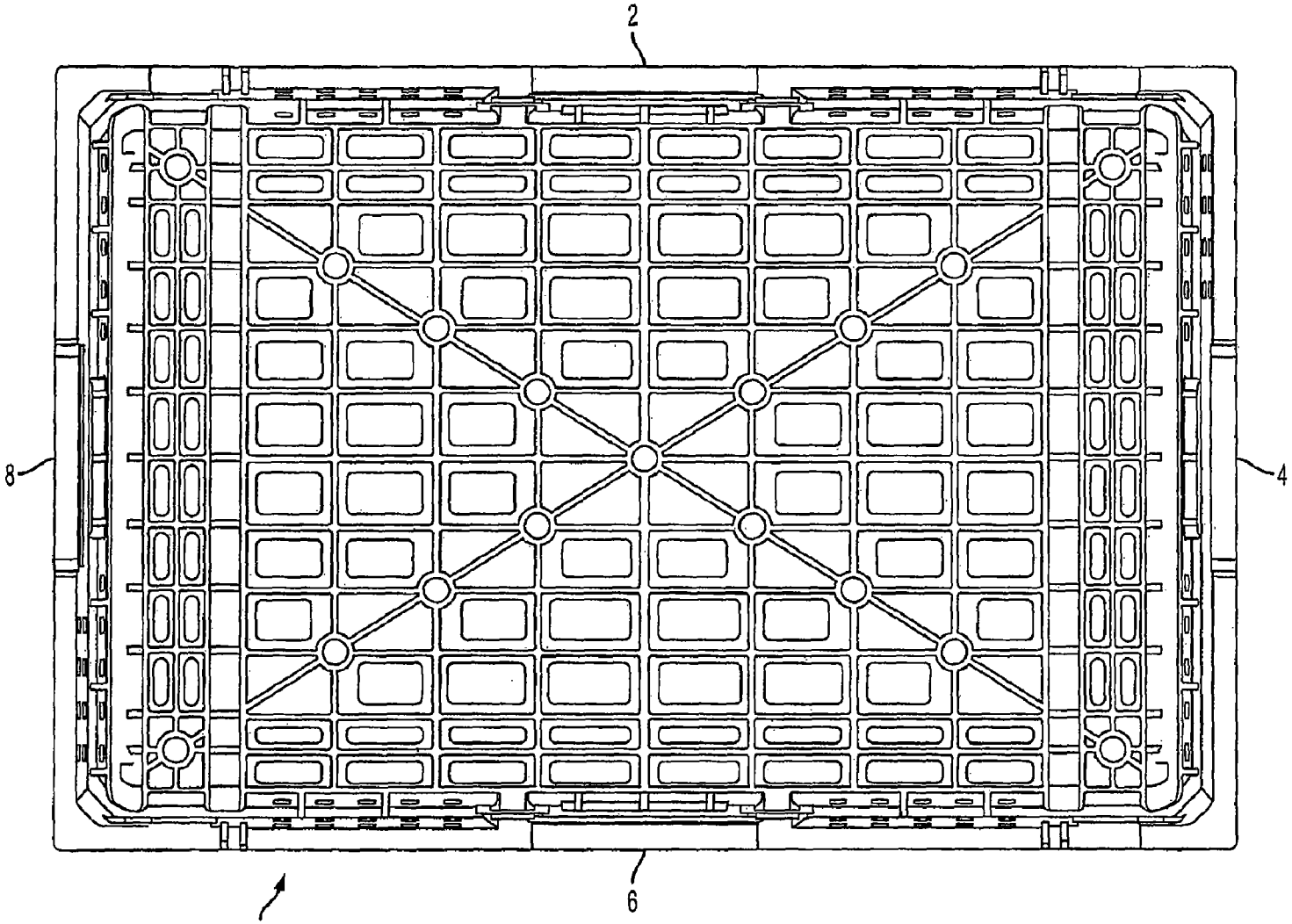
FIG. 39 illustrates a bottom view of the container shown in FIG. 33.
Figure 40:
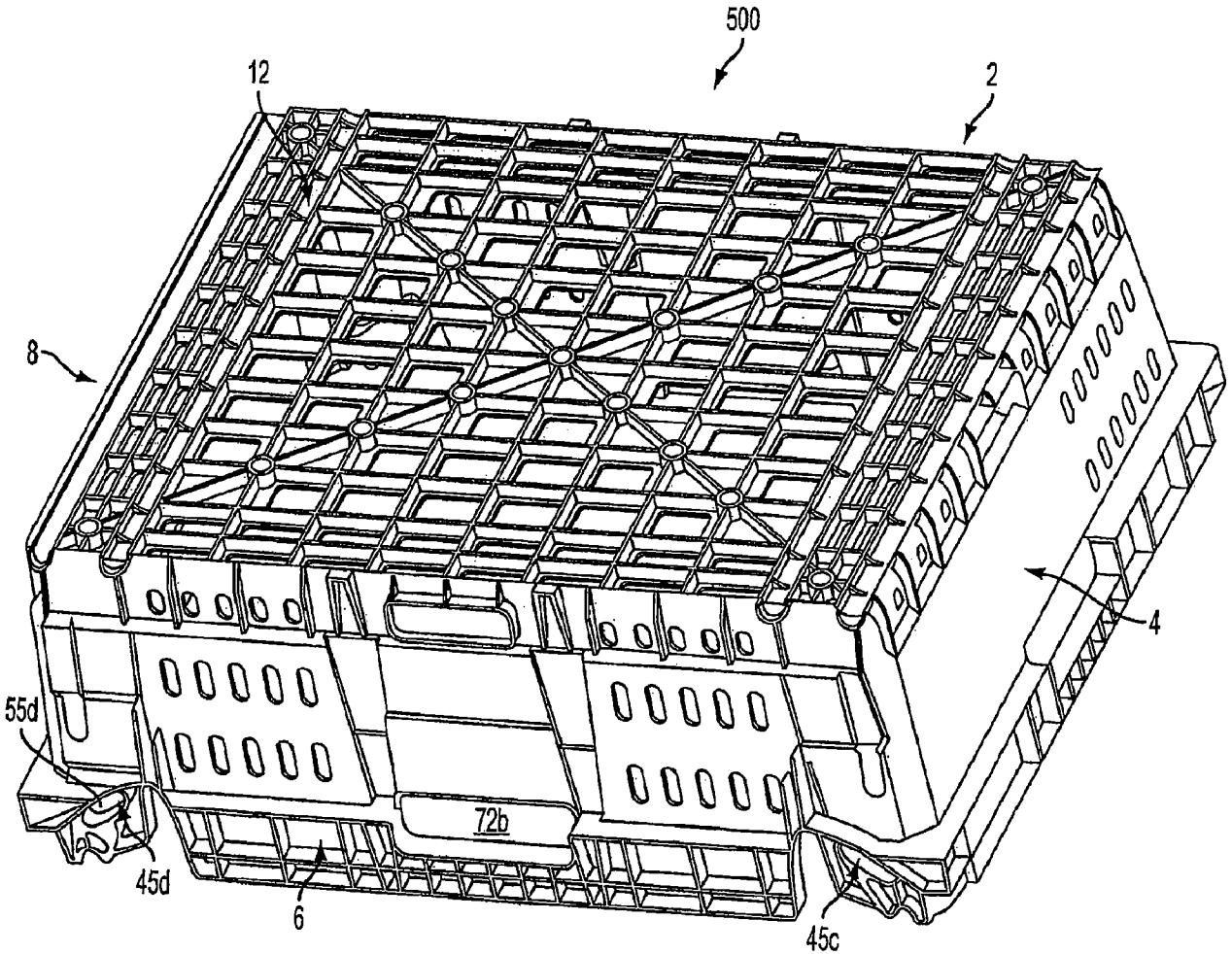
FIG. 40 illustrates a bottom perspective view of the container shown in FIG. 33.

FIGS. 24A-24C illustrate an exemplary method for using a plurality of containers 100 according to an embodiment of the present invention. Method 300, illustrated in FIGS. 24A-24C, begins with decision step 302. In decision step 302, a decision is made as to how the containers should be stacked. There are three possible stacking configurations, as decision step 302 reflects: the containers can be stacked in either a partially nested, substantially un-nested, or nearly fully nested configuration. If the containers are to be stacked in a nearly fully nested configuration, the user follows the nearly fully nested path to step 304. If the containers are to be stacked in an partially nested configuration, the user follows the partially nested path to step 318 in FIG. 24B. If the containers are to be stacked in a substantially un-nested configuration, the user follows the substantially un-nested path to step 330 in FIG. 24C. Each configuration will be discussed in turn.

In FIG. 24A, the user has decided to stack the containers 100 in a nearly fully nested configuration ("Nearly Fully Nested" path from decision step 302). Then, in step 304, the user moves the bail arms 50*a*, 50*b* of an existing container 100 to a nearly fully nested position, wherein the bail arms 50*a*, 50*b* are placed on the bail arm saddle 23*a*, 23*b* located on the top of the endwalls 4, 8, respectively. An example of the bail arms 50*a*, 50*b* in a nearly fully nested configuration can be seen in FIGS. 12B and 13B. After the bail arms 50*a*, 50*b* of existing container 100 had been moved to the nearly fully nested position, the user inserts a new container 100' into the existing container 100. In step 308, the container stacking foot 124' of the new container 100' is located onto the container stacking structure ledge 130 of the existing container 100. This is shown in FIGS. 18 and 19. Step 310 follows step 308. In step 310, the container sidewall interlock system 132' of the new container 100' is interfaced with the container sidewall interlock system 132 of the existing container 100. This is shown in FIG. 17. After the container sidewall interlock system 132' of the new container 100' has been interfaced with the container sidewall interlock system 132 of the existing container 100, the user determines, in decision step 312, whether there any new containers 100' left to stack. If there are no new containers 100' left to stack, the method proceeds to step 316 wherein the method is finished. Otherwise, if there are any new containers 100' left to stack ("Yes" path from decision step 312), the method proceeds to step 314, and the user obtains a new container 100'. Once the user obtains a new container 100', the method returns to step 304. The previous new container 100' now becomes the existing container 100. The bail arms of the existing container 100 (the "old" new container) are moved to the nearly fully nested position on the bail arm saddles 23A, 23B (and the process repeats itself).

Referring now to FIG. 24B, an exemplary method for stacking containers in a partially nested configuration is shown. Method 300 for stacking containers in a partially nested configuration proceeds from decision step 302 to step 318 when the user determines to put the containers in a partially nested configuration ("Partially Nested" path from decision step 302). In step 318, the user moves the bail arms 50*a*, 50*b* of the existing container 100 to the partially nested position, which is the first and second pairs of inner-notches 36*a*, 36*b*. This is shown in FIGS. 12D, 13D, and 21. Following step 318, the user inserts the new container 100' into the existing container 100. In step 322, the user interfaces the container sidewall interlock system 132' of the new container 100' with the sidewall interlock system 132 of the existing container 100. In step 324, the bail arms 50*a*, 50*b* of the existing container 100 are mated with the inner bail arm grooves 102*a'*, 102*b'* of the new container 100'. Following step 324, the user determines, in decision step 326, whether any new containers are left to stack. If no new containers are left to stack, the user is done as shown in step 316 ("No" path from decision step 326). If, however, there are new containers left to stack, the user obtains a new container 100' in step 328 ("Yes" path from decision step 326) and the method returns to step 318. The previous new container 100 now becomes the existing container 100. The bail arms 50*a*, 50*b* of the existing container 100 (the "old" new container) are moved to the partially nested position, which is the first and second pairs of inner-notches 36*a*, 36*b* (and the process repeats itself beginning at step 318).

Referring now to FIG. 24C, an exemplary method 300 for stacking containers in a substantially un-nested position is shown. Method 300 for stacking containers in a substantially un-nested configuration proceeds from decision step 302 to step 330 when the user determines to put the containers in the substantially un-nested configuration ("Substantially Un-Nested" path from decision step 302). In step 330, the user moves the bail arms 50*a*, 50*b* of an existing container 100 to the substantially un-nested position, which is the first and second pair of outer notches 34*a*, 34*b*. This shown in FIGS. 12C and 12D. Following step 330, the user inserts the new container 100' onto the existing container 100 in step 332. Then, in step 334, the user interfaces the bail arms 50*a*, 50*b* of the existing container 100 with the outer bail arm grooves 98*a*', 98*b*' of the new container 100'. Then, in decision step 336, the user determines whether there are any new containers to stack. If there are no new containers to stack, the method proceeds to step 316 wherein the method is finished ("No" path from decision step 336). If, however, the user determines that there are new containers to stack, the method proceeds to step 338, wherein the user obtains a new container ("Yes" path from decision step 336). After the user obtains a new container 100, the method proceeds to step 330. The previous new container 100' now becomes the existing container 100. The bail arms 50*a*, 50*b* of the existing container 100 (the "old" new container) are moved to the substantially un-nested position, which is the first and second pair of outer notches 34*a*, 34*b* (and the process repeats itself beginning at step 330).

As one of ordinary skill in the art can appreciate, it is possible to stack the containers in one or more of the three different configurations in any one column. The user can decide to stack the containers in any two configurations, or all three, in any order desired. Thus, the method described above can be slightly modified to include this option. Referring to FIGS. 24A, 24B and 24C, instead of returning to steps 304, 318 and 330 following step 312, 326 and 336, respectively, the method can return to step 302 following steps 312, 326 and 336. This would effectively cause the user to determine what configuration the next new container 100' should be stacked in. Of course, what might be possible may not be practical; if the previous container was filled with product, then it might not be practical to then decide to put the next new container 100' in a fully nested position in the existing container 100 (that is filled with product). Furthermore, as one of ordinary skill in the art can appreciate, the method 300 described above for stacking containers 100 applies equally as well to stacking a plurality of containers 200, 400 and 500.

FIGS. 25-40 illustrate various views of a multiple nestable stacking container according to an alternate embodiment of the present invention. Containers 400, 500, shown in various views in FIGS. 25-40, are referred to as a "4down" slot receptacle container 400 (FIGS. 25-32), and "5down" slot shaped receptacle container 500 (FIGS. 33-40). The difference between containers 400, 500 and containers 100, 200 are that containers 400, 500 have a slot shaped receptacle 45*a-d*, as described herein, according to an alternative embodiment of the present invention. In all other matters, containers 400, 500 are substantially similar to containers 100, 200, respectively. FIGS. 25-32 illustrate a top front perspective view, front view, right side view, back view, left side view, top view, bottom view, and a bottom perspective view of container 400. Note that all feature numbers are substantially identical to container 100 (also a "4down" container), except for the slot shaped receptacle 45*a-d*, and the slot shaped hole 55*a-d*. Similarly, FIGS. 33-40 illustrate a top front perspective view, front view, right side view, back view, left side view, top view, bottom view, and a bottom perspective view of container 500. Note that all feature numbers are substantially identical to container 200 (also a "5down" container"), except for the slot shaped receptacle 45*a-d*, and the slot shaped hole 55*a-d*. As a result, any and all features referenced to container 100 and/or 200, applies equally as well to containers 200, 400, and 500, including any of the processes and methods described herein. Therefore, for the purpose of brevity, a detailed description of containers 400, 500 will not be made.

Referring now to FIGS. 1, 2, and 41-43, a receptacle 45 feature is shown according to an embodiment of the present invention. As seen in FIGS. 41-43, but especially FIG. 41A, the receptacle 45 preferably comprises a slot shaped hole 55*b* that is defined by the outer surfaces of a receptacle inner wall 47*b*, and receptacle upper surface 56*b*. The receptacle inner wall 47*b* creates the lower part of the slot shaped receptacle 45, while receptacle upper surface defines an upper part of the slot shaped receptacle 45*b*. The receptacle inner wall 47*b* is displaced inwardly from the outer surface of the receptacle lower surface 48*b*. The plane of the outer surface of the receptacle lower surface 48*b* is substantially parallel to the plane of the sidewall exterior surface 24, in the vicinity of the slot shaped receptacle 45*b*. The receptacle upper surface 56 helps define the slot shape of the slot shaped receptacle 45 by joining the receptacle lower surface 48*b* at a receptacle upper and lower surface first intersection 58*b* and a receptacle upper and lower surface second intersection 60*b*. The outer surface of the receptacle inner wall 47*b* is also substantially parallel to the sidewall exterior surface 24 in the vicinity of the slot shaped receptacle 42.

Figure 41A:
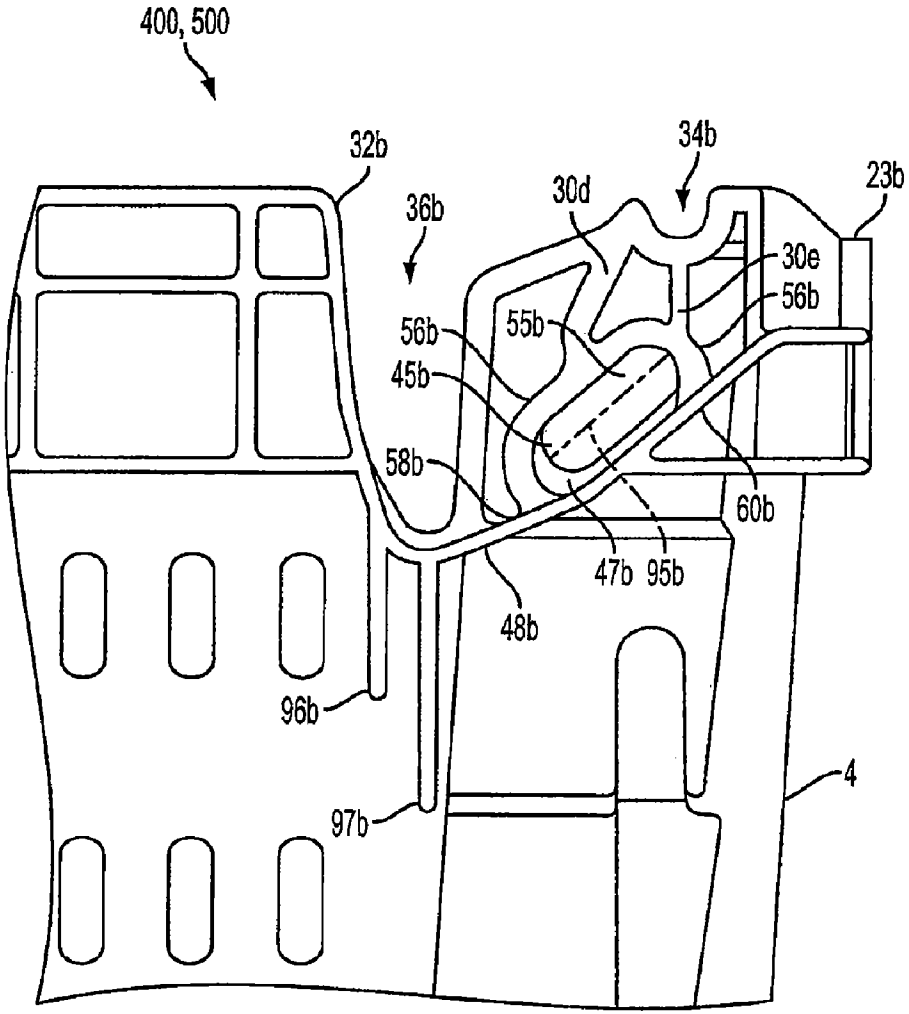
FIG. 41A illustrates a close-up front view of a second receptacle in the containers shown in FIGS. 25 through 40.
Figure 41B:
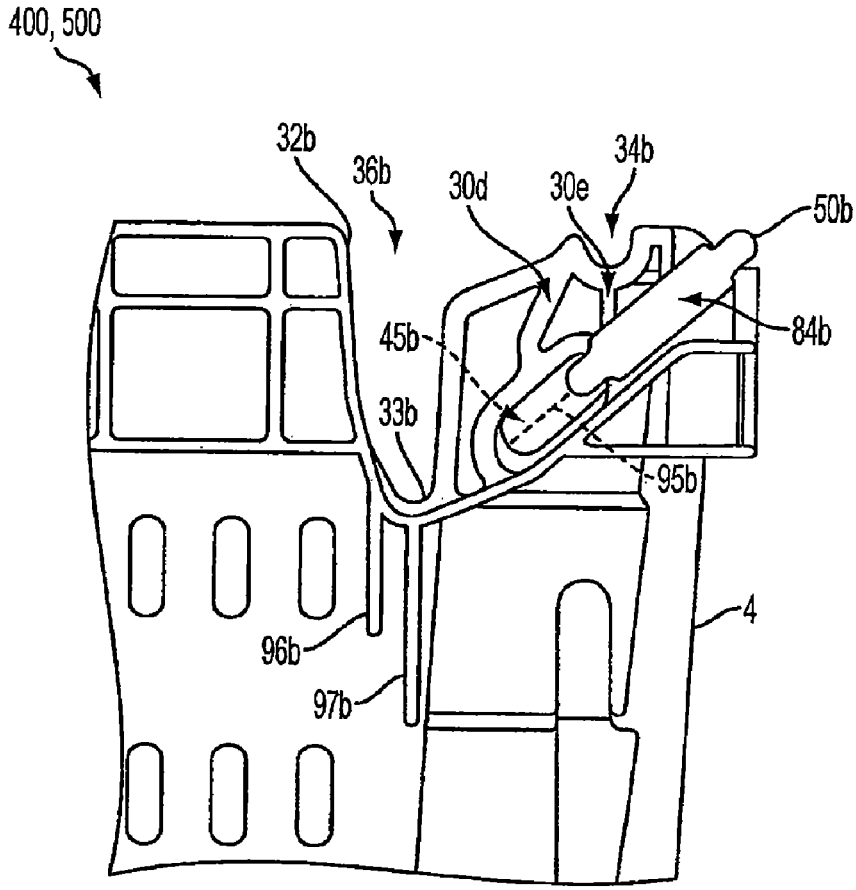
FIG. 41B illustrates the same close-up view as FIG. 41A, but with a bail arm according to an embodiment of the present invention.
Figure 41C:
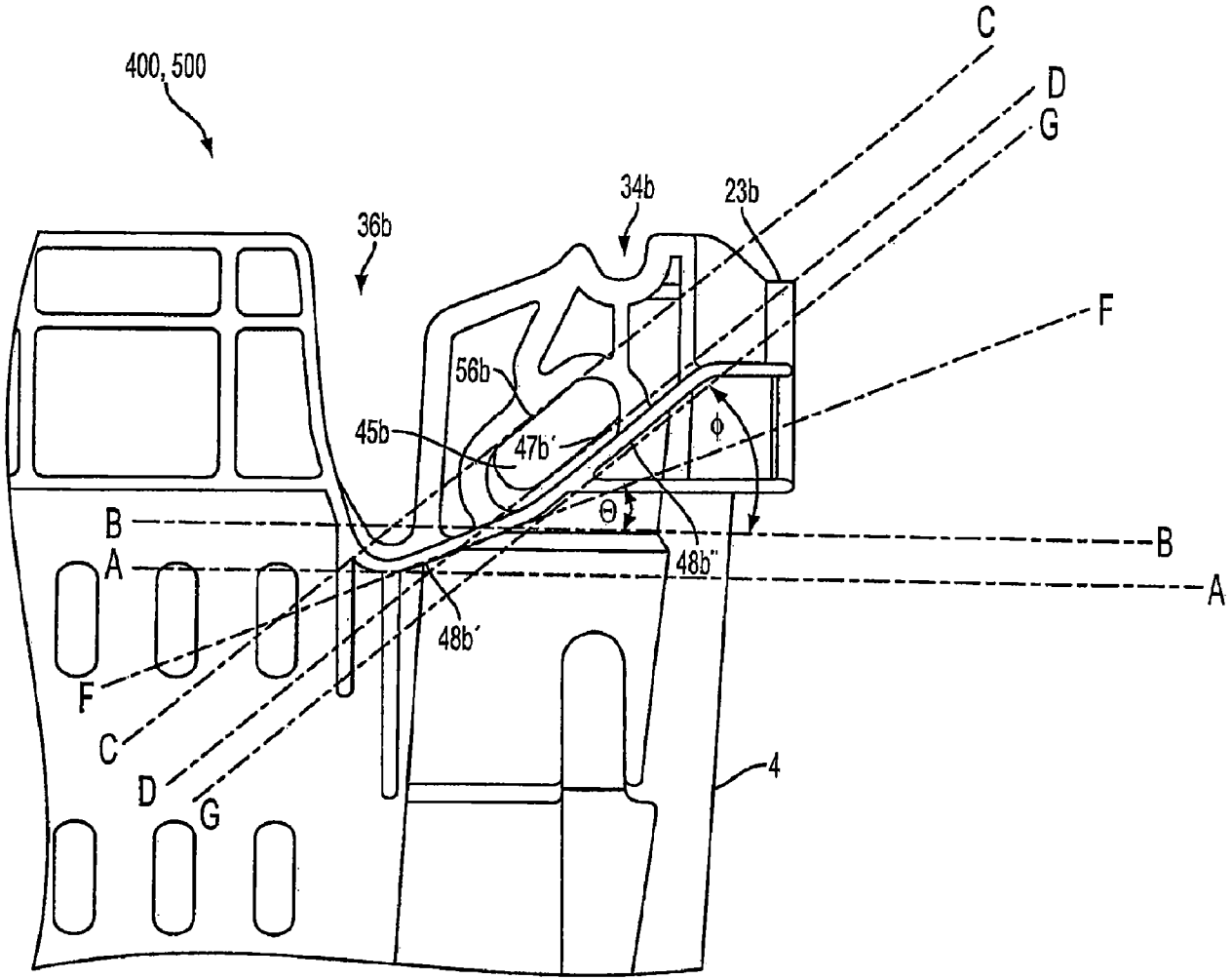
FIG. 41C illustrates an expanded view of the second receptacle in the containers shown in FIGS. 25 through 40.
Figure 41D:
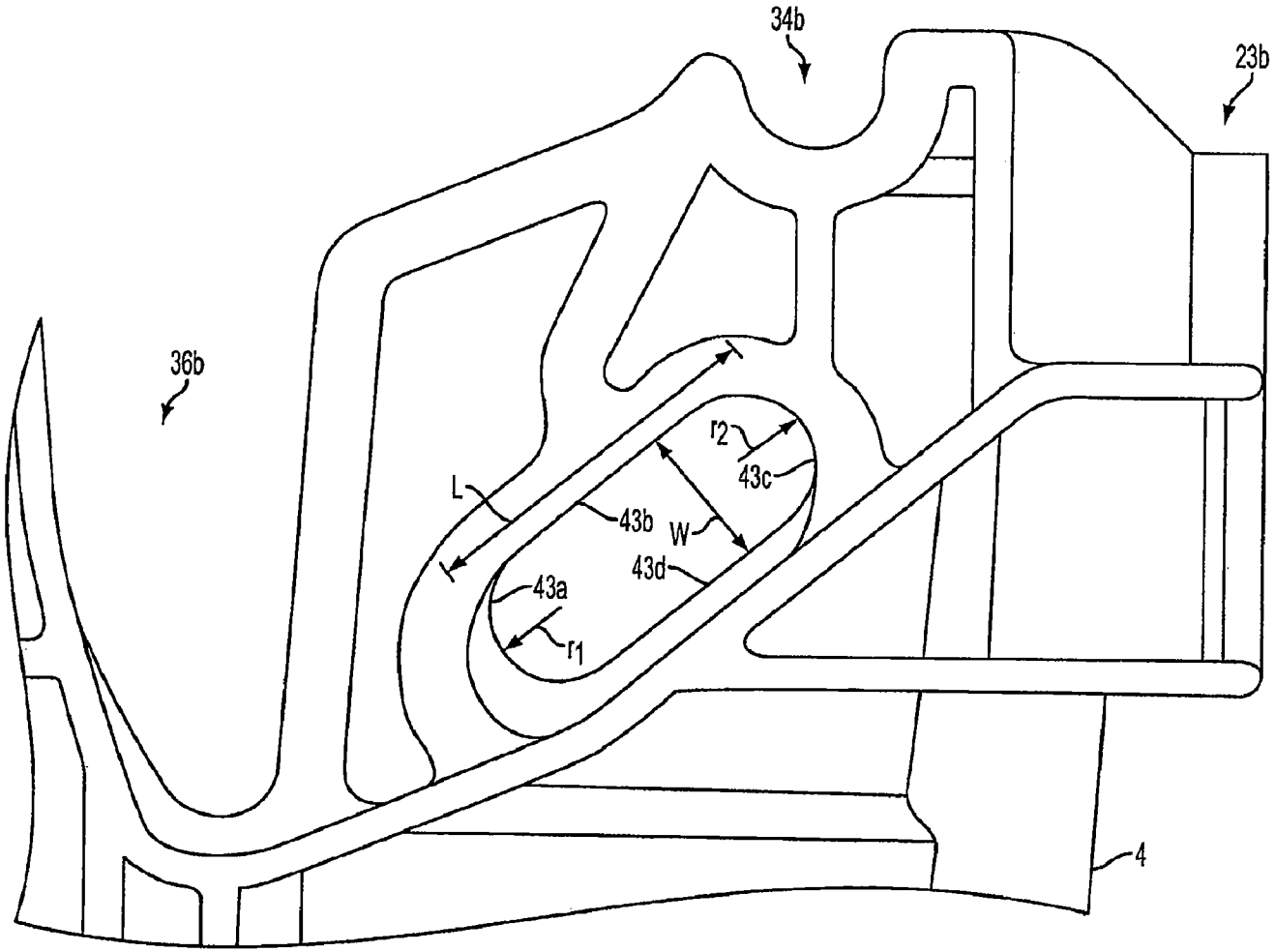
FIG. 41D illustrates a greater expanded view of the second receptacle of FIG. 41C.
Figure 42A:
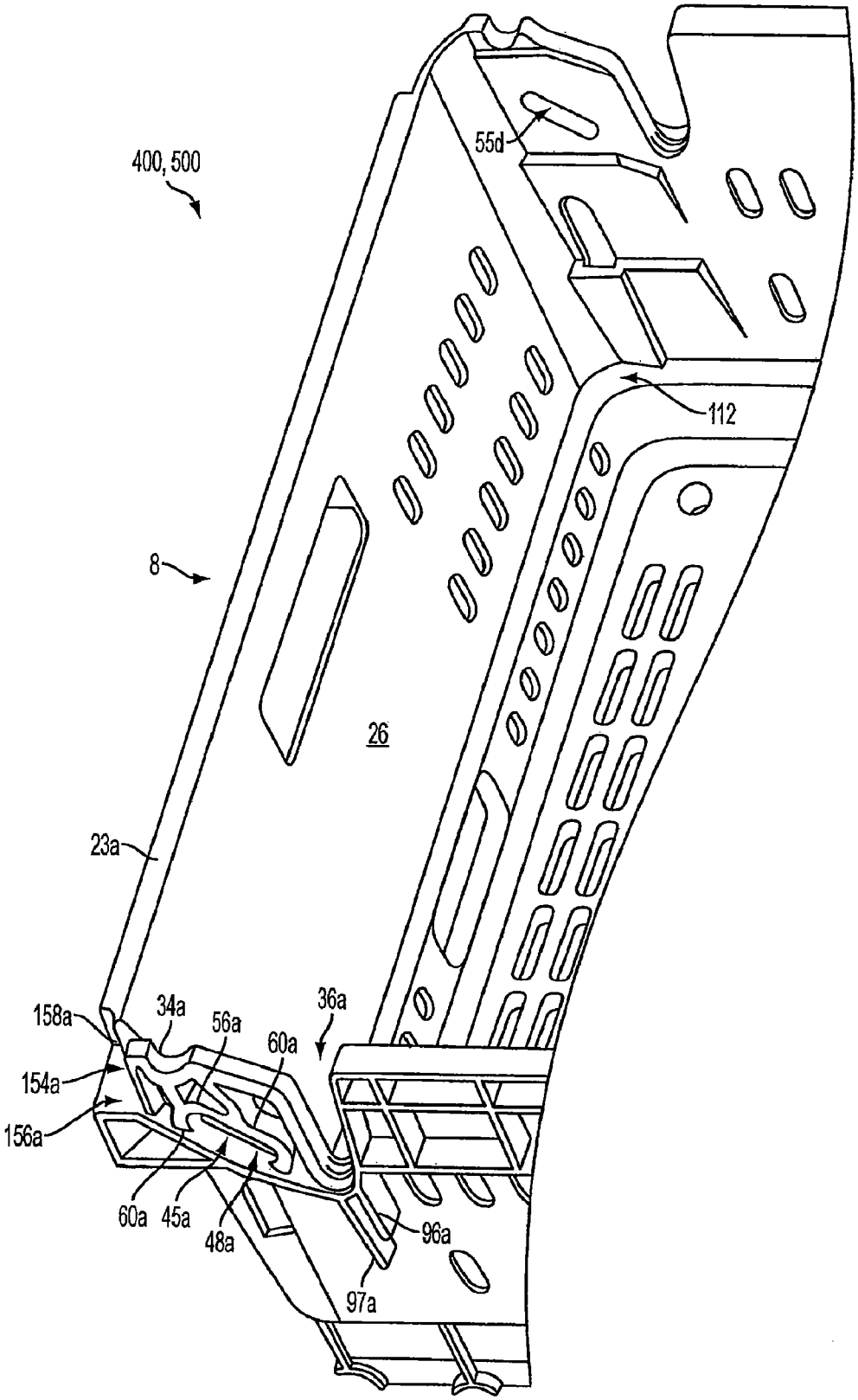
FIG. 42A illustrates a close-up perspective view of a first receptacle in the containers shown in FIGS. 25 through 40.
Figure 42B:
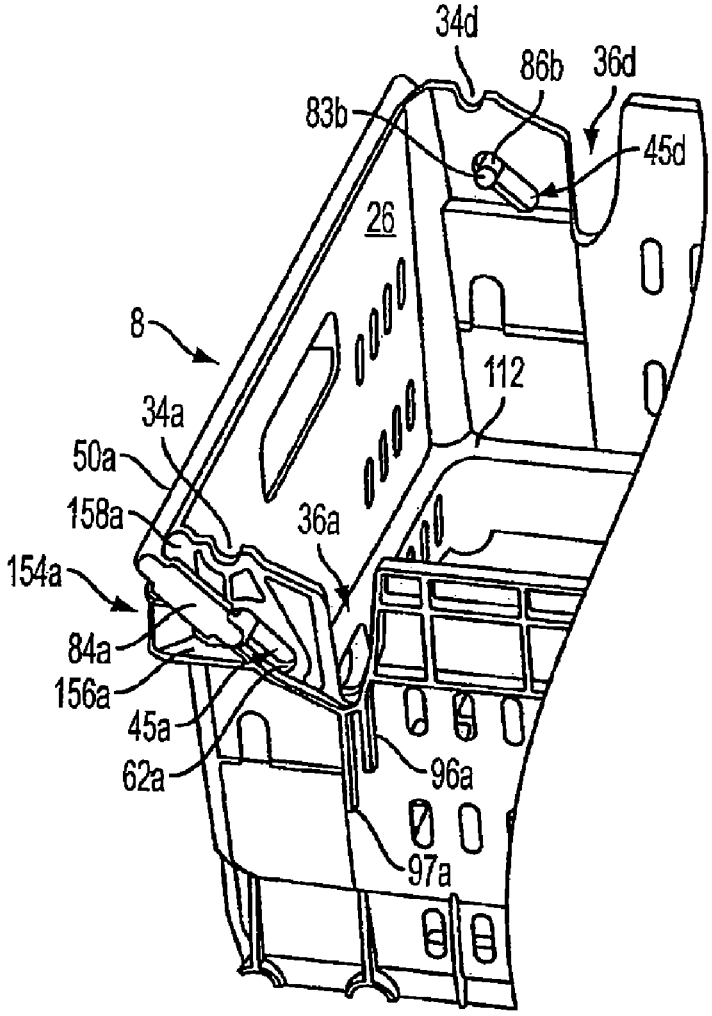
FIGS. 42B-D illustrate several close-up perspective views of the bail arm in the second receptacle in the containers shown in FIGS. 25 through 40 in a fully nested position, an un-nested position, and a partially nested position, according to an embodiment of the present invention.
Figure 42C:
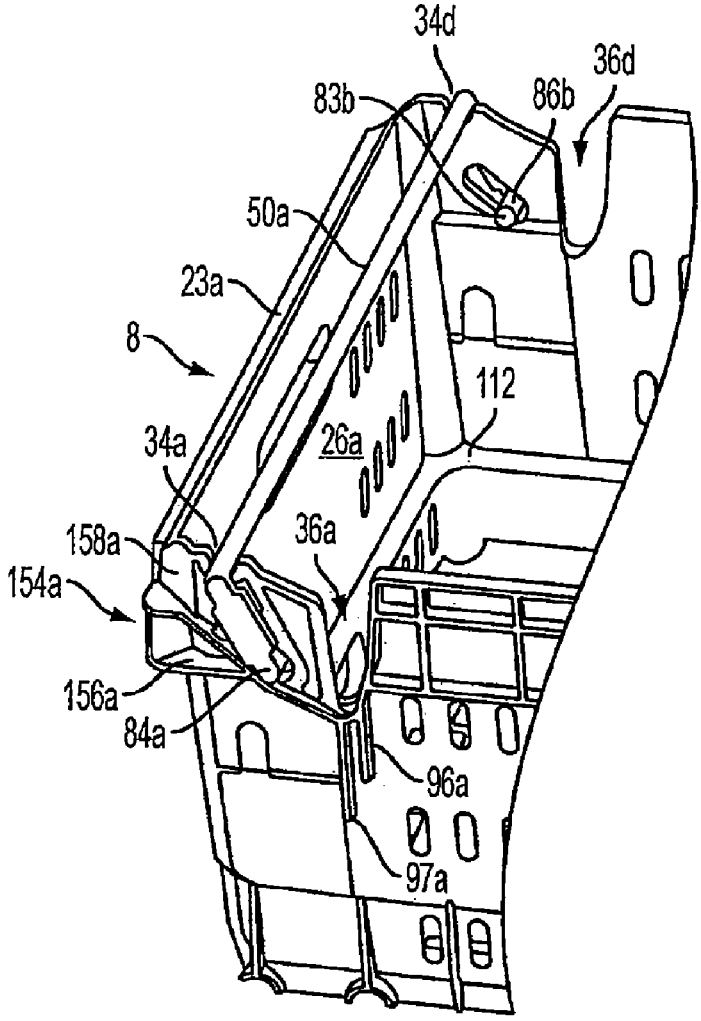
Figure 42D:
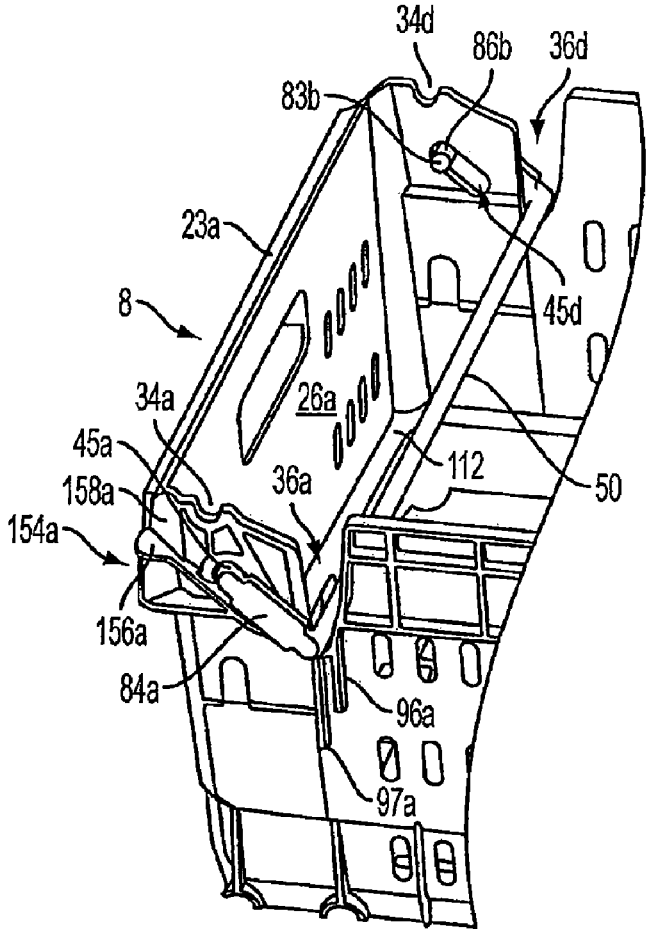
Figure 43A:
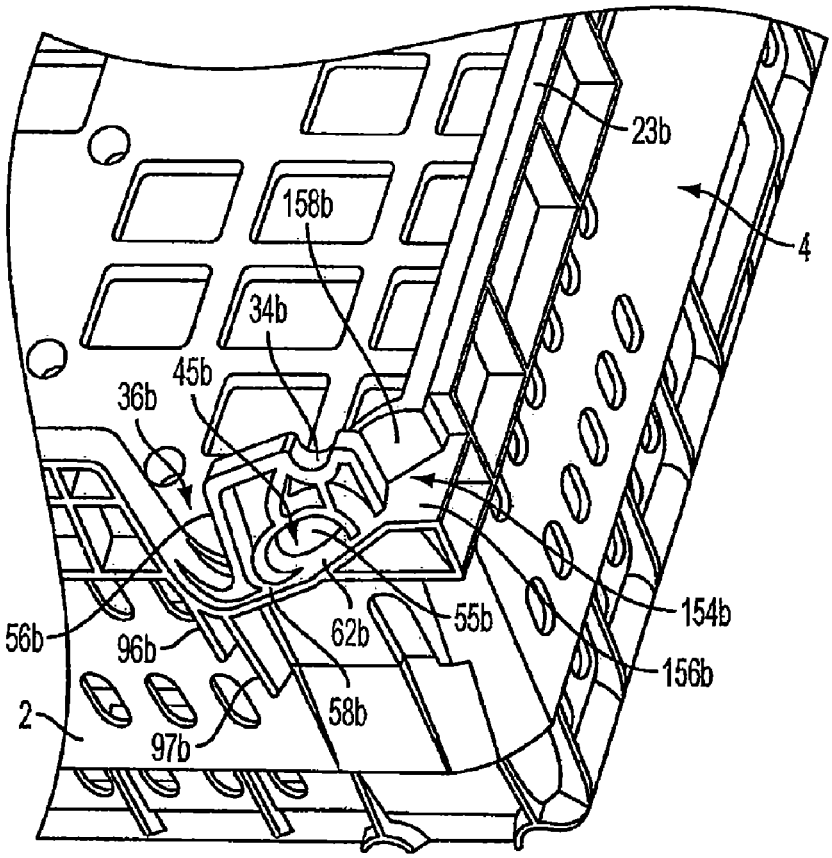
FIG. 43A illustrates a close-up perspective view of a second receptacle in the containers shown in FIGS. 25 through 40.
Figure 43B:
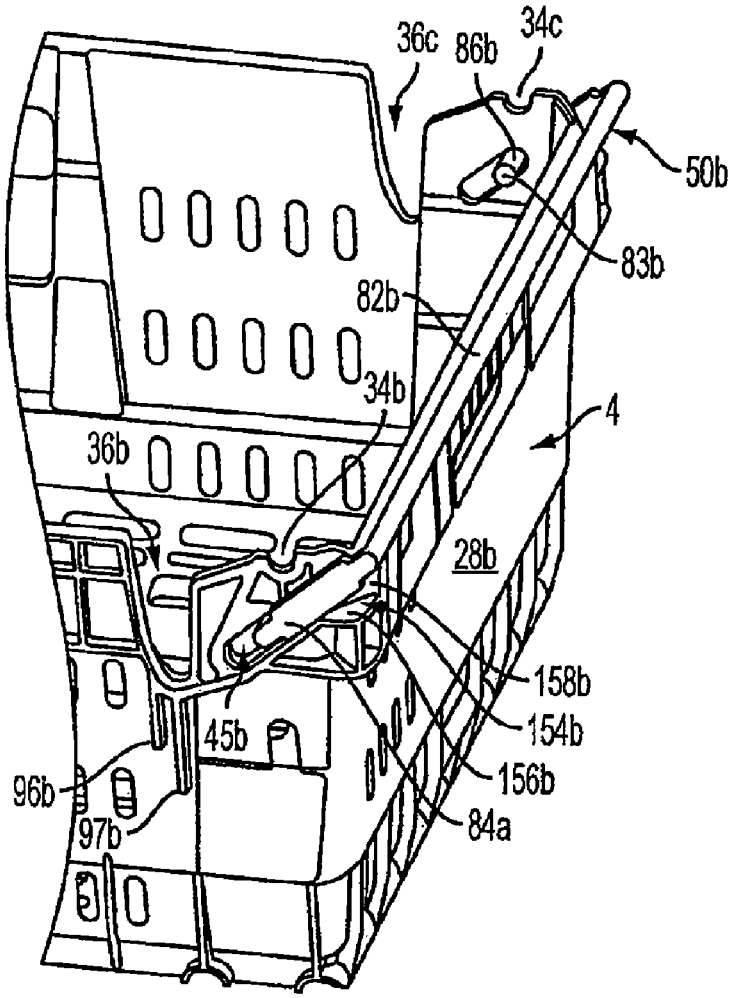
FIGS. 43B-D illustrates several close-up perspective views of the bail arm in the second receptacle in the containers shown in FIGS. 25 through 40 in a fully nested position, an un-nested position, and a partially nested position, according to an embodiment of the present invention.
Figure 43C:
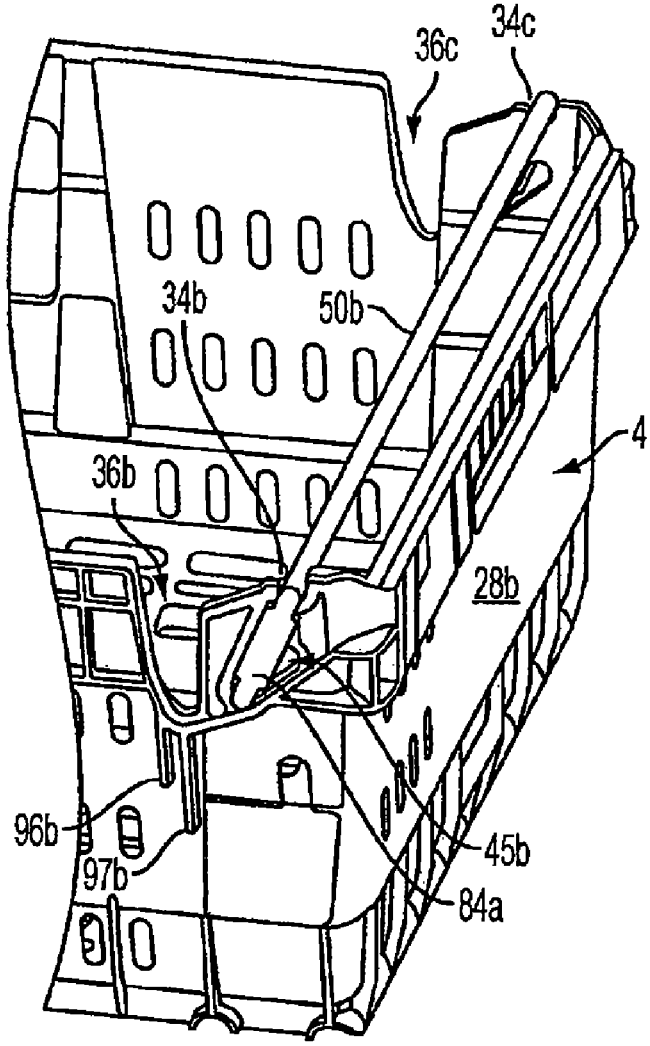
Figure 43D:
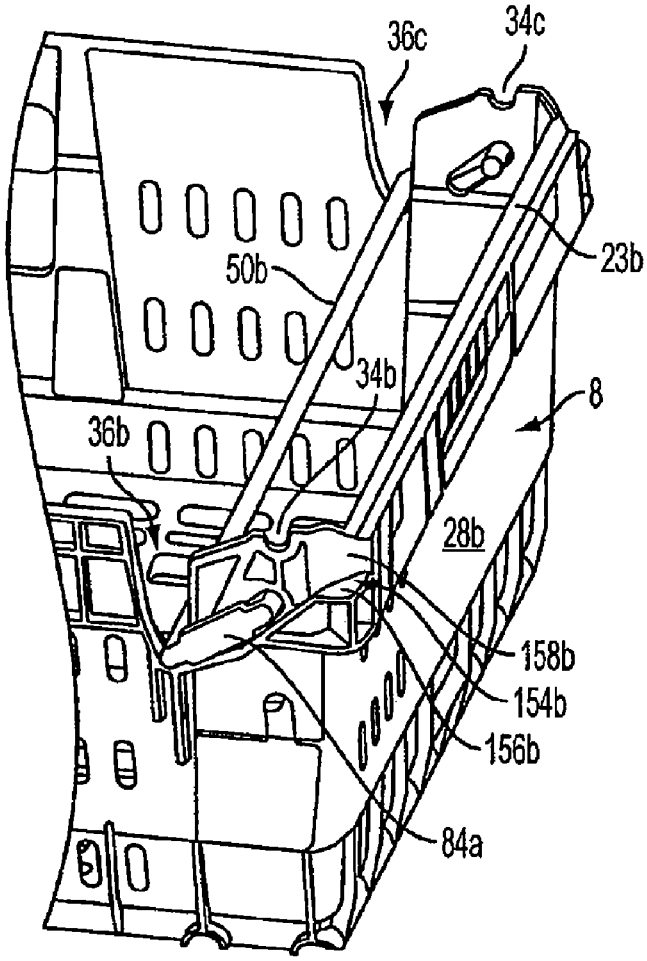

Attention is now directed to FIG. 41C. FIGS. 41C and 41D illustrate one exemplary embodiment of the present invention, but, as one of ordinary skill in the art can appreciate, are not meant to be limiting in any manner whatsoever. In FIG. 41C, which is substantially similar to the view of FIG. 41A, with differences as noted below, slot shaped receptacle 45*b* is illustrated along with a plurality of lines and angles, in order to more fully describe the advantages of the slot shaped receptacle 45. Many feature numbers have been purposely omitted, for clarity, in order to highlight the advantages by the unique shape and design of slot shaped receptacle 45. As one of ordinary skill in the art of the present invention can appreciate, the discussions above and below in regard to slot shaped receptacle 45*b* apply equally to receptacles 45*a*, 45*c* and 45*d*, and need not be repeated for the purpose of brevity. It can also be appreciated that identical feature numbers apply to FIG. 41C as in FIG. 41A.

As shown in FIG. 41C, lines C and D are drawn substantially tangent to the inner walls of the receptacle upper surface 56 and a first surface 47*b*' of receptacle inner wall 47 respectively. As shown in FIG. 41C, lines C and D are substantially parallel. Line C, and hence the inner wall of the receptacle upper surface 56*b*, is preferably about 40° to the horizontal, as the intersection of lines C and B illustrate in FIG. 41C. Further, line D, and hence the first surface 47*b*' of receptacle inner wall 47*b* is preferably also about 40° to the horizontal, as the intersection of lines D and B illustrate in FIG. 41C.

The receptacle lower surface 48*b* can be further described as comprising a first surface 48*b*' and a second surface 48*b*". First surface 48*b*' of receptacle lower surface 49*b* preferably forms an angle θ with horizontal line A of about 22.6°. Second surface 48*b*" of receptacle lower surface 48*b* preferably forms an angle Φ with horizontal line B of about 40°.

As discussed above, slot shaped receptacle 45*b* is straight slot shaped as shown in the accompanying figures, but especially in reference to FIG. 41C. Slot shaped receptacle 45*b* occupies an area of about 0.434 $in^2$. FIG. 41D illustrates an expanded view of slot shaped receptacle 45*b*. In FIG. 11D, slot shaped receptacle 45*b*, as shown, comprises several surfaces 43*a*-43*e*. Receptacle surface 43*a* is defined in the lower left region of slot shaped receptacle 45*b*. Receptacle surface 43*a* is preferably formed along a radius $r_1$ of about 0.225 inches, is substantially circular, and forms about a half of a complete circle. Receptacle surface 43*a* transitions from its circular shape to a linear portion of receptacle surface 43*b*. Receptacle surface 43*b* makes up almost the entire top portion of slot shaped receptacle 45*b*. From the substantially linear portion receptacle surface 43*b*, slot shaped receptacle 45*b* transitions to receptacle surface 43*c*. Receptacle surface 43*c* preferably has a radius $r_2$ of about 0.225 inches, and is substantially identical to receptacle surface 43*a*. Receptacle surface 43*d* joins receptacle surface 43*c*, and is substantially identical and parallel to receptacle surface 43*b*. Radii $r_1$, and $r_2$ are defined as interior radii, that is, they emanate from an interior of slot shaped receptacle 45*b*. The length of the slot shaped receptacle l, is about 1.235 inches, and the width w of the slot shaped receptacle is about 0.451 inches.

The design of the slot shaped receptacle 45*b* facilitates easier movement of the bail arms 50*a, b* because of its unique shape. A pivot axis line 95 is defined, as shown in FIG. 41A, along the center of slot shaped receptacle 45*b* along which the bail arms 50*a, b* moves when a user transitions the bail arms 50*a, b* from any one of its three positions to another. There is virtually no restriction or impeding of the movement along the pivot axis line 95 because of the unique slot shape of the slot shaped receptacle 45*b*. Since movement of the bail arms 50*a, b* is more fluid and less restricted, users of the container 400 will be less fatigued in using the container according to an embodiment of the present invention.

Thus, what has been described is a three level nestable stacking container comprising a base, a pair of opposing sidewalls, a pair of opposing endwalls and at least two bail arms. Each of the opposing sidewalls comprises a plurality of peanut or kidney shaped receptacles, and in an alternative embodiment of the present invention, a plurality of slot shaped receptacles. The receptacles allow for ease of rotational movement of the bail arms between any of at least three positions. The three positions for the bail arms provide three stacking configurations for a second, upper container, in regard to a first, lower container: a nearly fully nested configuration; a partially nested configuration; and a substantially un-nested configuration. The opposing sidewalls also comprise a sidewall interlock system, as well as a container stacking structure. The bails arms are completely contained within the "footprint" or area of the container, and mate with grooves in the base of the container in the partially nested and substantially un-nested configuration.

The individual components shown in outline or designated by blocks in the attached drawings are all well-known in the container arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

Any U.S. and foreign patent document discussed above is hereby incorporated by reference into the Detailed Description of the Preferred Embodiments.

What is claimed is:

1. A container, comprising:

a base;

a pair of opposing endwalls, each of the pair of opposing endwalls including (i) an endwall top portion, (ii) an endwall interior surface, (iii) an endwall exterior surface, and (iv) an endwall support surface located on the endwall top portion, wherein the endwall support surface further includes a bail arm lock structure;

a pair of opposing sidewalls, each of the pair of opposing sidewalls including (i) a sidewall top portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, wherein each receptacle includes an opening; and a pair of bail arms, each of the bail arm including (i) a pair of receptacle engaging portions that are rotationally received within the corresponding receptacle of each of the opposing sidewall, (ii) a pair of crank members located adjacent to the receptacle engaging portions, and (iii) an engaging portion located between each of a respective pair of crank members, wherein when the engaging portions of each of the bail arms are placed on the corresponding endwall support surfaces, the container is configured to stack a second identical container in nested position, and further wherein the bail arm lock structure is configured to substantially prevent the bail arm from moving inadvertently when the bail arm is substantially locked by the bail arm lock structure, wherein the bail arm lock structure comprises:

at least a first bail arm lock that is substantially vertical, and wherein the first ball arm lock includes a bail arm lock interior surface with a radius of curvature substantially equal to a radius of the bail arm, and a bail arm lock vertical portion that rises to a height above the endwall support surface that is at least as high as the radius of the bail arm.

2. The container according to claim 1, wherein the bail arm lock vertical portion rises to a height above the endwall support surface that is between about 50% and about 75% as high as the diameter of the bail arm.

3. The container of claim 1, wherein the bail arms configured such that (i) when the bail arms are placed in the corresponding inner pair of notches, the container is configured to stack the second identical container in a first stacking position that is higher than the nested position, and (ii) when the bail arms are placed in the corresponding outer pair of notches, the container is configured to stack the second identical container in a second stacking position that is higher than the nested position and different than the first stacking position.

4. A container, comprising:

a base a pair of opposing endwalls, each of the pair of opposing endwalls including (i) an endwall top portion, (ii) an endwall interior surface, (iii) an endwall exterior surface, and (iv) an endwall support surface located on the endwall top portion, wherein the endwall support surface further includes a bail arm lock structure;

a pair of opposing sidewalls, each of the pair of opposing sidewalls including (i) a sidewall top portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, and (vi) a pair of receptacles, wherein each receptacle includes an opening; and a pair of bail arms, each of the bail arm including (i) a pair of receptacle engaging portions that are rotationally received within the corresponding receptacle of each of the opposing sidewall, (ii) a pair of crank members located adjacent to the receptacle engaging portions, and (iii) an engaging portion located between each of a respective pair of crank members, wherein when the engaging portions of each of the bail arms are placed on the corresponding endwall support surfaces, the container is configured to stack a second identical container in nested position, and further wherein the bail arm lock structure is configured to substantially prevent the bail arm from moving inadvertently when the bail arm is substantially locked by the bail arm lock structure, wherein the bail arm lock structure comprises:

at least a first bail arm lock that is substantially vertical, and wherein the first ball arm lock includes a bail arm lock interior surface with a radius of curvature substantially equal to a radius of the bail arm, and a bail arm lock vertical portion that rises to a height above the endwall support surface that is at least as high as a centerline of the bail arm.

5. The container of claim 4, wherein the bail arm lock vertical portion rises to a height above the endwall upper surface that is between about 100% and about 150% as high as the centerline of the bail arm.

6. A container, comprising:

a base;

a pair of opposing endwalls, each of the pair of opposing endwalls including (i) an endwall top portion, (ii) an endwall interior surface, (iii) an endwall exterior surface, and (iv) an endwall support surface located on the endwall top portion;

a pair of opposing sidewalls, each of the pair of opposing sidewalls including (i) a sidewall top portion, (ii) a sidewall interior surface, (iii) a sidewall exterior surface, (iv) an outer pair of notches extending downwardly from the corresponding sidewall top portion, (v) an inner pair of notches extending downwardly from the corresponding sidewall top portion, (vi) a pair of receptacles, wherein each receptacle includes an opening;

(vii) a plurality of handles openings, the handle openings located substantially centrally on each of the sidewalls and at an upper portion of each of the sidewalls, (viii) a plurality of lifting areas, wherein the lifting areas are located above the plurality of handle openings on each of the sidewalls on an interior surface of each of the sidewalls, and wherein the lifting areas include a sloped surface of the sidewall, and a plurality of finger recess areas located adjacent the sloped surface of the surface of the sidewall, wherein the sloped surface of the sidewall and the plurality of finger recesses are configured to provide an ergonomic gripping surface for a user to grip and lift the container;

a pair of bail arms, each bail arm including (i) a pair of receptacle engaging portions that are rotationally received within the corresponding receptacle of the opposing sidewalls, (ii) a pair of crank members located adjacent to each of a corresponding receptacle engaging portions, and (iii) an engaging portion located between each of a respective pair of crank members, wherein when the engaging portions of the bail arms are placed on the corresponding endwall support surface, the container is configured to stack the second identical container in nested position, and the bail arms being configured such that (i) when the bail arms are placed in the corresponding inner pairs of notches, the container is configured to stack the second identical container in a first stacking position that is higher than the nested position, and (ii) when the bail arms are placed in the corresponding outer pairs of notches, the container is configured to stack the second identical container in a second stacking position that is higher than the nested position and at a position different than the first stacking position wherein the beveled ledge located on the endwall interior surface and the substantially horizontally oriented openings located substantially centrally on a lower portion of the endwall at or below the beveled edge are configured to provide a partially enclosed path to circulate air from a first endwall to a second endwall through a plurality of trays located on the upper surface of the base.

* * * * *

UNITED STATES PATENT AND TRADEMARK OFFICE

CERTIFICATE OF CORRECTION

PATENT NO. : 7,669,713 B2
APPLICATION NO. : 10/582165
DATED : March 2, 2010
INVENTOR(S) : Edward L. Stahl It is certified that error appears in the above-identified patent and that said Letters Patent is hereby corrected as shown below:

In Column 42, Line 47, in Claim 1, delete "ball" and insert --bail-- therefor.

In Column 43, Line 2, in Claim 4, delete "base" and insert --base;-- therefor.

In Column 43, Line 42, in Claim 4, delete "ball" and insert --bail-- therefor.

Signed and Sealed this

Twenty-fifth Day of May, 2010

David J. Kappos

David J. Kappos
*Director of the United States Patent and Trademark Office*